US006793305B2

(12) United States Patent
Tsukada et al.

(10) Patent No.: US 6,793,305 B2
(45) Date of Patent: Sep. 21, 2004

(54) METHOD AND APPARATUS FOR DETECTING CONSUMPTION OF INK

(75) Inventors: Kenji Tsukada, Nagano-Ken (JP); Munehide Kanaya, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/019,682

(22) PCT Filed: May 17, 2001

(86) PCT No.: PCT/JP01/04129

§ 371 (c)(1),
(2), (4) Date: Jan. 4, 2002

(87) PCT Pub. No.: WO01/87626

PCT Pub. Date: Nov. 22, 2001

(65) Prior Publication Data

US 2003/0071862 A1 Apr. 17, 2003

(30) Foreign Application Priority Data

May 18, 2000 (JP) ..... 2000-147123
May 18, 2000 (JP) ..... 2000-147124
Aug. 31, 2000 (JP) ..... 2000-263556

(51) Int. Cl.[7] ..... B41J 2/195
(52) U.S. Cl. ..... 347/7
(58) Field of Search ..... 347/7, 19; 73/290 V; 340/621, 626

(56) References Cited

U.S. PATENT DOCUMENTS 3,110,890 A 11/1963 Westcott et al.
3,220,258 A 11/1965 Rod
3,703,693 A 11/1972 Levinn
3,832,900 A 9/1974 Ross (List continued on next page.)

FOREIGN PATENT DOCUMENTS

EP 0 553 535 8/1993
EP 0 660 092 6/1995
EP 0 676 624 10/1995
EP 0 803 364 10/1997

(List continued on next page.)

OTHER PUBLICATIONS

U.S. patent application Ser. No. 09/574,012, Usui et al., filed May 19, 2000.
U.S. patent application Ser. No. 10/243,730, Usui et al., filed Sep. 16, 2002.
U.S. patent application Ser. No. 09/858,888, Tsukada et al., filed May 17, 2001.

(List continued on next page.)

*Primary Examiner*—Judy Nguyen
*Assistant Examiner*—Blaise Mouttet
(74) *Attorney, Agent, or Firm*—Sughrue Mion, PLLC

(57) ABSTRACT

A liquid sensor (802) composed of a piezoelectric device is provided on an ink cartridge (800). An actual consumption detection processing section (816) of a recording apparatus control section (810) detects an actual consuming state by detecting an oscillating state corresponding to an ink consuming state using a piezoelectric device. An estimate consumption calculation processing section (814) finds an estimate consuming state by calculating an ink consuming state based on printing amount when printing using ink. For example, a consuming volume is calculated by adding up and multiplying the number of printing dots. An estimate consumption calculation processing for finding a consuming volume in detail and an actual consumption detection processing capable of detecting precisely are used in combination. Preferably, the passage of liquid level is detected as detection of an actual consumption. Consuming volumes prior to and after it are estimated by adding up and multiplying the number of dots.

69 Claims, 72 Drawing Sheets

U.S. PATENT DOCUMENTS

| | | | | | |
|---|---|---|---|---|---|
| 3,889,247 | A | | 6/1975 | Voll | |
| 4,008,612 | A | | 2/1977 | Nagaoka et al. | |
| 4,107,994 | A | | 8/1978 | Sogo | |
| 4,310,957 | A | * | 1/1982 | Sachs | 29/25.35 |
| 4,329,875 | A | | 5/1982 | Nolting et al. | |
| 4,403,227 | A | | 9/1983 | Bertschy et al. | |
| 4,419,677 | A | | 12/1983 | Kasugayama et al. | |
| 4,570,482 | A | | 2/1986 | Murata et al. | |
| 4,594,891 | A | | 6/1986 | Benz et al. | |
| 4,636,814 | A | | 1/1987 | Terasawa | |
| 4,703,652 | A | | 11/1987 | Itoh et al. | |
| 4,770,038 | A | | 9/1988 | Zuckerwar et al. | |
| 4,796,782 | A | | 1/1989 | Wales et al. | |
| 4,811,595 | A | | 3/1989 | Marciniak et al. | |
| 4,853,718 | A | | 8/1989 | El Hatem et al. | |
| 4,984,449 | A | | 1/1991 | Caldwell et al. | |
| 4,984,457 | A | | 1/1991 | Morris | |
| 5,035,140 | A | | 7/1991 | Daniels et al. | |
| 5,179,389 | A | | 1/1993 | Arai et al. | |
| 5,233,369 | A | | 8/1993 | Carlotta et al. | |
| 5,315,317 | A | | 5/1994 | Terasawa et al. | |
| 5,353,631 | A | | 10/1994 | Woringer et al. | |
| 5,410,518 | A | | 4/1995 | Birkett | |
| 5,463,377 | A | | 10/1995 | Kronberg | |
| 5,473,353 | A | | 12/1995 | Soucemarianadin et al. | |
| 5,583,544 | A | | 12/1996 | Stamer et al. | |
| 5,586,085 | A | | 12/1996 | Lichte | |
| 5,610,635 | A | * | 3/1997 | Murray et al. | 347/7 |
| 5,619,238 | A | | 4/1997 | Higuma et al. | |
| 5,675,367 | A | | 10/1997 | Scheffelin et al. | |
| 5,689,288 | A | | 11/1997 | Wimmer et al. | |
| 5,697,248 | A | | 12/1997 | Brown | |
| 5,712,667 | A | | 1/1998 | Sato | |
| 5,737,963 | A | | 4/1998 | Eckert et al. | |
| 5,747,689 | A | | 5/1998 | Hampo et al. | |
| 5,774,136 | A | | 6/1998 | Barbehenn et al. | |
| 5,788,388 | A | | 8/1998 | Cowger et al. | |
| 5,788,819 | A | | 8/1998 | Onishi et al. | |
| 5,793,705 | A | | 8/1998 | Gazis et al. | |
| 5,841,454 | A | | 11/1998 | Hall et al. | |
| 5,877,997 | A | | 3/1999 | Fell | |
| 5,949,447 | A | | 9/1999 | Arai et al. | |
| 5,975,102 | A | | 11/1999 | Schalk | |
| 6,003,966 | A | | 12/1999 | Ahn | |
| 6,007,190 | A | | 12/1999 | Murray et al. | |
| 6,012,793 | A | | 1/2000 | Haigo | |
| 6,024,429 | A | * | 2/2000 | Coffy et al. | 347/7 |
| 6,044,694 | A | | 4/2000 | Anderson et al. | |
| 6,050,669 | A | | 4/2000 | Yano et al. | |
| 6,089,686 | A | | 6/2000 | Thornton et al. | |
| 6,089,688 | A | | 6/2000 | Froger et al. | |
| 6,164,744 | A | | 12/2000 | Froger et al. | |
| 6,302,527 | B1 | | 10/2001 | Walker | |
| 6,312,074 | B1 | | 11/2001 | Walker | |
| 6,312,106 | B1 | | 11/2001 | Walker | |
| 6,312,115 | B1 | | 11/2001 | Hara et al. | |
| 6,390,590 | B1 | | 5/2002 | Hansburg | |
| 6,470,744 | B1 | | 10/2002 | Usui et al. | |
| 6,536,861 | B1 | | 3/2003 | Usui et al. | |
| 2002/0012015 | A1 | | 1/2002 | Tsukada et al. | |
| 2002/0015084 | A1 | | 2/2002 | Tsukada et al. | |
| 2002/0105555 | A1 | | 8/2002 | Tsukada et al. | |
| 2002/0170353 | A1 | | 11/2002 | Usui et al. | |

FOREIGN PATENT DOCUMENTS

| | | | | | |
|---|---|---|---|---|---|
| EP | 0 853 236 | | | 7/1998 | |
| EP | 0 873 873 | | | 10/1998 | |
| EP | 956 964 | A2 | * | 11/1999 | B41J/2/175 |
| EP | 1 088 668 | | | 4/2001 | |
| FR | 2 572 519 | A1 | | 5/1986 | |
| GB | 2 304 898 | | | 3/1997 | |
| JP | 58-205820 | | | 11/1983 | |
| JP | 60-4820 | | | 1/1985 | |
| JP | 62-95225 | | | 5/1987 | |
| JP | 63247047 | | | 10/1988 | |
| JP | 63-295266 | | | 12/1988 | |
| JP | 03-218847 | | | 9/1991 | |
| JP | 04135862 | | | 5/1992 | |
| JP | 06297726 | | | 10/1994 | |
| JP | 07137276 | | | 5/1995 | |
| JP | 09-029991 | | | 2/1997 | |
| JP | 09-267488 | | | 10/1997 | |
| JP | 10026549 | | | 1/1998 | |
| JP | 10-038662 | | | 2/1998 | |
| JP | 10-151753 | | | 6/1998 | |
| JP | 10-305590 | | | 11/1998 | |
| JP | 11-020162 | | | 1/1999 | |
| JP | 2000-190523 | | | 7/2000 | |
| JP | 2000318183 | | | 11/2000 | |
| WO | WO 98/09139 | | | 3/1998 | |
| WO | WO 98/31548 | | | 7/1998 | |
| WO | WO 99/42293 | | | 8/1999 | |

OTHER PUBLICATIONS

U.S. patent application Ser. No. 09/881,662, Tsukada et al., Jun. 15, 2001.

U.S. patent application Ser. No. 09/572,849, Usui et al., filed May 18, 2000.

U.S. patent application Ser. No. 09/573,335, Usui et al., filed May 18, 2000.

U.S. patent application Ser. No. 09/574,015, Usui et al., filed May 19, 2000.

Partial Japanese Patent Application Publication No. Sho. 58–205820.

* cited by examiner

REFERENCE CONSUMPTION CONVERSION INFORMATION

| | | PRINTING STATE | | NON-PRINTING STATE (MAINTENANCE) | | | |
|---|---|---|---|---|---|---|---|
| | | DOT 1 | DOT 2 | FLASHING 1 | FLASHING 2 | CLEANING 12 | CLEANING 2 |
| RECORDING HEAD PERIPHERAL TEMPERATURE | 10°C | 30pl | 10pL | 50pl | 45pl | 0.5ml | 1.5ml |
| | 25°C | 31pl | 10.5pl | 52pl | 46pl | 0.6ml | 1.7ml |
| | 40°C | 32pl | 11pl | 54pl | 47pl | 0.7ml | 1.9ml |

FIG.70

DETERMINATION OF CORRECTION

| | EXPECTED SCORE OF ERROR OF ESTIMATE INK VOLUME PER DROPLET TO REAL INK VOLUME PER DROPLET | | ESTIMATE CONSUMING VOLUME | | DETERMINATION OF CORRECTION AND DETERMINATION SECTION 815 | |
|---|---|---|---|---|---|---|
| CASE | DOT 1 | DOT 2 | DOT 1 | DOT 2 | DOT 1 | DOT 2 |
| 1 | 3 | 8 | 200 | 800 | OUT OF OBJECTIVE OF CORRECTION | OBJECTIVE OF CORRECTION |
| 2 | 3 | 8 | 700 | 300 | OUT OF OBJECTIVE OF CORRECTION | OUT OF OBJECTIVE OF CORRECTION |

| CASE | ACT | NUMBER OF INK DROPLETS | ESTIMATE INK DROPLET VOLUME | ESTIMATE CONSUMING VOLUME | ACTUAL CONSUMING VOLUME | INK DROPLET VOLUME CORRECTNESS | ESTIMATE CONSUMING RATIO | DOT 2 ACTUALLY MEASURED INK DROPLET VOLUME 13 | | | | | | | | |
|---|---|---|---|---|---|---|---|---|---|---|---|---|---|---|---|---|
| | | | | | | | | NUMBER OF INK DROPLETS | ESTIMATE INK DROPLET VOLUME | ESTIMATE CONSUMING VOLUME | ACTUAL CONSUMING VOLUME | INK DROPLET VOLUME CORRECTNESS | ESTIMATE CONSUMING RATIO | ACTUAL CONSUMING VOLUME | TOTAL ESTIMATE CONSUMING VOLUME | CORRECTION COEFFICIENT |
| | | A | B | C | D | E | F | G | H | I | J | K | L | M | N | O |
| 1 | 0 | 0 | 30.00 | 0 | 0 | | 0.000 | 0 | 10.00 | 0 | 0 | | 0.000 | 0 | 0 | 1.000 |
| | 1 | 5000 | 30.00 | 150000 | 140000 | **1.071** | 0.750 | 5000 | 10.00 | 50000 | 65000 | **0.769** | 0.250 | 205000 | 200000 | 1.025 |
| | 2 | 7000 | 30.75 | 215250 | 196000 | **1.098** | 0.875 | 3000 | 10.25 | 30750 | 39000 | **0.788** | 0.125 | 235000 | 246000 | 0.955 |
| | 3 | 4000 | 29.38 | 117500 | 112000 | **1.049** | 0.667 | 6000 | 9.79 | 58750 | 78000 | **0.753** | 0.333 | 190000 | 176250 | 1.078 |
| | 4 | 6000 | 31.67 | 190000 | 168000 | **1.131** | 0.818 | 4000 | 10.56 | 42222 | 52000 | **0.812** | 0.182 | 220000 | 232222 | 0.947 |
| | 5 | 9000 | 30.00 | 270000 | 252000 | **1.071** | 0.964 | 1000 | 10.00 | 10000 | 13000 | **0.768** | 0.036 | 265000 | 280000 | 0.946 |
| | 6 | 1000 | 28.39 | 28393 | 28000 | **1.014** | 0.250 | 9000 | 9.46 | 85179 | 117000 | **0.728** | 0.750 | 145000 | 113571 | 1.277 |
| | 7 | 2000 | 36.25 | 72500 | 56000 | **1.295** | 0.429 | 8000 | 12.08 | 96667 | 104000 | **0.929** | 0.571 | 160000 | 169167 | 0.946 |
| 2 | 0 | 0 | 30.00 | 0 | 0 | | 0.000 | 0 | 10.00 | 0 | 0 | | 0.000 | 0 | 0 | 1.000 |
| | 1 | 5000 | 30.00 | 150000 | 140000 | **1.071** | 0.750 | 5000 | 10.00 | 50000 | 65000 | **0.769** | 0.250 | 205000 | 200000 | 1.025 |
| | 2 | 7000 | 30.75 | 215250 | 196000 | **1.098** | 0.875 | 3000 | 10.25 | 30750 | 39000 | **0.788** | 0.125 | 235000 | 246000 | 0.955 |
| | 3 | 4000 | 29.38 | 117500 | 112000 | **1.049** | 0.656 | 6000 | 10.25 | 61500 | 78000 | **0.788** | 0.344 | 190000 | 179000 | 1.061 |
| | 4 | 6000 | 29.38 | 176280 | 168000 | **1.049** | 0.811 | 4000 | 10.25 | 41000 | 52000 | **0.788** | 0.189 | 220000 | 217280 | 1.013 |
| | 5 | 9000 | 29.38 | 264420 | 252000 | **1.049** | 0.963 | 1000 | 10.25 | 10250 | 13000 | **0.788** | 0.037 | 265000 | 274670 | 0.965 |
| | 6 | 1000 | 28.35 | 28346 | 28000 | **1.012** | 0.235 | 9000 | 10.25 | 92250 | 117000 | **0.788** | 0.765 | 145000 | 120596 | 1.202 |
| | 7 | 2000 | 28.31 | 56620 | 56000 | **1.011** | 0.365 | 8000 | 12.32 | 98594 | 104000 | **0.948** | 0.635 | 160000 | 155214 | 1.031 |
| CHARACTER RECORD 3 | 0 | 0 | 30.00 | 0 | 0 | | 0.000 | 0 | 10.00 | 0 | 0 | | 0.000 | 0 | 0 | 1.000 |
| | 1 | 9000 | 30.00 | 270000 | 252000 | **1.071** | 0.964 | 1000 | 10.00 | 10000 | 13000 | **0.769** | 0.036 | 265000 | 280000 | 0.946 |
| | 2 | 9200 | 28.39 | 261214 | 257600 | **1.014** | 0.972 | 800 | 9.46 | 7571 | 10400 | **0.728** | 0.028 | 268000 | 268786 | 0.997 |
| | 3 | 9100 | 28.31 | 257620 | 254800 | **1.011** | 0.966 | 900 | 10.00 | 9000 | 11700 | **0.769** | 0.034 | 266500 | 266620 | 1.000 |
| | 4 | 8000 | 28.31 | 226480 | 224000 | **1.011** | 0.919 | 2000 | 10.00 | 20000 | 26000 | **0.769** | 0.081 | 250000 | 246480 | 1.014 |
| | 5 | 9500 | 28.31 | 268945 | 266000 | **1.011** | 0.981 | 500 | 10.14 | 5071 | 6500 | **0.780** | 0.019 | 272500 | 274016 | 0.994 |
| | 6 | 9900 | 28.15 | 278718 | 277200 | **1.005** | 0.996 | 100 | 10.14 | 1014 | 1300 | **0.780** | 0.004 | 278500 | 279732 | 0.996 |
| | 7 | 9000 | 28.15 | 253350 | 252000 | **1.005** | 0.962 | 1000 | 10.14 | 10140 | 13000 | **0.780** | 0.038 | 265000 | 263490 | 1.006 |
| CHARACTER RECORD 4 | 0 | 0 | 30.00 | 0 | 0 | | 0.000 | 0 | 10.00 | 0 | 0 | | 0.000 | 0 | 0 | 1.000 |
| | 1 | 9000 | 30.00 | 270000 | 252000 | **1.071** | 0.964 | 1000 | 10.00 | 10000 | 13000 | **0.769** | 0.036 | 265000 | 280000 | 0.946 |
| | 2 | 9200 | 28.39 | 261214 | 257600 | **1.014** | 0.970 | 800 | 10.00 | 8000 | 10400 | **0.769** | 0.030 | 268000 | 269214 | 0.995 |
| | 3 | 9100 | 28.26 | 257210 | 254800 | **1.009** | 0.966 | 900 | 10.00 | 9000 | 11700 | **0.769** | 0.034 | 266500 | 266210 | 1.001 |
| | 4 | 8000 | 28.30 | 226365 | 224000 | **1.011** | 0.919 | 2000 | 10.00 | 20000 | 26000 | **0.769** | 0.081 | 250000 | 246365 | 1.015 |
| | 5 | 9500 | 28.71 | 272775 | 266000 | **1.025** | 0.982 | 500 | 10.00 | 5000 | 6500 | **0.769** | 0.018 | 272500 | 277775 | 0.981 |
| | 6 | 9900 | 28.35 | 280665 | 277200 | **1.013** | 0.996 | 100 | 10.00 | 1000 | 1300 | **0.769** | 0.004 | 278500 | 281665 | 0.989 |
| | 7 | 9000 | 28.03 | 252283 | 252000 | **1.001** | 0.962 | 1000 | 10.00 | 10000 | 13000 | **0.769** | 0.038 | 265000 | 262283 | 1.010 |
| IMAGE RECORD 5 | 0 | 0 | 30.00 | 0 | 0 | | 0.000 | 0 | 10.00 | 0 | 0 | | 0.000 | 0 | 0 | 1.000 |
| | 1 | 1000 | 30.00 | 30000 | 28000 | **1.071** | 0.250 | 9000 | 10.00 | 90000 | 117000 | **0.769** | 0.750 | 145000 | 120000 | 1.208 |
| | 2 | 800 | 36.25 | 29000 | 22400 | **1.295** | 0.207 | 9200 | 12.08 | 111167 | 119600 | **0.929** | 0.793 | 142000 | 140167 | 1.013 |
| | 3 | 900 | 36.25 | 32625 | 25200 | **1.295** | 0.227 | 9100 | 12.24 | 111397 | 118300 | **0.942** | 0.773 | 143500 | 144022 | 0.996 |
| | 4 | 2000 | 36.25 | 72500 | 56000 | **1.295** | 0.425 | 8000 | 12.24 | 97920 | 104000 | **0.942** | 0.575 | 160000 | 170420 | 0.939 |
| | 5 | 500 | 34.03 | 17017 | 14000 | **1.215** | 0.128 | 9500 | 12.24 | 116280 | 123500 | **0.942** | 0.872 | 137500 | 133297 | 1.032 |
| | 6 | 100 | 34.10 | 3410 | 2800 | **1.218** | 0.027 | 9900 | 12.63 | 124997 | 128700 | **0.971** | 0.973 | 131500 | 128407 | 1.024 |
| | 7 | 1000 | 34.10 | 34100 | 28000 | **1.218** | 0.227 | 9000 | 12.93 | 116371 | 117000 | **0.995** | 0.773 | 145000 | 150471 | 0.964 |
| IMAGE RECORD 6 | 0 | 0 | 30.00 | 0 | 0 | | 0.000 | 0 | 10.00 | 0 | 0 | | 0.000 | 0 | 0 | 1.000 |
| | 1 | 1000 | 30.00 | 30000 | 28000 | **1.071** | 0.250 | 9000 | 10.00 | 90000 | 117000 | **0.769** | 0.750 | 145000 | 120000 | 1.208 |
| | 2 | 800 | 30.00 | 24000 | 22400 | **1.071** | 0.178 | 9200 | 12.08 | 111167 | 119600 | **0.928** | 0.822 | 142000 | 135167 | 1.051 |
| | 3 | 900 | 30.00 | 27000 | 25200 | **1.071** | 0.189 | 9100 | 12.69 | 115517 | 118300 | **0.978** | 0.811 | 143500 | 142517 | 1.007 |
| | 4 | 2000 | 30.00 | 60000 | 56000 | **1.071** | 0.371 | 8000 | 12.69 | 101520 | 104000 | **0.978** | 0.629 | 160000 | 161520 | 0.991 |
| | 5 | 500 | 30.00 | 15000 | 14000 | **1.071** | 0.111 | 9500 | 12.69 | 120555 | 123500 | **0.978** | 0.889 | 137500 | 135555 | 1.014 |
| | 6 | 100 | 30.00 | 3000 | 2800 | **1.071** | 0.023 | 9900 | 12.87 | 127434 | 128700 | **0.990** | 0.977 | 131500 | 130434 | 1.008 |
| | 7 | 1000 | 30.00 | 30000 | 28000 | **1.071** | 0.204 | 9000 | 12.98 | 116796 | 117000 | **0.998** | 0.796 | 145000 | 146796 | 0.988 |

$B(n)=B(n-1)\cdot O(n-1)$
$C(n)=A(n)\cdot B(n)$
$D(n)=C(n)\cdot 28$
$E(n)=C(n)/D(n)$
$F(n)=C(n)/N(n)$ $H(n)=H(n-1)\cdot O(n-1)$
$I(n)=G(n)\cdot H(n)$
$J(n)=I(n)\cdot 13$
$K(n)=I(n)/J(n)$
$L(n)=I(n)/N(n)$ $M(n)=D(n)+J(n)$
$N(n)=C(n)+I(n)$
$L(n)=M(n)/N(n)$

FIG.79

| | | | | | | | | DOT 2 ACTUALLY MEASURED INK DROPLET VOLUME 13 (ESTIMATE CONSUMING RATE ROUNDED DOWN VALUE 0.6) | | | | | | | | |
|---|---|---|---|---|---|---|---|---|---|---|---|---|---|---|---|---|
| CASE | ACT | NUMBER OF INK DROPLETS(N) | ESTIMATE INK DROPLET VOLUME | ESTIMATE CONSUMING VOLUME | ACTUAL CONSUMING VOLUME | INK DROPLET VOLUME CORRECTNESS | ESTIMATE CONSUMING RATIO | NUMBER OF INK DROPLETS | ESTIMATE INK DROPLET VOLUME | ESTIMATE CONSUMING VOLUME | ACTUAL CONSUMING VOLUME | INK DROPLET VOLUME CORRECTNESS | ESTIMATE CONSUMING RATIO | ACTUAL CONSUMING VOLUME | TOTAL ESTIMATE CONSUMING VOLUME | CORRECTION COEFFICIENT |
| 1 | 0 | 0 | 30.00 | 0 | 0 | | 0.000 | 0 | 10.00 | 0 | 0 | | 0.000 | 0 | 0 | 1.000 |
| | 1 | 5000 | 30.00 | 150000 | 140000 | **1.071** | 0.750 | 5000 | 10.00 | 50000 | 65000 | **0.769** | 0.250 | 205000 | 200000 | 1.025 |
| | 2 | 7000 | 30.75 | 215250 | 196000 | **1.098** | 0.878 | 3000 | 10.00 | 30000 | 39000 | **0.769** | 0.122 | 235000 | 245250 | 0.958 |
| | 3 | 4000 | 29.46 | 117859 | 112000 | **1.052** | 0.663 | 6000 | 10.00 | 60000 | 78000 | **0.769** | 0.337 | 190000 | 177859 | 1.068 |
| | 4 | 6000 | 31.48 | 188857 | 168000 | **1.124** | 0.825 | 4000 | 10.00 | 40000 | 52000 | **0.769** | 0.175 | 220000 | 228857 | 0.961 |
| | 5 | 9000 | 30.26 | 272322 | 252000 | **1.081** | 0.965 | 1000 | 10.00 | 10000 | 13000 | **0.769** | 0.035 | 265000 | 262322 | 0.939 |
| | 6 | 1000 | 28.40 | 28402 | 28000 | **1.014** | 0.240 | 9000 | 10.00 | 90000 | 117000 | **0.769** | 0.760 | 145000 | 118402 | 1.225 |
| | 7 | 2000 | 28.40 | 56800 | 56000 | **1.014** | 0.367 | 8000 | 12.25 | 97972 | 104000 | **0.942** | 0.633 | 160000 | 154772 | 1.034 |
| 2 | 0 | 0 | 30.00 | 0 | 0 | | 0.000 | 0 | 10.00 | 0 | 0 | | 0.000 | 0 | 0 | 1.000 |
| | 1 | 5000 | 30.00 | 150000 | 140000 | **1.071** | 0.750 | 5000 | 10.00 | 50000 | 65000 | **0.769** | 0.250 | 205000 | 200000 | 1.025 |
| | 2 | 7000 | 30.75 | 215250 | 196000 | **1.098** | 0.878 | 3000 | 10.00 | 30000 | 39000 | **0.769** | 0.122 | 235000 | 245250 | 0.958 |
| | 3 | 4000 | 29.46 | 117859 | 112000 | **1.052** | 0.663 | 6000 | 10.00 | 60000 | 78000 | **0.769** | 0.337 | 190000 | 177859 | 1.068 |
| | 4 | 6000 | 29.38 | 176280 | 168000 | **1.049** | 0.815 | 4000 | 10.00 | 40000 | 52000 | **0.769** | 0.185 | 220000 | 216280 | 1.017 |
| | 5 | 9000 | 29.38 | 264420 | 252000 | **1.049** | 0.964 | 1000 | 10.00 | 10000 | 13000 | **0.769** | 0.036 | 265000 | 274420 | 0.966 |
| | 6 | 1000 | 28.37 | 28371 | 28000 | **1.013** | 0.240 | 9000 | 10.00 | 90000 | 117000 | **0.769** | 0.760 | 145000 | 118371 | 1.225 |
| | 7 | 2000 | 28.37 | 56740 | 56000 | **1.013** | 0.367 | 8000 | 12.25 | 97997 | 104000 | **0.769** | 0.633 | 160000 | 154737 | 1.034 |
| CHARACTER RECORD 3 | 0 | 0 | 30.00 | 0 | 0 | | 0.000 | 0 | 10.00 | 0 | 0 | | 0.000 | 0 | 0 | 1.000 |
| | 1 | 9000 | 30.00 | 270000 | 252000 | **1.071** | 0.964 | 1000 | 10.00 | 10000 | 13000 | **0.769** | 0.036 | 265000 | 280000 | 0.946 |
| | 2 | 9200 | 28.39 | 261214 | 257600 | **1.014** | 0.970 | 800 | 10.00 | 8000 | 10400 | **0.769** | 0.030 | 268000 | 269214 | 0.995 |
| | 3 | 9100 | 28.26 | 257210 | 254800 | **1.009** | 0.966 | 900 | 10.00 | 9000 | 11700 | **0.769** | 0.034 | 266500 | 266210 | 1.001 |
| | 4 | 8000 | 28.31 | 226480 | 224000 | **1.011** | 0.919 | 2000 | 10.00 | 20000 | 26000 | **0.769** | 0.081 | 250000 | 246480 | 1.014 |
| | 5 | 9500 | 28.31 | 268945 | 266000 | **1.011** | 0.982 | 500 | 10.00 | 5000 | 6500 | **0.769** | 0.018 | 272500 | 273945 | 0.995 |
| | 6 | 9900 | 28.16 | 278791 | 277200 | **1.006** | 0.996 | 100 | 10.00 | 1000 | 1300 | **0.769** | 0.004 | 278500 | 279791 | 0.995 |
| | 7 | 9000 | 28.15 | 253350 | 252000 | **1.005** | 0.962 | 1000 | 10.00 | 10000 | 13000 | **0.769** | 0.038 | 265000 | 263350 | 1.006 |
| CHARACTER RECORD 4 | 0 | 0 | 30.00 | 0 | 0 | | 0.000 | 0 | 10.00 | 0 | 0 | | 0.000 | 0 | 0 | 1.000 |
| | 1 | 9000 | 30.00 | 270000 | 252000 | **1.071** | 0.964 | 1000 | 10.00 | 10000 | 13000 | **0.769** | 0.036 | 265000 | 280000 | 0.946 |
| | 2 | 9200 | 30.00 | 276000 | 257600 | **1.071** | 0.972 | 800 | 10.00 | 8000 | 10400 | **0.769** | 0.028 | 268000 | 284000 | 0.944 |
| | 3 | 9100 | 28.31 | 257620 | 254800 | **1.011** | 0.966 | 900 | 10.00 | 9000 | 11700 | **0.769** | 0.034 | 266500 | 266620 | 1.000 |
| | 4 | 8000 | 28.30 | 226377 | 224000 | **1.011** | 0.919 | 2000 | 10.00 | 20000 | 26000 | **0.769** | 0.081 | 250000 | 246377 | 1.015 |
| | 5 | 9500 | 28.71 | 272776 | 266000 | **1.025** | 0.982 | 500 | 10.00 | 5000 | 6500 | **0.769** | 0.018 | 272500 | 277776 | 0.981 |
| | 6 | 9900 | 28.35 | 280665 | 277200 | **1.013** | 0.996 | 100 | 10.00 | 1000 | 1300 | **0.769** | 0.004 | 278500 | 281665 | 0.989 |
| | 7 | 9000 | 28.03 | 252283 | 252000 | **1.001** | 0.962 | 1000 | 10.00 | 10000 | 13000 | **0.769** | 0.038 | 265000 | 262283 | 1.010 |
| IMAGE RECORD 5 | 0 | 0 | 30.00 | 0 | 0 | | 0.000 | 0 | 10.00 | 0 | 0 | | 0.000 | 0 | 0 | 1.000 |
| | 1 | 1000 | 30.00 | 30000 | 28000 | **1.071** | 0.250 | 9000 | 10.00 | 90000 | 117000 | **0.769** | 0.750 | 145000 | 120000 | 1.206 |
| | 2 | 800 | 30.00 | 24000 | 22400 | **1.071** | 0.178 | 9200 | 12.06 | 111167 | 119600 | **0.929** | 0.822 | 142000 | 135167 | 1.051 |
| | 3 | 900 | 30.00 | 27000 | 25200 | **1.071** | 0.189 | 9100 | 12.69 | 115517 | 118300 | **0.976** | 0.811 | 143500 | 142517 | 1.007 |
| | 4 | 2000 | 30.00 | 60000 | 56000 | **1.071** | 0.380 | 8000 | 12.24 | 97920 | 104000 | **0.942** | 0.620 | 160000 | 157920 | 1.013 |
| | 5 | 500 | 30.00 | 15000 | 14000 | **1.071** | 0.114 | 9500 | 12.24 | 116280 | 123500 | **0.942** | 0.886 | 137500 | 131280 | 1.047 |
| | 6 | 100 | 30.00 | 3000 | 2800 | **1.071** | 0.023 | 9900 | 12.82 | 126917 | 128700 | **0.986** | 0.977 | 131500 | 129917 | 1.012 |
| | 7 | 1000 | 30.00 | 30000 | 28000 | **1.071** | 0.204 | 9000 | 12.98 | 116785 | 117000 | **0.998** | 0.796 | 145000 | 146785 | 0.988 |
| IMAGE RECORD 6 | 0 | 0 | 30.00 | 0 | 0 | | 0.000 | 0 | 10.00 | 0 | 0 | | 0.000 | 0 | 0 | 1.000 |
| | 1 | 1000 | 30.00 | 30000 | 28000 | **1.071** | 0.250 | 9000 | 10.00 | 90000 | 117000 | **0.769** | 0.750 | 145000 | 120000 | 1.208 |
| | 2 | 800 | 30.00 | 24000 | 22400 | **1.071** | 0.178 | 9200 | 12.08 | 111167 | 119600 | **0.929** | 0.822 | 142000 | 135167 | 1.051 |
| | 3 | 900 | 30.00 | 27000 | 25200 | **1.071** | 0.189 | 9100 | 12.69 | 115517 | 118300 | **0.976** | 0.811 | 143500 | 142517 | 1.007 |
| | 4 | 2000 | 30.00 | 60000 | 56000 | **1.071** | 0.371 | 8000 | 12.69 | 101520 | 104000 | **0.976** | 0.629 | 160000 | 161520 | 0.991 |
| | 5 | 500 | 30.00 | 15000 | 14000 | **1.071** | 0.111 | 9500 | 12.69 | 120555 | 123500 | **0.976** | 0.889 | 137500 | 135555 | 1.014 |
| | 6 | 100 | 30.00 | 3000 | 2800 | **1.071** | 0.023 | 9900 | 12.87 | 127434 | 128700 | **0.990** | 0.977 | 131500 | 130434 | 1.008 |
| | 7 | 1000 | 30.00 | 30000 | 28000 | **1.071** | 0.204 | 9000 | 12.98 | 116798 | 117000 | **0.998** | 0.796 | 145000 | 146798 | 0.988 |

FIG.80

DETERMINATION ROUTINE OF CORRECTION OBJECTIVE OF CASE 4 OR CASE 6 (S22)

METHOD AND APPARATUS FOR DETECTING CONSUMPTION OF INK

TECHNICAL FIELD

The present invention relates to a method and an apparatus for detecting a consuming state of ink within an ink tank, and an ink jet recording apparatus and an ink tank to which the method of detecting and the apparatus for detecting are applied.

BACKGROUND ART

In general, an ink jet recording apparatus is configured so that the ink jet recording apparatus includes a carriage on which an ink jet type recording head equipped with pressure generation means for applying a pressure to a pressure generation is chamber and a nozzle opening from which an pressurized ink is discharged as an ink droplet is mounted, and an ink tank for containing the ink supplied to a recording head via a pass and continuously printable. In general, an ink tank is configured as a cartridge attachable to and detachable from the recording apparatus so that at the time when the ink is completely consumed, the ink tank is easily changeable by the user.

Conventionally, as a method of managing an ink consumption of an ink cartridge, a method of mathematically managing an ink consumption by adding up a count number of ink droplets discharged by a recording head, and a volume of ink absorbed in the maintenance step of a printing head using a software, a method of managing an ink consumption by detecting a point in time at which the predetermined volume is actually consumed by mounting two pieces of electrodes for directly detecting an ink level on an ink cartridge and the like have been known.

However, as for a method of mathematically managing an ink consumption by adding up the count of discharging ink droplets and a volume of the ink absorbed using a software, there has been a problem that the pressure within an ink cartridge and viscosity of the ink are changed by the circumstances used, for example, a high or low temperature and humidity within a room used for it, a lapsed time after opening a sealed ink cartridge, the difference of using frequency of the user side and the like, and the error not to be negligible is generated between an ink consuming volume mathematically added up and an actual volume of consumption. Moreover, in the case where the same cartridge is removed once and mounted again, there has been also a problem that an added up counting value is once reset, therefore, an actual ink residual volume becomes completely unknown.

On the other hand, as for a method of managing a point in time at which the ink is consumed using electrodes, since an actual volume of the ink at some point in time can be detected, an ink residual volume can be managed with a high degree of reliability. However, the ink must be electrically conductive for detecting an ink level, hence, kinds of inks for use are limited. Moreover, there is a problem that fluid-tight structure between electrodes and an ink cartridge becomes complex. Furthermore, since usually noble metal having a good conductivity and corrosion resistance is used as a material for an electrode, there has been also a problem that a manufacturing cost of an ink cartridge is increased. Moreover, since two pieces of electrodes are required to be mounted at different positions, respectively, there has been a problem that the number of steps for manufacturing it is increased, and as a result, the manufacturing cost is increased.

The present invention is achieved in consideration of the above-described circumstances, and an object of the present invention is to provide a method and an apparatus for detecting an ink consumption capable of precisely detecting a liquid consuming state.

The present invention provides a technology for detecting a liquid residual volume by especially utilizing an oscillation, and particularly is capable of precisely and finely detecting a change of a liquid volume.

Moreover, an object of the present invention is to provide a liquid container which is capable of precisely detecting a consuming state of a liquid and does not require a complex sealing structure.

Moreover, another object of the present invention is to provide an ink cartridge capable of precisely detecting a consuming state of the ink and not requiring a complex sealing structure.

It should be noted that the present invention is not limited to an ink cartridge, and the other liquid containers are also applicable.

DISCLOSURE OF THE INVENTION

An aspect of the present invention is a method of detecting an ink consuming state of an ink tank used for an ink jet recording apparatus. The method employs an estimate consumption calculation processing in combination with an actual consumption detection processing. In the estimate consumption calculation processing, an estimate consuming state of the ink within an ink tank is required. Ink consumption is an ink consumption by printing (can be found based on an amount of printing), an ink consumption for maintenance of an ink head and the like. Actual volume of consumption detection processing is to detect an actual volume of consuming state by detecting an oscillating state corresponding to an ink consuming state using a piezoelectric device.

According to the present invention, an actual consuming state can be detected by employing a piezoelectric device. On the other hand, according to an estimate processing, although accompanying with somewhat errors, a consuming state can be found in detail. Therefore, an ink consuming state can be precisely found in detail by the combined use of both processings.

Preferably, the actual consumption detection processing detects an ink liquid level passing through the piezoelectric device as the actual consuming state. When an ink liquid level passes through the piezoelectric device, an output of the piezoelectric device is largely changed. Therefore, the ink liquid level is securely detected. At least one of ink consuming states prior to and after the passage of the liquid level portion is found in detail by the estimate consumption calculation processing. For example, making the passage of the ink liquid level as a starting point, subsequent volume of consumption is calculated. An ink consuming state is found precisely and in detail by performing these processings.

Preferably, when detected that an ink liquid level passes through the piezoelectric device, the detection of the actual consuming state is completed. Owing to this, an operation of the piezoelectric device is limited when it is necessary to be done so. Specifically, useless operations of the piezoelectric device and actual consumption detection processings accompanying with them are omitted.

In the estimate consumption calculation processing, the estimate consuming state may be found by adding up the number of ink droplets ejected from a recording head.

Furthermore, in the estimate consumption calculation processing, the estimate consuming state may be found on the basis of a size of an ink droplet ejected from the recording head.

Preferably, in the estimate consumption calculation processing, consumption conversion information indicating the relationship between an amount of operation of an ink jet recording apparatus and a volume of ink consumption is corrected on the basis of the detection results of the actual consumption detection processing, and the estimate consuming state is found on the basis of the corrected consumption conversion information. The consumption conversion information may be information of a volume of ink consumed during the time of maintenance. The foregoing consumption conversion information may be also a volume of the ink corresponding to the ink droplet ejected from the recording head. A conversion parameter which indicates the relationship between the printing amount and the consuming state is different little by little due to ink jet recording apparatus and ink tanks and further combinations thereof. The error due to such differences of parameters can be reduced, therefore, a consuming state is more precisely found.

The corrected consumption conversion information may be also used to be limited to the ink tank which is an objective of the correction. Otherwise, the corrected consumption conversion information is not limited to the ink tank which is an objective of the correction, may be also used for an ink tank mounted later. The latter is, for example, advantageous in the case where the influence due to individual differences of ink jet heads on the consumption conversion parameter is large. Each ink jet recording apparatus can utilize consumption conversion information applicable to its head.

Preferably, in the estimate consumption calculation processing, the estimate consuming state is corrected on the basis of the detection results of the actual consumption detection processing. The foregoing estimate consumption calculation processing may be a processing for finding the estimate consuming state by adding up the number of ink droplets ejected from a recording head. When the detection results of the actual consumption detection processing are obtained, the estimate consuming state found by adding up until then is corrected. According to this form, when the actual consuming state is detected, the error generated during the estimate consumption calculation processing until then is corrected. Therefore, an ink consuming state can be precisely found.

In the present invention, the consuming state information is, for example, used as follows: a possibly available printing amount using the remaining ink may be indicated on the basis of the obtained consuming state which has been found. The remaining ink volume may be indicated on the basis of the consuming state which has been found. When the remaining ink volume is indicated, different colors may be employed corresponding to the ink volume. When the remaining ink is indicated, different graphic forms corresponding to volume of ink may be employed. An ink jet recording apparatus may be controlled in a different form on the basis of the consuming state information. For example, when the ink container is empty, the printing processing is stopped.

Moreover, in the present invention, the necessity and timing of the ink refilling or an ink tank exchange may be determined on the basis of the estimate consuming state. The necessity and timing of the ink refilling or an ink tank exchange may be determined on the basis of the actual consuming state.

The foregoing piezoelectric device employed in the actual consumption detection processing may be provided nearby the ink supplying opening of the ink tank.

The interior of the ink tank may be separated by at least one of partition walls into a plurality of chambers which are communicated with each other. The piezoelectric device employed in the actual consumption detection processing may be set on the upper portion of the chamber in which the ink is consumed later. It may be set so that a volume of a chamber where the ink is used later is smaller than a volume of a chamber where the ink is used ahead.

Preferably, the consuming state is stored in storage means, for example, the consuming state memory. The foregoing memory device may be a memory device mounted on the ink tank. This form is advantageous with respect to the removal of an ink tank. An ink tank is removed, and when it is mounted again, the consuming state is easily found.

The above-described consumption conversion information may be stored in the consuming state memory. The consumption conversion information following the correction on the basis of the actual consuming state may be stored. These information are also read from the memory when the ink tank is mounted, and preferably utilized.

The foregoing actual consumption detection processing section detects an actual consuming state on the basis of change of acoustic impedance accompanying with a liquid consumption using the piezoelectric device. The piezoelectric device may output a signal indicating a residual oscillating state after an oscillation is generated. The foregoing actual consuming state is detected on the basis of the remaining oscillating state being changed corresponding to the ink consuming state.

Moreover, the piezoelectric device may generate an elastic wave toward the interior of the liquid container and generate a detection signal corresponding to the reflected wave with respect to the elastic wave.

When the actual consuming state is detected by the actual consumption detection processing, the remaining possibly available printing amount may be calculated on the basis of the actual consuming state. When the possibly available printing amount is printed, the printing data prior to the printing may be stored in a printing data storage section.

Another aspect of the present invention is an ink jet recording apparatus having a consumption information memory for storing information concerning with an ink consuming state of an ink tank. The consumption information memory is composed of a semiconductor memory. In the consumption information memory, an estimate consuming state of the ink within the ink tank, an actual consuming state obtained by detection of an oscillating state corresponding to an ink consuming state using a piezoelectric device and ink end event information obtained as the actual consuming state, the ink end event information for indicating the generation of an ink end event, and an ink liquid level passing through the piezoelectric device are stored. Preferably, when the ink tank is mounted, the ink end event information stored in the consumption information memory is read. The ink jet recording apparatus determines whether or not an ink liquid level passes through the piezoelectric device, and in the case where it has already passed through, the predetermined operations are performed.

According to this aspect, an estimate consuming state, an actual consuming state and ink end event information are stored in the semiconductor memory. Those information are appropriately read and used. Preferably, ink end event information is stored in a storage region separate from the other consuming state information. When only seeing the ink end event information, it is easily found whether or not an ink liquid level has already passed through the piezoelectric device. This information is, for example, available in an ink tank mounting operation. Whether or not the ink exists in the mounted ink tank is informed to the user. In this way, by employing the ink end event information, the ink jet recording apparatus can be appropriately operated corresponding to the ink consuming states.

Another aspect of the present invention is an ink tank mounted in an ink jet recording apparatus, and has a consumption information memory for storing information concerning with an ink consuming state. The consumption information memory may be composed of a semiconductor memory. In the consumption information memory, an estimate consuming state of the ink tank and ink end event information obtained as an actual consuming state using a piezoelectric device, which indicates the generation of an ink end event in which an ink liquid level passes through the piezoelectric device are stored. According to this aspect, an effect similar to that of the aspect of an ink jet recording apparatus of the above-described ink end event is also obtained.

Another aspect of the present invention is an apparatus for detecting an ink consuming state of an ink tank used for an ink jet recording apparatus. This ink consumption detection apparatus includes an estimate consumption calculation processing section for finding an estimate consuming state by calculating an ink consuming state of the ink tank on the basis of the consumption conversion information, an actual consumption detection processing section for detecting an actual consuming state using the piezoelectric device mounted on the ink tank, a conversion information correction processing section for correcting the consumption conversion information on the basis of the actual consuming state, and a consumption information storage section for storing and providing a corrected consumption conversion information prior to and after the correction of the reference consumption conversion information to the estimate consumption calculation processing section.

Preferably, the consumption information storage section is provided on the ink tank. The consumption information storage section stores the corrected consumption conversion information along with the correction objective identification information for identifying an ink jet recording apparatus on which the ink tank has been mounted when the consumption conversion information was corrected. The foregoing estimate consumption calculation processing section uses its corrected consumption conversion information when the corrected consumption conversion information obtained making the ink jet recording apparatus as an objective is stored in the consumption information storage section. The estimate consumption calculation processing section uses the reference consumption conversion information when the corrected consumption conversion information obtained by making the ink jet recording apparatus as an objective is not stored in the consumption information storage section. Preferably, the estimate consumption calculation processing section selects the reference consumption conversion information or the corrected consumption conversion information based on the corrected objective identification information when the ink tank is exchanged.

According to the present invention, the corrected consumption conversion information is used only in the ink jet recording apparatus when its correction is performed by making reference to the corrected objective identification information. A situation that the corrected consumption conversion information is used in another ink jet recording apparatus can be avoided. For example, when an ink tank is removed from the recording apparatus and mounted on another recording apparatus, reference consumption conversion information is used. When the ink tank is mounted on the same recording apparatus again, the previous corrected consumption conversion information is used. In this way, since appropriate consumption conversion information is used, an ink consuming state is precisely found.

The foregoing corrected objective identification information may be information for identifying a kind of the ink jet recording apparatus. The foregoing corrected objective identification information may be information for individually identifying an ink consumption related constitution of the ink jet recording apparatus. The foregoing corrected objective identification information may be information for identifying a recording head of the ink jet recording apparatus.

Preferably, the ink tank has a plurality of piezoelectric device in different locations. The foregoing actual consumption detection processing section detects that an ink liquid level passes through each piezoelectric device. The foregoing conversion information correction processing section finds the corrected consumption conversion information on the basis of an estimate consuming volume (printing amount and/or the number of frequency of maintenance may be used) obtained from the point in time when one piezoelectric device detects the passage of a liquid level portion to the point in time when the next piezoelectric device detects the passage of a liquid level portion. The foregoing estimate consumption calculation processing section finds the consuming state by switching from the fundamental consumption conversion information to the corrected consumption conversion information when the corrected consumption conversion information was obtained. Preferably, after the ink tank was exchanged, when a plurality of piezoelectric devices have detected ink liquid level, the corrected consumption conversion information is found, and switched from the fundamental consumption conversion information to the corrected consumption conversion information.

According to this form, when the ink tank is mounted on the ink jet recording apparatus, after the corrected consumption conversion information whose objective is its recording apparatus is obtained, its corrected consumption conversion information is used. For example, even in the case where an ink tank half-used is removed and then it is mounted on another recording apparatus, appropriate consumption conversion information is used.

The present invention can be realized in various aspects. The present invention is not limited to an ink consumption detection apparatus, may be an ink jet recording apparatus, may be a control apparatus of an ink jet recording apparatus, may be an ink tank, and may be the other aspects. In the case where the present invention is an aspect of an ink tank, preferably, an ink tank has a consumption information memory, and provides information necessary to the various kinds of processings described above, especially consumption conversion information. A typical ink tank is an ink cartridge attachable to/detachable from a recording apparatus.

One aspect of the present invention is a method of detecting an ink consuming state of an ink tank used for an ink jet recording apparatus. This method uses both of an estimate consumption calculation processing and an actual consumption detection processing in combination. In an estimate consumption calculation processing, an estimate consuming state is found by calculating an ink consuming state on the basis of an ink consumption of the ink tank. The ink consumption may be an ink consumption by printing, or may be an ink consumption for maintenance of an ink head and the like. On the other hand, an actual consumption detection processing detects an actual consuming state by detecting an oscillating state corresponding to an ink consuming state using a piezoelectric device. In the present invention, the actual consumption detection processing plurality of stages using a plurality of piezoelectric devices mounted on different locations of the ink tank.

In the present invention, although errors are somewhat accompanied with, a consuming state is found in detail by an estimate processing on the basis of an ink consumption. On the other hand, by employing a piezoelectric device, an actual consuming state can be precisely detected without using a complex sealing structure. Particularly, by employing a plurality of piezoelectric devices, an actual consuming state of a plurality of stages are found. An ink consuming state can be found precisely and in detail from the actual consuming state in a plurality of stages and the estimate consuming state.

Preferably, in the actual consumption detection processing, that an ink liquid level passes through the respective multiple piezoelectric devices is detected as the actual consuming state. In the estimate consumption calculation processing, a consuming state from the point in time when one piezoelectric device detects the passage of a liquid level portion to the point in time when the next piezoelectric device detects the passage of a liquid level portion is found as the estimate consuming state. Moreover, in the estimate consumption calculation processing, a consumption state after the lowest piezoelectric device detects the passage of a liquid level portion is found as the estimate consumption state. By these processings, when a liquid level portion passes through, a consumption state is precisely detected, and consumption states prior to and after the passage are complemented with estimations. As a result, the ink consumption state can be complemented continuously, precisely and in detail.

Preferably, in the estimate consumption calculation processing, when an ink liquid level passes through the respective multiple piezoelectric devices, consumption conversion information is corrected, the estimate consumption state is found on the basis of the corrected consumption conversion information. The foregoing consumption conversion information may be a volume of the ink corresponding to the number of ink droplets ejected from the recording head. The consumption conversion information may be information of a volume of an ink consumed when performing the maintenance. A consumption conversion parameter is different little by little due to ink jet recording apparatus and ink tanks, and further combinations thereof. Since the errors due to these differences of conversion parameters can be reduced, a consumption state can be more precisely found.

The corrected consumption conversion information may be used so as to be limited to an ink tank which is the objective of the correction. Or, the corrected consumption conversion information may be used for an ink tank subsequently mounted without limiting to the ink tank which is the objective of the correction. The latter is advantageous, for example, in the case where the influence to the consumption conversion parameter due to the individual differences of ink jet heads is large. The respective ink jet recording apparatus can utilize consumption conversion information applicable to their heads.

In the method of the present invention, when the lowest piezoelectric device detects the passage of a liquid level portion, until then the final consumption conversion information may be also found on the basis of the corrected results of consumption conversion information for a plurality of times accompanying with detections of the passages of liquid levels for a plurality of times. The foregoing estimate consumption state is found after the lowest piezoelectric device detects the passage of a liquid level portion by the respective multiple piezoelectric devices using this final consumption conversion information.

Preferably, the estimate consumption calculation processing is a processing for finding the estimate consumption state by adding up the number of ink droplets ejected from a recording head, when the passage of a liquid level portion is detected by the respective multiple piezoelectric devices, the estimate consumption state found by adding up until then is corrected. According to this form, when the actual consumption state is detected, the errors generated by estimate consumption calculation processing until then are corrected. Therefore, the ink consumption state can be precisely found.

The foregoing actual consumption detection processing section may detect an actual consumption state on the basis of a change of an acoustic impedance accompanied with a liquid consumption using the piezoelectric device. The foregoing piezoelectric device may output a signal indicating the remaining oscillating state after an oscillation is generated. The foregoing actual consumption state is detected on the basis of the remaining oscillation state being changed corresponding to an ink consumption state.

Moreover, a piezoelectric device may generate a detection signal corresponding to a reflected wave with respect to an elastic wave as well as generate the elastic wave toward the interior of the liquid container.

The foregoing ink tank which is the objective of detection of an ink consumption state is, typically, an ink cartridge attachable to/detachable from the ink jet recording apparatus. However, an ink tank is not limited to an ink cartridge, and applicable to a sub tank fixed on a recording apparatus and the like.

Another aspect of the present invention is an apparatus for detecting an ink consuming state of an ink tank used for an ink jet recording apparatus includes an estimate consumption calculation processing section for finding an estimate consumption state by calculating an ink consumption state on the basis of the ink tank, a plurality of piezoelectric devices mounted on different locations of the ink tank, and an actual consumption detection processing section for detecting an actual consumption state of the ink in a plurality of stages by detecting an oscillating state corresponding to an ink consumption state using the multiple piezoelectric devices.

One aspect of an ink jet recording apparatus according to the present invention can be attached to/detached from an ink tank having a piezoelectric device for housing the ink for supplying to a recording head for discharging an ink droplet and recording and detecting the ink. Moreover, the relevant ink jet recording apparatus comprises an estimate consumption calculation processing section for finding an estimate consumption state of the ink within an ink tank on the basis of the reference consumption conversion information related to a volume of the ink consumed from a head, an actual consumption detection processing section for detecting an actual consumption state by detecting an oscillating state corresponding to a consumption state of the ink within the ink tank using a piezoelectric device, a correction section for correcting the reference consumption conversion information on the basis of the determination that whether or not the reference consumption conversion information is made a correction objective is determined and making it an objective of the correction.

Preferably, the relevant ink jet recording apparatus finds an estimate consumption state by adding up the number of times of an ink consumption consumed from the recording head and a volume of the ink obtained from the reference consumption conversion information.

Preferably, the reference consumption conversion information are classified into at least different two unit information with each other. Moreover, the correction section determines at least any one of unit information out of two units information as a correction objective at least on the basis of the estimate consuming state. Moreover, the correction section may be previously set so as to determine at least one of unit information as a correction objective.

At least two unit information may be classified according to a volume of ink droplets discharged from the recording head. At least two unit information may be classified according to a printing state and non-printing state. At least two unit information may be classified according to a circumferential temperature recorded by the recording head. At least two unit information may be classified according to a temperature of circumference recorded by the recording head.

Preferably, the correction section corrects the reference consumption conversion information using a ratio between an estimate consumption state and an actual consumption state.

Preferably, the relevant ink jet recording apparatus has a storage section for storing the reference consumption conversion information. Preferably, the relevant ink jet recording apparatus has a storage section for storing the reference consumption information corrected by the correction section.

A factor of the reference consumption conversion information may be represented by a volume of ink droplets discharged from the recording head. A factor of the reference consumption conversion information may be represented by mass of ink droplets discharged from the recording head. A factor of the reference consumption conversion information may be represented by a ratio making an optional unit information as a reference. The estimate consumption calculation processing section may find an estimate consumption state on the basis of any of the reference consumption conversion information out of a plurality of the reference consumption conversion information.

One aspect of an ink tank according to the present invention is equipped with a container for housing the ink for supplying to a recording head discharging ink droplets, a liquid supplying opening for supplying the ink to the recording head, a piezoelectric device for detecting a consumption state of the ink within the container, and a storage section for storing the reference consumption conversion information classified into at least two kinds of unit information which are related to a volume of the ink consumed from the recording head and different from each other. The relevant ink tank can be attached/detached from an ink jet recording apparatus for recording by discharging ink droplets.

Preferably, the storage section stores the reference consumption conversion information classified into the corrected unit information on the basis of an estimate consumption state of the ink within the relevant ink tank on the basis of the reference consumption conversion information and an actual consumption state detected from an oscillating state corresponding to a consumption state of the ink within the relevant ink tank using a piezoelectric device.

The storage section may store the multiple reference consumption conversion information which are different from each other. Preferably, the number of the multiple reference consumption conversion information is determined according to the number of piezoelectric devices.

One aspect of the method of detecting an ink consumption according to the present invention is a method of detecting a consumption state of the ink of an ink tank which has a piezoelectric device for housing the ink for supplying to the recording head for discharging an ink droplet and detecting the ink and which is mounted so as to be attachable to/detachable from the ink jet recording apparatus, and has a detection step for finding an estimate consumption state on the basis of the reference consumption conversion information related to a volume of the ink consumed from the recording head and detecting an actual consumption state by detecting an oscillating state corresponding to a consumption state of the ink using a piezoelectric device, a correction determination step for determining whether or not the reference consumption conversion information is made a correction objective, and a correction step for correcting the reference consumption conversion information on the basis of the results of the determination that the correction in the correction determination step is performed.

In the correction determination step, the correction section may determine whether or not the reference consumption conversion information in the correction step is corrected by the relationship between an estimate consumption state prior to the detection step and the reference consumption conversion information in the detection step.

Preferably, the reference consumption conversion information are classified into at least two kinds of unit information different from each other related to a volume of ink droplets discharged from the recording head.

Preferably, the relevant method of detecting an ink consumption determines whether or not at least two kinds of unit information are made a correction objective on the basis of an estimate consumption state in the correction determination step.

In the correction determination step, when an estimate consumption state based on the second unit information is larger than an estimate consumption state based on unit information except for the first unit information with respect to a volume of an ink consumption or a rate of consumption, the second unit information may be made as a correction objective.

In the correction determination step, when an estimate consumption state based on the relevant unit information in the detection step is larger than any of estimate consumption states based on the relevant unit information prior to the detection step with respect to a volume of an ink consumption or a rate of consumption, the unit information may be determined as a correction objective.

In the correction determination step, unit information whose estimate consumption state is larger than a predetermined threshold with respect to a volume of an ink consumption or a rate of consumption may be determined as a correction objective.

In the estimate consumption calculation processing, an estimate consumption may be found by approximation using a linear calculation between factors of the reference consumption conversion information.

In the correction determination step, at least one of unit information out of unit information may be determined as a correction objective by a probable value of the error between an estimate consumption state and an actual consumption state.

Another aspect of the method of detecting an ink consumption according to the present invention has a first detection step for finding an estimate consumption state based on first reference consumption conversion information out of the multiple reference consumption conversion information related to a volume of the ink consumed from a recording head and detecting an oscillating state corresponding to a consumption state of the ink using a piezoelectric device, and a second detection step for finding an estimate consumption state based on second reference consumption conversion information which is different from the first reference consumption conversion information out of the multiple reference consumption conversion information and detecting an actual consumption state by detecting an oscillating state corresponding to a consumption state of the ink using a piezoelectric device.

The present aspect may have a modification determination step for determining whether or not the first reference consumption conversion information is changed to the second reference consumption conversion information which is different from the first reference consumption conversion information between the first detection step and the second detection step. In such a case, in the second detection step, according to the results of the modification determination step, an estimate consumption state is found based on the first reference consumption conversion information or the second reference consumption conversion information and an actual consumption state is detected by detecting an oscillating state corresponding to a consumption state of the ink using a piezoelectric device.

Preferably, in the estimate consumption calculation processing, an estimate consumption state is found by adding up the number of ink consumption consumed from the recording head and a volume of the ink obtained from the reference consumption conversion information.

Preferably, in the actual consumption detection processing section, an actual consumption state is detected based on a change of an acoustic impedance accompanied with an ink consumption using the piezoelectric device.

Preferably, in the actual consumption detection processing section, an ink consumption state is detected based on a counter electromotive force generated by the residual oscillation remained in the oscillating section that a piezoelectric device has.

BRIEF DESCRIPTION OF DRAWINGS

FIG. 70 is a table showing a matrix indicating an embodiment of the reference consumption conversion information stored in consumption conversion information storage section 808;

FIG. 79 is a table indicating corrections performed by employing numeric value per unit information;

FIG. 80 is a table indicating corrections performed by employing numeric value per unit information;

BEST MODE FOR CARRYING OUT THE INVENTION

Figure 1:
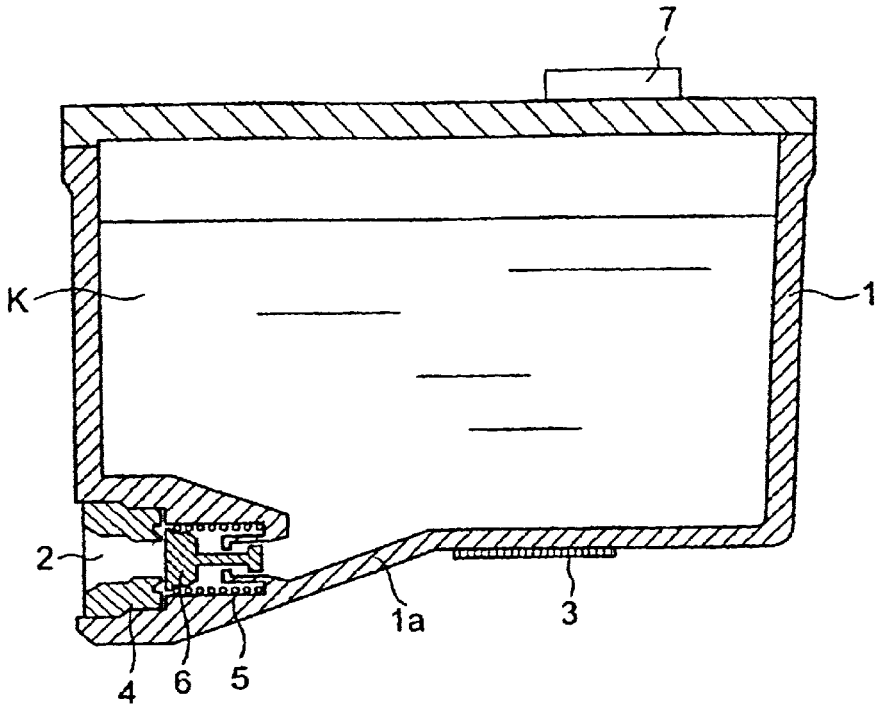
FIG. 1 is a view showing one embodiment of an ink cartridge used for mono color, for example, black color ink.

Hereinafter, the present invention will be described through embodiments of the present invention, however, the following embodiments do not limit the scope of the invention of the claims, nor is it always essential for means for solving the problems to have all of the combinations of the characteristics described in the embodiments.

First, the principle of the present embodiment will be described below. In the present embodiment, the present invention is applied to technologies for detecting an ink consumption state within an ink container. An ink consumption state is found in cooperation with two kinds of processings. One of the processings is an estimate consumption calculation processing, and the other processing is an actual consumption detection processing.

In an estimate consumption calculation processing, an estimate consumption state is found by calculating an ink consumption state based on ink consumption of an ink tank. Ink consumption includes ink consumption by printing and ink consumption by the recording head maintenance. The present invention may be applied to either of them, and may be applied to both of them. As for an ink volume, ink consuming volume is found by the number of ink droplets ejected from the recording head or the value of the product of the number of ink droplets and an ink volume of each droplet and the like. As for maintenance, ink consumption is found by the number of times of maintenance processing, processing volume, a volume converted from the processing volume into the number of ink droplets and the like.

In an actual consumption detection processing, an actual consumption state is detected by detecting an oscillating state corresponding to an ink consumption state using a piezoelectric device. Preferably, using a piezoelectric device, a change of acoustic impedance accompanied with ink consumption is detected.

According to an estimate processing, although an error is somewhat accompanied with it, a consumption state is found in detail. On the other hand, a consumption state can be precisely detected by employing a piezoelectric device without any complex sensor sealing structure being provided. Therefore, an ink consumption state is found precisely and in detail by employing both of processings in combination.

In the present embodiment described later, an actual consumption detection processings detects that an ink liquid level passes through the piezoelectric device as an actual consumption state. When an ink liquid level passes through the piezoelectric device, an output of the piezoelectric device is largely changed. Therefore, the passage of liquid level portion is securely detected. Ink consumption states prior to and after the passage of a liquid level portion are found in detail by an estimate consumption calculation processing. Furthermore, when a liquid level portion passes through the piezoelectric device, the error of the estimate calculation processing by then is corrected. Moreover, conversion information used for an estimate calculation processing is corrected. An ink consumption processing is found precisely and in detail by these processings.

Hereafter, the present embodiment will be described more concretely with reference to the drawings. First, the principle of a technology for detecting an ink consumption based on oscillation by employing a piezoelectric device will be described. Subsequently, various kinds of applications of detection technologies will be described. Consequently, with reference to FIG. 47, an ink consumption detection technology of the present embodiment, specifically, a detection technology using an estimate consumption calculation processing and an actual consumption detection processing will be described.

In the present embodiment, a piezoelectric device is provided in a liquid sensor. In the following explanation, "actuator" and "elastic wave generation means" are equivalent to a liquid sensor.

[Cartridge for Detecting Ink Consumption]

The fundamental concept of the present invention is to detect a liquid state within a liquid container (including the presence or absence of the liquid within the liquid container, a volume of the liquid, a liquid level, the kind of the liquid and components of the liquid) by utilizing an oscillation phenomenon. Some concrete methods are considered as a method of detecting a liquid state within the liquid container by utilizing an oscillation phenomenon. For example, there is a method such that elastic wave generation means generates an elastic wave with respect to the interior of the liquid container, receiving the reflected wave reflected by the liquid level or opposed wall and detects a medium within the liquid container and a change of its state. Moreover, apart from this, there is a method such that a change of acoustic impedance is detected from the oscillation property of an oscillating object. As a method of utilizing a change of acoustic impedance, a method in which a change of acoustic impedance is detected by making a piezoelectric device having a piezoelectric element or an oscillating section of the actuator oscillated, subsequently measuring a counter electromotive force generated by the residual oscillation remained in the oscillating section, and detecting an amplitude of resonance frequency or counter electromotive force waveform, and a method in which a change of current value and voltage value or a change of current value and voltage value due to frequency when an oscillation is given to the liquid is measured by measuring an impedance property of the liquid or an admittance property of the liquid using an impedance analyzer, for example, a measuring apparatus such as a transmission circuit. The operational principle of elastic wave generation means and a piezoelectric device or an actuator will be described in detail later.

FIG. 1 is a sectional view of one embodiment of an ink cartridge used for mono color, for example, black color ink to which the present invention is applied. An ink cartridge of FIG. 1 is based on a method of detecting a position of a liquid level within the liquid container and the presence and absence of the liquid by receiving a reflected wave of an elastic wave out of the above-described methods. As means for generating an elastic wave and receiving, elastic wave generation means 3 is employed. In a container 1 for housing the ink, an ink supplying opening 12 which is joined to an ink supplying needle of a recording apparatus is provided. On the outer side of a bottom surface 1*a* of the container 1, the elastic wave generation means 3 is mounted so that the elastic wave generation means 3 can transmit an elastic wave to the ink of the interior via the container. At the stage where the ink K is almost completely consumed, specifically, at the point in time when it is an ink near end, the elastic wave generation means 3 is provided at somewhat upper position than that of the ink supplying opening 2 in order to change the medium of transmission of the elastic wave from the ink to gas. It should be noted that receiving means is provided separately and the elastic wave generation means 3 may be used only as generation means.

Figure 3:
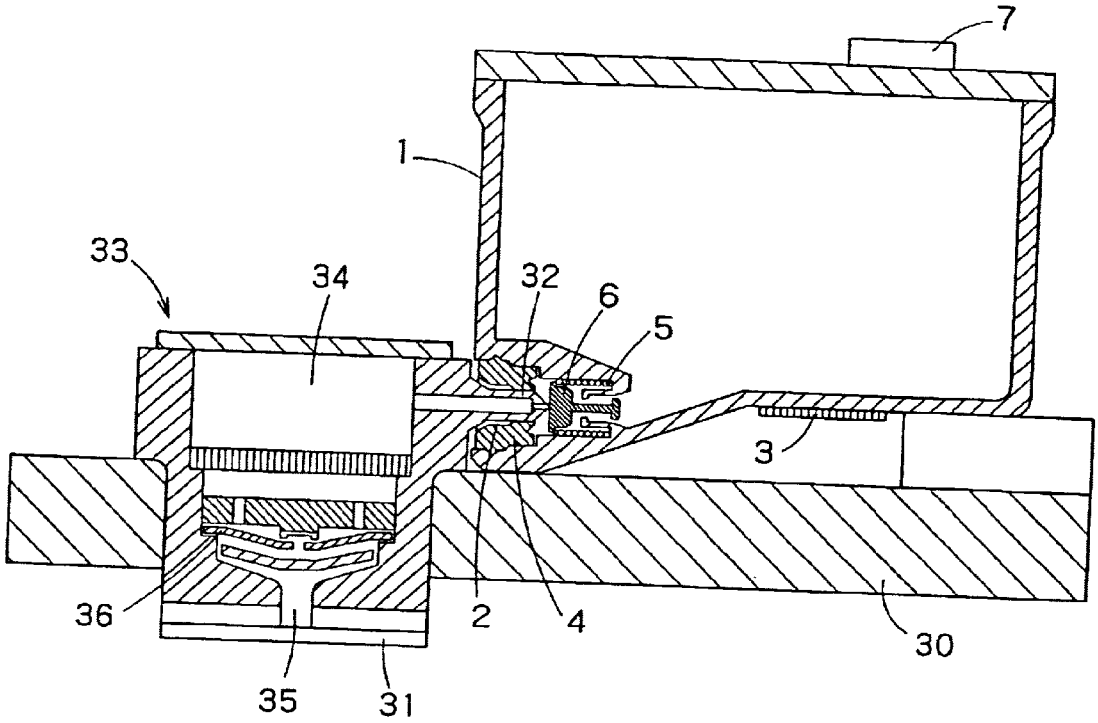
FIG. 3 is a view showing one embodiment of an ink jet recording apparatus suitable for the ink cartridge shown in FIG. 1 and FIG. 2.

A packing 4 and a valve element 6 are provided in the ink supplying opening 2. As shown in FIG. 3, the packing 4 engages in the ink supplying needle 32 in a fluid-tight manner, which communicates with a recording head 31. The valve element 6 is always contacted with the packing 4 by a spring 5. When the ink supplying needle 32 is inserted, the valve element 6 is pushed by the ink supplying needle 32 and opens an ink pass, the ink within the container 1 is supplied to the recording head 31 via the ink supplying opening 2 and the ink supplying needle 32. On the upper wall of the container 1, semiconductor storage means 7 in which information concerning with the ink within the ink cartridge is stored is mounted.

Figure 2:
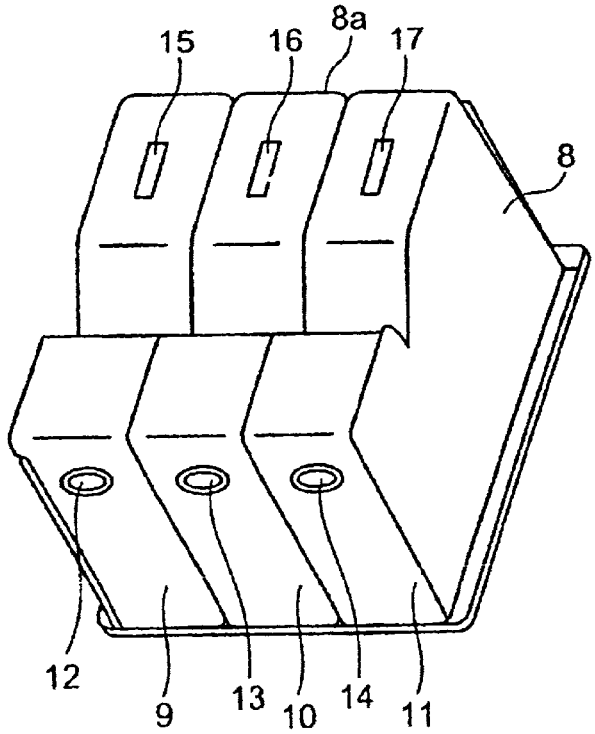
FIG. 2 is a view showing one embodiment of an ink cartridge for housing multiple kinds of inks.

FIG. 2 is a perspective view seen from the backside showing one embodiment of an ink cartridge for housing a plurality of kinds of inks. A container 8 is divided into three ink chambers 9, 10 and 11 by partition walls. In each ink chamber, ink supplying openings 12, 13 and 14 are formed. On the bottom surface 8*a* of the respective ink chambers 9, 10 and 11, elastic wave generation means 15, 16 and 17 are mounted so that these means can transmit an elastic wave to the ink contained in the respective ink chambers via the container 8.

FIG. 3 is a sectional view showing an embodiment of the major parts of an ink jet recording apparatus suitable for the ink cartridge shown in FIGS. 1 and 2. A carriage 30 which is capable of reciprocating in the width direction of a recording paper, which is equipped with a sub tank unit 33, and a recording head 31 is provided on the lower surface of the sub tank unit 33. Moreover, an ink supplying needle 32 is provided on the side of the ink cartridge mounted surface of the sub tank unit 33.

Figure 4:
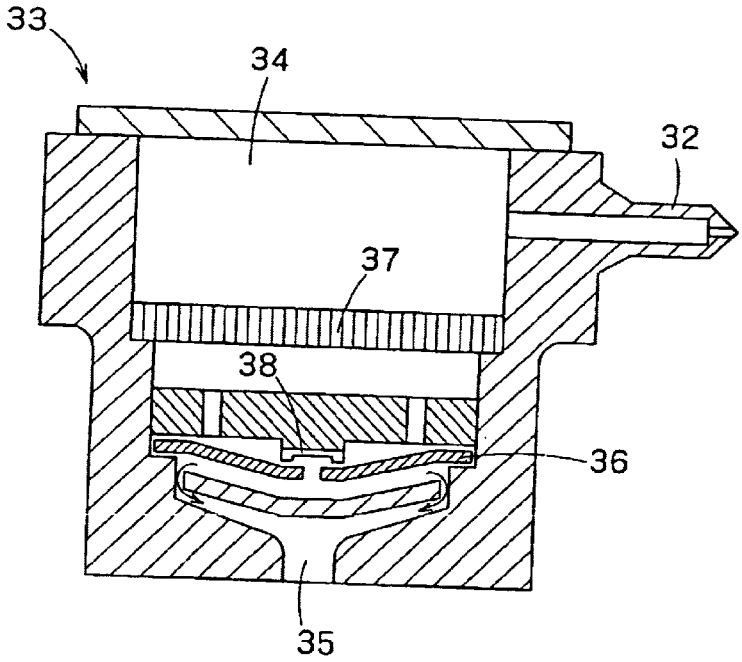
FIG. 4 is a view showing a section in detail of a sub tank unit 33.

FIG. 4 is a sectional view showing the details of the sub tank unit 33. The sub tank unit 33 has an ink supplying needle 32, an ink chamber 34, a film valve 36 and a filter 37. The ink supplied from the ink cartridge via the ink supplying needle 32 is contained within the ink chamber 34. The film valve 36 is designed so that the valve is opened and closed by a difference of the pressure between the ink chamber 34 and an ink supplying path 35. It is configured so that the ink supplying path 35 communicates with the recording head 31 and therefore the ink is supplied to the recording head 31.

As shown in FIG. 3, when the ink supplying opening 2 of the container 1 is inserted to and communicated with the ink supplying needle 32 of the sub tank unit 33, the valve element 6 is backed against the spring 5, an ink pass is formed, and the ink within the container 1 flows into the ink chamber 34. At the stage where the ink is filled in the ink chamber 34, a nozzle opening of the recording head 31 is negatively pressurized and the ink chamber 34 is filled with the ink, and subsequently a recording operation is carried out.

When the ink is consumed in the recording head 31 by the recording operation, since the pressure on the downstream side of the film valve 36 is lowered, the film valve 36 is separated from the valve element 38 and the valve is opened as shown in FIG. 4. By opening the film valve 36, the ink in the ink chamber 34 flows into the recording head 31 via the ink supplying path 35. Accompanying with inflow of the ink into the recording head 31, the ink in the container 1 flows into the sub tank unit 33 via the ink supplying needle 32.

During the operation of the recording apparatus, a drive signal is supplied to the elastic wave generation means 3 at the previously set timing of detection, for example, at a certain cycle. An elastic wave generated by the elastic wave generation means 3 propagates through the bottom surface 1*a* of the container 1, transmitted to the ink and propagated through the ink.

The elastic wave generation means 3 is attached and fixed on the container 1, thereby being capable of giving the remaining detection function to the ink cartridge itself. According to the present invention, since the embedding the electrode for detecting a liquid level at the time when the container 1 is molded is not needed, an injection molding step is simplified, a liquid leakage from the electrode embedded region is not seen, and the reliability of an ink cartridge can be enhanced.

Figure 5:
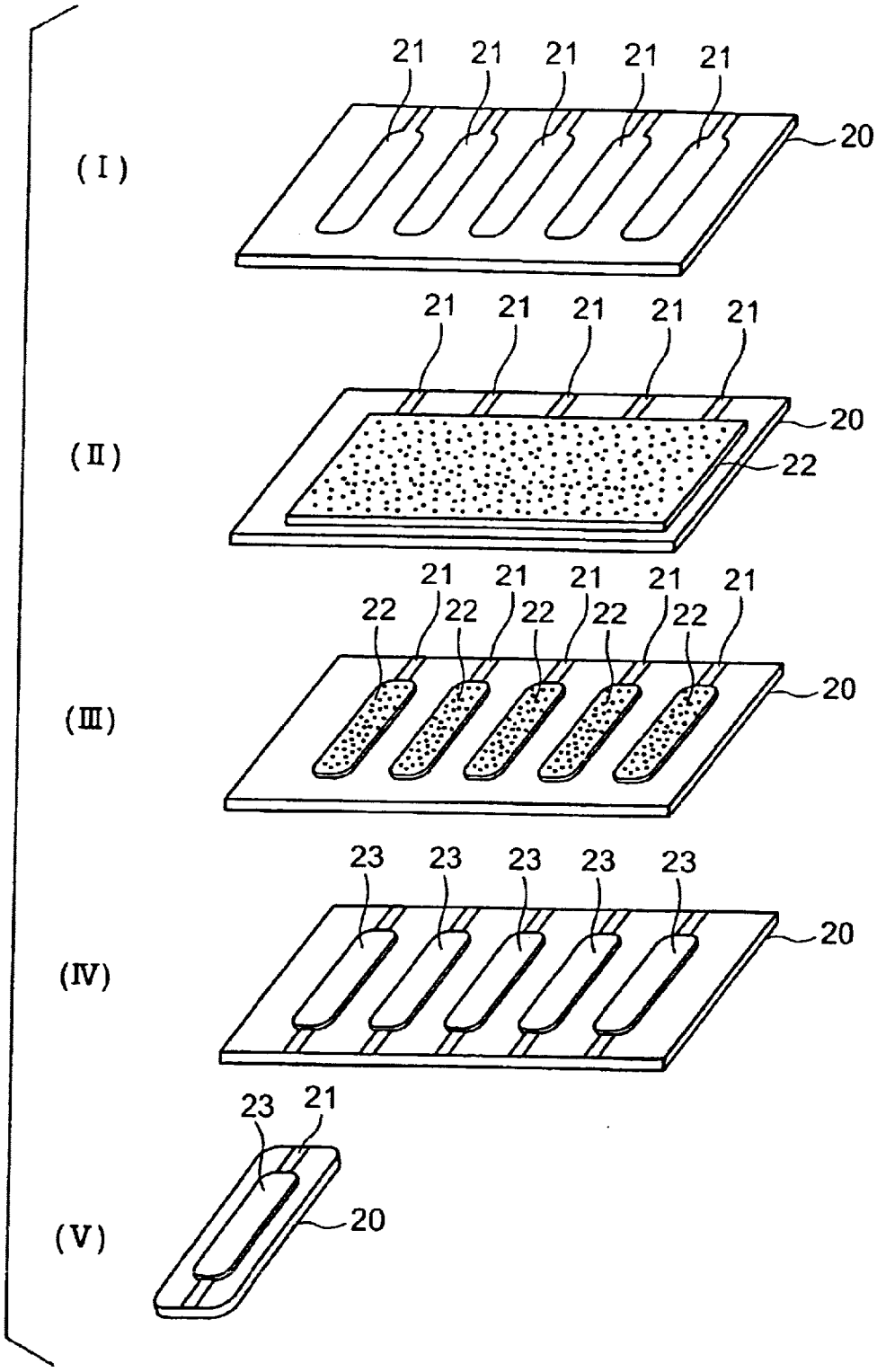
FIG. 5 is a view showing a method of manufacturing elastic wave generation means 3, 15, 16 and 17.

FIG. 5 shows a method of manufacturing the elastic wave generation means 3, 15, 16 and 17. A fixed substrate 20 is formed with materials such as ceramic and the like, which are capable of being burned. First, as shown in FIG. 5(I), an electrically conductive material layer 21 which is to be one of the electrodes is formed on the surface of the fixed substrate 20. Next, as shown in FIG. 5 (II), a green sheet 22 of a piezoelectric material is superimposed on the surface of the electrically conductive material layer 21. Next, as shown in FIG. 5 (III), the green sheet 22 is formed into the predetermined shape, for example, a shape of an oscillator by press and the like, after naturally dried, it is burned at the firing temperature, for example, 1200° C. Next, as shown in FIG. 5 (IV), an electrically conductive material layer 23 which is to be the other electrode is formed on the surface of the green sheet 22 and polarized with the flexural oscillation capability. Finally, as shown in FIG. 5(V), the fixed substrate 20 is cut into each element. By fixing the fixed substrate 20 on the predetermined surface of the container 1 using an adhesive or the like, the elastic wave generation means 3 is fixed on the predetermined surface of the container 1, and an ink cartridge with the remaining volume detection function is completed.

Figure 6:
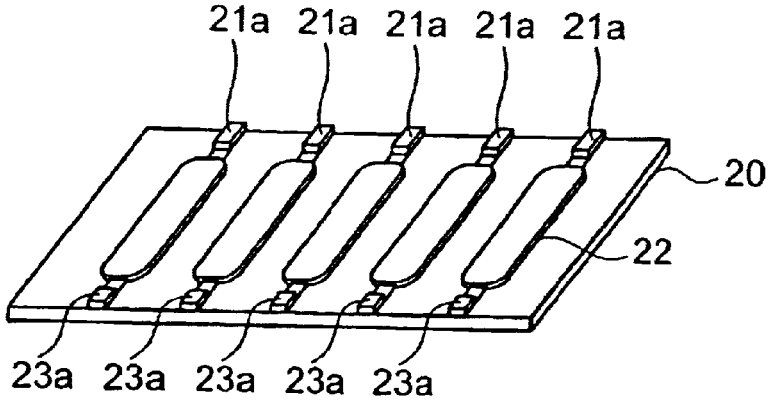
FIG. 6 is a view showing another embodiment of the elastic wave generation means 3 shown in FIG. 5.

FIG. 6 shows another embodiment of the elastic wave generation means 3 shown in FIG. 5. In the embodiment of FIG. 5, the electrically conductive material layer 21 is used as a connecting electrode. On the other hand, in the embodiment of FIG. 6, connecting terminals 21*a* and 23*a* are formed by soldering and the like at the position higher than that of the surface of the piezoelectric material layer composed of the green sheet 22. Owing to the connecting terminals 21*a* and 23*a*, a direct mounting of the elastic wave generation means 3 on the circuit substrate can be realized, and the routing of the lead wire is not needed.

By the way, an elastic wave is a kind of wave which is capable of propagating through gas, a liquid and a solid object as a medium. Therefore, a wavelength, an amplitude, a phase, the number of oscillation, a propagating direction, a propagating speed and the like are changed by the change of the medium. On the other hand, the wave state and property of a reflected wave of the elastic wave is also changed by the change of the medium. Therefore, by utilizing a reflected wave changed by the change of the medium through which the elastic wave propagates, it is possible to know the state of the medium. In the case where a state of a liquid within the liquid container is detected by this method, for example, an elastic wave transmitter receiver is used. As explaining it by exemplifying the forms of FIG. 1 through FIG. 3, first, a transmitter receiver transmits an elastic wave to a medium, for example, a liquid or a liquid container, its elastic wave propagates through the medium and reaches to the surface of the liquid. Since on the liquid surface, there is an interface between the liquid and gas, the reflected wave is returned to the transmitter receiver. The transmitter receiver receives the reflected wave, and the distance between the transmitter or receiver and the surface of the liquid can be measured from a time period of reciprocating of the elastic wave and its reflected wave, a ratio of attenuation generated between an amplitude of the elastic wave generated and an amplitude of the reflected wave reflected by the surface of the liquid and the like. A state of a liquid within the liquid container can be detected by utilizing it. The elastic wave generation means 3 may be used as a single unit and as a transmitter receiver in a method of utilizing a reflected wave due to the change of the medium through which the elastic wave propagates, or a separate receive-only apparatus may be mounted.

As described above, as to an elastic wave which is generated by the elastic wave generation means 3 and which propagates through an ink liquid, its incoming time to the elastic wave generation means 3 of the reflected wave generated on the surface of the ink liquid is changed by the density of the ink liquid and the liquid level. Therefore, in the case where components of the ink are consistent, an incoming time of the reflected wave generated on the surface of the ink liquid depends upon a volume of the ink. Therefore, a volume of the ink can be detected by measuring a time period spanning from the point in time when the elastic wave generation means 3 generates an elastic wave to the point in time when the reflected wave reflected from the surface of the ink liquid arrives at the elastic wave generation means 3. Moreover, since an elastic wave vibrates particles contained in the ink, in the case where the ink using a pigment as a coloring agent, it contributes to the prevention of precipitation of the pigment and the like.

By providing the elastic wave generation means 3 on the container 1, in the case where the ink of the ink cartridge is reduced to nearby the ink end by printing operation and maintenance operation and the reflected wave cannot be received by the elastic wave generation means 3, it is determined as an ink near end, and the exchange of an ink cartridge can be urged.

Figure 7:
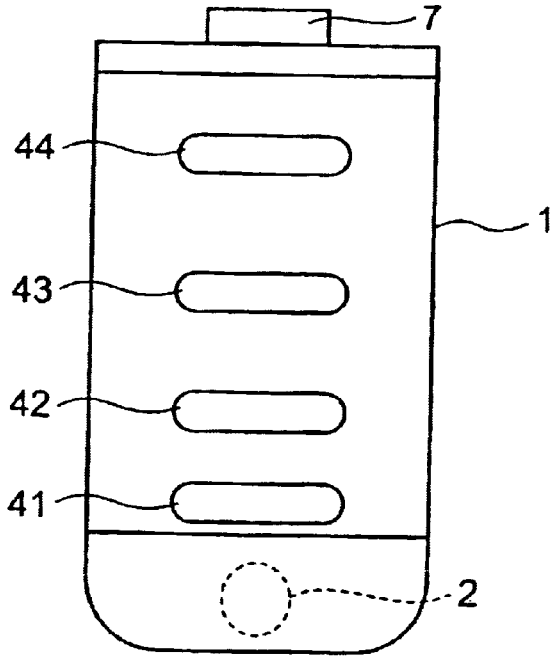
FIG. 7 is a diagram showing another embodiment of an ink cartridge of the present invention.

FIG. 7 shows another embodiment of an ink cartridge of the present invention. Multiple elastic wave generation means 41 through 44 are provided on the side wall of the container 1. As to the ink cartridge of FIG. 7, the presence and absence of the ink at the mounting levels of the respective elastic wave generation means 41 through 44 can be detected depending upon whether or not the ink exists at the respective positions of the elastic wave generation means 41 through 44. For example, when an ink liquid level exists at the level between the elastic wave generation means 44 and 43, since the elastic wave generation means 44 detects it as the ink being absent, the elastic wave generation means 41, 42 and 43 detects it as the ink being present, the ink liquid level exists at the level between the elastic wave generation means 44 and 43 is understood. Therefore, by providing the multiple elastic wave generation means 41 through 44, an ink remaining volume can be detected step by step.

Figure 8:
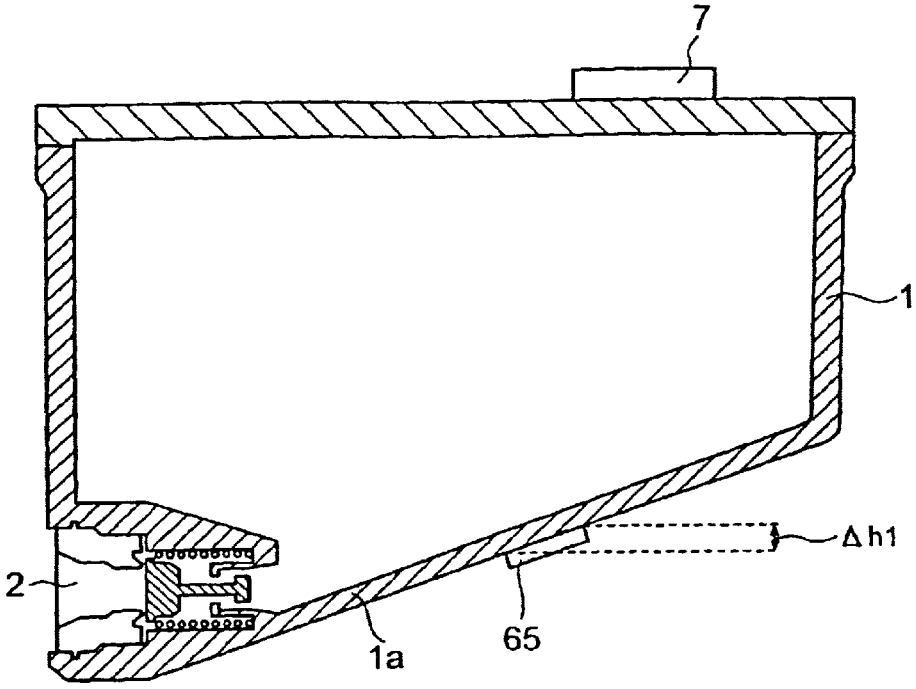
FIG. 8 is a view showing still another embodiment of an ink cartridge of the present invention.
Figure 9:
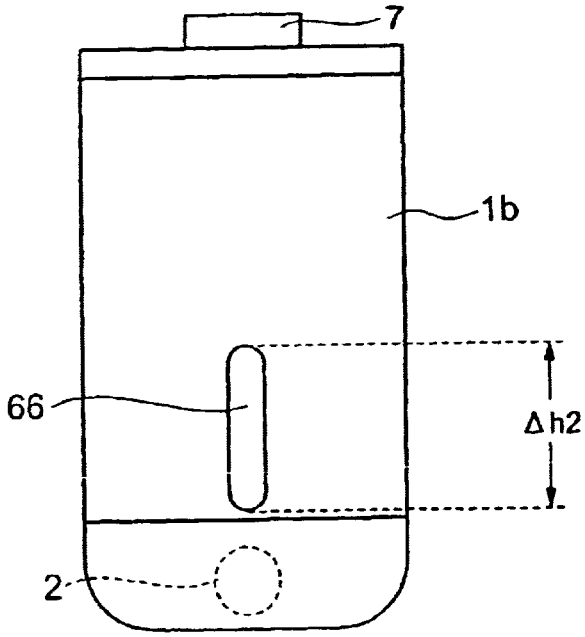
FIG. 9 is a diagram showing still another embodiment of an ink cartridge of the present invention.

FIG. 8 and FIG. 9 show still other embodiments of an ink cartridge of the present invention, respectively. In the embodiment shown in FIG. 8, elastic wave generation means 65 is mounted on the bottom surface 1*a* formed in a vertically slanting manner away from the lowest portion of the ink cartridge. Moreover, in the embodiment shown in FIG. 9, elastic wave generation means 66 being elongated in the vertical direction is provided on the nearby the bottom surface of the side wall 1*b*.

According to the embodiments of FIG. 8 and FIG. 9, when the ink is consumed and one portion of the respective elastic wave generation means 65 and 66 are exposed from the liquid level, an incoming time period and acoustic impedance of the reflected wave of the elastic wave generated by the elastic wave generation means 65 and 66 continuously changes corresponding to the change of liquid levels $\Delta h1$ and $\Delta h2$, respectively. Therefore, the processing from the ink near end state of the ink remaining volume to the ink end can be precisely detected by detecting the degree of change of an incoming time period or acoustic impedance of the reflected wave of an elastic wave.

It should be noted that in the above-described embodiments, an ink cartridge in the form of directly housing the ink in the liquid container was exemplified and explained. As another embodiment of an ink cartridge, the above-described elastic wave generation means may be mounted on an ink cartridge in the form of loading a porous elastic body in the container 1 and immersing liquid ink into the porous elastic body. Moreover, although in the above-described embodiments, the upsizing of a cartridge is suppressed by employing a flexural oscillator type piezoelectric oscillator, a longitudinal oscillation type piezoelectric vibrator is also capable of being used. Furthermore, in the above-described embodiments, an elastic wave is transmitted and received by the identical elastic wave generation means. As another embodiment, an ink remaining volume may be detected by employing different elastic wave generation means, specifically, one for echo-sounder transmitter and the other for echo-sounder receiver.

Figure 10:
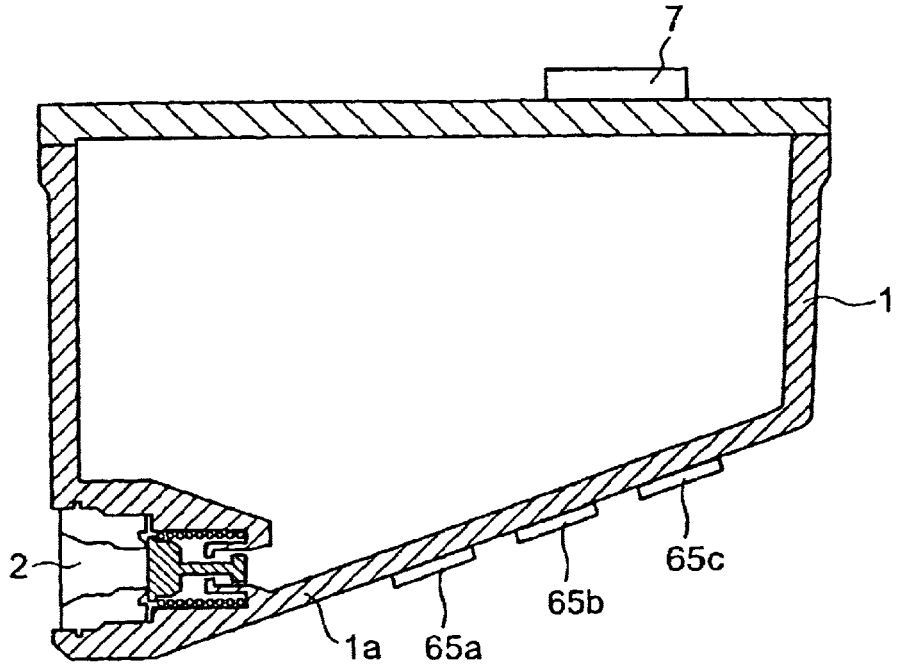
FIG. 10 is a view showing still another embodiment of an ink cartridge of the present invention.

FIG. 10 shows still another embodiment of in ink cartridge of the present invention. On the bottom surface 1*a* formed in a vertically slanting manner, the multiple elastic wave generation means 65*a*, 65*b* and 65*c* are provided one the container 1 at the intervals in the vertical direction. According to this embodiment, incoming time period of the reflected wave of the elastic wave to the respective elastic wave generation means 65*a*, 65*b* and 65*c* at the levels of the mounting positions are different depending upon whether or not the ink exists at the respective positions of the multiple elastic wave generation means 65*a*, 65*b* and 65*c*. Therefore, the elastic wave generation means 65 is scanned, incoming time periods of the reflected waves of the elastic waves in the elastic wave generation means 65*a*, 66*b* and 65*c* are detected, thereby being capable of detecting whether the ink exists or not at the levels of the mounting positions of the respective elastic wave generation means 65*a*, 65*b* and 65*c*. Therefore, an ink remaining volume can be detected step by step. For example, in the case where an ink liquid level exists between the elastic wave generation means 65*b* and the elastic wave generation means 65*c*, the elastic wave generation means 65*c* detects the absence of the ink, and on the other hand, the elastic wave generation means 65*b* and 65*a* detect the presence of the ink. By totally evaluating these results, it is understood that the ink liquid level exists at the position between the elastic wave generation means 65*b* and the elastic wave generation means 65*c*.

Figure 11:
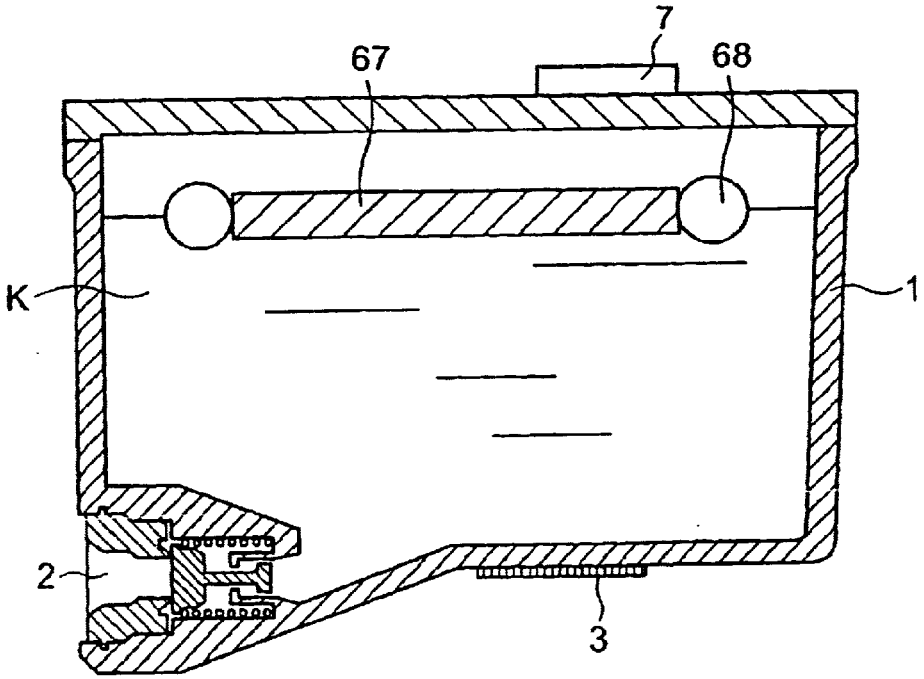
FIG. 11 is a view showing still another embodiment of an ink cartridge of the present invention.

FIG. 11 shows still another embodiment of an ink cartridge of the present invention. In the ink cartridge of FIG. 11, in order to enhance the intensity of the reflected wave reflected from the liquid level, a plate member 67 is mounted on a float 68 and covers the ink liquid level. The plate member 67 is formed with a material having a high acoustic impedance and an ink resist property, for example, a plate member of a ceramic.

Figure 12A:
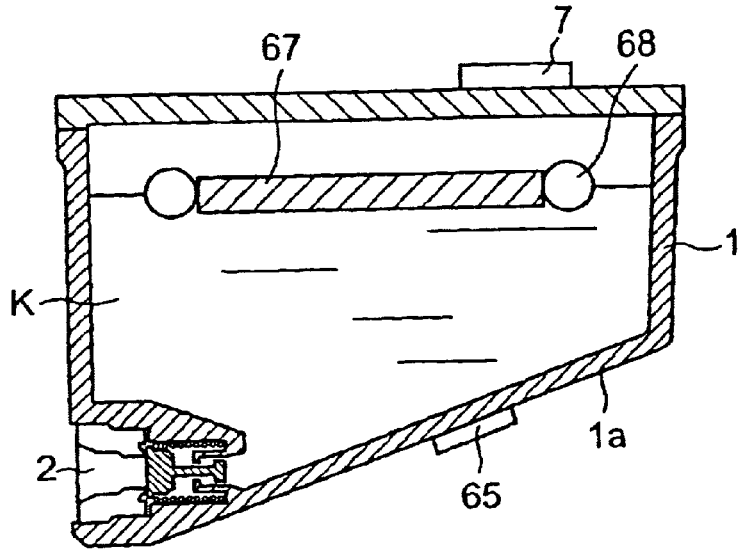
FIG. 12A and FIG. 12B are views showing still another embodiment of the ink cartridge shown in FIG. 11.
Figure 12B:
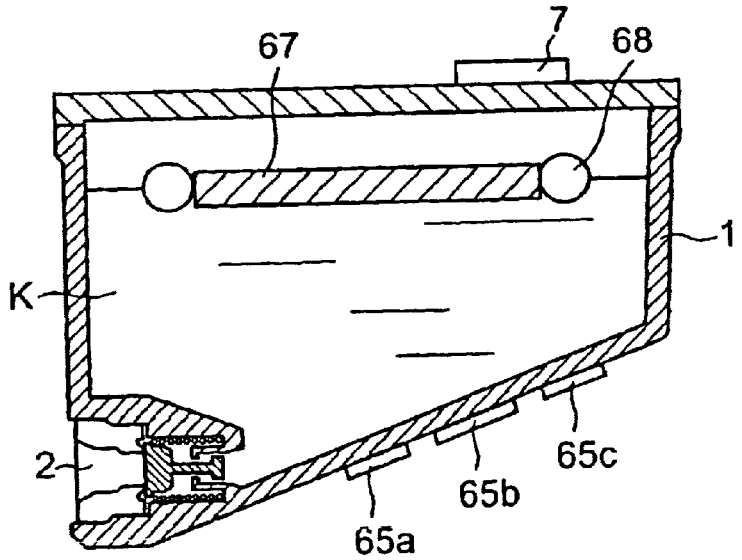

FIG. 12A and FIG. 12B show another embodiment of the ink cartridge shown in FIG. 11. In the ink cartridge of FIG. 12A and FIG. 12B, similar to the ink cartridge of FIG. 11, in order to enhance the intensity of the reflected wave reflected from the liquid level, the plate member 67 is mounted on the float 68 and covers the ink liquid level. In FIG. 12A, on the bottom surface 1*a* formed in a vertically slanting manner, the elastic wave generation means 65 is fixed. When an ink remaining volume is reduced and the elastic wave generation means 65 is exposed from the liquid level, since an incoming time period of the reflected wave of the elastic wave generated by the elastic wave generation means 65 to the elastic wave generation means 65 changes, the presence or absence of the ink can be detected at the levels of the mounting position of the elastic wave generation means 65. Since the elastic wave generation means 65 is mounted on the bottom surface 1*a* formed in a vertically slanting manner, even after the elastic wave generation means 65 detects it as the ink being absent, the ink remains somewhat within the container 1, therefore, an ink remaining volume can be detected at the point in time of the ink near end.

In FIG. 12B, on the bottom surface 1*a* formed in a vertically slanting manner, the multiple elastic wave generation means 65*a*, 65*b* and 65*c* are provided on the container 1 at the intervals in the vertical direction. According to the embodiment of FIG. 12B, depending upon whether or not the ink exists at the respective positions of the multiple elastic wave generation means 65*a*, 65*b* and 65*c*, incoming time period of the reflected wave to the elastic wave generation means 65*a*, 65*b* and 65*c* are different at the respective level of the mounting positions of the elastic wave generation means 65*a*, 65*b* and 65*c*. Therefore, Therefore, an ink remaining volume can be detected step by step. For example, in the case where an ink liquid level exists between the elastic wave generation means 65*b* and the elastic wave generation means 65*c*, the elastic wave generation means 65*c* detects the absence of the ink, and on the other hand, the elastic wave generation means 65*b* and 65*a* detect the presence of the ink. By totally evaluating these results, it is understood that the ink liquid level exists at the position between the elastic wave generation means 65*b* and the elastic wave generation means 65*c*.

Figure 13A:
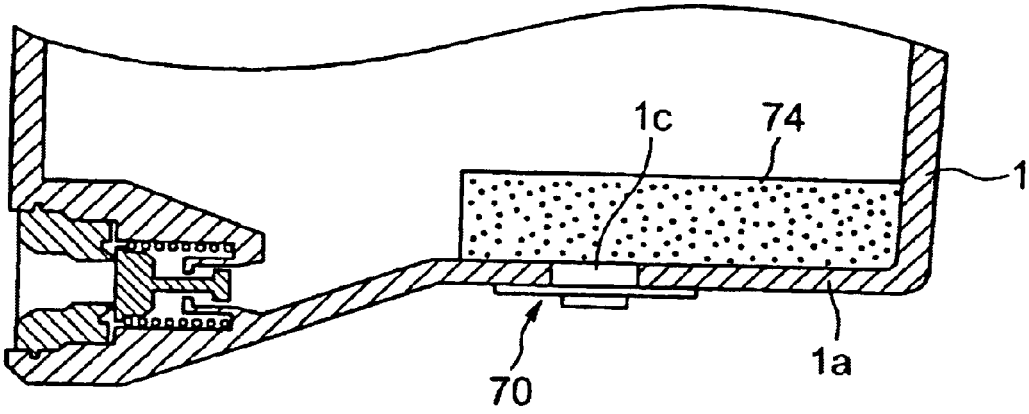
FIG. 13A and FIG. 13B are views showing still another embodiment of an ink cartridge of the present invention.
Figure 13B:
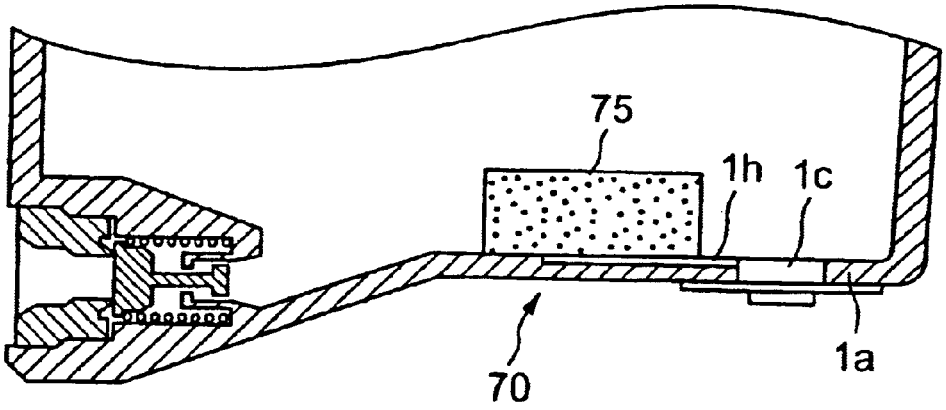

FIG. 13A and FIG. 13B show still another embodiment of an ink cartridge of the present invention. In the cartridge shown in FIG. 13A, an ink absorbing body 74 is arranged as at least one of the ink absorbing body 74 is opposed to a penetrating hole 1*c* provided on the interior of the container 1. The elastic wave generation means 70 is fixed on the bottom surface 1*a* of the container 1 as opposed to the penetrating hole 1*c*. In the ink cartridge shown in FIG. 13B, an ink absorbing body 75 opposing to a channel 1*h* communicated with the penetrated hole 1*c* and formed is arranged.

According to the embodiment shown in FIG. 13A and FIG. 13B, when the ink within the container 1 is consumed and the ink absorbing bodies 74 and 75 are exposed from the ink, the ink of the ink absorbing bodies 74 and 75 flows out by self-weight and is supplied to the recording head 31. When the ink is completely consumed, since the ink absorbing bodies 74 and 75 absorb the ink remaining in the penetrating hole 1*c* upward, the ink is completely drained from the concave portion of the penetrated hole 1*c*. Therefore, a state of the reflected wave of the elastic wave generated by the elastic wave generation means 70 at the time of the ink end changes, and the ink end can be further securely detected.

Figure 14A:
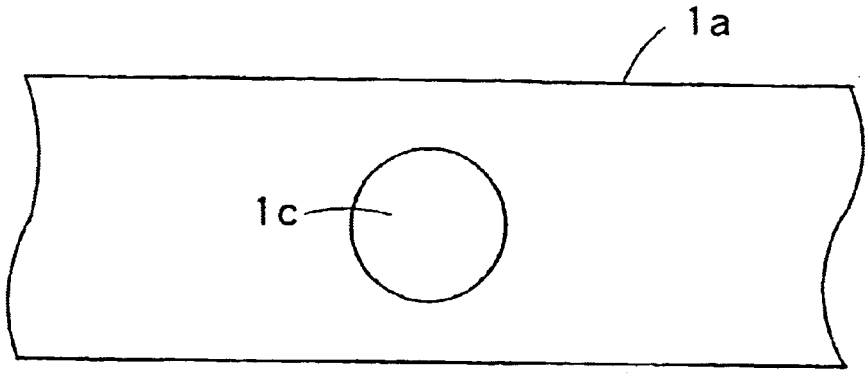
FIG. 14A, FIG. 14B and FIG. 14C are diagrams showing a plane of still another embodiment of a penetrating hole 1*c;*
Figure 14B:
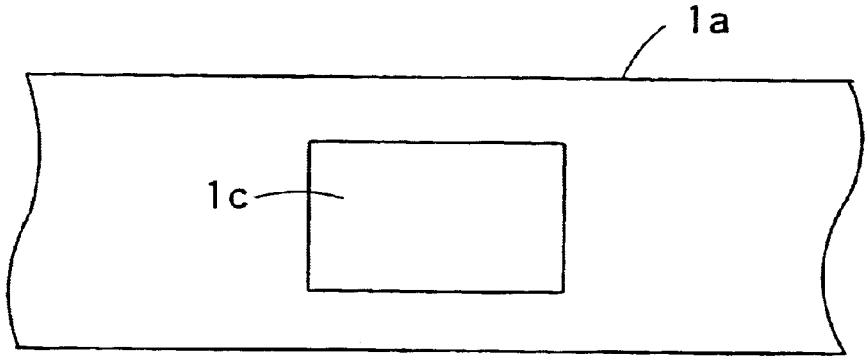
Figure 14C:
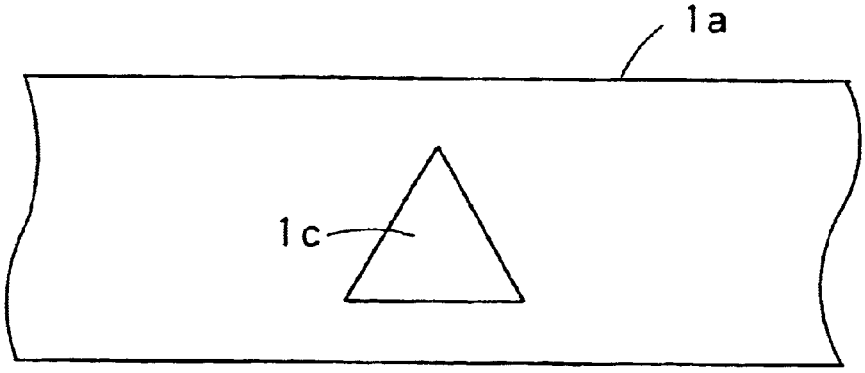

FIG. 14A, FIG. 14B and FIG. 14C show a plane of still another embodiment of the penetrated hole 1*c*. As shown in FIG. 14A through FIG. 14C, respectively, a planar shape of the penetrated hole 1*c* may be an optional shape such as circular, rectangular, and triangle 1*f* it is a kind of shape on which the elastic wave generation means is capable of being mounted.

Figure 15A:
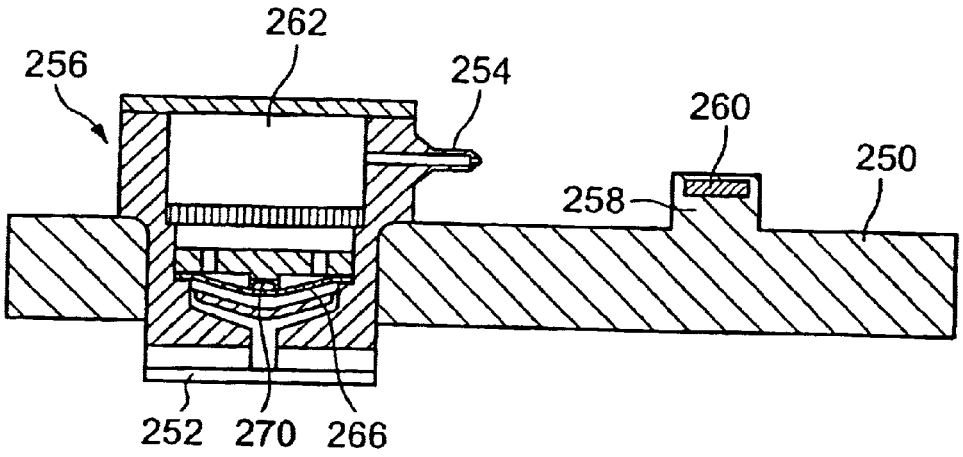
FIG. 15A and FIG. 15B are views showing sections of an embodiment of an ink jet recording apparatus of the present invention.
Figure 15B:
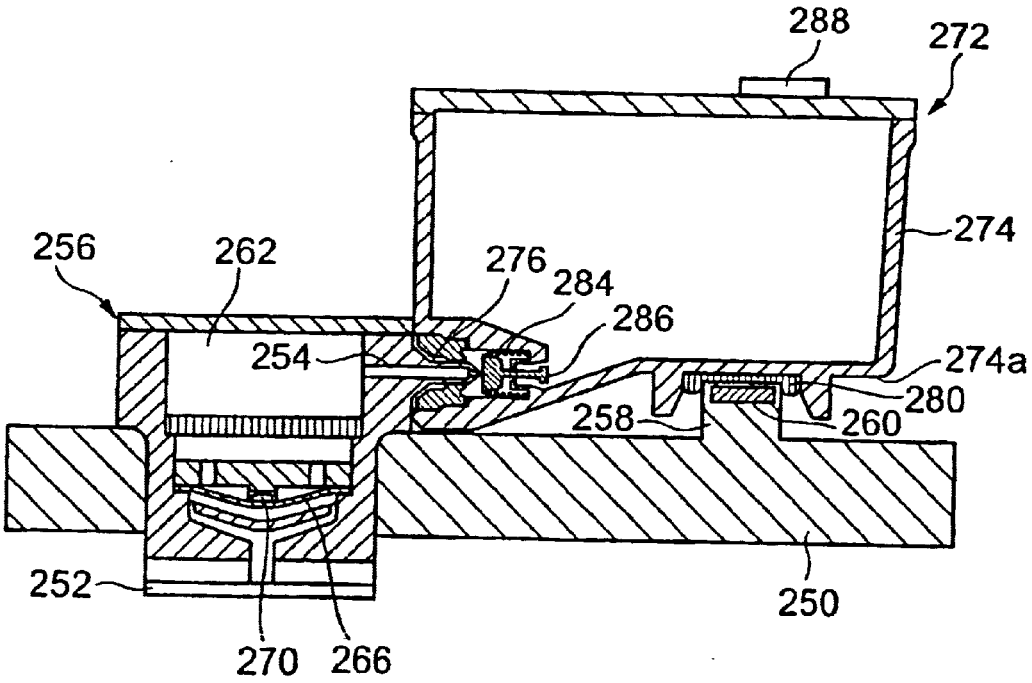

FIG. 15A and FIG. 15B show another embodiment of an ink jet recording apparatus of the present invention. FIG. 15A shows a section of the ink jet recording apparatus alone. FIG. 15B shows a section at the time when an ink cartridge 272 is mounted on the ink jet recording apparatus. A carriage 250 capable of reciprocating in the direction of the width of ink jet recording paper has a recording head 252 on the lower surface. The carriage 250 has a sub tank unit 256 on the upper surface of the recording head 252. The sub tank unit 256 has a similar configuration with that of the sub tank unit 33. The sub tank unit 256 has an ink supplying needle 254 on the mounting surface side of the ink cartridge 272. The carriage 250 has a convex portion 258 as opposing to the base portion of the ink cartridge 272 on the region on which the ink cartridge 272 is mounted. The convex portion 258 has elastic wave generation means 260 such as a piezoelectric vibrator.

Figure 16A:
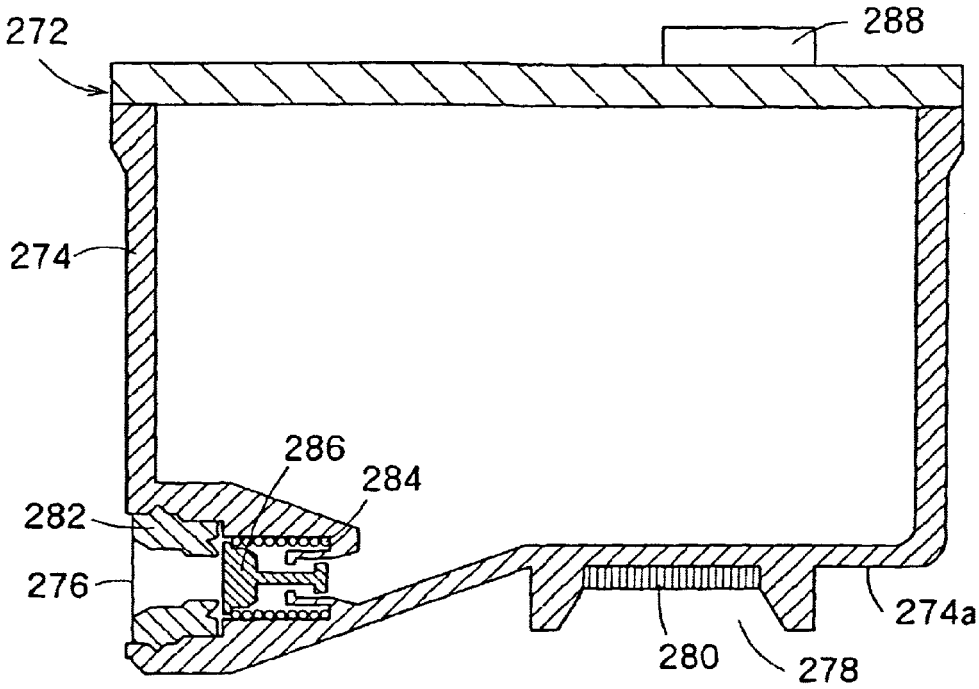
FIG. 16A and FIG. 16B are views showing an embodiment of an ink cartridge suitable for the recording apparatus shown in FIG. 15A and FIG. 15B.
Figure 16B:
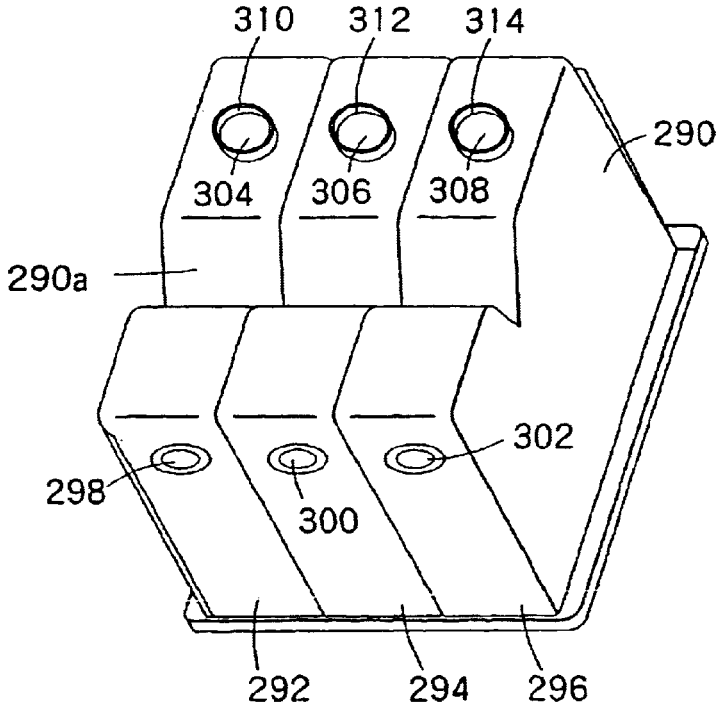

FIG. 16A and FIG. 16B show an embodiment of an ink cartridge suitable for the recording apparatus shown in FIG. 15A and FIG. 15B. FIG. 16A shows an embodiment of an ink cartridge used for a mono color, for example, a black color ink. The ink cartridge 272 of the present embodiment has a container 274 for housing the ink and an ink supplying opening 276 joined with the ink supplying needle 254 of the recording apparatus. The container 274 has a concave portion 278 which engages in a convex portion 258 on a bottom surface 274*a*. The concave portion 278 contains a supersonic transmitting material, for example, gelation material 280.

The ink supplying opening 276 has a packing 282, a valve element 286 and a spring 284. The packing 282 engages in the ink supplying needle 254 in a fluid-tight manner. The valve element 286 is always elastically contacted with the packing 282 by the spring 284. When the ink supplying needle 254 is inserted into the ink supplying opening 276, the ink path is opened by the valve element 286 being pushed with the ink supplying needle 254. On the upper surface of the container 274, semiconductor storage means 288 in which the information concerning with the ink of the ink cartridge 272 and the like are stored is mounted.

FIG. 16B shows an embodiment of an ink cartridge for containing a plurality of kinds of inks. A container 290 is divided into a plurality of regions by means of walls, specifically, three ink chambers 292, 294, and 296. The respective ink chambers 292, 294 and 296 have ink supplying openings 298, 300 and 302. In the regions opposing to the respective ink chambers 292, 294 and 296 of the bottom surface 290*a* of the container 290, gelation materials 304, 306 and 308 for transmitting an elastic wave generated by the elastic wave generation means 260 are contained in cylindrical concave portions 310, 312 and 314

As shown in FIG. 15, when the ink supplying opening 276 of the ink cartridge 272 is inserted to and communicated with the ink supplying needle 254 of the sub tank unit 256, since the valve element 286 is backed against the spring 284, an ink pass is formed, and the ink within the ink cartridge 272 flows into the ink chamber 262. At the stage where the ink is tilled in the ink chamber 262, the nozzle opening of the recording head 252 is negatively pressurized and the recording head 252 is filled with the ink, and subsequently a recording operation is carried out. When the ink is consumed in the recording head 252 by the recording operation, since the pressure on the downstream side of a film valve 266 is lowered, the film valve 266 is separated from a valve element 270 and the valve is opened as shown in FIG. 4. By opening the film valve 266, the ink of the ink chamber 262 flows into the recording head 252. Accompanying with inflow of the ink into the recording head 252, the ink cartridge 272 flows into the sub tank unit 256.

During the operation of the recording apparatus, a drive signal is supplied to the elastic wave generation means 260 at the previously set timing of detection, for example, at a certain cycle. An elastic wave generated by the elastic wave generation means 260 is emitted from the convex portion 258, propagates through the gelation material 280 of the bottom surface 274*a* of the ink cartridge 272 and transmitted to the ink within the ink cartridge 272. In FIG. 15A and FIG. 15B, the elastic wave generation means 260 was provided, however, the elastic wave generation means 260 may be provided within the sub tank unit 256.

Since an elastic wave generated by the elastic wave generation means 260 propagates through an ink liquid, incoming time to the elastic wave generation means 260 of the reflected wave reflected from the surface of the ink liquid is changed by the density of the ink liquid and the liquid level. Therefore, in the case where components of the ink are consistent, an incoming time of the reflected wave generated on the surface of the ink liquid only depends upon a volume of the ink. Therefore, a volume of the ink within the ink cartridge 272 can be detected by detecting a time period spanning from the point in time of the excitation of the elastic wave generation means 260 to the point in time when the reflected wave reflected from the surface of the ink liquid arrives at the elastic wave generation means 260. Moreover, since an elastic wave generated by the elastic wave generation means 260 vibrates the particles contained in the ink, it prevents the precipitation of the pigment and the like.

In the case where the ink within the ink cartridge 272 is reduced to nearby the ink end by printing operation and maintenance operation and the reflected wave from the ink liquid level after the generation of an elastic wave by the elastic wave generation means 260 cannot be received, it is determined as an ink near end, and the exchange of an ink cartridge can be urged. It should be noted that in the case where the ink cartridge 272 is not mounted on the carriage 250 according to the regulation, the propagation form of an elastic wave generated by the elastic wave generation means 260 is extremely changed. By utilizing this, in the case where the extreme change of an elastic wave is detected, an alarm is generated and can urge the user to make a check of the ink cartridge 272.

Incoming time period of the reflected wave of the elastic wave generated by the elastic wave generation means 260 to the elastic wave generation means 260 is influenced depending upon the density of the ink contained in the container 274. The density of the ink may be different, respectively depending on a kind of the ink, data concerning with the kinds of the ink contained within the ink cartridge 272 are stored. In semiconductor storage means 288, an ink remaining volume can be precisely detected by carrying out a detection sequence corresponding to it.

Figure 17:
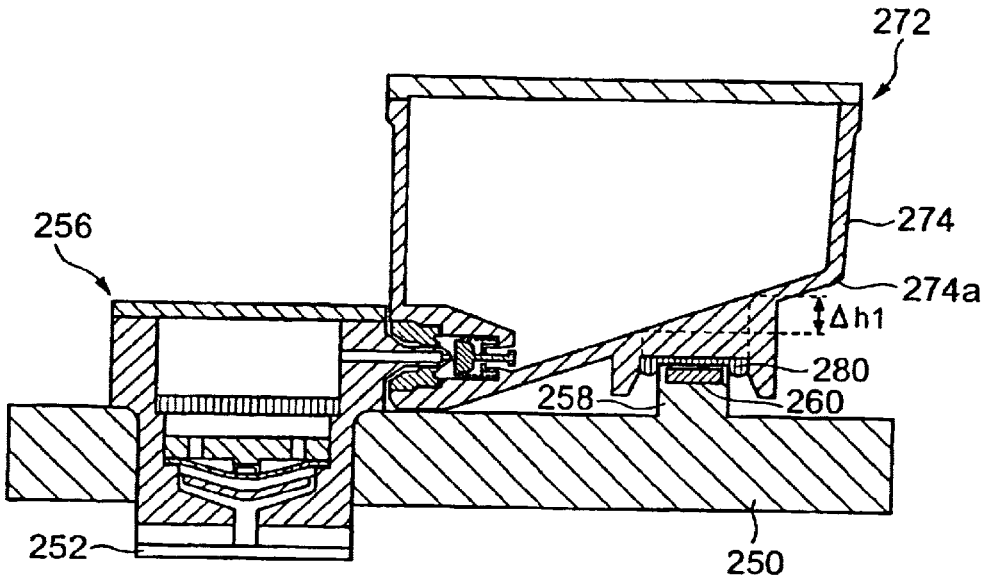
FIG. 17 is a view showing another embodiment of an ink cartridge 272 of the present invention.

FIG. 17 shows another embodiment of the ink cartridge 272 of the present invention. The bottom surface 274*a* of the ink cartridge 272 shown in FIG. 17 is formed in a vertically slanting manner. As to the ink cartridge 272 of FIG. 17, when an ink remaining volume is reduced and one portion of the emitted region of the elastic wave of the elastic wave generation means 260 is exposed from the liquid level, an incoming time period of the reflected wave of the elastic wave generated by the elastic wave generation means 260 continuously changes corresponding to the change of the liquid level Δh1. Δh1 denotes a difference of the height of the bottom surface 274*a* in the both ends of the gelation material 280. Therefore, the processing from the ink near end state of the ink remaining volume to the ink end can be precisely detected by detecting the degree of change of an incoming time period of the reflected wave to the elastic wave generation means 260.

Figure 18:
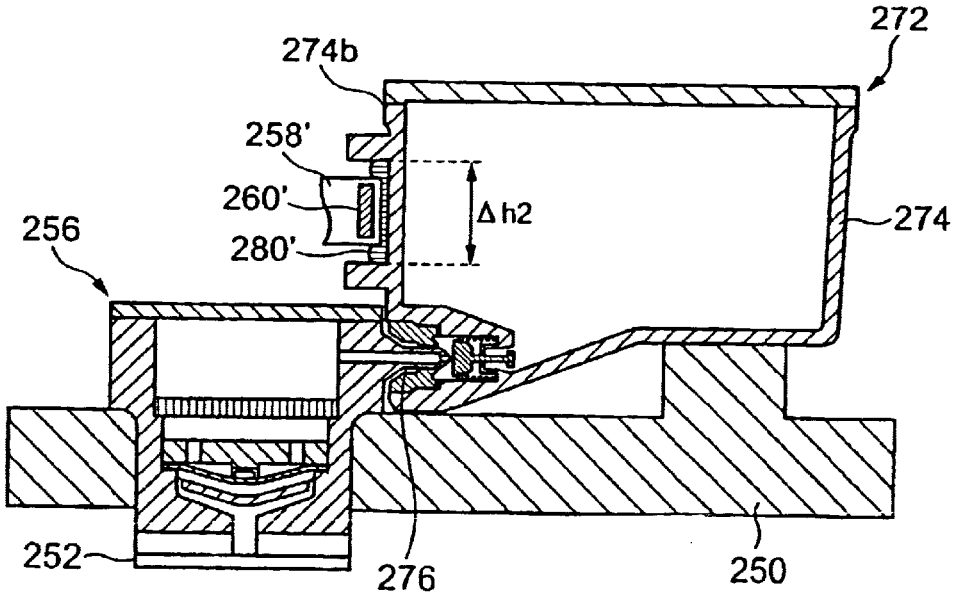
FIG. 18 is a sectional view showing still another embodiment of the ink cartridge 272 and an ink jet recording apparatus of the present invention.

FIG. 18 shows still another embodiment of the ink cartridge 272 and the ink jet recording apparatus of the present invention. The ink jet recording apparatus of FIG. 18 has a convex portion 258' on a side surface 274*b* of the ink supplying opening 276 side of the ink cartridge 272. The convex 258' includes elastic wave generation means 260'. A gelation material 280' is provided on the side surface 274*b* of the ink cartridge 272 so that the gelation material 280' engages in the convex portion 258'. According to the ink cartridge 272 of the FIG. 18, when an ink remaining volume is reduced and one portion of the emitted region of the elastic wave of the elastic wave generation means 260' is exposed from the liquid level, an incoming time period and acoustic impedance of the reflected wave of the elastic wave generated by the elastic wave generation means 260' continuously changes corresponding to the change of the liquid level Δh2. Δh2 denotes a difference of the height of the upper and lower ends of the gelation material 280'. Therefore, the processing from the ink near end state of the ink remaining volume to the ink end can be precisely detected by detecting the degree of change of an incoming time period or acoustic impedance of the reflected wave to the elastic wave generation means 260'.

It should be noted that in the above-described embodiments, an ink cartridge in the form of directly housing the ink in the liquid container was exemplified and explained. As another embodiment of an ink cartridge, the above-described elastic wave generation means 260 may be applied to an ink cartridge in the form of loading a porous elastic body in the container 174 and immersing liquid ink into the porous elastic body. Furthermore, in the above-described embodiments, an elastic wave is transmitted and received by the identical elastic wave generation means 260 and 260' in the case where an ink remaining volume is detected on the basis of a reflection wave on the liquid level. However, the present invention is not limited to these, in another embodiment, an elastic wave is transmitted and received by different elastic wave generation means 260 from each other.

Figure 19:
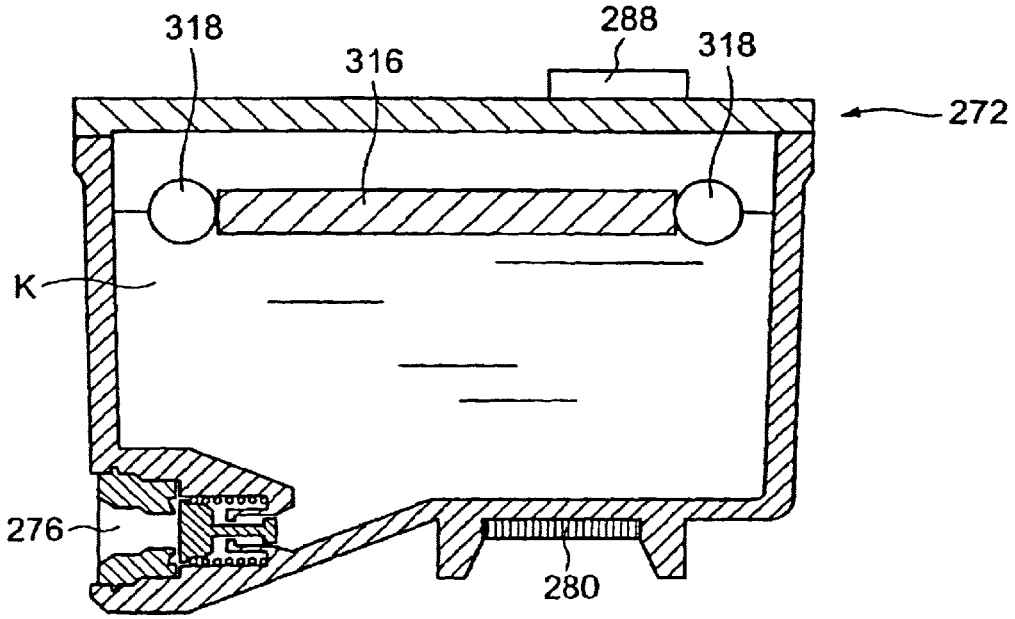
FIG. 19 is a view showing another embodiment of the ink cartridge 272 shown in FIG. 16A and FIG. 16B.

FIG. 19 shows another embodiment of the ink cartridge 272 shown if FIG. 16A and FIG. 16B. In the ink cartridge 272, in order to enhance the intensity of the reflected wave reflected from the liquid level, a plate member 316 is mounted on a float 318 and covers the ink liquid level. It is preferable that the plate member 316 is formed with a material having high acoustic impedance and an ink resist property, for example, a plate member of a ceramic.

Figure 20C:
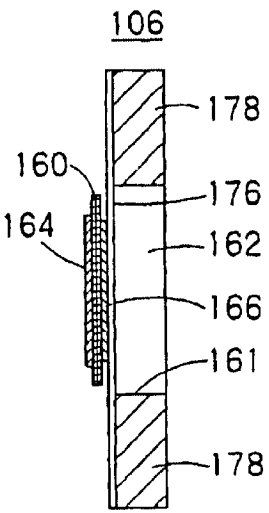
FIG. 20A, FIG. 20B and FIG. 20C are views showing the details of an actuator 106.
Figure 20A:
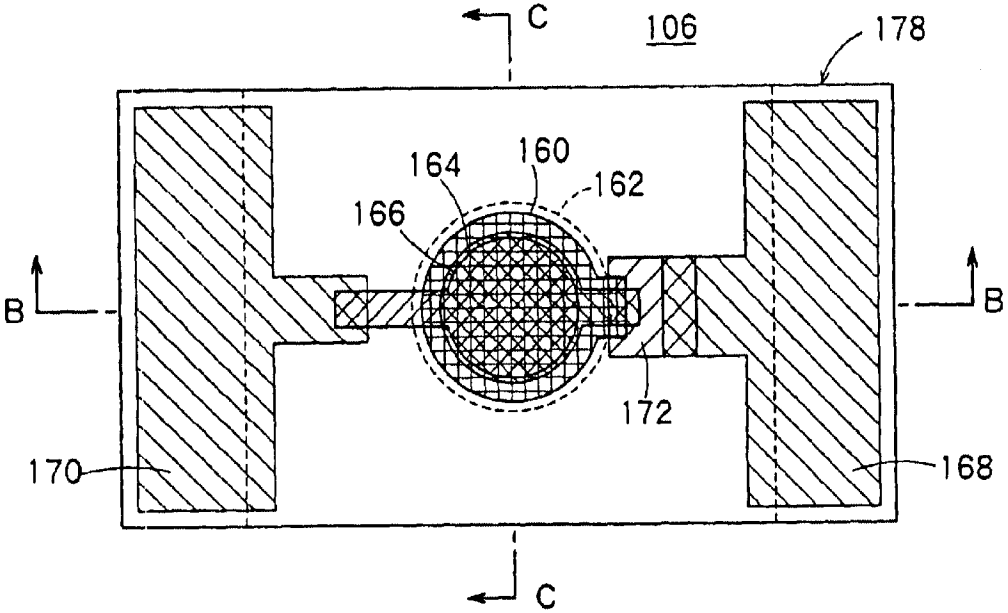
Figure 20B:
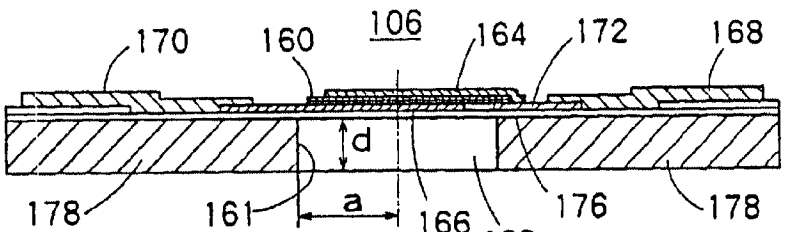

FIG. 20A, FIG. 20B, FIG. 20C and FIG. 21 show the details and equivalent circuit of the actuator 106 which is one embodiment of a piezoelectric device. An actuator referred to herein is employed in a method of detecting at least the change of acoustic impedance and detecting a consumption state of a liquid within the liquid container. Particularly, it is employed in a method of detecting at least the change of acoustic impedance by detecting resonance frequency from the remaining oscillation and detecting a consumption state of a liquid within the liquid container. FIG. 20A is an enlarged plan view of the actuator 106. FIG. 20B shows a section taken along the line B—B. FIG. 20C shows a section taken along the line C—C. Furthermore, FIG. 21(A) and FIG. 21(B) show the equivalent circuits of the actuator 106. Moreover, FIG. 21(C) and FIG. 21(D) show the peripherals including the actuator 106 and its equivalent circuit when the ink is filled within the ink cartridge, respectively, and FIG. 21(E) and FIG. 21(F) show the peripherals including the actuator 106 and its equivalent circuit when the ink is absent within the ink cartridge, respectively.

The actuator 106 has a substrate 178 having a circular opening 161 at approximate center of it, an oscillation plate 176 arranged on one of the faces (hereinafter, referred to as surface) of the substrate 178 so as to cover the opening 161, a piezoelectric layer arranged on the side of the surface of the oscillation plate 176, an upper portion electrode 164 and a lower portion electrode 166 sandwiching the piezoelectric layer 160 from the both sides, an upper portion electrode terminal 168 for electrically coupling to the upper portion electrode 164, a lower portion electrode terminal 170 for electrically coupling to the lower portion electrode 166, and an auxiliary electrode 172 provided and arranged between the upper portion electrode 164 and the upper portion electrode terminal 168 and electrically coupling both of these. The piezoelectric layer 160, the upper portion electrode 164 and the lower portion electrode 166 have a circular portion as a major portion, respectively. The respective circular portions of the piezoelectric layer 160, the upper portion electrode 164 and the lower portion electrode 166 forms the piezoelectric elements.

The oscillation plate 176 is formed so as to cover the opening 161 on the surface of the substrate 178. The cavity 162 is formed by the portion facing the opening 161 of the oscillation plate 176 and the opening 161 of the surface of the substrate 178. The face of the contrary side (hereinafter, referred to as reverse face) of a piezoelectric element of the substrate 178 faces the liquid container side, the cavity 162 is configured so that the cavity 162 contacts with a liquid. The oscillation plate 176 is mounted with respect to the substrate 178 in a fluid-tight manner so that even if a liquid enters within the cavity 162, the liquid does not leak to the surface side of the substrate 178.

The lower portion electrode 166 is located on the surface of the oscillation plate 176, that is to say, on the face of the contrary side of the liquid container, and it is mounted so that the center of the circular portion which is the major portion of the lower portion electrode 166 and the center of the opening 161 are approximately consistent with each other. It should be noted it is set so that an area of the circular portion of the lower portion electrode 166 is smaller than that of the opening 161. On the other hand, on the surface side of the lower portion electrode 166, the piezoelectric layer 160 is formed so that the center of its circular portion and the center of the opening 161 are approximately consistent with each other. It is set so that an area of the circular portion of the piezoelectric layer 160 is smaller than that of the opening 161 and larger than that of the circular portion of the lower portion electrode 166.

On the other hand, on the surface side of the piezoelectric layer 160, the upper portion electrode 164 is formed so that the center of the circular portion which is the major portion of it and the center of the opening 161 are approximately consistent with each other. It is set so that an area of the circular portion of the upper portion electrode 164 is smaller than those of the circular portion of the opening 161 and the piezoelectric layer 160 and larger than that of the circular portion of the lower portion electrode 166.

Therefore, the major portion of the piezoelectric layer 160 has a structure so that the major portion of it is sandwiched from the front face side and back face side by the major portion of the upper portion electrode 164 and the major portion of the lower portion electrode 166, respectively, and the piezoelectric layer 160 can be effectively deformed and driven. The circular portions which are the major portions of the piezoelectric layer 160, the upper portion electrode 164 and the lower portion electrode 166, respectively, form piezoelectric elements in the actuator 106. As described above, the piezoelectric element contacts with the oscillation plate 176. Moreover, the largest area is the area of the opening 161 among the circular portion of the upper portion electrode 164, the circular portion of the piezoelectric layer 160, the circular portion of the lower portion electrode 166 and the opening 161. Owing to this structure, the actually oscillating region out of the oscillation plate 176 is determined by the opening 161. Moreover, since the circular portion of the upper portion electrode 164, the piezoelectric layer 160 and the circular portion of the lower portion electrode 166 are smaller than that of the opening 161, the oscillation plate 176 is more easily oscillating. Moreover, when comparing the circular portion of the circular portion of the upper portion electrode 164 and the lower portion electrode 166 for electrically connecting with the piezoelectric layer 160, the circular portion of the lower portion electrode 166 is smaller. Therefore, the circular portion of the lower portion terminal 166 determines the portion of the piezoelectric layer 160 where the piezoelectric effect is generated.

The upper portion electrode terminal 168 is formed on the front face of the oscillation plate 176 so that it electrically connects with the upper portion electrode 164 via the auxiliary electrode 172. On the other hand, the lower portion electrode terminal 170 is formed on the front face side of the oscillation plate 176 so that it electrically connects with the lower portion electrode 166. The upper portion electrode 164 is formed on the front face side of the piezoelectric layer 160, on the way of connecting with the upper portion electrode terminal 168, it is necessary to have a step difference equivalent to the sum of the thickness of the piezoelectric layer 160 and the thickness of the lower portion electrode 166. It is difficult to form this step difference only by the upper portion electrode 164, if it is possible, the connection state between the upper portion electrode 164 and the upper portion electrode terminal 168 becomes fragile, there may be a risk to be cut. Therefore, the upper portion electrode 164 and the upper portion electrode terminal 168 are connected by employing the auxiliary electrode 172 as an auxiliary member. By dealing with it in such a manner, it becomes a structure that the piezoelectric layer 160 as well as the electrode portion electrode 164 is supported by the auxiliary electrode 172, the desired mechanical strength can be obtained, and the connection between the upper portion electrode 164 and the upper portion electrode terminal 168 is capable of being secured.

It should be noted that the piezoelectric element and the oscillating region directly facing the piezoelectric element out of the oscillating plate 176 are the oscillating section for actually oscillating in the actuator 106. Moreover, it is preferable that members contained in the actuator 106 is integrally formed by burning each other. The treatment of the actuator 106 becomes easier by integrally forming the actuator 106. Furthermore, the oscillating property is enhanced by enhancing the strength of the substrate 178. Specifically, by enhancing the strength of the substrate 178, only the oscillating section of the actuator 106 vibrates and portions except for the oscillating section do not vibrate. Moreover, the purpose for making the portions except for the oscillating section of the actuator 106 not vibrate can be achieved by making the piezoelectric element of the actuator 106 thinner and smaller and the oscillation plate 176 thinner in the contrast to by enhancing the strength of the substrate 178.

As a material for the piezoelectric layer 160, it is preferable to employ lead zirconate titanate (PZT), lead lanthanum zirconate titanate (PLZT) or lead less piezoelectric film in which lead is not used, and as a material for the substrate 178, it is preferable to employ zirconia or almina. Moreover, for the oscillation plate 176, it is preferable to employ the same material with the substrate 178. For the upper portion electrode 164, the lower portion electrode 166, the upper portion electrode terminal 168 and the lower portion electrode terminal 170, a material having electrical conductivity, for example, a metal such as gold, silver, copper, platinum, aluminum, nickel and the like can be employed.

The actuator 106 constituted as described above can be applied to a container for containing a liquid. For example, the actuator can be mounted on an ink cartridge and an ink tank, or a container containing a washing solvent for solving a recording head and the like.

The actuator 106 shown in FIG. 20A, FIG. 20B, FIG. 20C and FIG. 21 is mounted in the predetermined position on the liquid container so that the cavity 162 is contacted with a liquid contained within the liquid container. In the case where the liquid is sufficiently contained within the liquid container, the interior of the cavity 162 and outside of it is filled with the liquid. On the other hand, when the liquid within the liquid container is consumed and the liquid level is lowered to the point lower than the mounting position of the actuator, a state where either the liquid does not exist within the cavity 162 or the liquid remains only within the cavity 162 and gas exists its outside appears. The actuator 106 detects at least difference of acoustic impedance occurred by this change of a state. Owing to this, the actuator 106 can detect whether or not it is a state where a liquid is sufficiently contained within the liquid container or more than certain volume of the liquid is consumed. Furthermore, the actuator 106 is capable of detecting a kind of the ink within the liquid container.

Now, the principle of a liquid level detection by an actuator will be described below.

In order to detect a change of acoustic impedance of the medium, an impedance property or admittance property of the medium is measured. In the case where an impedance property or admittance property is measured, for example, a transmission circuit can be utilized. A transmission circuit applies a certain voltage to the medium and measures the electric current supplying to the medium by changing the frequency. Or, a transmission circuit supplies a certain electric current to the medium and measures the voltage applying to the medium by changing the frequency. A change of current value or voltage value measured in the transmission circuit indicates a change of acoustic impedance. Moreover, a change of frequency fm whose current value or voltage value becomes maximum or minimum indicates a change of acoustic impedance.

Separate from the above-described method, an actuator can detect a change of acoustic impedance of a liquid by employing only a change of resonance frequency. As a method of utilizing a change of acoustic impedance of a liquid, there is a method that in the case where resonance frequency is detected by measuring a counter electromotive force generated by a residual oscillation remaining in an oscillating section after the oscillating section of an actuator, for example, a piezoelectric element can be utilized. A piezoelectric element is an element for generating a counter electromotive force by residual oscillation remaining in an oscillating section of the actuator, a largeness of a counter electromotive force by an amplitude of the oscillating section of the actuator. Therefore, the larger the amplitude of the oscillating section of the actuator is, the easier it is detected. Moreover, a cycle of changing the largeness of counter electromotive force is changed by frequency of the residual oscillation in the oscillating section of the actuator. Therefore, a frequency of the oscillating section of the actuator corresponds to a frequency of a counter electromotive force. By the way, resonance frequency is referred to a frequency in resonance state of the oscillating section of the actuator and the medium contacted with the oscillating section.

In order to obtain resonance frequency fs, Fourier transform is performed to a waveform obtained by measuring a counter electromotive force when the oscillating section and the medium are in a state of resonance. Since an oscillation of an actuator accompanies with not only a deformation in one direction but also a variety of deformations such as deflection, extension and the like, it has a variety of frequencies including the resonance frequency fs. Hence, the resonance frequency fs is determined by performing Fourier transform to a waveform of the counter electromotive force when the piezoelectric element and the medium are in a state of resonance and specifying the most predominant frequency component.

A frequency fm denotes a frequency at the time when the admittance of the medium is maximum or the impedance of the medium is minimum. Supposing resonance frequency is fs, frequency fm generates subtle error with respect to resonance frequency fs by dielectric loss, or mechanical loss of the medium. However, since it is troublesome to lead resonance frequency fs from the frequency fm actually measured, in general, frequency fm is replaced by resonance frequency and used. Where, the actuator 106 can detect at least acoustic impedance by inputting an output of the actuator 106 into the transmission circuit.

It has been proved by the experiment that there is almost no difference between resonance frequency specified by a method of measuring impedance property or admittance property of the medium and measuring frequency fm and a resonance frequency specified by a method of measuring resonance frequency fs by measuring a counter electromotive force generated by residual oscillation in the oscillating section of an actuator.

The oscillating region of the actuator 106 is a portion composed of the cavity 162 determined by the opening 161 out of the oscillation plate 176. In the case where the liquid container is sufficiently contained with the liquid, the cavity 162 is filled with a liquid, the oscillating region contacts with the liquid within the liquid container. On the other hand, in the case where the liquid container is not filled with the liquid, the oscillating region contacts with the liquid remained in the cavity within the container, or the oscillating region does not contact with the liquid, and contacts with gas or vacuum.

In the actuator 106 of the present invention, the cavity 162 is provided, owing to this, it is designed so that in the oscillating region of the actuator 106, a liquid within the liquid container remains. The reasons why are the following.

Depending on mounting position and mounting angle to the liquid container of the actuator, the liquid is attached to the oscillating region of the actuator, although the liquid level of the liquid within the liquid container is lower than the mounting position of the actuator. In the case where the actuator detects the presence or absence of the liquid only by the presence or the absence of the liquid in the oscillating region, the liquid attached to the oscillating region of the actuator hinders it from precisely detecting the presence or absence of the liquid. For example, in a state where the liquid level is lower than the mounting position of the actuator, if the liquid container is swung by reciprocating movement of the carriage and the like, the liquid is waved and the liquid droplets are attached to the oscillating region, the actuator erroneously determines that the liquid sufficiently exists within the liquid container. Therefore, to the contrary, by positively providing a cavity designed to precisely detect the presence or absence of the liquid even in the case where the liquid remains there, if the liquid container is swung and the liquid level is waved, malfunction of the actuator can be prevented. In this way, by employing an actuator having a cavity, malfunction can be prevented.

Moreover, as shown in FIG. 21(E), the case where the liquid is absent within the liquid container and the liquid within the liquid container remains in the cavity 162 of the actuator 106 is made as threshold. Specifically, in the case where the liquid is absent on the periphery of the cavity 162 and the liquid within the cavity is less than this threshold, the absence of the ink is determined, in the case where the liquid is present on the periphery of cavity 162 and the liquid is more than this threshold, the presence of the ink is determined. For example, in the case where the actuator 106 is mounted on the side wall of the liquid container, the case where the liquid within the liquid container is lower than the mounting position of the actuator is determined as the case where the ink is absent, and the case where the liquid within the liquid container is higher than the mounting position of the actuator is determined as the case where the ink is present. In this way, by providing the threshold, even in the case where the ink within the cavity is dried and the ink is absent is also determined as the case where the ink is absent, the case where the ink is absent within the cavity and where the ink is attached to the cavity by the swinging of the carriage and the like can be determined as the case where the ink is absent because it does not exceed over the threshold.

Figure 21:
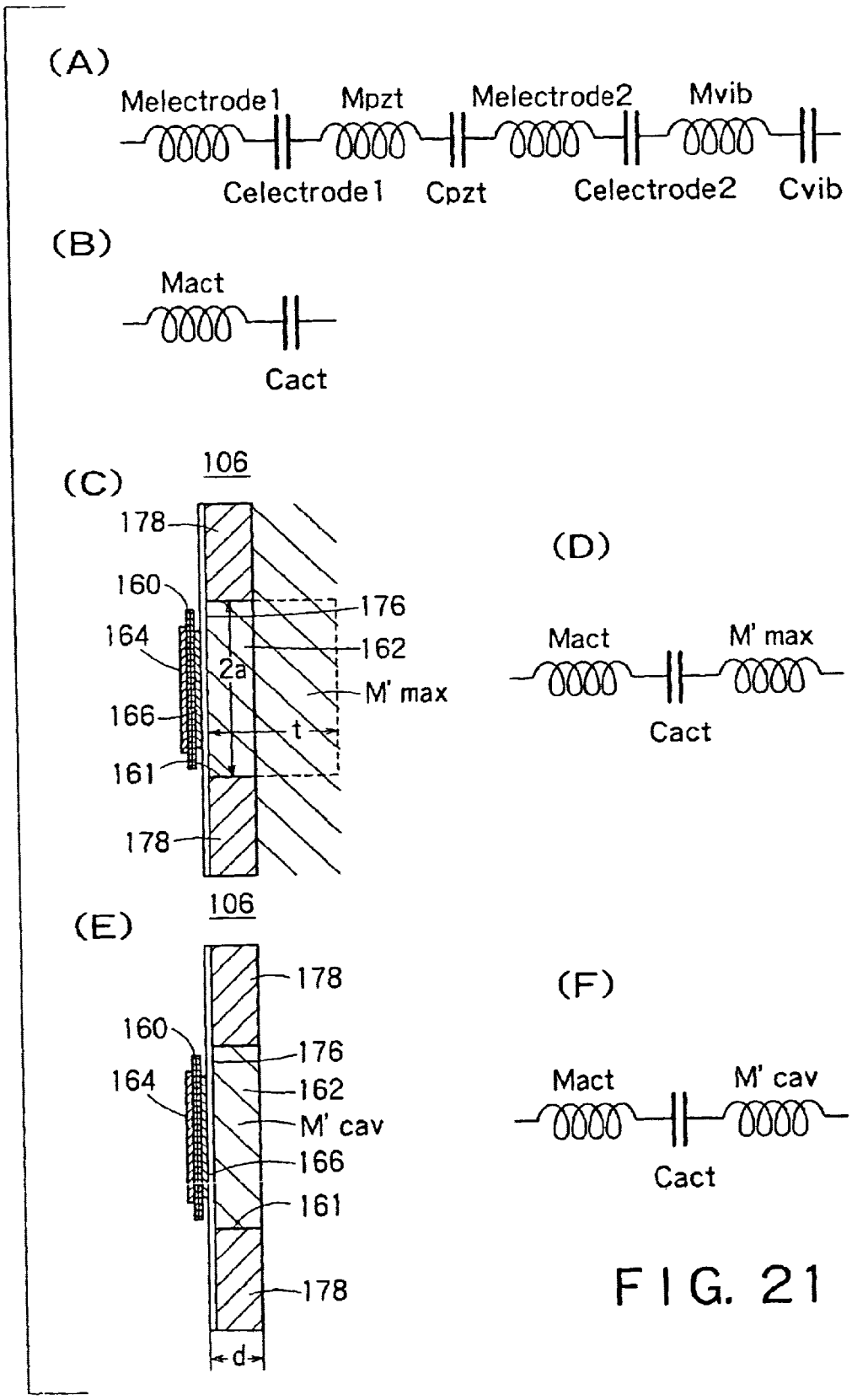
FIG. 21 is a diagram showing peripherals of the actuator 106 and its equivalent circuits.

Now, an operation and the principle of detecting a state of the liquid within the liquid container from the resonance frequency of the medium and the oscillating section of the actuator 106 by measurement of a counter electromotive force with reference to FIG. 20A, FIG. B, FIG. 20C and FIG. 21 will be described below. In the actuator 106, a voltage is applied to the upper portion electrode 164 and the lower portion electrode 166 via the upper portion electrode terminal 168 and the lower electrode terminal 170. Out of the areas of the piezoelectric layer 160, the electric field is generated in the portion sandwiched between the upper portion electrode 164 and the lower portion electrode terminal 166, respectively. The piezoelectric layer 160 is deformed by its electric field. The oscillating region out of the oscillation plate 176 is deflected and vibrated by the piezoelectric layer 160 being deformed. After the piezoelectric layer 160 is deformed, for a while, the deflected oscillation remains in the oscillating section of the actuator 106.

A residual oscillation is a free oscillation of the oscillating section of the actuator 106 and the medium. Therefore, the resonance state of the oscillating section and the medium can be easily obtained after the voltage is applied by converting the voltage applied to the piezoelectric layer 160 into a pulse waveform or rectangular wave. The residual oscillation also deforms even the piezoelectric layer 160 in order to make the oscillating section of the actuator 106. Therefore, the piezoelectric layer 160 generates a counter electromotive force. Its counter electromotive force is detected via the upper portion electrode 164, the lower portion electrode 166, the upper portion electrode terminal 168 and the lower portion electrode terminal 170. A state of the liquid within the liquid container can be detected since resonance frequency can be specified by the detected counter electromotive force.

In general, resonance frequency fs is represented as follows:

$$fs=1/(2*\pi*(M*C_{act})^{1/2}) \quad \text{(Expression 1)}$$

wherein M denotes the sum of inertance $M_{act}$ of the oscillating section and additive inertance M' and $C_{act}$ denotes compliance of the oscillating section.

FIG. 20C is a sectional view of the actuator 106 when the ink does not remain in the cavity in the present embodiment. FIG. 21(A) and FIG. 21(B) are the oscillating section of the actuator 106 and the equivalent circuit of the cavity 162 when the ink does not remain in the cavity.

M act denotes the product of the thickness of the oscillating section and the density of the oscillating section which is divided by the area of the oscillating section, and further in detail, as shown in FIG. 21(A), is represented as:

$$M\ act=M\ pzt+M\ \text{electrode1}+M\ \text{electrode2}+M\ vib \quad \text{(Expression 2)}$$

wherein M pzt is the product of the thickness of the piezoelectric layer 160 in the oscillating layer 160 and the density of the piezoelectric layer 160 which is divided by the area of the piezoelectric layer 160, M electrode1 denotes the product of the thickness of the upper portion electrode 164 and the density of the upper portion electrode 164 in the oscillating section which is divided by the area of the upper portion electrode 164, M electrode2 denotes the product of the thickness of the lower portion electrode 166 and the density of the lower portion electrode 166 in the oscillating section which is divided by the area of the lower portion electrode 166, and M vib denotes the product of the thickness of the oscillation plate 176 in the oscillating section and the density of the oscillation plate 176 which is divided by the area of the oscillating region. However, it is preferable that in the present embodiment, the respective areas of the piezoelectric layer 160, the upper portion electrode 164, the lower portion electrode 166 and the oscillating region of the oscillation plate 176 have relationships of being larger and smaller between them as described above, mutual difference of the area is minute so that M act can be calculated from the thickness, density, and area as the entire oscillation portion. Moreover, in the present embodiment, it is preferable that the portions except for these major portion which is circular portion is minute to the degree of being negligible in the piezoelectric layer 160, the upper portion electrode 164 and the lower portion electrode 166. Therefore, in the actuator 106, M act denotes the sum of the respective inertance of the oscillating regions out of the upper portion electrode 164, the lower portion electrode 166, the piezoelectric layer 160 and the oscillation plate 176. Moreover, compliance C act denotes the compliance of the portion formed by the oscillating region out of the upper portion electrode 164, the lower portion electrode 166, the piezoelectric layer 160 and the oscillation plate 176.

It should be noted that FIG. 21(A), FIG. 21(B), FIG. 21(D) and FIG. 21(F) show equivalent circuits of the oscillating section of the actuator 106 and the cavity 162, however, in these equivalent circuits, C act denotes a compliance of the oscillating section of the actuator 106. C pzt, C electrodes, C electrodes, and C vib denotes respective compliances of the piezoelectric layer 160, the upper portion electrode 164, the lower portion electrode 166 and the oscillation plate 176 in the oscillating section. C act is represented by the following equation 3.

$$1/C\ act=(1/C\ pzt)+(1/C\ \text{electrode 1})+(1/C\ \text{electrode 2})+(1/C\ vib) \quad \text{(Expression 3)}$$

By Expression 2 and Expression 3, FIG. 21(A) can be represented as FIG. 21(B).

Compliance C act denotes volume capable of receiving the medium generated by deformation occurred at the time when a pressure is added on one unit area of the oscillating section. Moreover, it can be said that compliance C act denotes the easiness of deformation.

FIG. 21(C) shows a sectional view of the actuator 106 in the case where the liquid is sufficiently contained in the liquid container and the liquid is filled on the periphery of the oscillating region of the actuator 106. M'max of the FIG. 21(C) denotes the maximum value of the additive inertance in the case where the liquid is sufficiently contained in the liquid container and the liquid is filled on the periphery of the oscillating region of the actuator 106. M' max is represented by, $$M'\max=(\pi*\rho/(2*k^3))*(2*(2*k*a)^3/(3*\pi))/(\pi*a^2)^2 \quad \text{(Expression 4)}$$

Wherein a denotes diameter of the oscillating section and ρ denotes density of the medium and k denotes wave number.

It should be noted that Expression 4 holds in the case where the oscillating region of the actuator 106 is a circular shape of the diameter a. An additive inertance M' denotes a volume indicating the apparent increase of mass of the oscillating section. As understood from Expression 4, M'max is largely changed by diameter a of the oscillating section and density p of the medium.

Wave number k is represented by:

$$k=2*\pi*f\ act/c \quad \text{(Expression 5)}$$

wherein f act denotes a resonance frequency of the oscillating section at the time when the liquid does not contact with and c denotes a speed of sound which propagates through the medium.

FIG. 21(D) shows the oscillating section of the actuator 106 and equivalent circuit of the cavity 162 in the case of FIG. 21(C) in which the liquid is sufficiently contained in the liquid container and the liquid is filled on the periphery of the oscillating region of the actuator 106.

FIG. 21(E) shows a sectional view of the actuator 106 in the case where the liquid of the liquid container is consumed, the liquid is absent on the periphery of the oscillating region of the actuator 106 but the liquid remains within the cavity 162 of the actuator 106. Expression 4 represents maximum inertance M'max determined from the density ρ of the link for example in the case where the liquid container is filled with the liquid. On the other hand, in the case where the liquid within the liquid container is consumed, and the liquid on the periphery of the oscillating region of the actuator 106 becomes gas or vacuum while the liquid remains within the cavity 162, it is represented by the following:

$$M'=\pi*t/S \quad \text{(Expression 6)}$$

Wherein t denotes thickness of the medium involved with oscillation and S denotes an area of the oscillating region of the actuator 106. In the case where the oscillating region is a circular shape of diameter a, $S=\pi*a^2$ holds. Therefore, An additive inertance M' adheres to Expression 4 in the case where the liquid is sufficiently contained in the liquid container and the liquid is filled on the periphery of the oscillating region of the actuator 106. On the other hand, in the case where the liquid is consumed and the liquid on the periphery of the oscillating region of the actuator 106 becomes gas or vacuum while the liquid remains within the cavity 162, adhere to Expression 6.

Now, as shown in FIG. 21(E), an additive inertance M' in the case where the liquid of the liquid container is consumed, the liquid is absent on the periphery of the oscillating region of the actuator 106 but the liquid remains within the cavity 162 of the actuator 106 is defined as M'cav, and M'cav is discriminated from an additive inertance M'max in the case where the liquid is filled on the periphery of the oscillating region of the actuator 106.

FIG. 21(F) shows the oscillating section of the actuator 106 and equivalent circuit of the cavity 162 in the case of FIG. 21(E) in which the liquid of the liquid container is consumed, the liquid is absent on the periphery of the oscillating region of the actuator 106 but the liquid remains within the cavity 162 of the actuator 106.

Now, parameters involved with a state of the medium are density ρ of the medium and thickness t of the medium in Expression 6. In the case where the liquid is sufficiently contained in the liquid container, the liquid contacts with the oscillating section of the actuator 106, and in the case where the liquid is sufficiently contained within the liquid container, the liquid remains within the cavity, or gas or vacuum contacts with the oscillating section of the actuator 106. The liquid on the periphery of the actuator 106 is consumed, and if an additive inertance in the processing for moving from M'max of FIG. 21(C) to M'cav of FIG. 21(E) is defined as M'var, since thickness t of the medium is changed depending on the containing state of the liquid of the liquid container, an additive inertance M'var is changed, and resonance frequency fs is also changed. Therefore, the presence or absence of the liquid of the liquid container can be detected by specifying the resonance frequency fs. Now, as shown in FIG. 21(E), supposing t=d, M'cav is represented by employing Expression 6 and substituting the depth d of the cavity into t of Expression 6.

$$M'cav=\rho*d/S \quad \text{(Expression 7)}$$

Moreover, even if the media are different kinds of liquids with each other, since densities ρ are different from the difference of the components, an additive inertance M' is changed, and resonance frequency fs is also changed. Therefore, the presence or absence of the liquid of the liquid container can be detected by specifying resonance frequency fs.

It should be noted that in the case where only any one of the ink or the air contacts with the oscillating section of the actuator 106 and these are not mixed up, the difference of M' can be detected even if calculated by Expression 4.

Figure 22A:
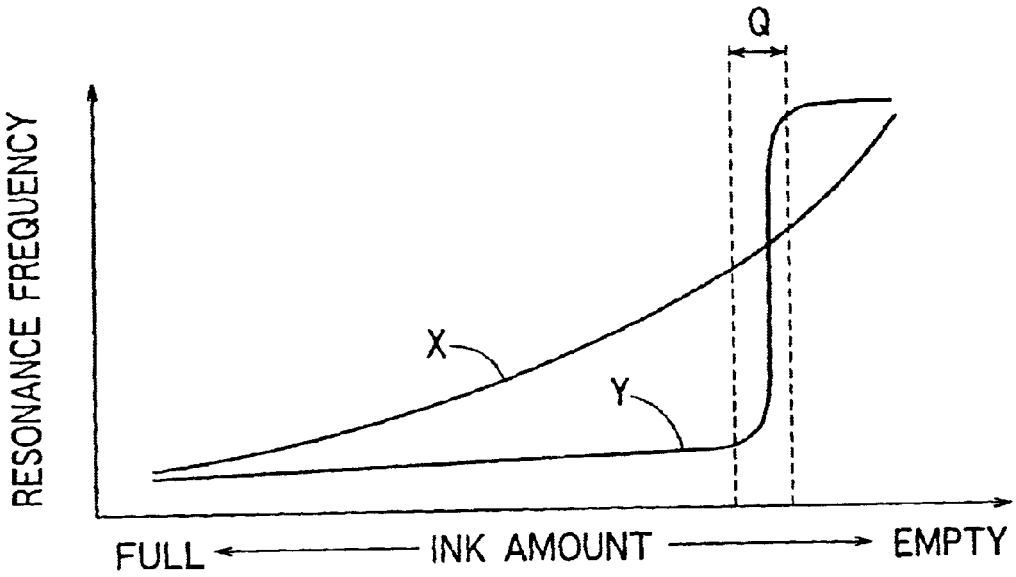
FIG. 22A and FIG. 22B are graphs showing the relationship of the ink density and resonance frequency of the ink detected by the actuator 106.

FIG. 22A is a graph showing the relationship between a volume of the ink within the ink tank and resonance frequency fs of the ink and the oscillating section. Now, the ink will be described as one embodiment of a liquid below. Axis of ordinates indicates resonance frequency fs, and axis of abscissas indicates a volume of the ink. When the ink components are consistent, resonance frequency fs rises accompanying with lowering of the remaining ink volume.

In the case where the ink is sufficiently contained in the ink container and the ink is filled on the periphery of the oscillating region of the actuator 106, the maximum additive inertance M'max is a value represented by Expression 4. On the other hand, in the case where the ink is consumed and the ink is not filled on the periphery of the oscillating region of the actuator 106 while the ink remains within the cavity 162, the additive inertance M'var is calculated on the thickness of the medium by Expression 6. Since t in Expression 6 denotes thickness of the medium involving with the oscillation, by making d of the cavity of the actuator 106 (see FIG. 20B) smaller, specifically, by making the substrate 178 sufficiently thinner, the processing in which the ink is step by step consumed can be detected (see FIG. 21(C)). Where, t ink is defined as thickness of the ink involving with the oscillation, and t ink−max is defined as t ink in M'max. For example, the actuator 106 is arranged on the bottom surface of the ink cartridge in an approximately parallel with the ink liquid level. When the ink is consumed and the ink liquid level arrives at the height lower by the portion of t ink−max from the actuator 106, M'var is gradually changed adhere to Expression 6, and resonance frequency fs is gradually changed adhere to Expression 1. Therefore, as far as the ink liquid level exists within the range of t, the actuator 106 can detect a consuming state of the ink step by step.

Moreover, by making the oscillating region of the actuator 106 larger or longer and arranging it in a longitudinal direction, S in Expression 6 is changed adhere to the liquid level position due to the ink consumption. Therefore, the actuator 106 can detect the processing in which the ink is consumed step by step. For example, the actuator 106 is arranged on the side wall of the ink cartridge in an approximately perpendicular to the ink liquid level. When the ink is consumed and the ink liquid level arrives at the oscillating region of the actuator 106, since the additive inertance M' is reduced accompanied with lowering of the liquid level, resonance frequency fs is increased step by step. Therefore, as far as the ink liquid level exists within the range of a radius 2*a* of the cavity 162 (see FIG. 21(C)), the actuator 106 can detect a consuming state of the ink step by step.

Curve X of the FIG. 22A denotes relationship between a volume of the ink contained within the ink tank and resonance frequency fs of the ink and the oscillating section in the case where the cavity 162 of the actuator 106 is sufficiently made shallow or in the case where the oscillating region of the actuator 106 is made larger or longer. It can be understood that resonance frequency of the ink and the oscillating section is appeared to be changed step by step as a volume of the ink is reduced within the ink tank.

More particularly, the case where that the processing in which the ink is consumed step by step can be detected is a case where a liquid and gas having different densities with each other both exist and involves with the oscillation. As the ink is consumed step by step, as to the media involving with the oscillation on the periphery of the oscillating region of the actuator 106, the gas is increased while the liquid is reduced. For example, in the case where the actuator 106 is arranged in parallel with the ink liquid level, and when t ink is smaller than t ink−max, the media involving with the oscillation of the actuator 106 include both the ink and the gas. Therefore, supposing an area S of the oscillating region of the actuator 106, a state of being less than M'max of Expression 4 is represented by additive masses of the ink and the gas as the following:

$$M'=M'\text{air}+M'\text{ink}=\rho\ \text{air}*t\ \text{air}/S+\rho\ \text{ink}*t\ \text{ink}/S \qquad \text{(Expression 8)}$$

wherein M'air denotes inertance of the air, and M'ink denotes inertance of the ink, ρ air denotes density of the air, and ρ ink denotes density of the ink, and Tt air denotes thickness of the air involving with the oscillation, and t ink denotes thickness of the ink involving with the oscillation. Out of the media involving with the oscillation on the periphery of the oscillating region of the actuator 106, as the liquid is reduced and the air is increased, t air is increased and t ink is reduced in the case where the actuator 106 is arranged in an approximately parallel with the ink liquid level, thereby M'var is reduced step by step and resonance frequency is increased step by step. Therefore, a volume of the ink remaining within the ink tank or the consuming volume of the ink can be detected. It should be noted that the reason why Expression 7 is an equation involving only with density of the liquid is because the case where the density of the air is small as negligible is supposed.

In the case where the actuator 106 is arranged in an approximately perpendicular to the ink liquid level, parallel equivalent circuits (not shown) of the region where the medium involving with the oscillation of the actuator 106 is only the ink and the region where the medium involving with the oscillation of the actuator 106 is only the air out of the oscillating region of the actuator 106 are considered. Supposing that the region where an area of the medium involving with the oscillation of the actuator 106 is only the ink is S ink, and the region where an area of the medium involving with the oscillation of the actuator 106 is only the air is S air:

$$1/M'=1/M'\text{air}+1/M'\text{ink}=S\ \text{air}/(\rho\ \text{air}*t\ \text{air})+S\ \text{ink}/(\rho\ \text{ink}*t\ \text{air}) \qquad \text{(Expression 9)}$$

It should be noted that Expression 9 is applied in the case where the ink is not held in the cavity of the actuator 106. In the case where the ink is held in the cavity of the actuator 106, it can be calculated by Expression 7, Expression 8 and Expression 9.

On the other hand, in the case where the substrate 178 is thick, specifically, the depth d of the cavity 162 is deep, d is comparatively close to the thickness t ink−max of the medium, or in the case where an actuator whose oscillating region is very small compared to the height of the liquid container is employed, actually whether or not the ink liquid level is higher position or lower position than the mounting position of the actuator, rather than detecting the processing in which the ink is reduced step by step. In other words, the presence or absence of the ink in the oscillating region of an actuator is detected. For example, curve Y of FIG. 22A denotes relationship between a volume of the ink within the ink tank in the case of small circular oscillating region and resonance frequency fs of the ink and the oscillating section. In the range of a volume of the ink Q prior to and after the ink liquid level within the ink tank passes through the mounting position of the actuator, the appearance that resonance frequency fs of the ink and the oscillating section is dramatically changed is indicated, thereby being capable of detecting whether or not the predetermined volume of the ink within the ink tank remains.

Figure 22B:
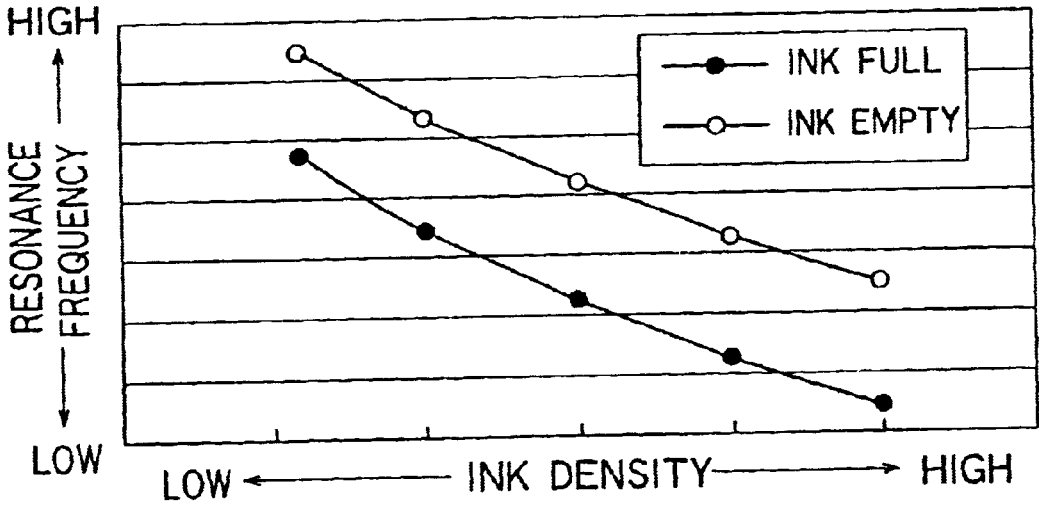

FIG. 22B shows the relationship between the density of the ink in curve Y of FIG. 22A and resonance frequency fs of the ink and oscillating section. An ink is exemplified as a liquid. As shown in FIG. 22B, as the density of the ink is increased, the additive inertance is increased, therefore, resonance frequency fs is lowered. Specifically, resonance frequencies are different depending upon kinds of inks. Therefore, by measuring resonance frequency fs, when the ink is refilled, whether or not the ink having different density is mixed is checked.

Specifically, an ink tank containing kinds of inks different with each other can be identified.

Subsequently, conditions in which a state of the liquid when the size and shape of the cavity is set so that the liquid remains within the cavity 162 of the actuator 106 even if the liquid within the liquid container is hollow can be precisely detected will be described in detail below. If the actuator 106 can detect a state of the liquid in the case where the liquid is filled within the cavity 162, it can detect a state of the liquid even in the case where the liquid is not filled within the cavity 162.

Resonance frequency fs is a function of inertance M. Inertance M is the sum of inertance M act and additive inertance M', where the additive inertance involves with a state of the liquid. Additive inertance M' is a volume indicating the apparent increase of mass of the oscillating section by the action of the medium nearby the oscillating section. Specifically, that is referred to a increment of mass of the oscillating section by apparently absorbing the medium by the oscillation of the oscillating section.

Accordingly, in the case where M'cav is larger than M'max in Expression 4, the apparently absorbed medium is all the liquid remaining within the cavity 162 and gas within the liquid container or vacuum. At that time, since M' is not changed, resonance frequency fs is not changed neither. Therefore, the actuator 106 cannot detect a state of the liquid within the liquid container.

On the other hand, in the case where M'cav is smaller than M'max in Expression 4, the apparently absorbed media are the remaining liquid within the cavity 162 and the gas or vacuum within the liquid container. At that time, since M' is changed differently from a state where the liquid is filled within the liquid container, resonance frequency fs is changed. Therefore, the actuator 106 can detect a state of the liquid within the liquid container.

Specifically, in the case where the liquid within the liquid container is in a state of being empty and the liquid remains within the cavity 162 of the actuator 106, the conditions in which the actuator 106 can precisely detect a state of the liquid is that M'cav is smaller than M'max. It should be noted that the conditions M'max>M'cav in which the actuator 106 can precisely detect a state of the liquid is not involved with the shape of the cavity 162.

Where M'cav is mass of the liquid having an approximately equivalent to the volume of the cavity 162. Accordingly, from the inequality of M'max>M'cav, the conditions in which the actuator 106 can precisely detect a state of the liquid can be represented as conditions for the volume of the cavity 162. For example, suppose that diameter of the opening 161 of the circular cavity 162 is a, and the depth of the cavity 162 is d, $$M'\max > \rho^* d/\pi a^2 \qquad \text{(Expression 10)}$$

Expression 10 is expanded, the following conditions are found:

$$a/d > 3^*\pi/8 \qquad \text{(Expression 11)}$$

It should be noted that Expression 10, Expression 11 hold as far as shape of the cavity 162 is circular. When Expression of M'max in the case where it is not circular is employed and substituting its area into $\pi a2$ in Expression 10, the relationship between dimensions such as width and length of the cavity and the depth of the cavity is led.

Therefore, the actuator 106 having the cavity 162 whose dimensions are the radius a of the opening 161 and the depth d of the cavity 162 which satisfies Expression 11 can detect a state of the liquid without malfunctions even in the case where the liquid within the liquid container is empty and the liquid remains within the cavity 162.

Since additive inertance M' has influence on acoustic impedance property, it can be said that a method of measuring a counter electromotive force generated by the actuator 106 due to the residual oscillation detects at least a change of acoustic impedance.

Moreover, according to the present embodiment, the actuator 106 generates an oscillation and measures a counter electromotive force generated in the actuator 106 due to the subsequently occurred residual oscillation. However, it is not always necessary that the oscillating section of the actuator 106 gives the oscillation to the liquid by oscillation itself due to the drive voltage. Specifically, if the oscillating section itself does not oscillate, the piezoelectric layer 160 is deflected and deformed by oscillating with the liquid in a certain range in which the oscillating section contacts with the liquid. This residual oscillation causes the piezoelectric layer 160 to generate a counter electromotive force voltage and transmits its counter electromotive force voltage to the upper portion electrode 164 and the lower portion electrode 166. A state of the medium may be detected by utilizing this phenomenon. For example, in an ink jet recording apparatus, a state of the ink tank or the ink within it may be detected by utilizing the oscillation occurred on the periphery of the oscillating section of an actuator generated by the oscillation due to the reciprocating movement of the carriage by scanning of the printing head at the time when it is printing.

Figure 23A:
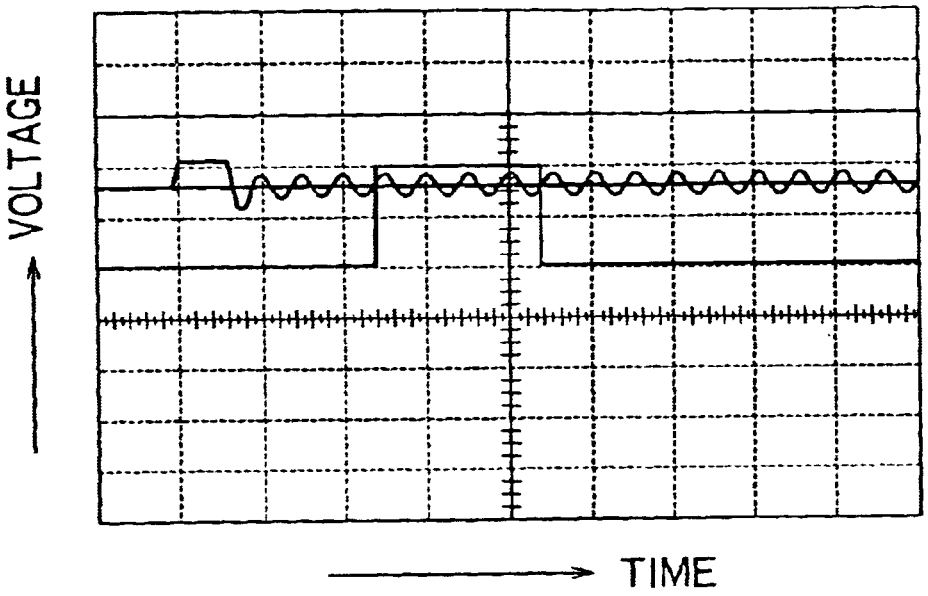
FIG. 23A and FIG. 23B are graphs showing a counter electromotive force wave of the actuator 106.
Figure 23B:
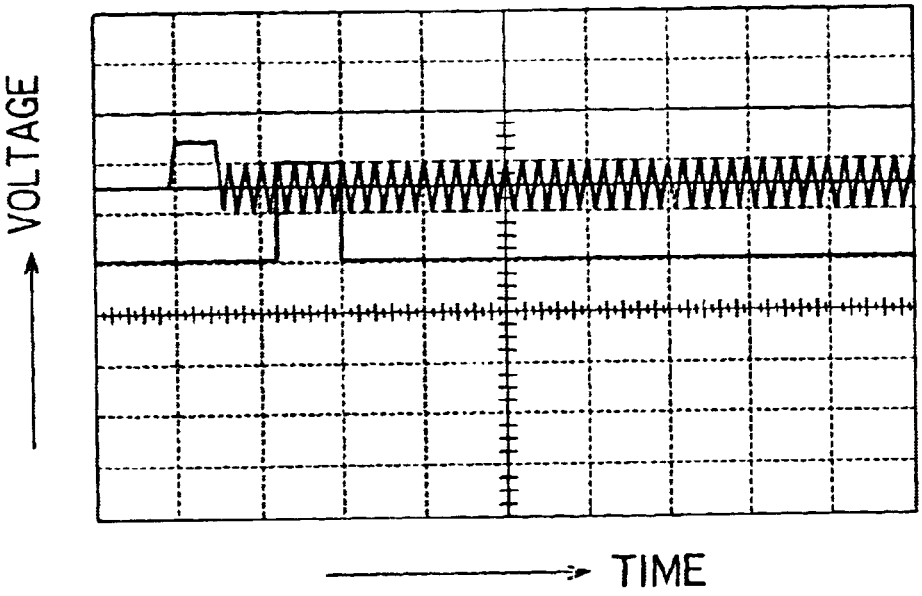

FIG. 23A and FIG. 23B show a waveform of the residual oscillation and a method of measuring the residual oscillation of the actuator 106 after the actuator 106 is made vibrated. Up and down of the ink liquid level in the mounting position level of the actuator 106 within the ink cartridge can be detected by a change of frequency of the residual oscillation and a change of the amplitude after the actuator 106 oscillates. In FIG. 23A and FIG. 23B, axis of ordinates indicates a voltage of a counter electromotive force generated by the residual oscillation of the actuator 106 and axis of abscissa indicates a time. A waveform of analogue signal of voltage as shown in FIG. 23A and FIG. 23B is generated by the residual oscillation of the actuator 106. Next, the analogue signal is converted into a digital numeric value corresponding to the frequency of the signal.

In the embodiment shown in FIG. 23A and FIG. 23B, the presence or absence of the ink is detected by measuring a time period generated by four pieces of pulse from fourth pulse to eighth pulse of the analogue signal.

More particularly, after the actuator 106 oscillates, the times that the reference voltage previously set is crossed from the lower voltage side to the higher voltage side are counted. Digital signal in the range from four counts to the 8 counts is defined as High, a time period spanning from four counts to 8 counts is measured by the predetermined clock pulse.

FIG. 23A shows a waveform at the time when the ink liquid level exists at higher level than the mounting position level of the actuator 106. On the other hand, FIG. 23B shows a waveform at the time when the ink is absent at the mounting position level of the actuator 106. Comparing FIG. 23A and FIG. 23B, the waveform in FIG. 23A is longer than the waveform in FIG. 23B in the time span from the fourth count to the eighth count. In other words, time spans from the fourth count to the eighth count are different depending on the presence or absence of the ink. An ink consuming state can be detected by utilizing these differences of the time spans. The reason why the counting from the fourth count of the analogue waveform is started is because it should be started after the oscillation of the actuator 106 is stable. The counting from the fourth count is only an embodiment, the counting may be started from an optional ordinal number of count. Here, a signal from the fourth count to the eighth count is detected, and a time span from the fourth count to the eighth count is measured, thereby finding resonance frequency. A clock pulse is preferably a pulse of clock equivalent to a clock for controlling a semiconductor and the like mounted on the ink cartridge. It should be noted that it is not necessary to measure a time span until the eighth count and it may count until an optional ordinal number of count. In FIG. 23A and FIG. 23B, a time span from the fourth count to the eighth count is measured, however, a time span within the different counts of interval may be measured according to a circuit configuration in which the frequency is detected.

For example, in the case where the quality of the ink is stable and variation of the amplitude between the peaks are small, in order to speed up the detection rate, resonance frequency may be found by detecting a time span from the fourth count to the sixth count. Moreover, in the case where the quality of the ink is unstable and the variation of the amplitude of the pulse is large, in order to precisely detect the residual oscillation a time span from the fourth count to twelfth count may be detected.

Moreover, as another embodiment, wave number of voltage waveform of counter electromotive force in the predetermined period may be counted (not shown). By this method, resonance frequency can be also found. More particularly, after the actuator 106 oscillates, a digital signal is made High only in the predetermined period, the predetermined reference voltage is crossed from the lower voltage side to the higher voltage side. The presence or absence of the ink can be detected by measuring its number of count.

Furthermore, as it is understood by comparing FIG. 23A and FIG. 23B, in the case where the ink is filled within the ink cartridge, and in the case where the ink is absent within the ink cartridge, the amplitudes of the counter electromotive forces are different. Accordingly, an ink consuming state within the ink cartridge may be detected by measuring an amplitude of a counter electromotive force. More particularly, for example, the reference voltage is set between the vertex of a counter electromotive force of FIG. 23A and the vertex of a counter electromotive force of FIG. 23B. After the actuator 106 oscillates, a digital signal is made High, in the case where the counter electromotive force crosses the reference voltage, the absence of the ink is determined. In the case where the counter electromotive force does not cross the reference voltage, the presence of the ink is determined.

Figure 24:
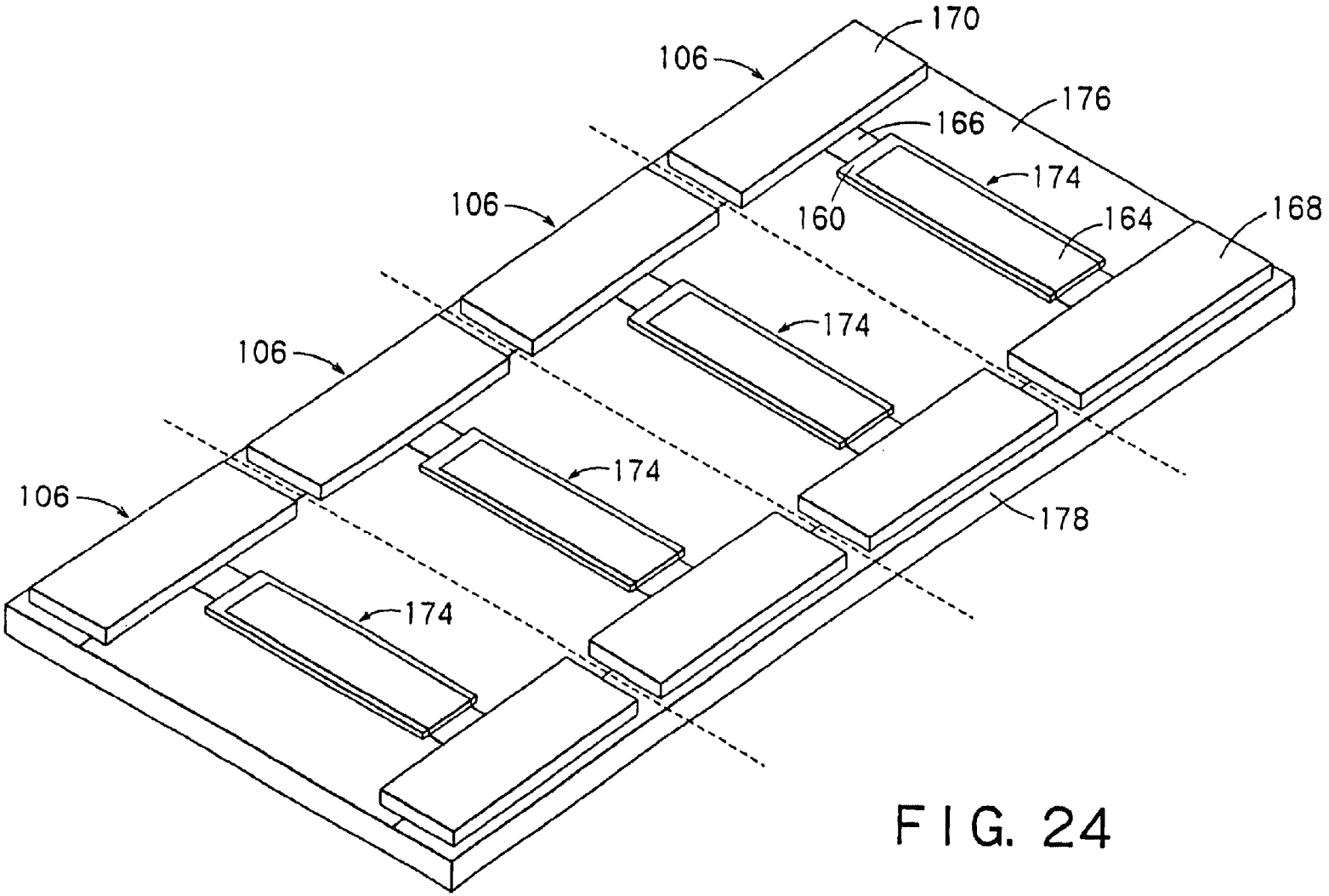
FIG. 24 is a view showing another embodiment of the actuator 106.
Figure 25:
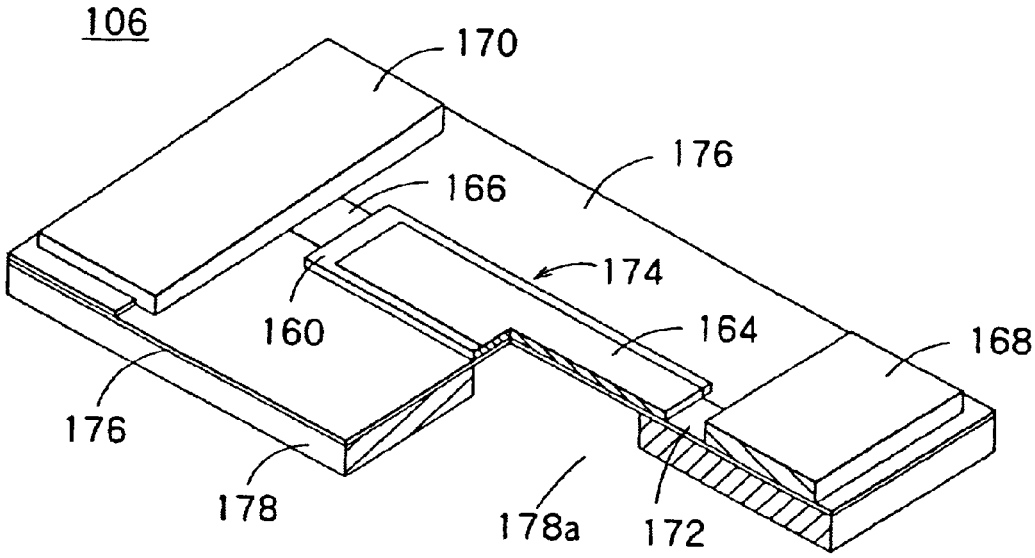
FIG. 25 is a view showing sections of portions of the actuator 106 shown in FIG. 24.

FIG. 24 shows a method of manufacturing the actuator 106. The multiple actuators 106 (in the embodiment of FIG. 24, 4 pieces) are integrally formed. The actuator 106 shown in FIG. 25 is manufactured by cutting integrally molded multiple actuator shown in FIG. 24 in the form of respective actuators 106. In the case where the respective piezoelectric elements of the multiple actuators 106 integrally molded shown in FIG. 24 are circular, the integrally molded one is cut in the form of the respective actuators 106, the actuator 106 shown in FIG. 20A, FIG. 20B and FIG. 20C can be manufactured. The multiple actuators 106 can be efficiently manufactured at the same time and treatment at the material handling time is easier by integrally forming the multiple actuators 106.

The actuator 106 has a thin plate or oscillation plate 176, the substrate 178, the elastic wave generation means or piezoelectric element 174, a terminal forming material or the upper portion electrode terminal 168, and the terminal forming member or the lower portion electrode terminal 170. The piezoelectric element 174 includes the piezoelectric oscillation plate or piezoelectric layer 160, the upper electrode or upper portion electrode 164, and the lower electrode or lower portion electrode 166. The oscillation plate 176 is formed on the upper surface of the substrate 178, the lower portion electrode 166 is formed on the upper surface of the oscillation plate 176. The piezoelectric layer 160 is formed on the lower portion electrode 160, the upper portion electrode 164 is formed on the upper surface of the piezoelectric layer 160. Therefore, the major section portion of the piezoelectric layer 160 is formed as sandwiched from the up and down by the major portions of the upper portion electrode 164 and the lower portion electrode 166.

The multiple piezoelectric elements 174 (in the embodiment of FIG. 24, 4 pieces) is formed on the oscillation plate 176. The lower portion electrode 166 is formed on the front face of the oscillation plate 176, the piezoelectric layer 160 is formed on the front face of the lower portion electrode 166, and the upper portion electrode 164 is formed on the upper surface of the piezoelectric layer. The upper portion electrode terminal 168 and the lower electrode terminal 170 is formed on the end portions of the upper portion electrode 164 and the lower portion electrode 166. The respective actuators 106 of the 4 pieces is separately cut and used individually.

FIG. 25 shows a sectional view of one portion of the actuator 106 whose piezoelectric element is rectangular.

Figure 26:
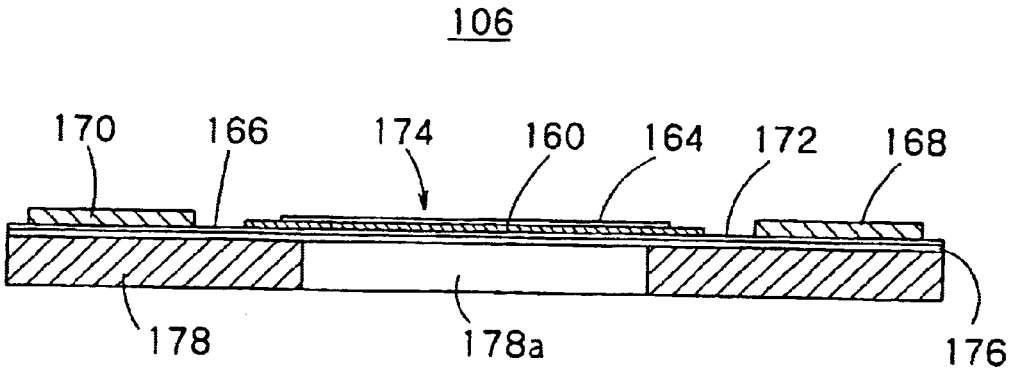
FIG. 26 is a view showing an entire section of the actuator 106 shown in FIG. 25.

FIG. 26 shows a sectional view of the whole of actuator 106 shown in FIG. 25. The penetrating hole 178*a* is formed on the surface opposed to the piezoelectric element 174 of the substrate 178. The penetrating hole 178*a* is sealed with the oscillation plate 176. The oscillation plate 176 has an electric insulation such as alumina and zirconia oxide and is formed by elastic and deformable material. The piezoelectric element 174 is formed on the oscillation plate 176 as opposing to the penetrating hole 178*a*. The lower portion electrode 166 is formed on the front face of the oscillation plate 176 so as to extend to the left side in FIG. 26, in one direction from the penetrating hole 178*a*. The upper portion electrode 164 is formed on the front face of the piezoelectric layer 160 so as to extend in the right side of FIG. 26, in the opposite direction of the lower portion electrode from the penetrating hole 178*a*. The upper portion electrode terminal 168 and the lower portion electrode terminal 170 are formed on the upper surfaces of the auxiliary electrode 172 and the lower portion electrode 166, respectively. The lower portion electrode terminal 170 electrically contacts with the lower portion electrode 166, the upper portion electrode terminal 168 electrically contacts with the upper portion electrode 164 via the auxiliary electrode 172, and receives and transmits a signal between the piezoelectric element and the external of the actuator 106. The upper portion electrode terminal 168 and the lower portion electrode terminal 170 have heights more than the height of the piezoelectric element which combines the electrode and the piezoelectric layer.

Figure 27:
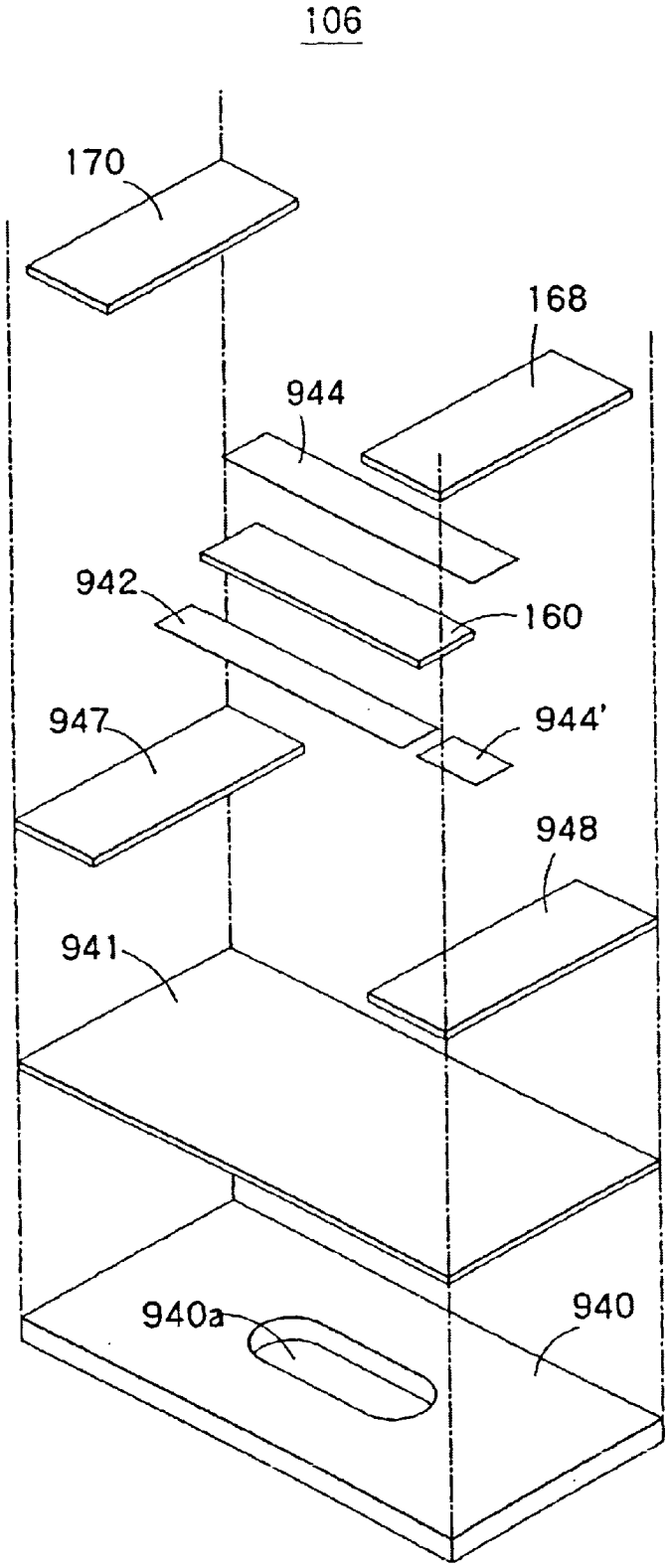
FIG. 27 is a view showing a method of manufacturing the actuator 106 shown in FIG. 24.

FIG. 27 shows a method of manufacturing the actuator 106 shown in FIG. 24. First, a penetrating hole 940*a* is punched by employing press or laser processing and the like in a green sheet 940. The green sheet 940 is the substrate 178 after burning. The green sheet 940 is formed with a material such as ceramic and the like. Next, on the green sheet 940, the green sheet 941 is laminated. The green sheet 941 is the oscillation plate 176 after burning. The green sheet 941 is formed with a material such as zirconia oxide and the like. Next, on the surface of the green sheet 941, an electrically conductive layer 942, the piezoelectric layer 160, an electrically conductive layer 944 are in turn formed by a method of pressure membrane printing and the like. The electrically conductive layer 942 is the lower portion electrode 166 later and the electrically conductive layer 944 is the upper portion electrode 164 later. Next, the formed green sheet 940, the green sheet 941, the electrically conductive layer 942, the piezoelectric layer 160, and the electrically conductive layer 944 are dried and burned. Spacer members 947 and 948 heighten the heights of the upper portion electrode terminal 168 and the lower portion electrode terminal 170 by being stacked on the bottoms of them and make them higher than the piezoelectric element. The spacer members 947 and 948 are formed by printing the green sheets 940 and 941 with the identical material or by laminating green sheets. Owing to these spacer members 947 and 948, since not only the material of the upper portion electrode terminal 168 and the lower portion electrode terminal 170, which is a metal, can be reduced, but also the thickness of the upper portion electrode terminal 168 and the lower portion electrode terminal 170 can be thinner, the upper portion electrode terminal 168 and the lower portion electrode terminal 170 can be finely printed, and further can be made stable heights.

When the electrically conductive layer 942 is formed, if a connecting portion 944' and the spacer member 947 and 948 are formed at the same time, the upper portion electrode terminal 168 and the lower portion electrode terminal 170 can be easily formed and firmly fixed. Finally, on the end portion regions, the electrically conductive layer 942 and the electrically conductive layer 944 are formed. When the upper electrode terminal 168 and the lower electrode terminal 170 are formed, these are formed so that the upper electrode terminal 168 and the lower electrode terminal 170 are electrically connected to the piezoelectric layer 160.

Figure 28A:
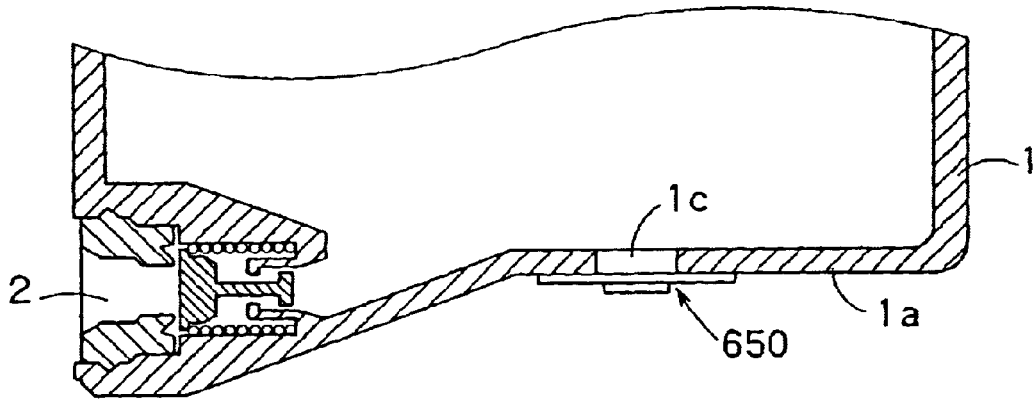
FIG. 28A, FIG. 28B and FIG. 28C are views showing still another embodiment of an ink cartridge of the present invention.
Figure 28B:
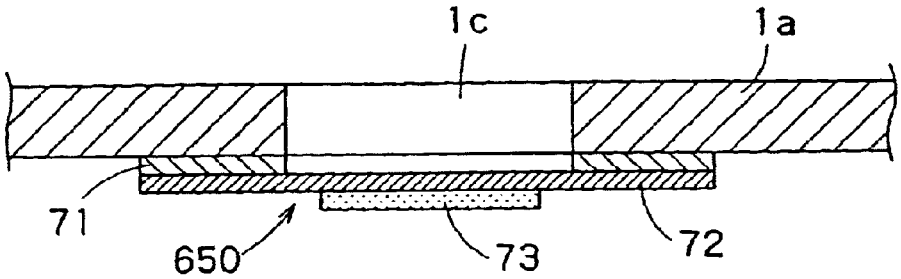
Figure 28C:
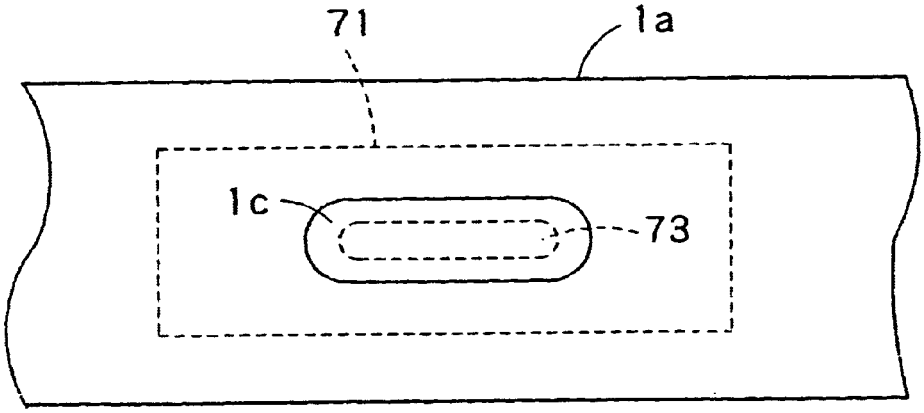

FIG. 28A, FIG. 28B and FIG. 28C show still another embodiment of an ink cartridge applied to the present invention. FIG. 28A is a sectional view of a bottom portion of the ink cartridge according to the present embodiment. The ink cartridge of the present embodiment has the penetrating hole 1*c* on the bottom surface 1*a* of the container 1 containing the ink. The bottom portion of the penetrating hole 1*c* is sealed with an actuator 605 and an ink reservoir is formed.

FIG. 28B shows the detailed sectional view of the actuator 650 and the penetrating hole 1*c* shown in FIG. 28A. FIG. 28C shows a plane of the actuator 650 and the penetrating hole 1*c* shown in FIG. 28B. The actuator 650 has an oscillation plate 72 and a piezoelectric element 73 fixed on the oscillation plate 72. The actuator 650 is fixed on the bottom surface of the container 1 so that the piezoelectric element 73 is opposed to the penetrating hole 1*c* via the oscillation plate 72 and the substrate 71. The oscillation plate 72 is elastic and deformable and has an ink-resist property.

An amplitude and frequency are changed of the counter electromotive force generated by the residual oscillation of the piezoelectric element 73 and the oscillation plate 72 depending on a volume of the ink of the container 1. The penetrating hole 1*c* is formed at the position opposed to the actuator 650, the ink of the certain minimum volume is secured in the penetrating hole 1*c*. Therefore, an ink end of the container 1 can be securely detected by previously measuring the property of the oscillation of the actuator 650 determined by the ink volume secured in the penetrating hole 1*c*.

Figure 29A:
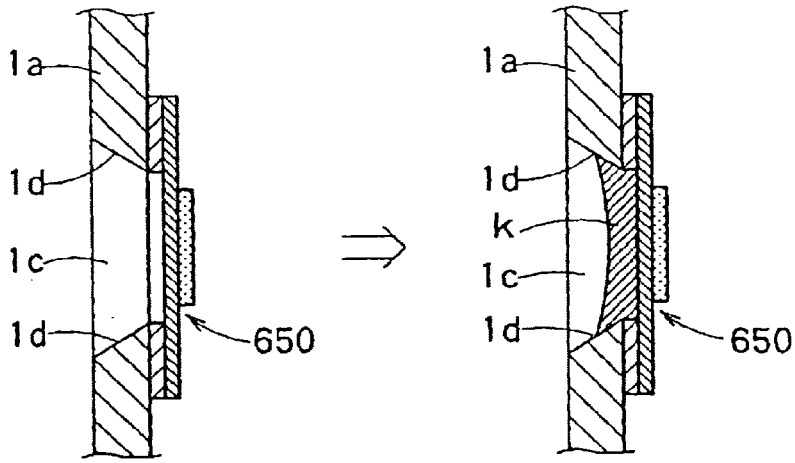
FIG. 29A, FIG. 29B and FIG. 29C are views showing another embodiment of the penetrating hole 1*c;*
Figure 29B:
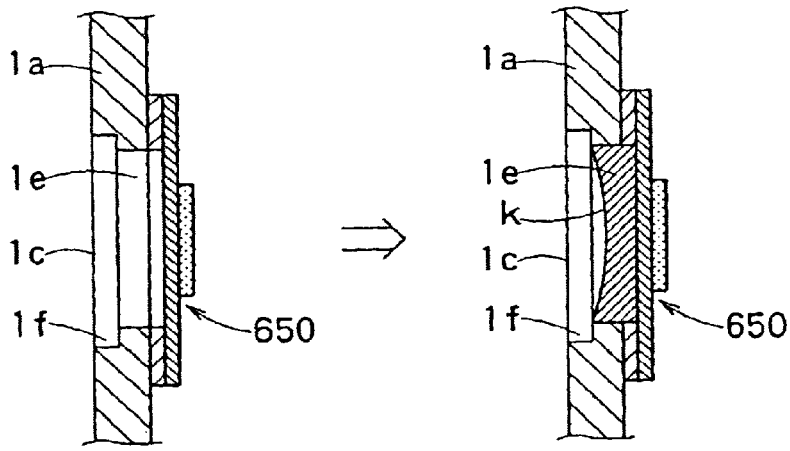
Figure 29C:
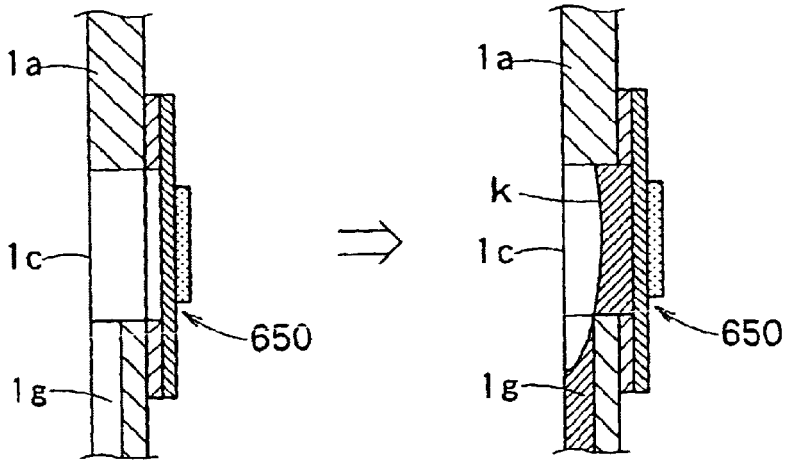

FIG. 29A, FIG. 29B and FIG. 29C show another embodiment of the penetrating hole 1*c*. In respective FIG. 29A, FIG. 29B and FIG. 29*c*, drawings of the left side show a state where the ink K is absent in the penetrating hole 1*c*, and the right side drawings show a state where the ink K remains in the penetrating hole 1*c*. In the embodiments of FIG. 28A, FIG. 28B and FIG. 28C, the side wall of the penetrating hole 1*c* is formed as a vertical wall. In FIG. 29A, the penetrating hole 1*c* in which the side walls 1*d* is formed in a vertically slanting manner, opened to be widened toward the external. In FIG. 29B, stepped portions 1*e* and 1*f* are formed on the side wall of the penetrating hole 1*c*. The stepped portion 1*f* which is located at upper position is wider than the stepped portion 1*e* which is located at the lower position. In FIG. 29C, the penetrating hole 1*c* has a channel 1*g* extending in a direction in which the ink K is easily drained, specifically in a direction of the ink supplying opening 2.

Depending on the shape of the penetrating hole 1*c* shown in FIG. 29A through FIG. 29C, the ink K volume of the ink reservoir portion can be reduced. Therefore, M'cav and M'max described in FIG. 20A, FIG. 20B, FIG. 20C and FIG. 21 are compared and it can be made it small, and since the oscillation property of the actuator 650 at the time of the ink end can be largely differentiated from the case where the ink K of printable volume remains in the container 1, the ink end can be more securely detected.

Figure 30:
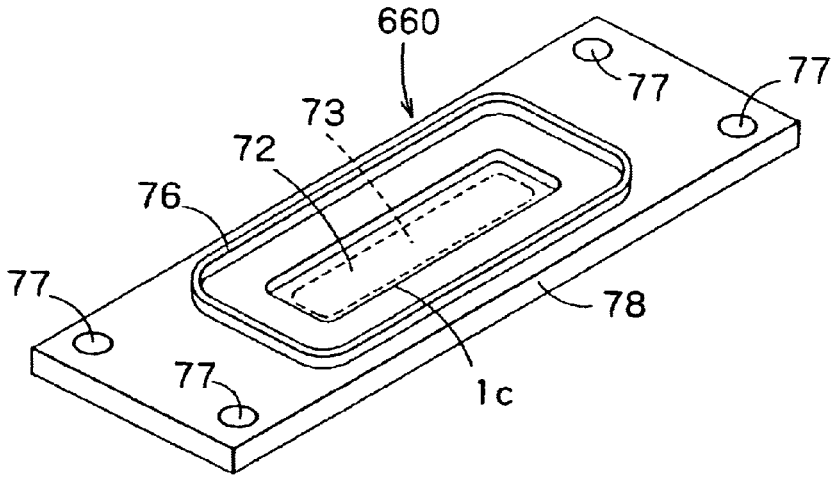
FIG. 30 is a view showing another embodiment of an actuator 660.

FIG. 30 is a perspective view showing another embodiment of an actuator. An actuator 660 has a packing 76 which is positioned at the position outer than the penetrating hole 1*c* of the substrate or a mounting plate 78 configuring the actuator 660. On the circumference of the actuator 660, a swaged hole 77 is formed. The actuator 660 is fixed on the container 1 by swaging via a swaged hole 77.

Figure 31A:
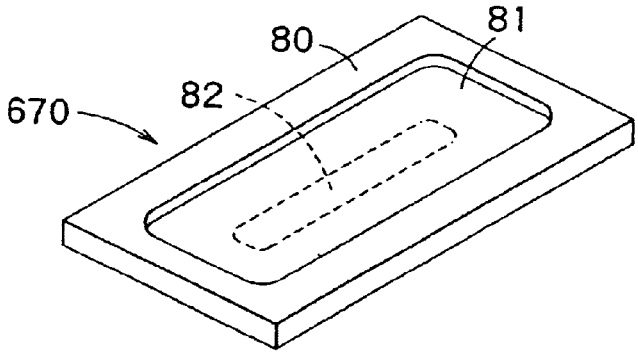
FIG. 31A and FIG. 31B are views showing still another embodiment of an actuator 670.
Figure 31B:
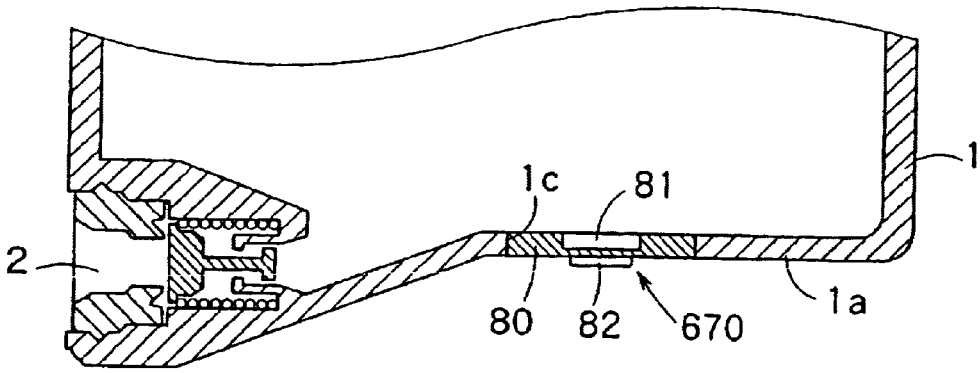

FIG. 31A and FIG. 31B are perspective views showing still another embodiment of an actuator. In the present embodiment, the actuator 670 has a convex formation substrate 80 and a piezoelectric element 82. A convex portion 81 is formed on one surface of the convex formation substrate 80 by a technique such as etching and the like, and on the other surface, the piezoelectric element 82 is mounted. The bottom portion of the convex portion 81 out of the convex formation substrate 80 acts as the oscillating region. Therefore, the oscillating region of an actuator 670 is defined by the marginal portion of the convex portion 81. Moreover, the structure of the actuator 670 is similar to a structure forming integrally the substrate 178 and the oscillation plate 176 out of the actuators 106 according to the embodiments of FIG. 20A, FIG. 20B and FIG. 20C. Therefore, the manufacturing steps can be shortened when the ink cartridge is manufactured, and its cost is reduced. The actuator 670 is sized for being embedded in the penetrating hole 1*c* provided on the container 1, thereby enabling the convex portion 81 to act as a cavity. It should be noted that the actuator 106 according to the embodiments of FIG. 20A, FIG. 20B and FIG. 20C may be formed so that it is capable of being embedded in the penetrating hole 1*c* similarly to the actuator 670 according to the embodiments of FIG. 31A and FIG. 31B.

Figure 32:
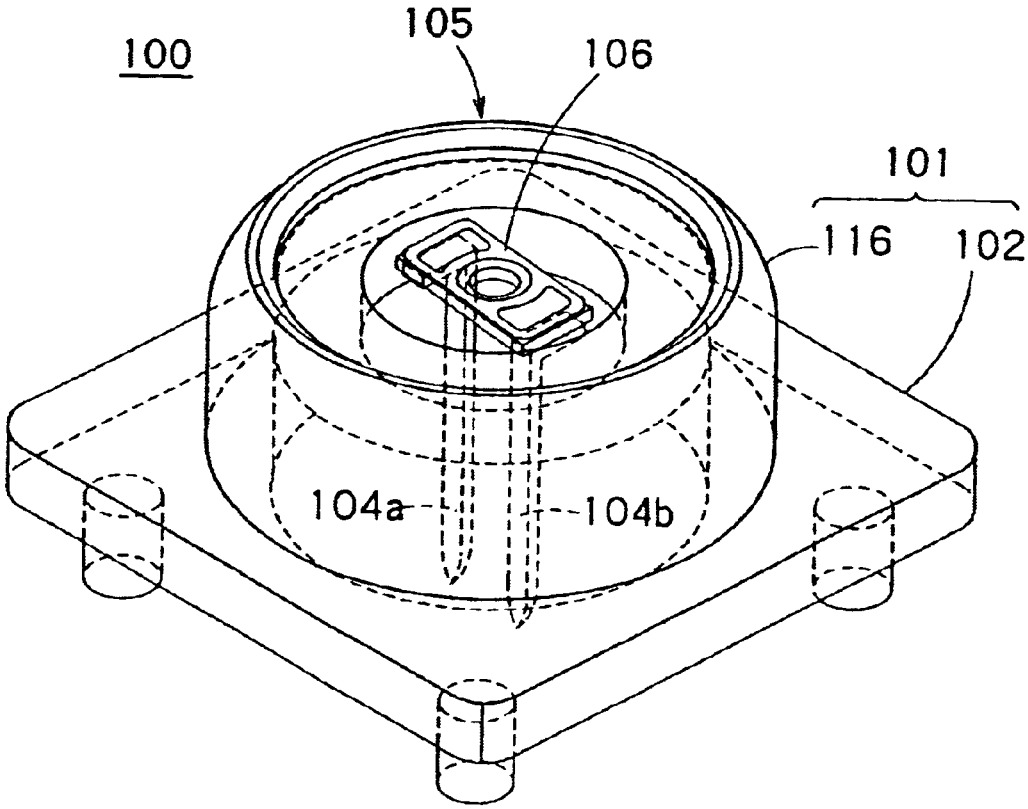
FIG. 32 is a perspective view showing a module body 100.

FIG. 32 is a perspective view showing a configuration integrally forming the actuator 106 as a mounting module body 100. The module body 100 is equipped on the predetermined location of the container 1. The module body 100 is configured so that it detects a consuming state of the liquid within the container 1 by detecting at least a change of acoustic impedance in the ink liquid. The module body 100 of the present embodiment has a liquid container mounting portion 101 for mounting the actuator 106 on the container 1. The liquid container mounting portion 101 is configured such that a circular cylinder portion 116 containing the actuator 106 for oscillating by a drive signal is mounted on the base 102 whose plane is approximately rectangular. Since it is configured so that the actuator 106 of the module body 100 cannot be contacted from the external when the module body 100 is equipped on the ink cartridge, the actuator 106 can be protected from contacting it from the external. It should be noted that an edge of tip side of the circular cylinder portion 116 is formed in a round shape, and it is easily interfitted when it is equipped in the hole formed on the ink cartridge.

Figure 33:
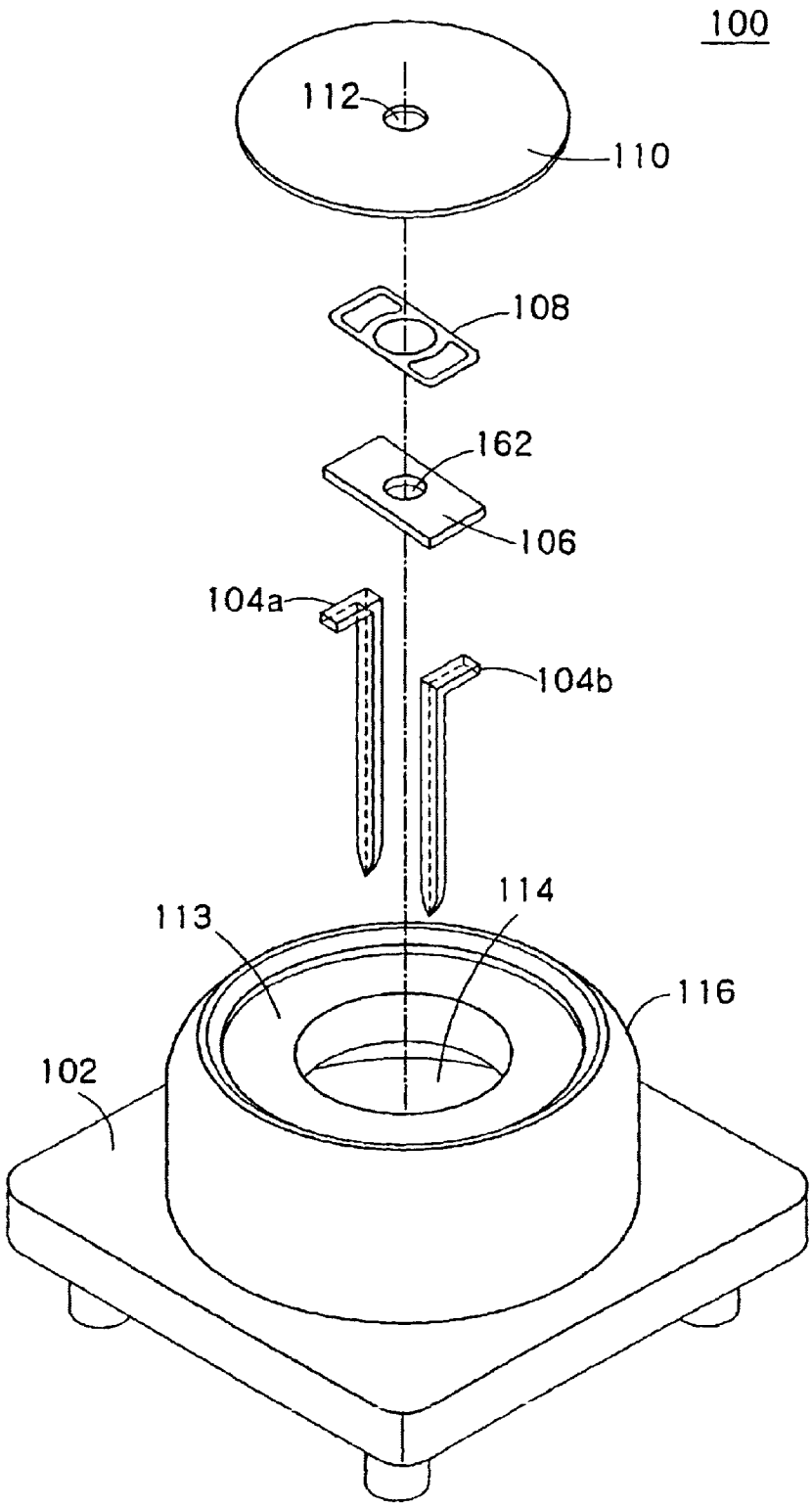
FIG. 33 is an exploded view showing a configuration of the module body 100 shown in FIG. 32.

FIG. 33 is an exploded view showing a configuration of the module body 100 shown in FIG. 32. The module body 100 includes a liquid container mounting portion 101 composed of resin, a plate 110 and a piezoelectric device mounting portion 105 having a convex portion 113. Furthermore, the module body 100 has lead wires 104*a* and 104*b*, the actuator 106, and a film 108. Preferably, the plate 110 is formed from a material not easily rusting such as stainless steel or stainless steel alloy and the like. On the circular cylinder portion 116 and the base 102 contained in the liquid container mounting portion 101, an opening portion 114 is formed in the center portion so that the lead wires 104*a* and 104*b* can be contained and the convex portion 113 is formed so that the actuator 105, the film 108, and the plate 110 can be contained. The actuator 106 is joined to the plate 110 via the film 108, the plate 110 and the actuator 106 are fixed on the liquid container mounting portion 101. Therefore, the lead wires 104*a* and 104*b*, the actuator 106, the film 108 and the plate 110 are integrally mounted on the liquid container mounting portion 101. The lead wires 104*a* and 104*b* are coupled to the upper portion electrode and the lower portion electrode, respectively, and transmit a drive signal to the piezoelectric layer, while transmitting a signal of resonance frequency detected by the actuator 106 to the recording apparatus and the like. The actuator 106 temporarily oscillates on the basis of the drive signal transmitted from the lead wires 104*a* and 104*b*. The actuator 106 performs the residual oscillation after oscillation, and its oscillation causes a counter electromotive force to be generated. At that time, resonance frequency corresponding to a consuming state of the ink within the liquid container can be detected by detecting an oscillation cycle of the counter electromotive force. The film 108 makes the actuator 106 and the plate 110 adhered and makes the actuator sealed in a fluid-tight manner. The film 108 is formed by polyolefine and the like, and preferably adhered by the thermofusion.

The plate 110 is a circular shaped plate and the opening portion 114 of the base 102 is formed in a cylindrical shape. The actuator 106 and the film 108 are formed in a rectangular shape. The lead wire 104, the actuator 106, the film 108, and the plate 110 may be attachable to/detachable from the base 102. The base 102, the lead wire 104, the actuator 106, the film 108 and the plate 110 are arranged symmetrically with respect to the center axis of the module body 100. Furthermore, the center of the base 102, the actuator 106, the film 108 and the plate 110 is arranged approximately on the central axis.

An area of the opening 114 of the base 102 is formed so that it is larger than that of the oscillating region of the actuator 106. In the center of the plate 110 and at the position facing the oscillating section of the actuator 106, a penetrating hole 112 is formed. On the actuator 106 as shown in FIG. 20A, FIG. 20B, FIG. 20C and the FIG. 21, the cavity 162 is formed, and the penetrating hole 112 and the cavity 162 form an ink reservoir portion in cooperation. The thickness of the plate 110 is preferably smaller compared to the radius of the penetrating hole 112 in order to lessen the influence of the residual ink. For example, the depth of the penetrating hole 112 is preferably less than one third of its radius. The penetrating hole 112 is approximately a complete round shape symmetric with respect to the central axis of the module body 100. Moreover, an area of the penetrating hole 112 is larger than an area of opening of the cavity 162 of the actuator 106. The circumference of the penetrating hole 112 may be in a taper shape or in a step shape. The module body 100 is mounted on the side wall, the upper portion or the bottom portion of the container 1 so that the penetrating hole 112 face the interior of the container 1. When the ink is consumed and the ink on the periphery of the actuator 106 is absent, since resonance frequency of the actuator 106 is largely changed, a change of the ink liquid level can be detected.

Figure 34:
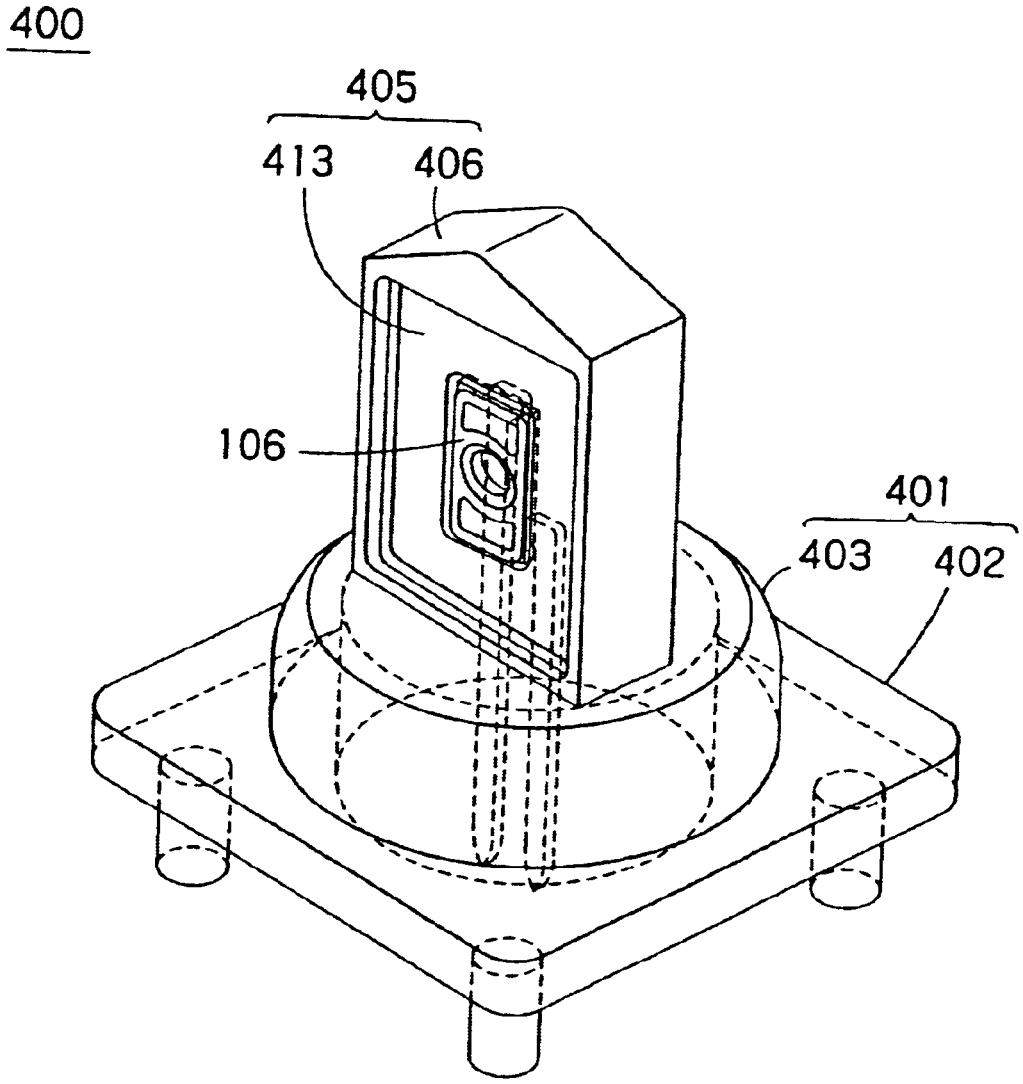
FIG. 34 is a view showing another embodiment of the module body 100.

FIG. 34 is a perspective view showing another embodiment of a module body. In a module body 400 of the present embodiment, a piezoelectric device mounting portion 405 is formed on the liquid container mounting portion 401. In the liquid container mounting portion 401, the cylindrical circular cylinder portion 403 is formed on the base 402 whose plane is approximately square and rounded off. Furthermore, the piezoelectric device mounting portion 405 includes a planar factor 406 stood on the circular cylinder portion 403 and the convex 413. The actuator 106 is arranged on the convex portion 413 provided on the side wall of the planar factor 406. It should be noted that the tip of the planar factor 406 is beveled at the predetermined angle and it is easily fitted when it is mounted in the hole formed in the ink cartridge.

Figure 35:
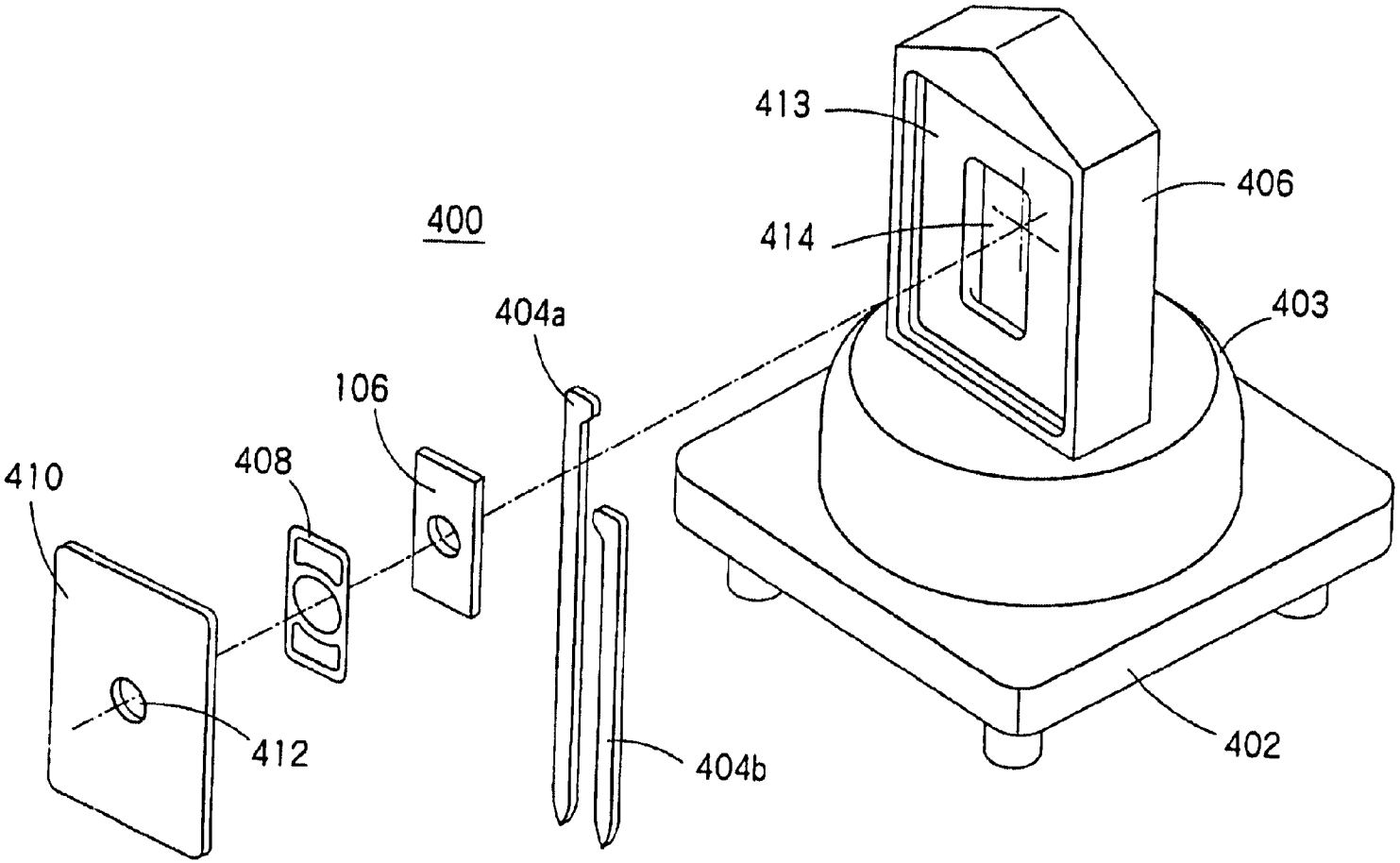
FIG. 35 is an exploded view showing a configuration of the module body 100 shown in FIG. 34.

FIG. 35 is an exploded perspective view showing a configuration of a module body 400 shown in FIG. 34. Similarly to the module body 100 shown in FIG. 32, the module body 400 includes the liquid container mounting 401 and the piezoelectric device mounting portion 405. The liquid container mounting portion 401 has the base 402 and the circular cylinder portion 403, and the piezoelectric device mounting portion 405 has the planar factor 406 and the convex portion 413. The actuator 106 is joined to the plate 410, and fixed on the convex portion 413. The module body 400 has further the lead wire 404*a* and 404*b*, the actuator 106 and the film 408.

According to the present embodiment, the plate 410 is in a rectangular shape, and the opening portion 414 provided on the planar factor 406 is formed in a rectangular shape. The lead wire 404*a* and 404*b*, the actuator 106, the film 408, and the plate 410 may be configured as being attachable to/detachable from the base 402. The actuator 106, the film 408 and the plate 410 pass through the center of the opening 414, and arranged symmetrically with respect to the central axis extending in the vertical direction to the plane of the opening portion 414. Furthermore, the center of the actuator 406, the film 408, and the plate 410 is arranged approximately on the central axis.

An area of the penetrating hole 412 provided in the center of the plate 410 is formed so that it is larger than that of the opening of the cavity 162 of the actuator 106. The cavity 162 of the actuator 106 and the penetrating hole 412 form an ink reservoir portion in cooperation. The thickness of the plate 410 is preferably smaller compared to the radius of the penetrating hole 412. For example, the depth of the penetrating hole 412 is preferably less than one third of its radius. The penetrating hole 412 is approximately a complete round shape, which is symmetric with respect to the central axis of the module body 400. The circumference of the penetrating hole 112 may be in a taper shape or in a step shape. The module body 400 can be mounted on the bottom portion of the container 1 so that the penetrating hole 412 is arranged within the container 1. Since the actuator 106 is arranged within the container 1 so that the actuator 106 extends in the vertical direction, the setting of the point in time of an ink end can be easily changed by changing the height at which the actuator 106 is arranged within the container 1 by changing the height of the base 402.

Figure 36A:
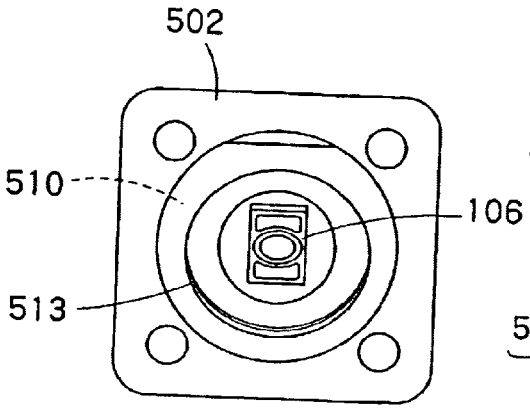
FIG. 36A, FIG. 36B and FIG. 36C are views showing still another embodiment of the module body 100.
Figure 36C:
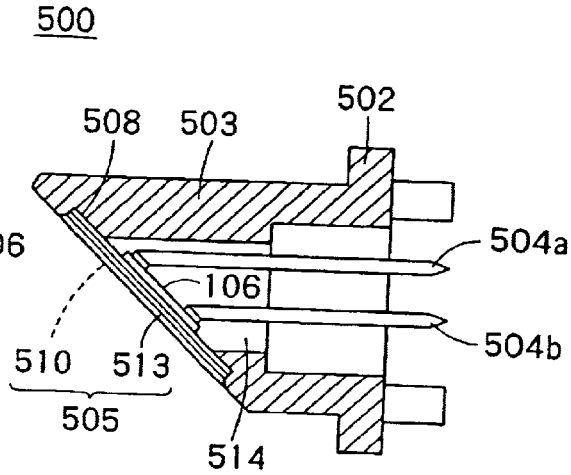
Figure 36B:
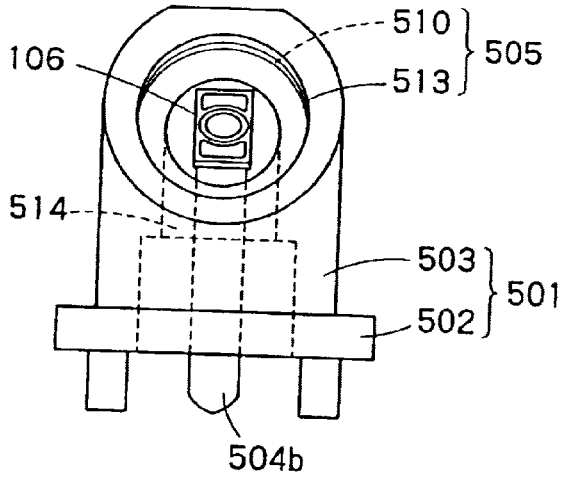

FIG. 36A, FIG. 36B, and FIG. 36C show still another embodiment of a module body. Similarly to the module body 100 shown in FIG. 32, a module body 500 of FIG. 36A, FIG. 36B and FIG. 36C includes the liquid container mounting 501 having a base 502 and a circular cylinder portion 503. The module body 500 has further the lead wires 504*a* and 504*b*, the actuator 106 and the film 508 and the plate 510. In the base 502 included in the liquid container mounting section 501, the opening portion 514 is formed in the center portion so as to be able to contain the lead wires 504*a* and 504*b* and the convex portion 513 is formed so as to be capable of containing the actuator 106, the film 508 and the plate 510. The actuator 106 is fixed on the piezoelectric device mounting section 505 via the plate 510. Therefore, the lead wires 504*a* and 504*b*, the actuator 106, the film 508 and the plate 510 are integrally mounted on the liquid container mounting section 501. In the module body 500 of the present embodiment, the circular cylinder portion 503 provided on the upper surface in a vertically slanting manner is formed on the base whose plane is a square and rounded off. The actuator 106 is arranged on the convex portion 513 provided on the circular cylinder portion 503 in a vertically slanting manner.

The tip of the module body 500 is slanting, and the actuator 106 is mounted on its slanting surface. Therefore, when the module body 500 is mounted on the bottom portion or side wall of the container 1, the actuator 106 has a slope with respect to the vertical direction of the container 1. The slanting angle of the tip of the module body 500 is preferably between approximately 30° and 60° in consideration of detection performance.

The module body 500 is mounted on the bottom or side wall of the container 1 so that the actuator 106 is arranged within the container 1. In the case where the module body 500 is mounted on the side portion of the container 1, the actuator 106 is mounted on the container 1 so that the actuator 106 is slanting and facing toward the upper side, lower side or lateral side. On the other hand, in the case where the module body 500 is mounted on the bottom portion of the container 1, the actuator 106 is mounted on the container 1 so that the actuator 106 is slanting and facing toward the ink supplying opening of the container 1.

Figure 37:
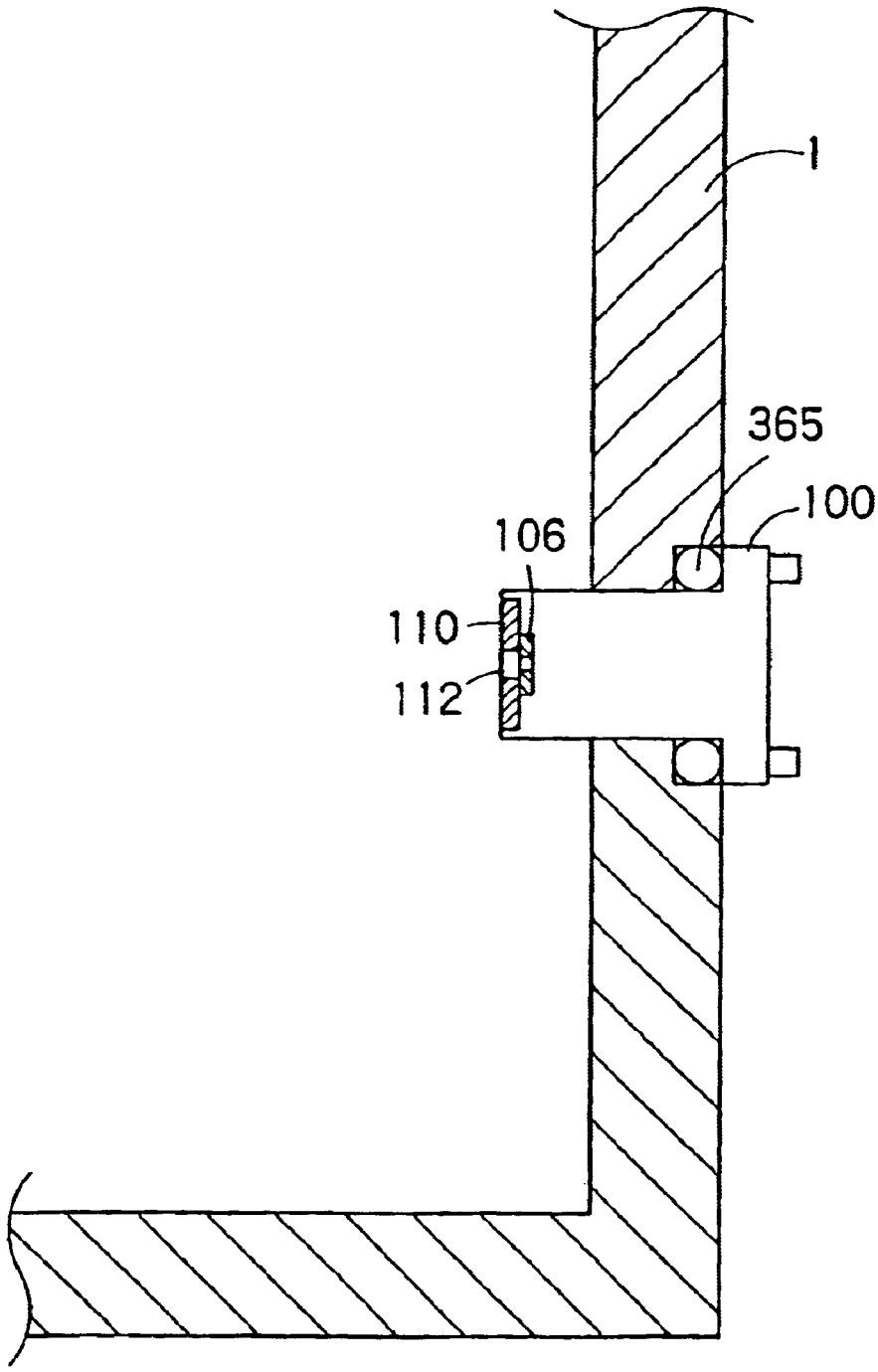
FIG. 37 is a view showing an embodiment of a section of an ink container 1 on which the module body 100 shown in FIG. 32 is mounted.

FIG. 37 is a sectional view of nearby the bottom portion of the ink container when the module body 100 shown in FIG. 32 is mounted on the container 1. The module body 100 is mounted so as to penetrate the side wall of the container 1. On the joint surface of the side wall of the container 1 and the module body 100, an O-ring 365 is provided, and holds the module body 100 and the container 1 in a fluid-tight manner. The module body 100 is preferably equipped with a circular cylinder portion as described in FIG. 32 so that the module body 100 can be sealed with an O-ring. An ink within the container 1 contacts with the actuator 106 via the penetrating hole 112 of the plate 110 by inserting the tip of the module body 100 into the interior of the container 1. Since resonance frequencies of the residual oscillation of the actuator 106 are different depending on, which medium, a liquid or gas exists on the periphery of the oscillating section of the actuator 106, an ink consuming state can be detected by employing the module body 100. Moreover, it is not limited to the module body 100, the module body 400 shown in FIG. 34, the module body 500 shown in FIG. 36A, FIG. 36B, and FIG. 36C, or module bodies 700A and 700B shown in FIG. 38A, FIG. 38B and FIG. 38C and a mold structured body 600 may be mounted on the container 1 to detect the presence or absence of the ink.

Figure 38C:
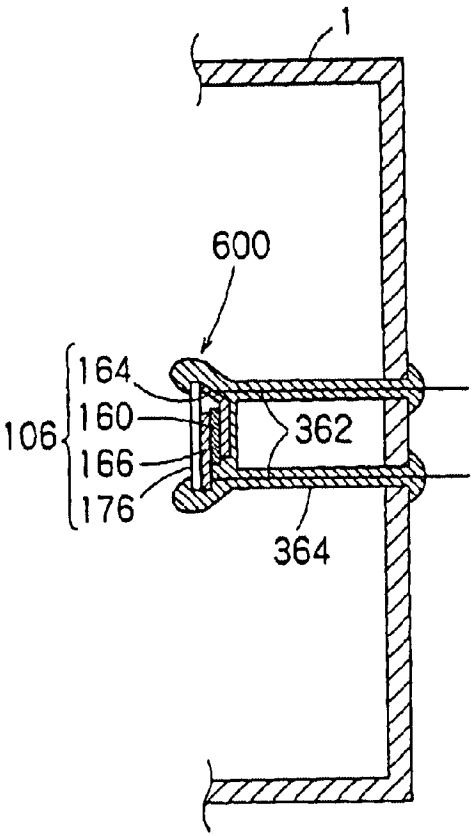
FIG. 38A, FIG. 38B and FIG. 38C are sectional views showing still another embodiment of the module body 100.
Figure 38B:
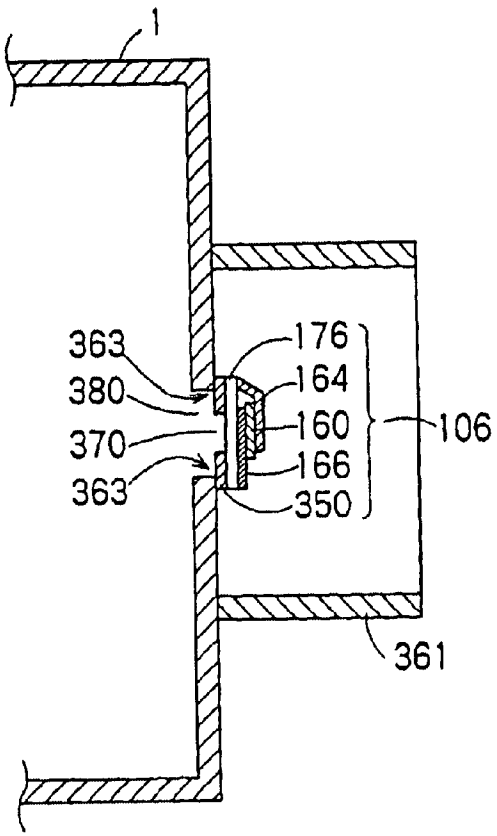
Figure 38A:
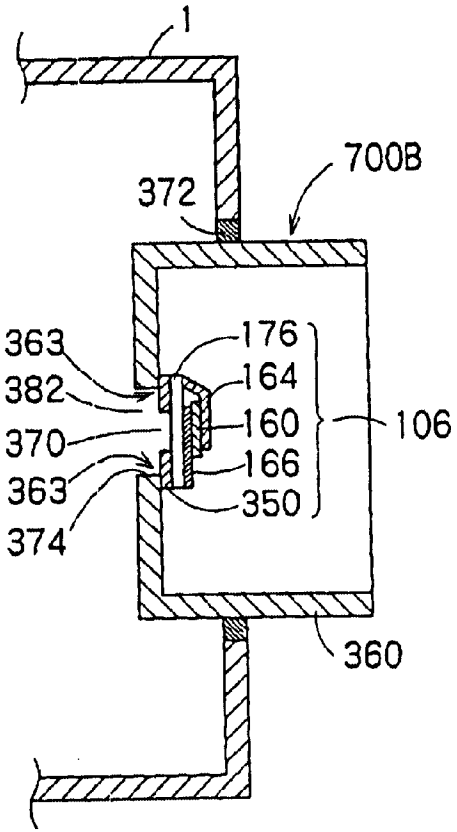

FIG. 38A shows a sectional view of an ink container when the module body 700B is mounted on the container 1. In the present embodiment, the module body 700B is used as one of the mounting structures. The module body 700B is mounted on the container 1 so that the liquid container mounting portion 360 is projected into the interior of the container 1. The penetrating hole 370 is formed on the mounting plate 350 and the penetrating hole 370 and the oscillating section of the actuator 106 face it. Furthermore, the hole 382 and the piezoelectric device mounting portion are formed on the bottom wall of the module body 700B. The actuator 106 is arranged so as to seal one side of the hole 382. Accordingly, the ink contacts with the oscillation plate 176 via a hole 382 of a piezoelectric device mounting section 363 and a penetrated hole 370 of a mounting plate 350. The hole 382 of the piezoelectric device mounting section 363 and the penetrated hole 370 of the mounting plate 350 form an ink reservoir portion in cooperation. The piezoelectric device mounting section 363 and the actuator 106 are fixed with the mounting plate 350 and the film member. A sealing structure 372 is provided on the connecting section between the liquid container mounting section 360 and the container 1. The sealing structure 372 may be formed with a material having plasticity such as synthetic resin and the like, or may be formed with an O-ring. The module body 700B of FIG. 38A and the container 1 are separated bodies, however, the piezoelectric device mounting section of the module body 700B may be composed of one portion of the container 1.

In the module body 700B of FIG. 38A, the embedding of lead wire into a module body as shown in FIG. 32 through FIG. 36A, FIG. 36B, FIG. 36C is not necessary. Therefore, molding processing is simplified. Furthermore, an exchange of the module body 700B is possible and the recycling is possible.

There may be such a risk that when the ink cartridge is swung, the ink is attached on the upper surface or side wall of the container 1 and the actuator 106 is malfunctioned by the ink running from the upper surface and side wall of the container 1. However, as to the module body 700B, since the liquid container mounting section 360 is projected into the interior of the container 1, the actuator 106 is not malfunctioned by the ink running from the upper surface and side wall of the container Moreover, in the embodiment of FIG. 38A, the module body 700B is mounted on the container 1 so that only one portion of the oscillation plate 176 and the mounting plate 350 contacts with the ink within the container 1. In the embodiment of FIG. 38A, the embedding of the lead wires 104*a*, 104*b*, 404*a*, 404*b*, 504*a* and 504*b* shown in FIG. 32 through FIG. 36A, FIG. 36B and FIG. 36C into the electrode of the module body is not necessary. Therefore, the molding processing is simplified. Furthermore, the exchange of the actuator 106 is possible and the recycling is possible.

FIG. 38B shows a sectional view of an ink container as an embodiment when the actuator 106 is mounted on the container 1. In an ink cartridge according to the embodiment of FIG. 38B, a protecting member 361 is mounted on the container 1 as a separate body separated from the actuator 106. Therefore, the protecting member 361 and the actuator 106 are not integrated as a module, however, on the other hand, the actuator 106 can be protected from being contacted with the user's hand by the protecting member 361. A hole 380 provided in front of the actuator 106 is provided and arranged on the side wall of the container 1. The actuator 106 includes the piezoelectric layer 160, the upper portion electrode 164, the lower portion electrode 166, the oscillation plate 176 and the mounting plate 350. The oscillation plate 176 is formed on the upper surface of the mounting plate 350 and the lower portion electrode 166 is formed on the upper surface of the oscillation plate 176. The piezoelectric layer 160 is formed on the upper surface of the lower portion electrode 166 and the upper portion electrode 164 is formed on the upper surface of the piezoelectric layer 160. Therefore, the major portion of the piezoelectric layer 160 is formed so as to be sandwiched between the major portion of the upper portion electrode 164 and the major portion of the lower portion electrode 166 from the upper and lower sides. The circular portions which are the respective major portions of the piezoelectric layer 160, the upper portion electrode 164 and the lower portion electrode 166 forms piezoelectric elements. The piezoelectric elements are formed on the oscillation plate 176. The oscillating region of the piezoelectric elements and the oscillation plate 176 is the oscillating section in which the actuator actually vibrates. The penetrated hole 370 is provided on the mounting plate 350. Furthermore, the hole 380 is formed on the side wall of the container 1. Accordingly, the ink contacts with the oscillation plate 176 via the hole 380 of the container 1 and the penetrated hole 370 of the mounting plate 350. The hole 380 of the container 1 and the penetrated hole 370 of the mounting plate 350 form an ink reservoir portion in cooperation. Moreover, in the present embodiment of FIG. 38B, since the protecting member 361 protects the actuator 106, the actuator 106 can be protected from the contacts from the external.

It should be noted that the substrate 178 of the FIG. 20A, FIG. 20B and FIG. 20C may be used instead of the mounting plate 350 of FIG. 38A and FIG. 38B.

FIG. 38C shows an embodiment having a mold structure body 600 including the actuator 106. In the present embodiment, the mold structure body 600 is used as one of the mounting structure body. The mold structure body 600 has the actuator 106, and the mold section 364. The actuator 106 and the mold portion 364 are integrally molded. The mold portion 364 is molded with a material having plasticity such as silicon resin and the like. The mold portion 364 has a lead wire 362 inside. The mold portion 364 is formed so as to have two legs extending from the actuator 106. Ends of the two legs of the mold portion 364 are formed in a semi-spherical shape in order to fix the mold portion 364 and the container 1 in a fluid-tight manner. The mold portion 364 is mounted on the container 1 so that the actuator 106 is projected into the interior of the container 1, and the oscillating section of the actuator 106 contacts with the ink within the container 1. The upper portion electrode 164, the piezoelectric layer 160 and the lower portion electrode 166 are protected from the ink by the mold portion 364.

In the mold structure body 600, since it is not necessary to provide the sealing structure 372 between the mold portion 364 and the container 1, the ink is not easily leaked. Moreover, since the mold structure body 600 is not configured so as to be projecting from the external of the container 1, the actuator 106 can be protected from contacting from the external. There may be such a risk that when the ink cartridge is swung, the ink is attached on the upper surface or side wall of the container 1 and the actuator 106 is malfunctioned by the ink running from the upper surface and side wall of the container 1 contacting with the actuator 106. However, as to the mold structure body 600, since the mold portion 364 is projected into the interior of the container 1, the actuator 106 is not malfunctioned by the ink running from the upper surface and side wall of the container 1.

Figure 39:
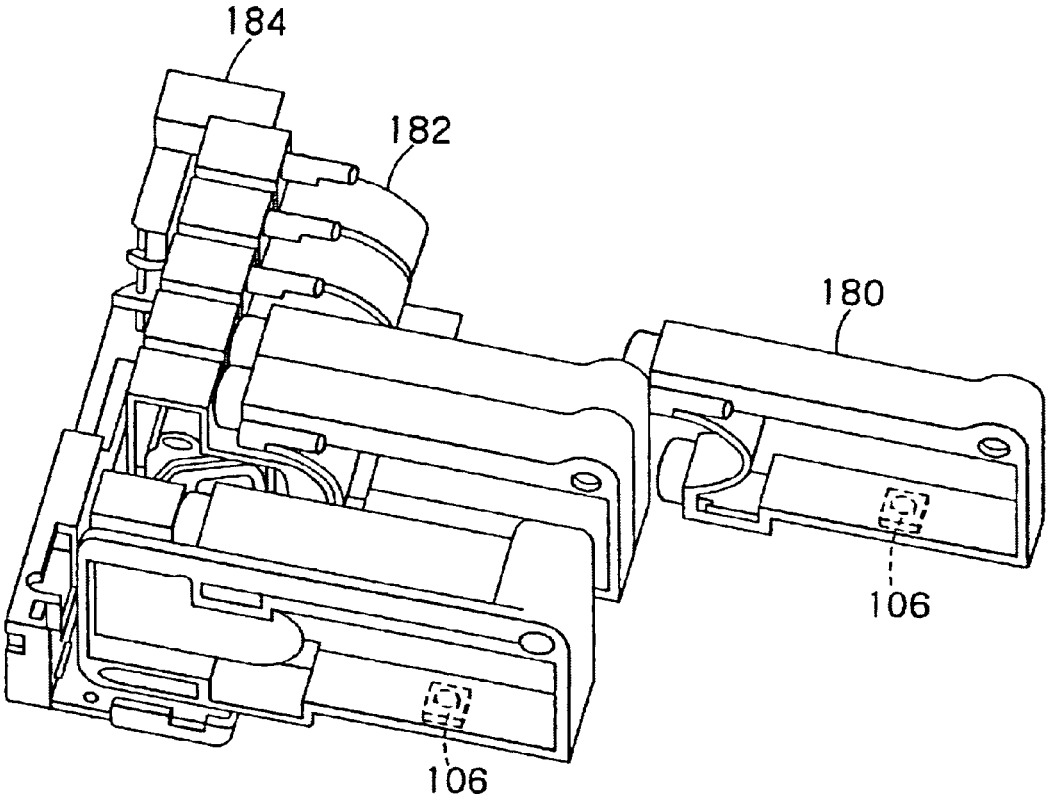
FIG. 39 is a perspective view showing an embodiment of an ink cartridge and an ink jet recording apparatus using the actuator 106 shown in FIG. 20A, FIG. 20B, FIG. 20C and FIG. 21.

FIG. 39 shows an embodiment of an ink cartridge and an ink jet recording apparatus by employing the actuator 106 shown in FIG. 20A, FIG. 20B and FIG. 20C. The multiple ink cartridges 180 are mounted on an ink jet recording apparatus having the multiple ink inlet portions 182 and the holders 184 corresponding to the respective ink cartridges 180. The multiple ink cartridges 180 contain the respective different kinds, for example, inks of different colors. The actuator 106 which is means for detecting at least acoustic impedance is mounted on the respective bottom surfaces of the multiple ink cartridges 180. An ink remaining volume within the ink cartridge 180 can be detected by mounting the actuator 106 on the ink cartridge 180.

Figure 40:
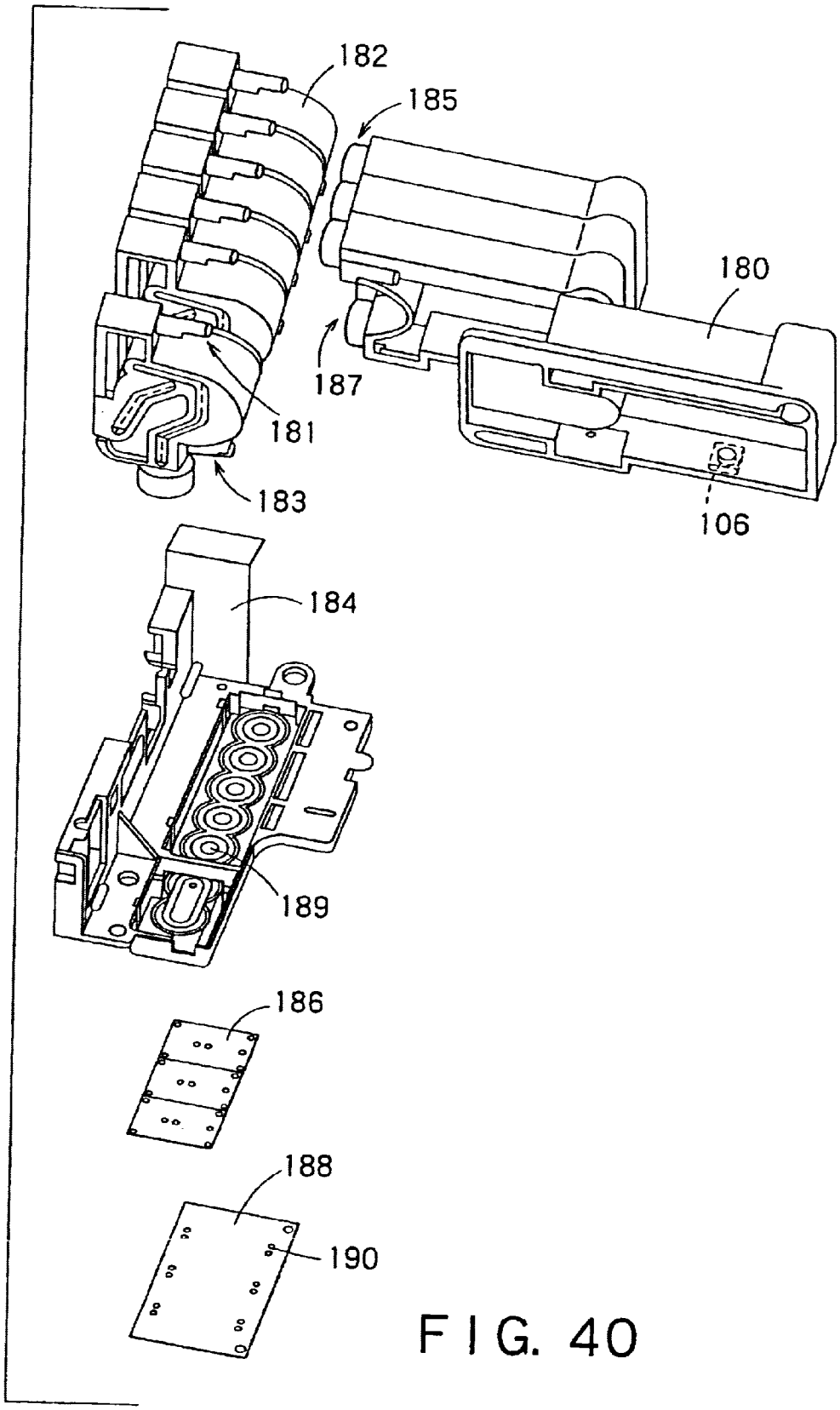
FIG. 40 is a view showing the details of an ink jet recording apparatus.

FIG. 40 shows the details of the periphery of a head portion of an ink jet recording apparatus. The ink jet recording apparatus has an ink inlet portion 182, a holder 184, a head plate 186, and a nozzle plate 188. Multiple nozzles 190 for injecting the ink are formed on the nozzle plate 188. The ink inlet portion 182 has an air supplying opening 181 and the an inlet 183. The air supplying opening 181 supplies air to the ink cartridge 180. The ink inlet 183 introduces the ink from the ink cartridge 180. The ink cartridge 180 has an air inlet 185 and an ink supplying opening 187. The air supplying inlet 185 introduces the air from the air supplying opening 181 of the ink inlet portion 182. The ink supplying opening 187 supplies the ink to the ink inlet 183 of the ink inlet portion 182. The ink cartridge 180 introduces the air form the ink inlet portion 182, thereby urging the ink supplying from the ink cartridge 180 to the ink inlet portion 182. The holder 184 communicates the ink supplied from the ink cartridge 180 via the ink inlet portion 182 to the head plate 186.

Figure 41A:
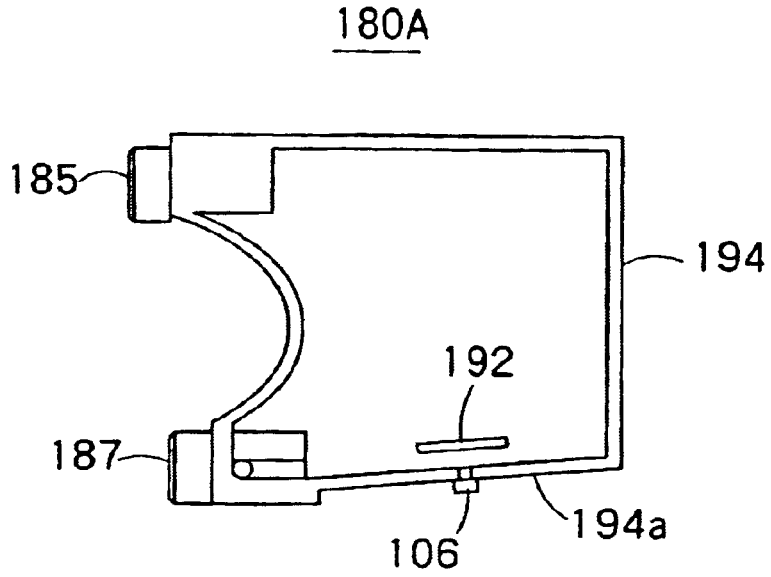
FIG. 41A and FIG. 41B are views showing another embodiment of an ink cartridge 180 shown in FIG. 40.
Figure 41B:
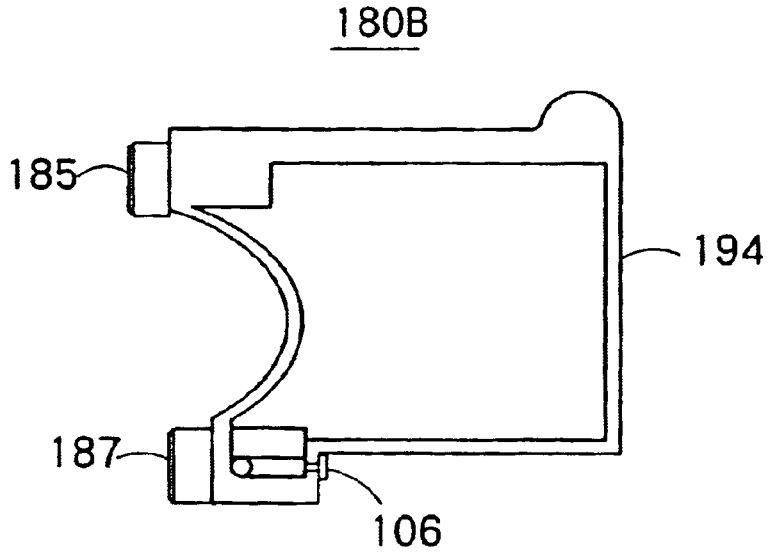

Another embodiment of the ink cartridge 180 shown in FIG. 41A, FIG. 41B and FIG. 40 is shown.

In the ink cartridge 180 of FIG. 41A, the actuator 106 is mounted on the bottom surface 194*a* formed in vertically a slanting manner. Inside of the ink container 194 of the ink cartridge 180, a breakwater wall 192 having the predetermined height from the interior bottom surface of the ink container 194 is provided at the position facing the actuator 106. Since the actuator 106 is mounted on the ink container 194 in vertically slanting manner, the ink is drained well.

A gap filled with the ink is formed between the actuator 106 and the breakwater wall 192. Moreover, the gap between the breakwater wall 192 and the actuator 106 is spaced not so as to hold the ink by capillary attraction. When the ink container 194 is laterally swung, a wave of the ink is generated within the ink container 194 by laterally swinging, and there may be such a risk that the actuator 106 is malfunctioned by gas or a bubble being detected by the actuator 106 due to that impact. A wave of the ink nearby the actuator 106 can be prevented and malfunction of the actuator 106 can be prevented by providing the breakwater wall 192.

The actuator 106 of the ink cartridge 180B of FIG. 41B is mounted on the side wall of the supplying opening of the ink container 194. As far as it is nearby the ink supplying opening 187, the actuator 106 may be mounted on the side wall or the bottom surface of the ink container 194. Moreover, the actuator 106 is preferably mounted at the center of the cross direction of the ink container 194. Since the ink is supplied through the ink supplying opening 187 to the external, the ink and the actuator 106 securely contacts with each other until the point in time of the ink near end by providing the actuator 106 nearby the ink supplying opening 187. Therefore, the actuator 106 can securely detect the point in time of the ink near end.

Furthermore, by providing the actuator 106 nearby the ink supplying opening 187, when the ink container is mounted on the cartridge holder on the carriage, the positioning of contact of the actuator 106 on the carriage is securely performed. The reason for it is because the most important thing in a coupling of the ink container and the carriage, is a secure coupling of the ink supplying opening and the supplying needle. Because if there is even slight deviation, the tip of the supplying needle is damaged or the sealing structure such as O-ring and the like are damaged, and the ink leaks. In order to prevent these problems, usually, an ink jet printer has a special structure which is capable of precisely positioning when the ink container is mounted on the carriage. Hence, by arranging an actuator nearby a supplying opening, the positioning of an actuator is also securely performed at the same time. Furthermore, a more secured positioning can be performed by mounting the actuator 106 at the center of the cross direction of the ink container 194. Because when the ink container axially rocks as a center of the center line of the cross direction at the time of mounting on the holder, the swinging of the container is the slightest.

Figure 42A:
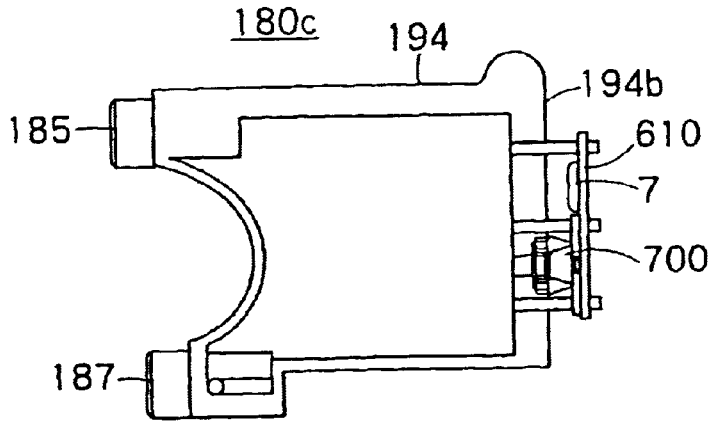
FIG. 42A, FIG. 42B and FIG. 42C are views showing still another embodiment of an ink cartridge 180.
Figure 42B:
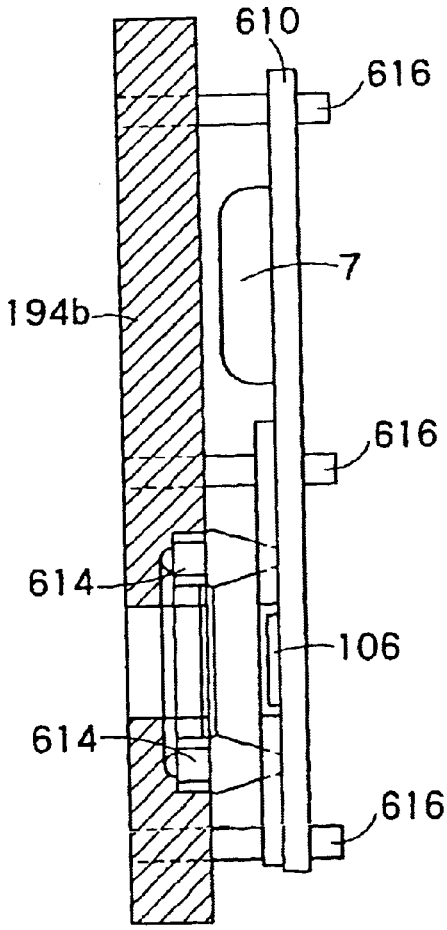
Figure 42C:
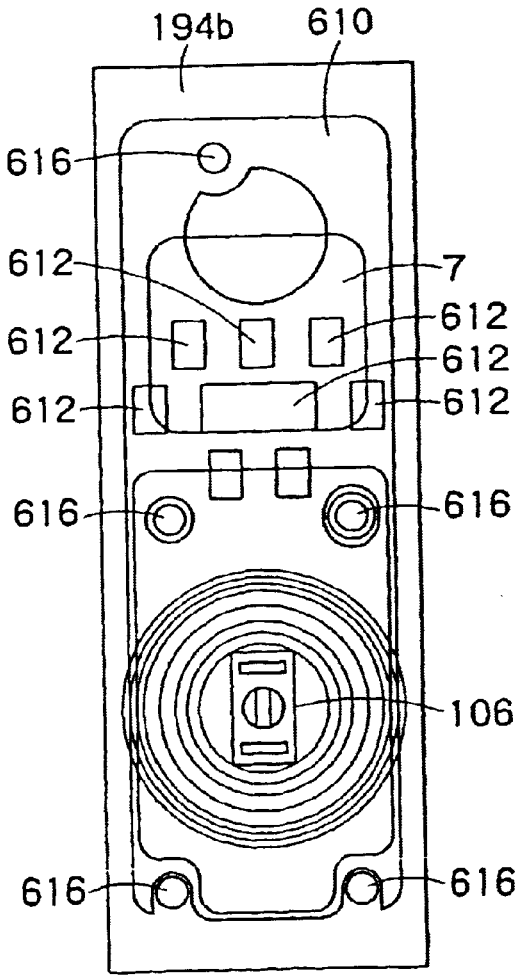

FIG. 42A, FIG. 42B and FIG. 42C show still another embodiment of the ink cartridge 180. FIG. 42A is a section view of an ink cartridge 180C, FIG. 42B is an enlarged sectional view of the side wall 194*b* of the ink cartridge 180C shown in FIG. 42A and FIG. 42C is a perspective view seen from its front. As to the ink cartridge 180C, the semiconductor storage means 7 and the actuator 106 are formed on the same circuit substrate 610.

As shown in FIG. 42B and FIG. 42C, the semiconductor storage means 7 is formed on the upper portion of the circuit substrate 610, the actuator 106 is formed on the lower portion of the semiconductor storage means 7 in the same circuit substrate 610. A special form O-ring 614 as surrounding the actuator 106 is mounted on the side wall 194*b*. On the side wall 194*b*, multiple swaging portions 616 for joining the circuit substrate 610 to the ink container 194 are formed. The circuit substrate 610 is joined to the ink container 194 by the swaging portion 616, and the special form O-ring 614 is pushed on the circuit substrate 610, thereby maintaining the external and internal of the ink cartridge in a fluid-tight manner while enabling the oscillating region of the actuator 106 to contact with the ink.

A terminal 612 is formed on the semiconductor storage means 7 and nearby the semiconductor storage means 7. The terminal 612 receives and transmits a signal between the semiconductor storage means 7 and the externals such as the ink jet recording apparatus. The semiconductor storage means 7 may be, for example, composed of a semiconductor memory capable of being programmable such as EEPROM and the like. Since the semiconductor storage means 7 and the actuator 106 are formed on the same circuit substrate 610, when the actuator 106 and the semiconductor storage means 7 are mounted on the ink cartridge 180C, only one mounting processing step is required. Moreover, the work processing steps at the time of manufacturing and recycling the ink cartridge 180C are simplified. Furthermore, since the number of the parts is reduced, the manufacturing cost of the ink cartridge 180C can be reduced.

The actuator 106 detects an ink consuming state within the ink container 194. The semiconductor storage means 7 stores ink information such as ink remaining volume detected by the actuator 106. Specifically, the semiconductor storage means 7 stores information concerning with property parameters such as ink and an ink cartridge employed at the time of detecting. The semiconductor storage means 7 stores resonance frequency as one of the property parameters when the ink within the ink container 194 is in previously a fully filled state, that is to say, when the ink is filled within the ink container 194, or when the ink is ended, that is to say, when the ink within the ink container 194 is consumed. Resonance frequency in a state where the ink is fully filled within the ink container 194 or in a state where the ink is completely consumed and ended may be stored when the ink container is for the first time mounted on an ink jet recording apparatus. Moreover, resonance frequency in a state where the ink is fully filled within the ink container 194 or in a state where the ink is completely consumed and ended may be stored when the ink container 194 is manufactured. Since the dispersion can be adjusted at the time of detecting ink remaining volumes by previously storing resonance frequency in the semiconductor storage means 7 when the ink is fully filled within the ink container 194 or when the ink is ended and by reading the data of resonance frequency on the ink jet recording apparatus side, that the ink remaining volume is reduced to the reference value can be precisely detected.

Figure 43A:
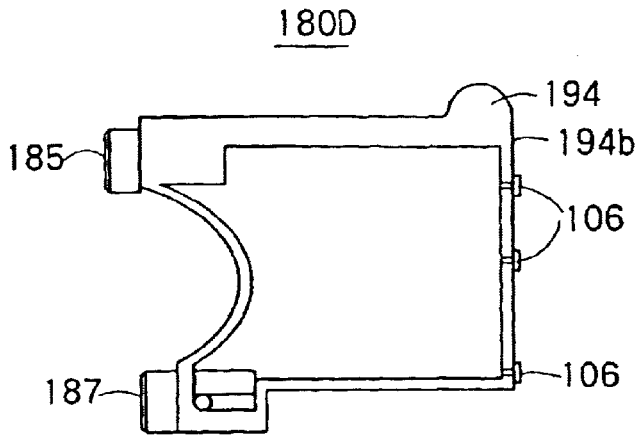
FIG. 43A, FIG. 43B and FIG. 43C are views showing still another embodiment of the ink cartridge 180.
Figure 43B:
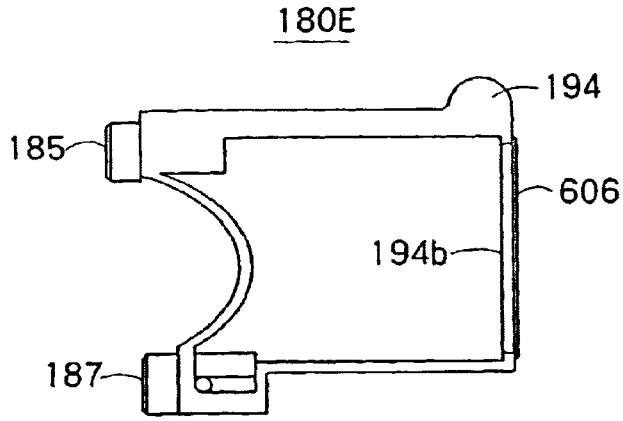
Figure 43C:
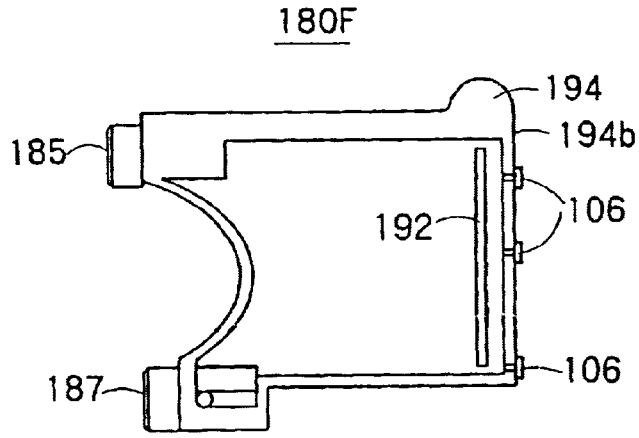

FIG. 43A, FIG. 43B and FIG. 43C show still another embodiment of the ink cartridge 180. In an ink cartridge 180D shown in FIG. 43A, the multiple actuators 106 are mounted on the side wall 194*b* of the ink container 194. It is preferably that the multiple actuators 106 integrally molded and shown in FIG. 24 are employed as these multiple actuators 106. The multiple actuators 106 are arranged on the side wall 194*b* at the intervals in the vertical direction. An ink remaining volume can be detected step by step by arranging the multiple actuators 106 on the side wall 194*b* at the intervals in the vertical direction.

In an ink cartridge 180E shown in FIG. 43B, the actuator 606 which is long in the vertical direction is mounted on the side wall 194*b* of the ink container 194. A change of an ink remaining volume within the ink container 194 can be continuously detected by the actuator 606 which is long in the vertical direction. As for the length of the actuator 606, it is preferable that it has the length of more than a half of the height of the side wall 194*b*, in FIG. 43B, the actuator 606 has the length of spanning from the approximately top end to the approximately bottom end of the side wall 194*b*.

In an ink cartridge 180F shown in FIG. 43C, similar to the ink cartridge 180D shown in FIG. 43A, the multiple actuators 106' are mounted on the side wall 194*b* of the ink container 194, and the breakwater wall 192 is provided at the predetermined interval from the multiple actuators 106 facing the breakwater wall 192 which is long in the vertical direction. It is preferably that the multiple actuators 106 integrally molded and shown in FIG. 24 are employed as these multiple actuators 106. A gap filled with the ink is formed between the actuator 106 and the breakwater wall 192. Moreover, the gap between the breakwater wall 192 and the actuator 106 is spaced not so as to hold the ink by capillary attraction. When the ink container 194 is laterally swung, a wave of the ink is generated within the ink container 194 by laterally swinging, and there may be such a risk that the actuator 106 is malfunctioned by gas or a bubble being detected by the actuator 106 due to that impact. A wave of the ink nearby the actuator 106 can be prevented and malfunction of the actuator 106 can be prevented by providing the breakwater wall 192 as the present invention. Moreover, the breakwater wall 192 prevents the bubbles generated by swinging of the ink from invading into the actuator 106.

FIG. 44A, FIG. 44B, FIG. 44C and FIG. 44D show still another embodiment of the ink cartridge 180. An ink cartridge 180G of FIG. 44A has multiple partition walls 212 extending from the upper surface 194*c* of the ink container 194 to the lower portion. Since the predetermined gap is spaced between the lower ends of the respective partition walls 212 and the bottom surface of the ink container 194, the bottom portion of the ink container 194 is communicated. The ink cartridge 180G has the multiple containing chambers 213 laid out per block by the multiple partition walls 212. The bottom portions of the multiple containing chambers 213 are communicated with each other. In the respective multiple housing chambers 213, the actuators 106 are mounted on the upper surface 194*c* of the ink container 194. It is preferably that the multiple actuators 106 integrally molded and shown in FIG. 24 are employed as these multiple actuators 106. The actuators 106 are arranged approximately at the center of the upper surface 194*c* of the housing chambers 213 of the ink container 194. The largest volume of the housing chambers 213 is the volume of the housing chamber on the side of the ink supplying opening 187, and as the housing chambers away from the ink supplying opening 187 toward the backward of the ink container 194, the volume of the housing chambers 213 are gradually smaller. Therefore, intervals at which the actuators 106 are arranged is wider on the side of the ink supplying opening 187, and the far away from the ink supplying opening 187 to the interior of the ink container 194, the narrower the intervals become.

Since the ink is drained from the ink supplying opening 187 and the air enters from the air inlet 185, the ink is consumed from the housing chamber 213 on the side of the ink supplying opening 187 to the housing chamber 213 located backward of the ink cartridge 180G. For example, the ink of the housing chamber 213 nearest from the ink supplying opening 187 is consumed, and during the ink liquid level of the housing chamber 213 nearest from the ink supplying opening 187 is lowered, the ink is filled within the other housing chambers 213. When the ink of the housing chamber 213 nearest from the ink supplying opening 187 is completely consumed, the air invades into the housing chamber 213 second numbered from the ink supplying opening 187, the ink within the second housing chamber 213 begins to be consumed, and the ink liquid level of the second housing chamber 213 begins to be lowered. At this point in time, in the housing chambers after the third housing chamber 213 numbered from the ink supplying opening 187, the ink is filled. In this way, the ink is consumed in turn from the housing chamber 213 nearest from the ink supplying opening 187 to the housing chamber 213 which is far from the ink supplying opening 187.

In this way, since the actuators 106 are arranged on the upper surface 194*c* of the ink container 194 at the intervals per each housing chamber 213, the actuators 106 can detect the reduction of the ink volume step by step. Furthermore, the volume of the housing chamber 213 is gradually smaller from the volume of the housing chamber on the side of the ink supplying opening 187 to the volume of the backward of the housing chamber 213, a time interval from the point in time at which the actuator 106 detects the reduction of the ink volume to the next point in time at which the actuator 106 detects the reduction of the ink volume is gradually small, and the more it is close to the ink end, the more frequently it can detect.

Figure 44A:
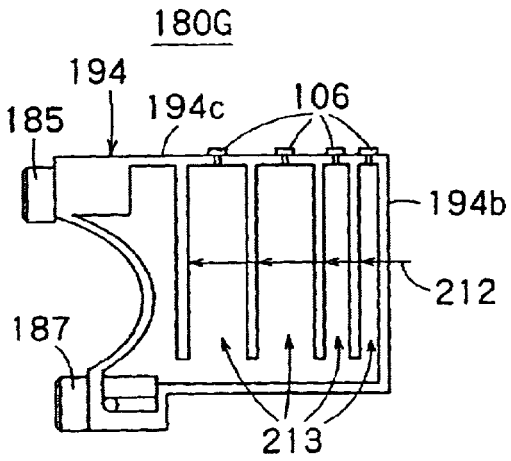
FIG. 44A, FIG. 44B, FIG. 44C and FIG. 44D are views showing still another embodiment of the ink cartridge 180.
Figure 44B:
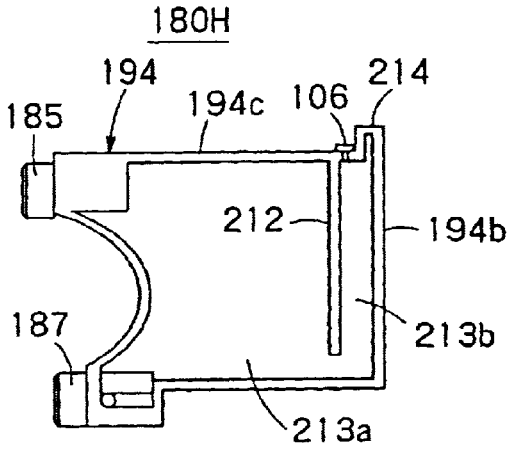

An ink cartridge 180H of FIG. 44B has one partition wall 212 extending from the upper surface 194*c* of the ink container 194 to the lower portion. Since the predetermined interval is spaced between the lower end of the partition wall 212 and the bottom surface of the ink container 194, the bottom portion of the ink container 194 is communicated. The ink cartridge 180H has two housing chambers 213*a* and 312*b* divided by the partition wall 212. The bottom portions of the housing chambers 213*a* and 313*b* are communicated with each other. The volume of the housing chamber 213*a* on the side of the ink supplying opening 187 is larger than that of the housing chamber 213*b* backward from the ink supplying opening 187. It is preferable that the volume of the housing chamber 213*b* is smaller than a half of the volume of the housing chamber 213*a*.

The actuator 106 is mounted on the upper surface 194*c* of the housing chamber 213*b*. Furthermore, in the housing chamber 213*b*, a buffer 214 which is a channel for catching bubbles entering at the time of manufacturing the ink cartridge 180H is formed. In FIG. 44B, the buffer 214 is formed as a channel extending from the side wall 194*b* of the ink container 194 to the upper portion. Since the buffer 214 catches the bubbles invaded within the ink housing chamber 213*b*, it can prevent the actuator 106 from malfunctioning to detect an ink end by the bubbles. Moreover, by providing the actuator 106 on the upper surface 194*c* of the housing chamber 213*b*, and by correcting an ink volume from the point in time when the ink near end is detected to the point in time when it is completely ink end state by corresponding to the ink consuming state in the housing chamber 213*a* grasped by dot counter, the ink can be consumed to the last. Furthermore, a consumable ink volume after the ink near end is detected can be changed by adjusting the volume of the housing chamber 213*b* by changing the lengths and intervals of the partition wall 212 and the like.

Figure 44C:
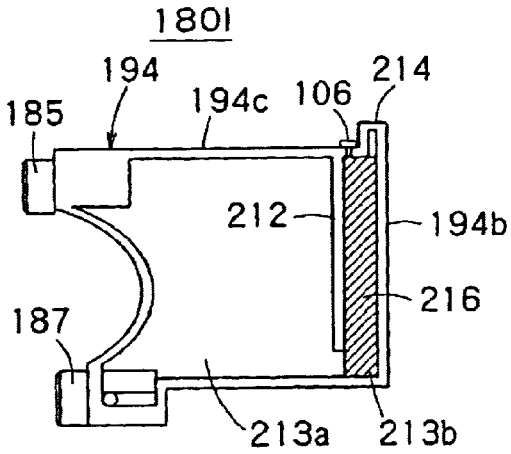

In FIG. 44C, the housing chamber 213*b* of an ink cartridge 180I of FIG. 4B is filled with a porous member 216. The porous member 216 is set so as to embed the whole space from the upper surface within the housing chamber 213*b* to the lower surface. The porous member 216 contacts with the actuator 106. When the ink container fell down or during the reciprocation movement on the carriage, the air invades the housing chamber 213*b*, thereby resulting in a risk for causing the malfunction of the actuator 106. However, if the porous member 216 is equipped with it, the porous member 216 can prevent the actuator 106 from being invaded by the air by catching the air. Moreover, since the porous member 216 holds the ink, it can prevent that the ink runs over the actuator 106 and the actuator 106 falsely detects the absence of the ink as the presence of the ink by swinging the ink container. It is preferable that the porous member 216 is set in the housing chamber 213 of the smallest volume. Moreover, the ink can be consumed to the last by providing the actuator 106 on the upper surface 194*c* of the housing chamber 213*b* and by correcting an ink volume from the point in time when the ink near end is detected to the point in time when it is in a complete ink end state. Furthermore, a consumable ink volume after the ink near end is detected can be changed by adjusting the volume of the housing chamber 213*b* by changing the lengths and intervals of the partition walls 212 and the like.

Figure 44D:
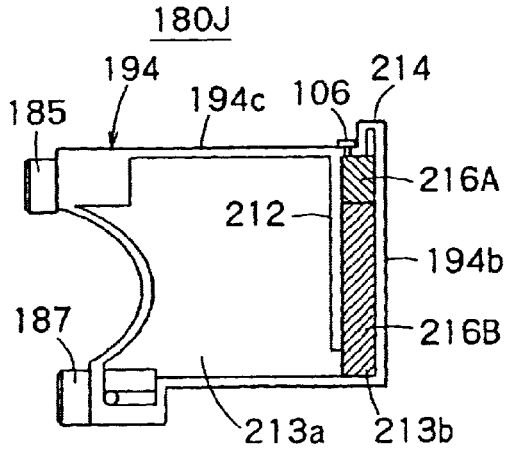

FIG. 44D shows an ink cartridge 180J composed of two kinds of porous member 216A and 216B having different pore sizes instead of the porous member 216 of the ink cartridge 180I of FIG. 44C. The porous member 216A is arranged in the upper portion of the porous member 216B. The pore size of the porous member 216A of the upper side is larger than the pore size of the porous member 216B of the lower side. Or, the porous member 216A is formed by the member whose affinity for a liquid is higher than that of the porous member 216B. Since the capillary attraction of the porous member 216B whose pore size is small is large than that of the porous member 216A whose pore size is large, the ink within the housing chamber 213*b* congregates to the porous member 216B of the lower side, and held. Therefore, once the air arrives at the actuator 106 and the absence of the ink is detected, there is no chance that the ink arrives at the actuator again and the presence of the ink is detected. Furthermore, since the ink is absorbed by the porous member 216B of the far side from the actuator 106, the ink nearby the actuator 106 is drained well, and a changing value of the acoustic impedance when the presence or absence of the ink is detected. Moreover, the ink can be consumed to the last by providing the actuator 106 on the upper surface of the housing chamber 213*b* and by correcting an ink volume from the point in time when the ink near end is detected to the point in time when the ink is in a complete ink end state.

Furthermore, a consumable ink volume after the ink near end is detected can be changed by adjusting the volume of the housing chamber 213*b* by changing the lengths and intervals of the partition walls 212 and the like.

Figure 45A:
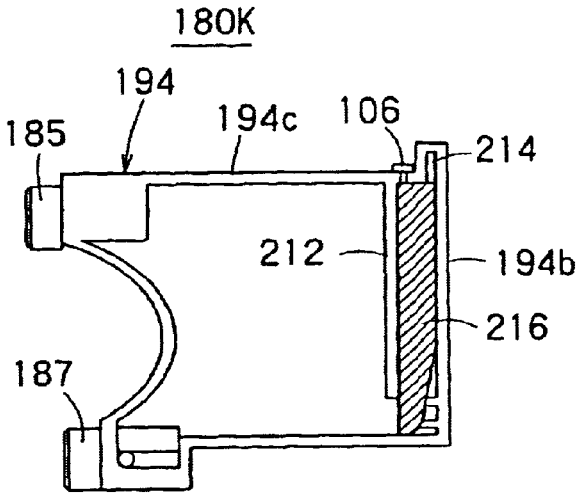
FIG. 45A, FIG. 45B and FIG. 45C are views showing another embodiment of the ink cartridge 180 shown in FIG. 44C.
Figure 45B:
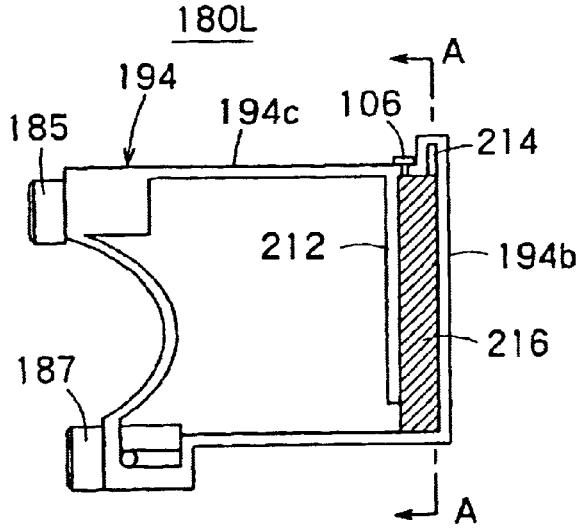
Figure 45C:
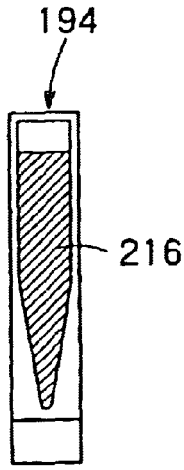

FIG. 45A, FIG. 45B and FIG. 45C are sectional views showing an ink cartridge 180K which is another embodiment of the ink cartridge 180I shown in FIG. 44C. The porous member 216 of the ink cartridge 180 shown in FIG. 45A, FIG. 45B and FIG. 45C is designed so that sectional area in the horizontal direction of the lower portion of the porous member 216 is compressed so as to be gradually smaller toward the bottom surface of the ink container 194 and its pore size is smaller toward it. In the ink cartridge 180K of FIG. 45A, a rib is provided on the side wall to compress the porous member so that the pore size of the porous member 216 of the lower side is smaller. Since the pore size of the lower portion of the porous member 216 is compressed and be small, the ink is congregated to the lower portion of the porous member 216 and held. Since the ink is absorbed by the porous member 216B of the far side from the actuator 106, the ink nearby the actuator 106 is drained well, and a changing value of the acoustic impedance when the presence or absence of the ink is detected. Therefore, it can be prevented that the ink runs over the actuator 106 mounted on the upper surface of the ink cartridge 180K by the ink swinging and the actuator 106 falsely detects the absence of the ink as the presence of the ink.

On the other hand, in an ink cartridge 180L of FIG. 45B and FIG. 45C, sectional area in the horizontal direction of the lower portion of the porous member 216 is compressed so as to be gradually smaller toward the bottom surface of the ink container 194 and its pore size is gradually smaller toward it. Since the pore size of the porous member of the lower portion is compressed and be small, the ink is congregated to the lower portion of the porous member 216 and held. Since the ink is absorbed by the porous member 216B of the far side from the actuator 106, the ink nearby the actuator 106 is drained well, and a changing value of the acoustic impedance when the presence or absence of the ink is detected. Therefore, it can be prevented that the ink runs over the actuator 106 mounted on the upper surface of the ink cartridge 180K by the ink swinging and the actuator 106 falsely detects the absence of the ink as the presence of the ink.

FIG. 46A, FIG. 46B, FIG. 46C and FIG. 46D show still another embodiment of the ink cartridge using the actuator 106. An ink cartridge 220A of FIG. 46A has a first partition wall 222 extending from the upper surface to the lower portion. Since the predetermined gap is spaced between the lower end of the first partition wall 222 and the bottom surface of the ink cartridge 220A, the ink can flow into the ink supplying opening 230 through the bottom surface of the ink cartridge 220A. On the side of the ink supplying opening 230 away from the first partition wall 222, a second partition wall 224 is formed as being stood upward from the bottom surface of the ink cartridge 220A. Since the predetermined gap is spaced between the upper end of the second partition wall 224 and the upper surface of the ink cartridge 220A, the ink can flow into the ink supplying opening 230 through the upper surface of the ink cartridge 220A.

A first housing chamber 225*a* is formed on the back side of the first partition wall 222 seen in the far side from the ink supplying opening 230 by the first partition wall 222. On the other hand, a second housing chamber 225*b* is formed on this side of the first partition wall 224 seen in the nearer side from the ink supplying opening 230 by the first partition wall 224. The volume of the first housing chamber 225*a* is larger than the volume of the second housing chamber 225*b*. The capillary pass 227 is formed by spacing only portion of a gap capable of generating the capillary phenomenon between the first partition wall 222 and the second partition wall 224. Therefore, the ink of the first housing chamber 225*a* is congregated to the capillary pass 227 by capillary attraction of the capillary pass 227. Therefore, the entrapment of gas and a bubble in the second housing chamber 225*b* can be prevented. Moreover, the ink liquid level within the second housing chamber 225*b* can be gradually and stably lowered. Since the first housing chamber 225*a* is formed on the back side of the second housing chamber 225*b* seen from the ink supplying opening 230, after the ink of the first housing chamber 225*a* is consumed, the ink of the second housing chamber 225*b* is consumed.

The actuator 106 is mounted on the side wall of the ink supplying opening 230 side of the ink cartridge 220A, that is to say, on the side wall of the ink supplying opening 230 side of the second housing chamber 225*b*. The actuator 106 detects an ink consuming state within the second housing chamber 225*b*. An ink remaining volume at the point in time nearer to the ink end can be stably detected by mounting the actuator 106 on the side wall of the second housing chamber 225*b*. Furthermore, an ink remaining volume at which point in time is made as the ink end can be freely set by changing the height at which the actuator 106 is mounted on the side wall of the second housing chamber 225*b*. Since he actuator 106 is not influenced by the ink laterally swinging of the ink cartridge 220A by supplying the ink from the first housing chamber 225*a* to the second housing chamber 225*b* through the capillary pass 227, the actuator 106 can securely measure the ink remaining volume. Furthermore, since the capillary pass 227 holds the ink, that the ink is refluxed from the second housing chamber 225*b* to the first housing chamber 225*a* is prevented.

A check valve 228 is provided on the upper surface of the ink cartridge 220A. When the ink cartridge 220A is laterally swung, it can be prevented that the ink leaks to the external of the ink cartridge 220A by the check valve 228. Furthermore, the evaporation of the ink from the ink cartridge 220A can be prevented by setting the check valve 228 on the upper surface of the ink cartridge 220A. When the ink within the ink cartridge 220A is consumed and negative pressure within the ink cartridge 220A exceeds over the pressure of the check valve 228, the check valve 228 is opened, absorbs the air into the ink cartridge 220A, and subsequently it is closed and maintains the pressure within the ink cartridge 220A at a certain level.

Figure 46A:
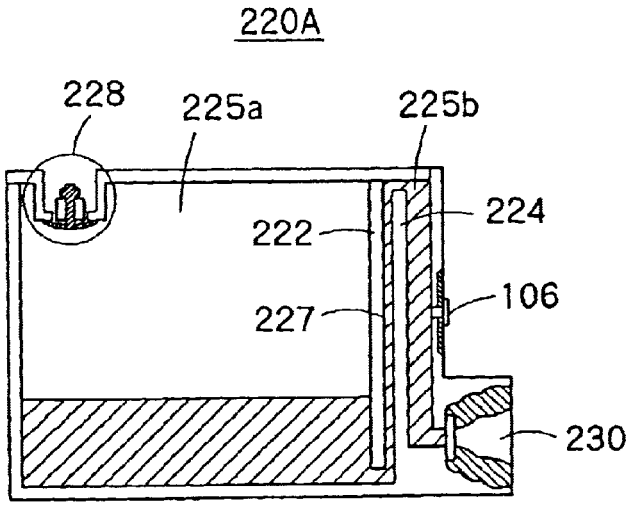
FIG. 46A, FIG. 46B, FIG. 46C and FIG. 46D are drawings showing still another embodiment of an ink cartridge using the module body 100.
Figure 46B:
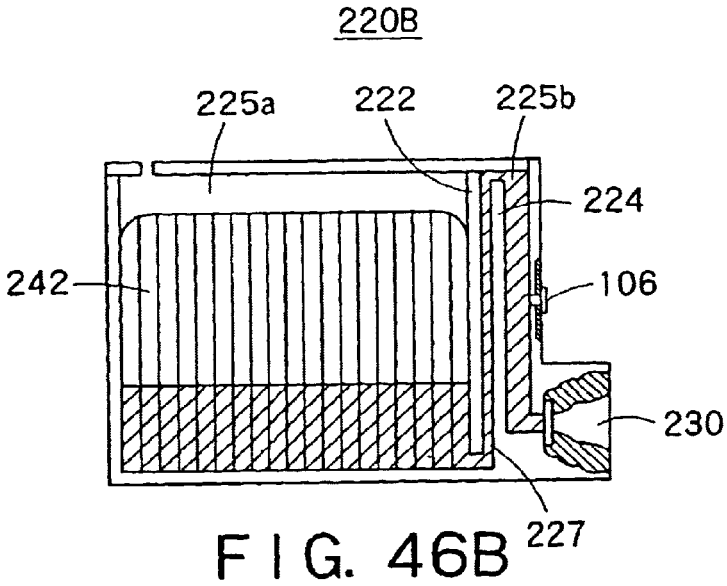
Figure 46C:
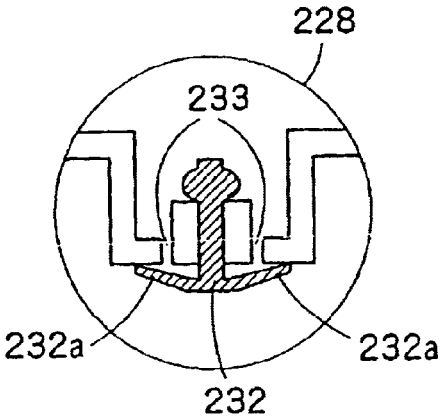
Figure 46D:
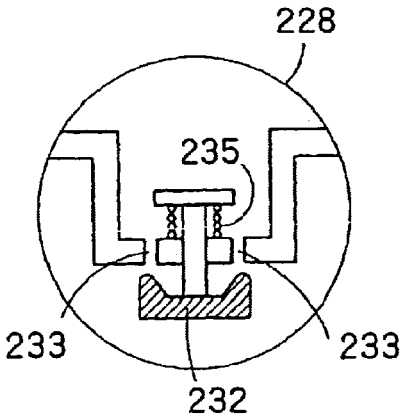

FIG. 46C and FIG. 46D show a section of the check valve 228 in detail. The check valve 228 of FIG. 46C has a valve 232 having a vane 232*a* formed with a rubber. An air hole 233 communicated with the external of the ink cartridge 220 is provided on the ink cartridge 220 as opposing to the vane 232*a*. The air hole 233 is opened and closed by the vane 232*a*. In the check valve 228, when the ink within the ink cartridge 220 is reduced and the negative pressure within the ink cartridge 220 exceeds over the pressure of the check valve 228, the vane 232*a* opens inside of the ink cartridge 220, and takes the air of the external into the ink cartridge 220. The check valve 228 of FIG. 46D has the valve 232 formed with a rubber and a spring 235. In the check valve 228, when the negative pressure within the ink cartridge 220 exceeds over the pressure of the check valve 228, the valve 232 pushes and pressurizes the spring 235 to be opened, absorbs the air of the external into the ink cartridge 220, and subsequently closed and maintains the negative pressure within the cartridge 220 at a certain level.

In an ink cartridge 220B of FIG. 46B, instead of providing the check valve 228 in the ink cartridge 220A of FIG. 46A, the porous member 242 is arranged. The porous member 242 prevents that the ink leaks to the external of the ink cartridge 220B when the ink cartridge 220B is laterally swung as well as the porous member 242 holds the ink within the ink cartridge 220B.

Up to this point, although the case where the actuator 106 is mounted on an ink cartridge which is mounted on the carriage in the ink cartridge separate from the carriage or in the case where the actuator 106 is mounted on a carriage in the ink cartridge separate from the carriage has been described, the actuator 106 may be mounted on an ink tank which is integrated with a carriage and mounted on an ink jet recording apparatus along with the carriage. Furthermore, the actuator 106 may be mounted on off carriage type an ink tank, separated from the carriage, from which the carriage is supplied with the ink via a tube or the like. Still furthermore, an actuator of the present invention may be mounted on an ink cartridge composed of a recording head and an ink container being integrated and exchangeable.

[Combination of Actual Consuming State Detection and Estimate Consuming State Calculation]

Up to this point, various kinds of ink cartridges equipped with an ink consumption detection function of the present embodiment have been described. These ink cartridges had a liquid sensor (actuator or so forth) composed of a piezoelectric device. An actually occurred consuming state, that is to say, an actual consuming state is detected by employing a liquid sensor. In the present embodiment, the consuming state is further estimated. The ink consumption is ink consumption due to the printing or recording head maintenance, either both of them may be estimated or one of them may be estimated. In the present embodiment, mainly, an estimate processing on the basis of an amount of printing as an amount of operation of an ink jet recording apparatus will be described. The consuming state found in this way is referred to as an estimate consuming state. An ink consuming state is found more precisely and in detail by combining the detection of an actual consuming state and the calculation of an actual consuming state. Hereinafter, a preferable configuration in which an actual consuming state and an estimate consuming state are combined will be described.

Figure 47:
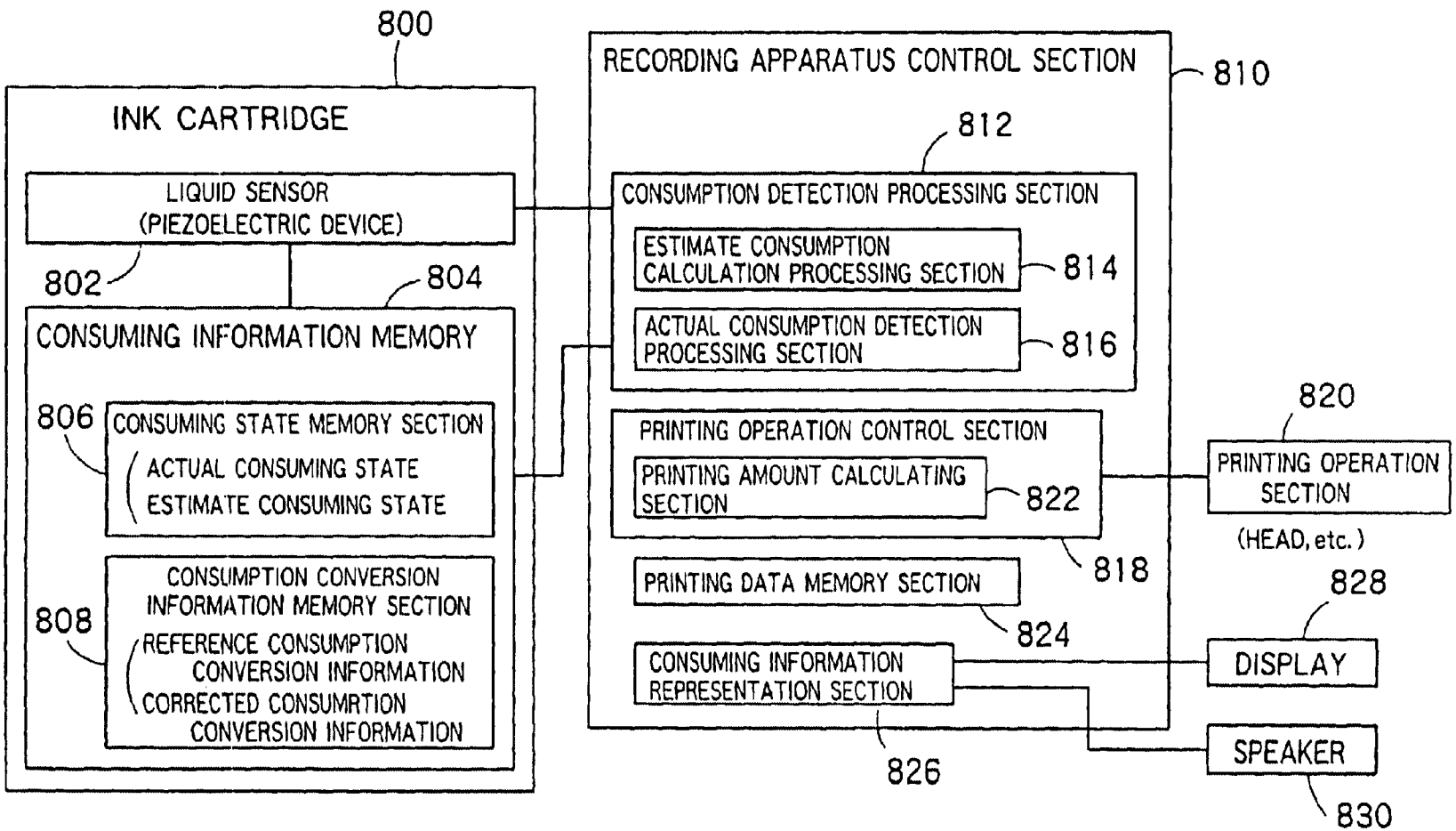
FIG. 47 is a block diagram showing a constitution of employing both of an estimate consumption calculation and an actual consumption detection in combination and an ink jet recording apparatus as well.

FIG. 47 shows a configuration of a system having an ink consuming detection function of the present embodiment. An ink cartridge 800 corresponds to, for example, the cartridge of FIG. 1. The ink cartridge 800 has a liquid sensor 802 and a consuming information memory 804. The liquid sensor 802 is composed of a piezoelectric device. Concretely, the liquid sensor 802 is composed of the above-described elastic wave generation means or an actuator, and outputs a signal corresponding to an ink consuming state. The consuming information memory 804 is a rewritable memory of EEPROM and the like, and corresponds to the above-described semiconductor storage means (FIG. 1, the reference numeral 7).

A recording apparatus control section 810 is composed of a computer for controlling an ink jet recording apparatus. The ink jet recording apparatus may be equipped with the recording apparatus control section 810. Moreover, an external apparatus such as another computer connected to the recording apparatus is equipped with one or whole of functions of the recording apparatus control section 810.

The recording apparatus control section 810 has a consumption detection processing section 812. The ink consumption detection apparatus is composed of the consumption detection processing section 812, the liquid sensor 802 and the consuming information memory 804. The consumption detection processing section 812 finds a consuming state by employing the liquid sensor 802 and the consuming information memory 804. Then, the consuming state which has been found is stored in the consuming information memory 804.

The recording apparatus control section 810 further includes a printing operation control section 818, a printing data storage section 824 and a consuming information presentation section 826. These configurations will be described later.

The consumption detection processing section 812 of the recording apparatus control section 810 includes an estimate consumption calculation processing section 814 and an actual consumption detection processing section 816. The actual consumption detection processing section 816 detects an actual consuming state by controlling the liquid sensor 802, and writes the actual consuming state in the consuming information memory 804. The actual consuming state is detected according the afore-mentioned principle. For example, in order to detect an actual consuming state on the basis of acoustic impedance, the actual consumption detection processing section 816 drives a piezoelectric element of the liquid sensor 802. The piezoelectric element outputs a signal indicating a residual oscillation state following the oscillation is generated. An actual consuming state is detected on the basis of the residual oscillation state changing corresponding to an ink consuming state.

In the present embodiment, particularly, whether or not the ink liquid level passes through the liquid sensor 802 is detected as an actual consuming state. An output signal of the sensor largely changes prior to and after the liquid level portion passes through. Therefore, the passage of the liquid level portion is securely found. Hereinafter, a state prior to the passage of the liquid level portion is referred to as "a state of the presence of the ink" and a state after the passage of the liquid level portion is referred to as "a state of the absence of the ink".

On the other hand, the estimate consumption calculation processing section 814 finds an estimate consuming state based on an ink consumption of the ink cartridge 800. The ink is consumed by printing and the maintenance operation of the recording head. Hence, preferably, an ink consuming volume is found from the number of ink droplets used by printing and the number of times of the maintenance. However, within the scope of the present invention, an ink consuming volume may be found from any one of them. Now, a processing in which an ink consuming volume is found from an amount of the printing will be mainly described below.

Specifically, the estimate consumption calculation processing section 814 finds an estimate consuming state by calculating an ink consuming state on the basis of an amount of printing when the ink of the ink cartridge 800 is used. An amount of printing is found by a printing amount calculation section 822 of a printing operation control section 818 and given to the estimate consumption calculation processing section 814. The printing operation control section 818 receives the printing data and controls the printing using the head and the like. Therefore, the printing operation control section 818 can grasp the amount of printing. If the amount of printing is grasped, an ink consuming volume corresponding to the amount of printing can be estimated. The estimate consuming state thus found is, similar to the actual consuming state, also stored in the consuming information memory 804 of the ink cartridge 800.

Consumption conversion information is employed for an estimate of a consuming volume. Consumption conversion information is information indicating between an amount of printing as an amount of operation of an ink jet recording apparatus and an estimate consuming state. In the present embodiment, as consumption conversion information, an ink volume (ink volume per droplet) corresponding to ink droplets ejected from the recording head is employed. In this case, the number of printing dots corresponds to an amount of printing. A consuming volume is estimated by multiplying an ink volume per droplet solely by portion of the number of dots.

It should be noted that as it is clear from the described above, the number of dots is proportional to the ink consuming volume. Therefore, the number of dots may be treated as a parameter directly indicating an ink consuming volume.

Furthermore, it is preferable that an estimate of a consuming volume is performed on the basis of the size of an ink droplet. It is known that the recording apparatus ejects a plurality of sizes of ink droplets according to printing data. An ink volume per droplet differs depending on the size of an ink droplet. Therefore, more precise estimation can be performed by employing different conversion values corresponding to the sizes.

For example, supposing that three kinds of largeness a, b and c of ink droplets are ejected. Supposing that ink volumes of each ink droplet are Va, Vb and Vc. And suppose that the accumulated numbers of ejections of each ink droplet have been Na, Nb and Nc, respectively. In the case, the ink consuming volume is represented as the following:

$Va \cdot Na + Vb \cdot Nb + Vc + Nc$.

In such a consumption estimation processing, since the number of dots are multiplied and added by employing software means, this processing can be also referred to as soft account processing.

Conversion information for finding an estimate consuming state is stored in the consuming information memory 804 of the ink cartridge 800. In the consuming information memory 804, consumption conversion information storage section 808 for storing conversion information is provided.

By the way, in general, consumption conversion information includes an error in some degree. The main causes of this error are dispersion of discharging amount of the head, individual differences of ink cartridges and ink jet recording apparatus, conditions for use and their combinations. For example, an ink volume per dot differs due to the variation of ink viscosities among lot numbers. Hence, in the consumption conversion information storage section 808, the reference consumption conversion information and the corrected consumption conversion information are stored. The reference consumption conversion information is the standard conversion information. The corrected consumption conversion information is obtained by correcting the reference consumption conversion information based on the actual consuming state when the actual consuming state is detected by employing the liquid sensor 802.

Until the corrected consumption conversion information is obtained, the reference consumption conversion information is used. When the corrected consumption conversion information is obtained, its corrected value is used. Owing to this, a more precise detection becomes possible.

Figure 48:
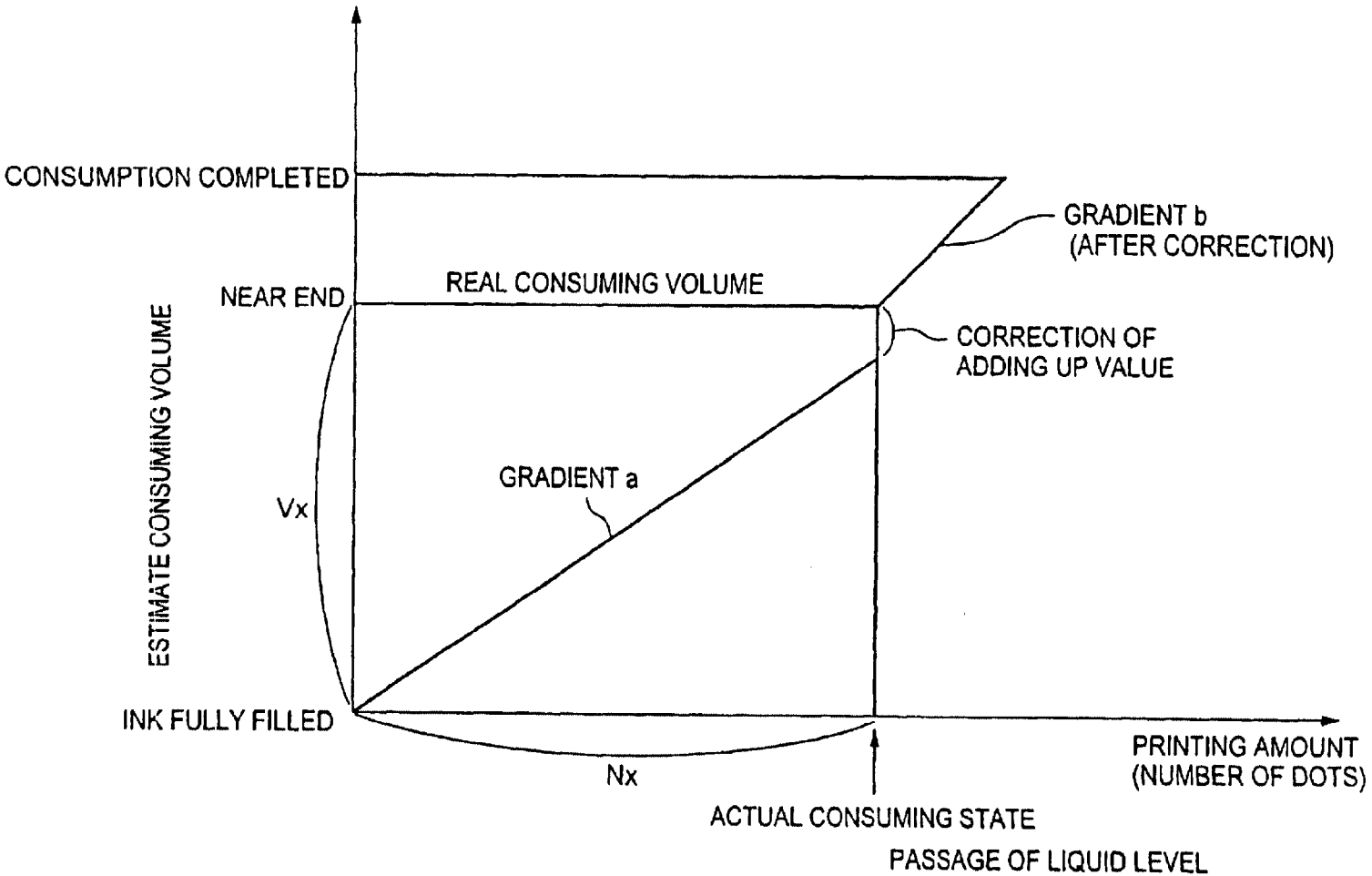
FIG. 48 is a graph showing a consumption detection processing by employing the constitution of FIG. 47.

FIG. 48 shows an embodiment of ink consumption detection according to the present embodiment. In FIG. 48, the correction processing of the consumption conversion information is also shown. An ink fully filled state is a state at the time when the usage of a cartridge is started and value of the ink consuming volume is zero. First, although an estimate consuming volume is found by multiplying the number of dots by means of the estimate consumption calculation processing section 814, where the reference consumption conversion information which has been read from the consuming state storage section 806 is employed.

As afore-mentioned, an estimate consuming volume is the product of the number of printing dots and an ink volume per dot (conversion information). Therefore, an estimate consuming volume is increase in proportion to the number of dots. The gradient (a) of the estimate consuming volume corresponds to conversion information.

When the ink consumption progresses, the ink liquid level arrives at the liquid sensor 802. At this time, the liquid sensor 802 detects the passage of the liquid level portion as an actual consuming state. The actually measured ink consuming volume at the time of passage of the liquid level is a volume of the cartridge whose liquid level is above the liquid sensor 802 and it is previously understood. It is preferable that this information is stored in the consuming information memory 804. The liquid sensor 802 is preferably provided at the position of the liquid level when the ink remaining volume is reduced. Owing to this, the liquid sensor 802 detects the passage of the liquid level in the ink near end state as an actual consuming state.

As shown in FIG. 48, when an actual consuming state is detected, an error is generated between the actually measured consuming volume and the estimate consuming volume (adding up value of the ink volume per droplet). This is because the conversion value used for estimate processing is different from the actually occurred value. Hence, at the time when the actual consuming state is detected, an estimate consuming volume which is adding up value is corrected to the actually measured value. The corrected value is stored in the consuming state storage section 806 of the consuming information memory 804.

Furthermore, the conversion information is also corrected based on the actual consuming state. Supposing that the number of dots from the ink fully filled state to the passage of the liquid level is Nx. Moreover, suppose that a consuming volume from the ink fully filled state to the passage of the liquid level is Vx. In this case, the corrected conversion information is Vx/Nx. The corrected conversion information is stored in the consuming conversion information storage section 808 of the consuming information memory 804.

After the actual consuming state is detected, the consuming volume is again estimated by multiplying the number of dots. However the subsequent consuming volume is calculated on the basis of the adding up value after the correction. Moreover, in the calculation of the consuming volume, the conversion information after the correction is employed. Specifically, the gradient of the estimate consuming volume after the correction in FIG. 48 is Vx/Nx, which is described above.

In this way, the corrected data is employed, and owing to this, an ink consuming state can be precisely found from the point in time of the ink near end to the point in time of the consumption completion.

Particularly when the volume of the ink is small, it is more important that the ink consuming volume is precisely detected compared to the point in time when the volume of the ink is large. According to the present embodiment, since the estimate consuming volume and the conversion information are corrected at the point in time of the ink near end state, these requirements can be appropriately dealt with. Owing to this, the poor printing due to the deficiency of the ink can be prevented. Moreover, the appropriate timing of the exchange of the cartridge can be acknowledged to the user.

Figure 49:
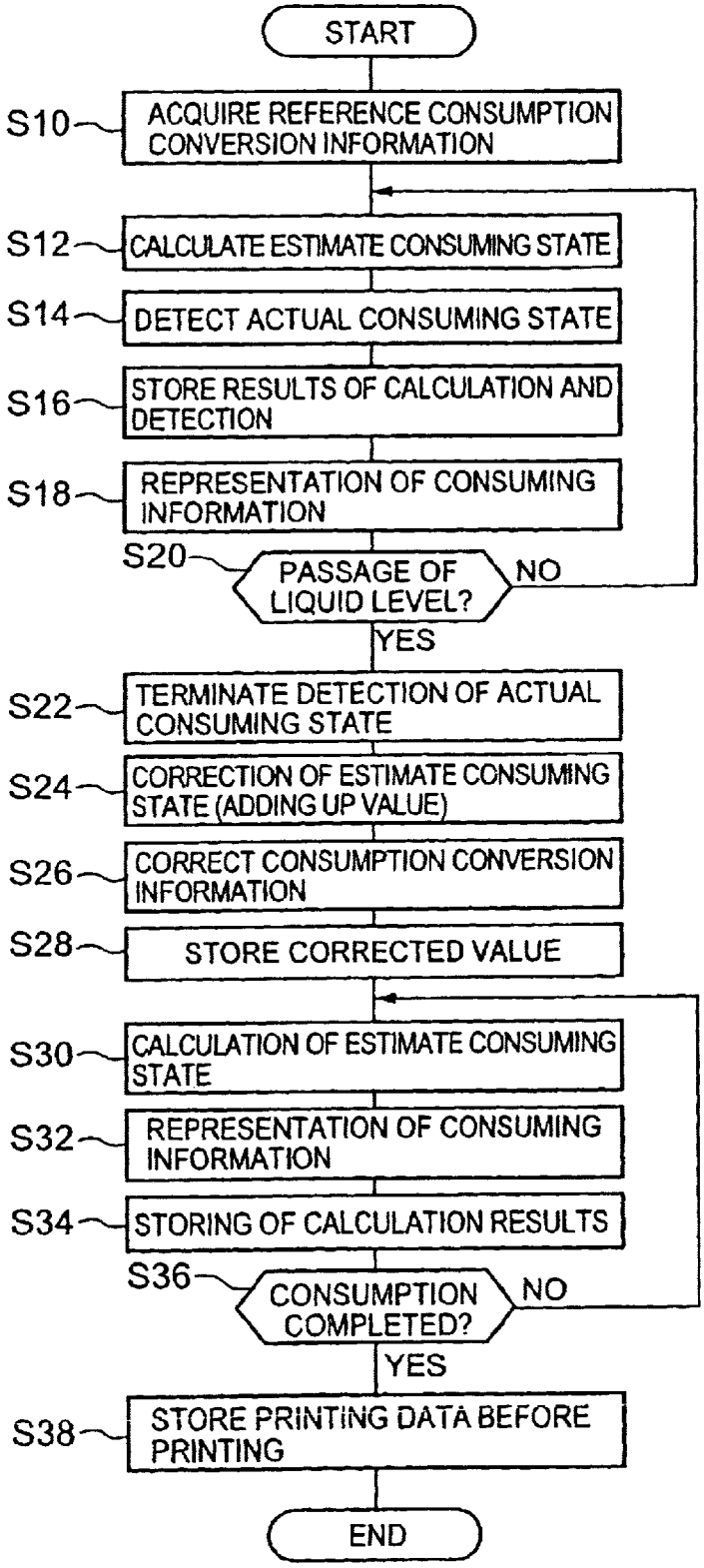
FIG. 49 is a flowchart showing a consumption detection processing by employing the constitution of FIG. 47.

FIG. 49 shows a detection processing by the consumption detection processing section 812. When the ink cartridge 800 is mounted, the reference consumption conversion information is acquired from the consumption conversion information storage section 808 (S10). Then, the estimate consuming state is calculated by the estimate consumption calculation processing section 814 (S12). Moreover, the actual consuming state is detected using the liquid sensor 802 by the actual consumption detection processing section 816 (S14). Until the ink liquid level arrives at the liquid sensor 802, "a state of the presence of the ink" is detected as an actual consuming state.

An actual consuming volume may be detected at the appropriate intervals. Moreover, when the estimate consuming volume is small, the frequency of the detection is made less, and when the estimate consuming volume arrives at the predetermined switching value, the frequency of the detection is made more. Or, until the estimate consuming volume arrives at the predetermined switching value, the actual consuming state may not be detected.

The predetermined switching value is set at the appropriate value before the ink liquid level arrives at the liquid sensor 802. Preferably, the predetermined switching value is a consuming volume at the point in time when the ink liquid level approaches to the liquid sensor 802. The switching value is set so that the difference between a consuming volume at the time of switching and a consuming volume at the time of the passage of the liquid level is larger than the maximum error of the estimate consuming volume at the time of the passage of the liquid level.

Owing to these processings, an actual consumption detection when the possibility of the detection of the passage of the liquid level is low is suppressed. Therefore, operations of the piezoelectric device and the processings for those operations can be made less. The piezoelectric devices can be efficiently utilized.

Returning to FIG. 49, after the step S14, the calculation results of the estimate consuming volume and the detection results of the actual consuming state are stored in the consuming state storage section 806 (S16). Next, the consuming information is represented to the user (S18). The processing of the step S18 is performed by the consuming information representation section 826 of the recording apparatus control section 810 (FIG. 47). This processing will be further described later.

Next, whether or not the passage of the liquid level is detected as an actual consuming state is determined (S20). If it is indicated as NO, returns to the step S12. In the next routine, the results are obtained by adding the subsequent consuming volume to the estimate consuming volume of the last time as an estimate consuming volume.

In the step S20, in the case where YES is indicated, the detection of an actual consuming state using the liquid sensor 802 is terminated (S22). When the liquid level passes through the sensor, the actual consuming state is switched from the state of presence of the ink to the state of absence of the ink. Subsequently, the state of absence of the ink is continuously detected. Therefore, it is not necessary any more to detect the actual consuming state. Hence, the detection of the actual consuming state is terminated. Owing to these processings, the operations of the piezoelectric devices and the processings for those operations can be made less, and accordingly, the piezoelectric devices can be efficiently utilized.

Next, as described using FIG. 48, in the step S24, the estimate consuming state (adding up value) is corrected, in the step S26, the consuming conversion information storage section 808 is stored (S28).

In the step S30, an estimate consuming state is calculated similarly to the S12. However, differing from the step S12, the conversion information after the correction is employed. Moreover, subsequent consuming volumes are calculated by defining the consuming state corrected in the step S24 as the reference. Then, in the step S32, the consuming state is represented to the user, in the step S34, the calculation results of the consuming volume are stored in the consuming state storage section 806. In the step S36, whether or not the estimate consuming volume arrives at the whole volume of the ink (consumption completed or not) is determined, if it is indicated as NO, returns to the step S30. In the consumption is completed, that is to say, in the case where the ink is absent, the printing data prior to the printing is saved (S38).

[Estimation of Consuming Volume During Maintenance]

In the above-described processings, an ink consuming volume is found from the number of droplets. By the way, in the ink jet recording apparatus, the maintenance processing of the recording head is carried out in the appropriate intervals. Also in the maintenance processing, the ink is consumed, it is possible that its consuming volume is large not to be negligible. Hence, it is preferable to consider the consuming volume due to the maintenance.

Preferably, the recording apparatus control section transmits the performance of the maintenance processing to the estimate consumption calculation section. An ink consuming volume per one performance of the maintenance is stored in the consumption conversion information storage section. The estimate consumption calculation processing section multiplies the performance times of the maintenance by the consuming volume per each time. Owing to this, an ink consuming volume due to the ink consuming volume is found. The sum of the consuming volume due to this maintenance performance and the consuming volume found from the ink droplets is found as the estimate consuming volume.

As described above, an ink consuming volume may be represented by the number of ink droplets. Both are proportional to each other. In this case, the consuming volume due to the maintenance may be converted into the number of the ink droplets. This converted number of droplets is added to the number of the ink droplets used for printing. The added number of droplets is treated as a parameter representing an ink consuming volume.

In this way, according to the present embodiment, in addition to the ink consuming volume by printing, an ink consuming volume due to the maintenance is also estimated, an ink consuming state is estimated in a more precise manner.

It should be noted that it is similar to that in another embodiment described later involving with this maintenance processing.

[Utilization of Consuming State]

Next, a constitution for utilizing the consuming state obtained as described above will be described below. Referring to FIG. 47, the printing operation control section 818 is a control section for controlling the printing operation section 820, and realizes the printing according to the printing data. The printing operation section 820 includes a printing head, a head movement apparatus, a form feed apparatus and the like. As described above, the printing amount calculation section 822 of the printing operation control section 818 gives the amount of printing for estimating an ink consuming volume to the consumption detection processing section 812.

The printing operation control section 818 operates on the basis of the consuming state information detected by the consumption detection processing section 812. In the present embodiment, when the absence of the ink is determined from the estimate consuming volume, the operations of consuming the ink such as printing operation and maintenance operation are stopped. Then the printing data prior to the printing is stored in the printing data storage section 824. This printing data is printed after a new ink cartridge is mounted. This processing corresponds to the step S38 of FIG. 49.

It should be noted that it is preferable to determine the absence of the ink in a state where the appropriate slight ink volume remains in order to prevent the poor printing due to the deficiency of the ink.

Moreover, there is a case where it is not preferable the printing is stopped on the way of printing one sheet. In this case, it is preferable to determine whether or not the ink is deficient on the basis of one sheet of the paper as the reference. For example, an ink volume necessary to print one sheet of the paper is appropriately set. It is determined that the ink is absent at the point in time when the remaining volume is less than its ink volume.

A similar determination may be performed on the basis of the printing data. For example, suppose that document data in bulk is printed. It is determined that the ink is absent at the point in time when the remaining volume is less than the ink volume corresponding to the number of printing sheets.

In another processing embodiment of the printing operation control section 818, when the actual consuming state is detected by the actual consumption detection processing, the remaining printable amount is calculated on the actual consuming state. When the remaining printable amount has been printed, the printing data prior to the printing is stored in the printing data storage section 824. The processing is securely performed on the basis of the actual consuming state.

In still another processing embodiment, another constitution is controlled on the basis of the detected consuming state. For example, an ink refilling apparatus, an ink cartridge exchanging apparatus and the like are provided, these apparatus may be controlled. Specifically, on the basis of the consuming state (actual consuming state and/or estimate consuming state), the necessity or an ink refilling, an ink tank exchanging, or the timing is determined, and refilling or exchange is performed according to the results of the determination. The user may be, needless to say, urged to refill the ink or exchange the ink tank.

The consuming information representation section 826 of FIG. 47 is another constitution of utilizing a consuming state. The consuming information representation section 826 represents the consuming state information detected by the consumption detection processing section 812 to the user using a display 818 and a speaker 820. On the display 818, graphical forms showing the consuming state and the like are displayed, acknowledging sound or synthetic voice is outputted. An appropriate operation may be guided by the synthetic voice.

The consuming state may be represented corresponding to the requirements of the user. Moreover, it may be represented periodically at appropriate intervals. Moreover, when an appropriate event, for example, events such as the start of the printing or the like is occurred, it may be represented. Moreover, when the ink remaining volume is the predetermined value, it may be automatically represented.

Figure 50:
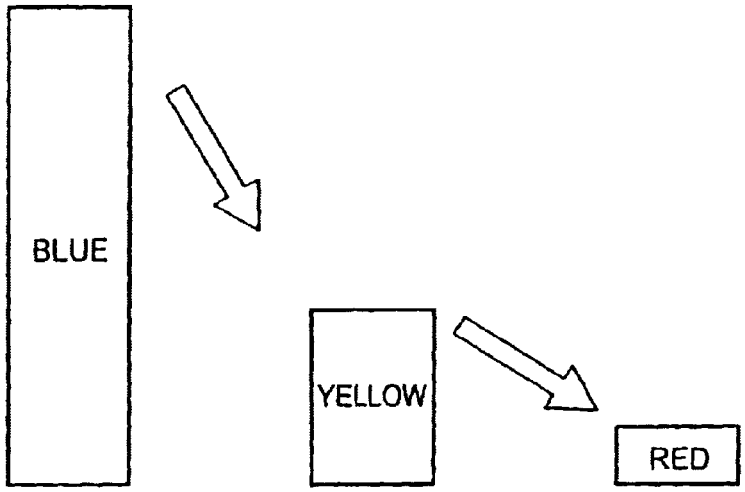
FIG. 50 is a diagram showing an embodiment of a presentation form when a consumption state is presented to the user.

FIG. 50 shows a display embodiment of a consuming state. In this form, the remaining ink volume is displayed. Preferably, the ink volume is displayed in different forms corresponding to the consuming state. Specifically, corresponding to the ink volume, the length of a bar indicating an ink volume is changed. Furthermore, as the ink volume is decreased, the color of the graphical form of the bar is changed as blue, yellow and red. The ink consuming state can clearly notified to the user.

Moreover, the display 828 is, for example, a display panel of the recording apparatus. Moreover, the display 828 may be the screen of a computer connected to the recording apparatus.

In FIG. 50, the ink remaining volume is represented. Concerned with it, the printable printing amount using the remaining ink may be found on the basis of the consuming state and represented. The printable printing amount is, for example, the number of sheet of papers. As a calculation embodiment, the printable printing amount is found by dividing the ink remaining volume by the standard ink consuming volume per one sheet of the paper.

[Arrangement of Liquid Sensor and Consuming Information Memory]

Figure 51:
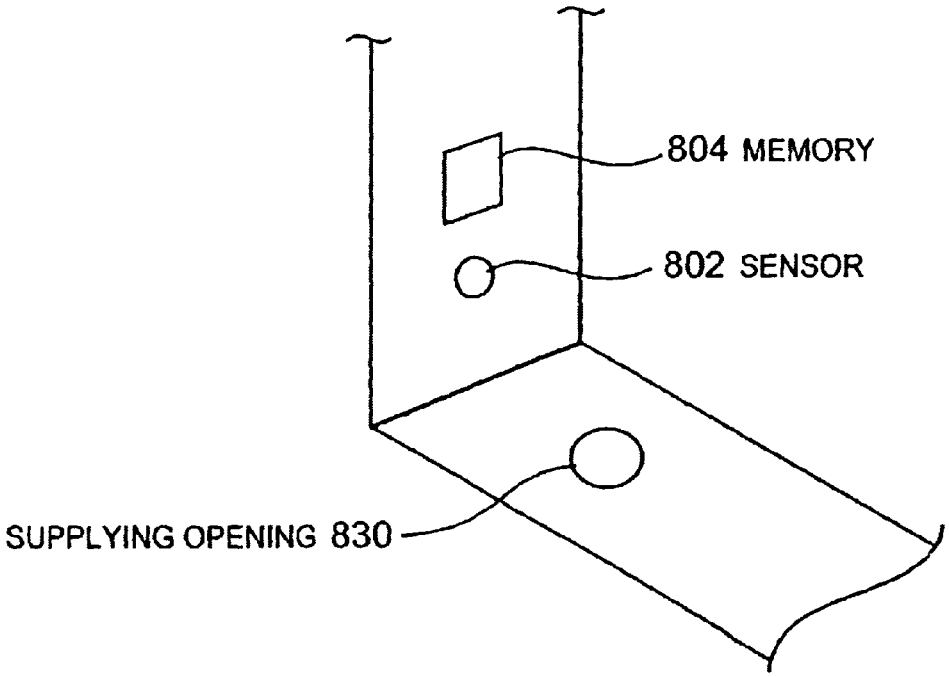
FIG. 51 is a diagram showing an embodiment of a suitable arrangement of a liquid sensor and a consumption information memory.

Referring to FIG. 51, a preferable arrangement of the liquid sensor 802 and the consuming information memory 804 will be described below. As shown in FIG. 51, the liquid sensor 802 and the consuming information memory 804 are provided nearby the ink supplying opening 840.

By this arranging, the following advantages are obtained. In general, the positioning with high precision is required in positioning the supplying opening, a configuration for positioning which satisfies the requirement is provided. For example, a projection for positioning and stopper for positioning are provided. A configuration for positioning of the supplying opening also functions as a configuration for positioning of the liquid sensor and the memory by providing the liquid sensor and memory on the wall portion nearby the supplying opening. One configuration for positioning of the supplying opening acts on the supplying opening, the liquid sensor and the memory. The precise positioning can be performed by a simple configuration. Then, the enhancement of the detection precision is realized. It should be noted that any one of the liquid sensor and the memory are provided nearby the supplying opening may be provided.

Figure 52A:
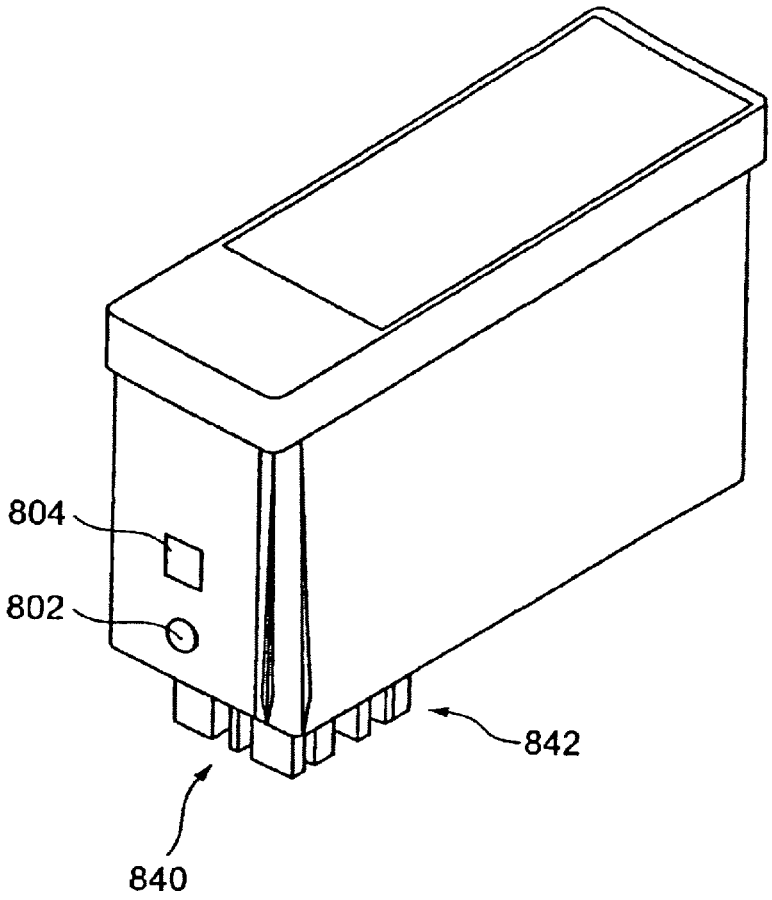
FIG. 52A and FIG. 52B are views showing an embodiment of a suitable arrangement of the liquid sensor and the consumption information memory.
Figure 52B:
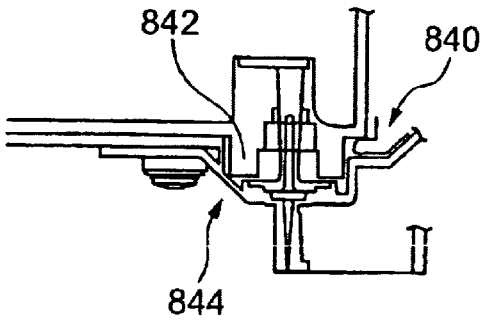

FIG. 52A and FIG. 52B show a configuration embodiment of the positioning of the supplying opening 840. A rectangular positioning projection 842 is provided on the periphery of the supplying opening 840 on the lower surface of the ink cartridge.

The positioning projection 842 is fitted into a positioning convex portion 844 on the side of the recording apparatus. The positioning convex portion 844 has a shape corresponding to the positioning projection 842.

In the above-described configuration, the liquid sensor has been provided nearby the supplying opening. However, the liquid sensor may be arranged at an appropriate location corresponding to the specification of the ink cartridge. In a preferable configuration embodiment, the inside of the ink cartridge is separated by at least one partition wall into a plurality of chambers communicating with each other. The liquid sensor is installed on the upper portion where the ink is consumed later. The volume of the chamber whose ink is used later is set to be smaller than the volume of the chamber whose ink is used earlier. These configurations have been described with reference to the drawings in the description of the ink cartridge with detection function described above.

Next, another embodiment of the present invention will be described below.

Figure 53:
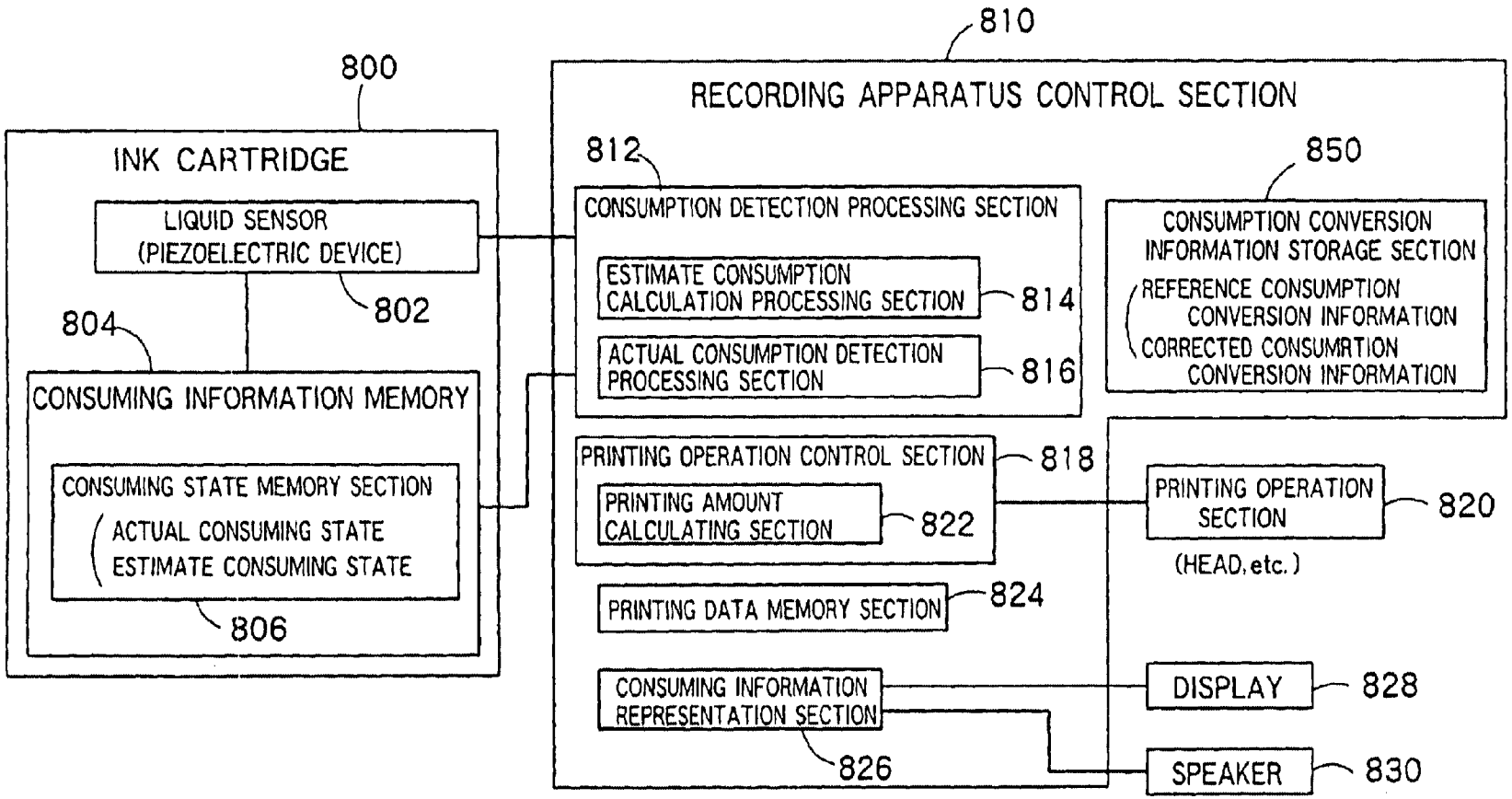
FIG. 53 is a diagram showing an embodiment of an ink jet recording apparatus of another embodiment.

FIG. 53 shows an ink jet recording apparatus having an ink consumption detection function of the present embodiment. In the present embodiment, different from the configuration of FIG. 47, a consumption conversion information storage section 850 is provided on the recording apparatus control section 810.

Suppose that in this form, the consumption conversion information is corrected on the basis of the actual consuming state when a ink cartridge is mounted. The obtained corrected consumption information conversion information is held in the consumption conversion information storage section 850 within the control section 810. When another ink cartridge is mounted, the corrected consumption conversion information of the consumption conversion information storage section 850 is read, and utilized for estimation of the ink consuming volume.

In this way, according to the present embodiment, since the consumption conversion information is held on the side of the recording apparatus, even after the ink cartridge is exchanged, the corrected consumption conversion information can be continuously utilized. The present embodiment is particularly advantageous in the case where the individual difference of the ink jet recording apparatus has an influence on the actual consumption conversion value. The individual difference between the recording apparatus typically indicates the individual difference between the recording heads.

Moreover, in this form, a plurality of ink cartridges are used, and when a plurality of performances of the correction processings are performed, the conversion information approaches to a more appropriate value. A more precise estimate processing is possible by utilizing this value.

Moreover, as a deformed form of the present embodiment, the consumption conversion information storage section 850 may be provided on still another constitution, for example, an external computer connected to the ink jet recording apparatus.

Besides those, in the present embodiment, a value (information) per cartridge ID (serial) is stored in the memory, when the same cartridge is mounted, the stored value may be read and utilized.

Moreover, as a modified embodiment of the present embodiment, the storage section of the consumption conversion information is provided on both of the ink cartridge and the recording apparatus. These storage sections may rewrite memory contents in both of them at the same time, or it may be constituted so that data is downloaded from the ink cartridge at the time when the ink cartridge is removed.

Next, still another embodiment of the present invention will be described below.

Figure 54:
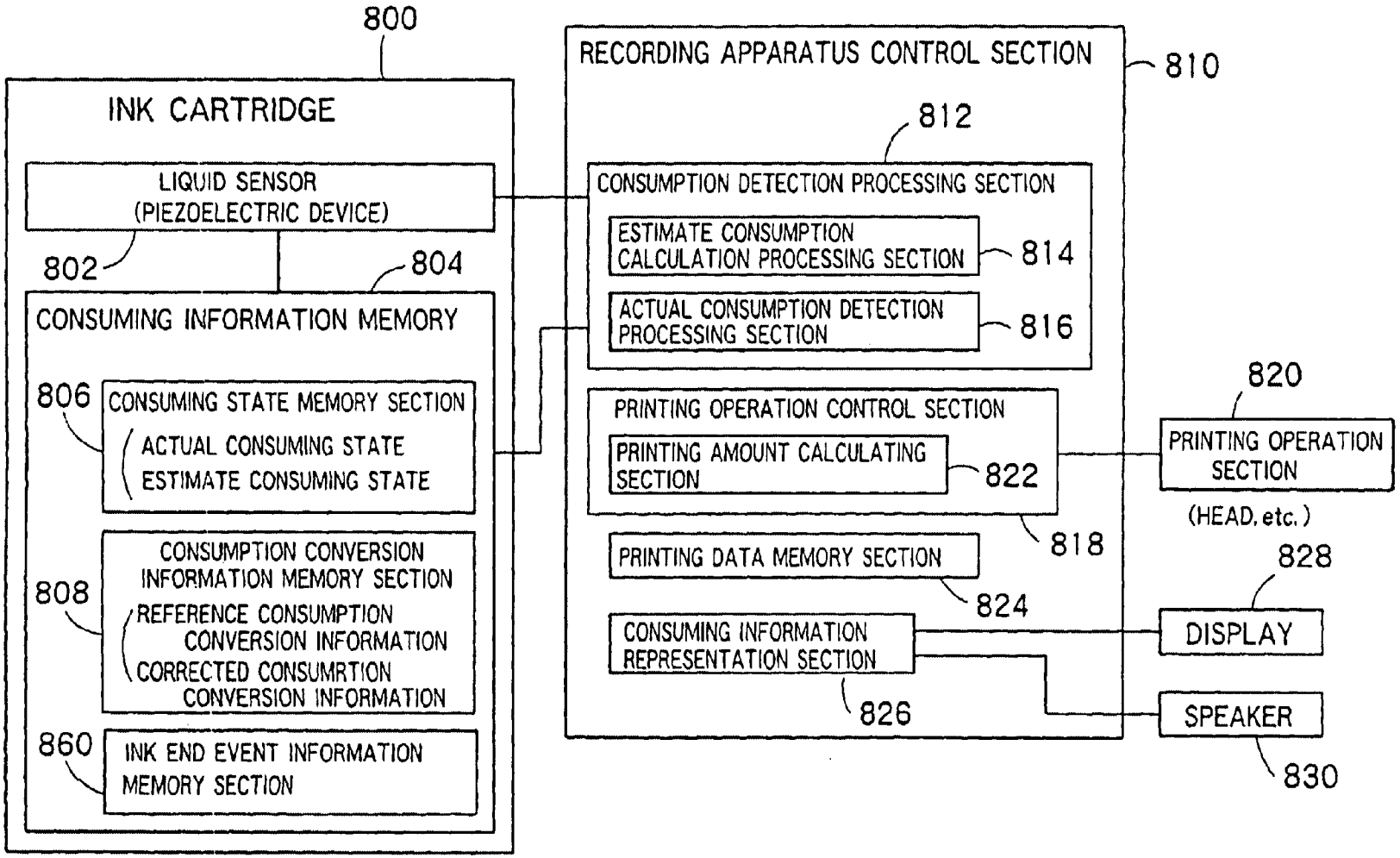
FIG. 54 is a diagram showing an embodiment of an ink jet recording apparatus of another embodiment.

FIG. 54 shows an ink jet recording apparatus having an ink consumption detection function of the present embodiment. As different point comparing with the configuration of FIG. 47, an ink end event information storage section 860 is added to the consuming information memory 804 of the ink cartridge 800.

The ink end event information storage section 860 stores ink end event information under the control of the consumption detection processing section 812. The ink end event information is information obtained as an actual consuming state and information indicating that an ink liquid level passes through the liquid sensor. Here, the liquid level passage is referred to as an ink end event. Specifically, the ink end event is a phenomenon moving from "a state of presence of the ink" prior to the passage of the liquid level to "a state of absence of the ink" after the passage of the liquid level. When the consumption detection processing section 812 detects the passage of the liquid level, it rewrites the ink end event information storage section 860 from "event not generated" to "event generated".

The consumption detection processing section 812 can easily grasp the presence or absence of the ink liquid level passage by recording the ink end event information. A variety of processings are progressed on the basis of the passage of the liquid level by utilizing this information. In the consuming state storage section 806, a more detailed information involving with actual consuming states may be stored.

The present embodiment is advantageous for operations, for example, at the time when an ink cartridge is mounted. At the time when it is mounted, the stored ink end event information is read. The ink jet recording apparatus determines whether or not the link liquid level has already passed through the liquid sensor, and in the case where it has already passed through the sensor, the predetermined operation is performed. For example, that the ink remains little is immediately acknowledged to the user. Moreover, even in such a case where the recording apparatus is not placed in an appropriate manner, it is easily found that the remaining ink is little.

In this way, the present embodiment is advantageous in the viewpoint of easily obtaining particularly available ink end event information as an actual consuming state.

[Advantages of the Present Embodiment]

Up to this point, the present embodiment has been described. Next, the advantages of the present embodiment will be described all together. The other advantages are as described above.

According to the present embodiment, an estimate consumption calculation and an actual consumption detection are used in combination. The actual consuming state is more precisely detected by employing a piezoelectric device, and since the piezoelectric device is employed, an ink leakage and the like are preferably prevented. On the other hand, according to the estimate processing, although somewhat error is accompanied with it, the consuming state is found in detail. Therefore, by employing both processing processings, the ink consuming state is found precisely and in detail.

In the present embodiment, that the ink liquid level passes through the piezoelectric device is detected by the actual consumption detection processing. When the ink liquid level passes through the piezoelectric device, the output of the piezoelectric device is largely changed. Therefore, the passage of the liquid level is securely detected. The ink consuming states prior to and after the passage of the liquid level are estimated in detail. The ink consuming state is found precisely and in detail by these processings.

Moreover, in the present embodiment, when it is detected that the ink liquid level passes through the piezoelectric device, the detection of the actual consuming state is terminated. Owing to this, operations of the piezoelectric device is limited as it is necessary to be limited. Specifically, useless operations of the piezoelectric device and an actual consumption detection processing accompanied with it are omitted.

In the present embodiment, the consumption conversion information is corrected on the basis of the detection results of the actual consuming state. Owing to this, an error of the estimate processing of the consuming state can be reduced, and a more precise consuming state can be estimated.

The corrected consumption conversion information may be employed by limiting to the ink tank which is the objective of the correction. Or, the corrected consumption conversion information may be employed, not limiting to the ink tank which is the objective of the correction, also for an ink tank mounted later. According to the latter, the corrected information can be continuously utilized even after the ink cartridge is exchanged.

Moreover, in the present embodiment, as described by employing FIG. 48, the estimate consuming state is corrected on the basis of the detection results of the actual consumption detection processing. Subsequent estimation is precisely performed on the basis of the consuming state after the correction.

In the present embodiment, the information of the consuming volume is displayed on the display and the like by employing the estimate consuming state. For example, on the basis of the consuming state which has been found, the printable printing amount using the remaining ink is represented. Moreover, on the basis of the consuming state which has been found, the remaining ink volume is represented. At that time, different colors and shapes of graphical forms are employed corresponding to the ink volume. In this way, the ink consuming state is easily acknowledged to the user.

In the present embodiment, the liquid sensor is provided nearby the ink supplying opening of the ink cartridge. Owing to this, the liquid sensor can be precisely positioned. Furthermore, the consumption information memory is also provided nearby the supplying opening, and owing to this, the precisely positioned.

In the present embodiment, the consuming state which has been found is stored in the consuming information memory. The consuming information memory is mounted on the ink cartridge. Therefore, the ink cartridge is removed, and then, when it is mounted again, the consuming state is easily found.

Moreover, the consumption conversion information is also stored in the consuming information memory. This information is also read from the memory when the ink cartridge is mounted, and preferably utilized.

On the other hand, the corrected consumption conversion information may be held on the side of the recording apparatus. In this case, even after the ink cartridge is exchanged, the corrected conversion information can be continuously utilized. When the corrections are repeated, the conversion information approaches to an appropriate value, and the estimate processing is more precisely performed.

Moreover, in the present embodiment, when it is determined that the ink is absent, the printing data is stored in the storage section. Owing to this, the printing data is not lost.

Moreover, in another embodiment, when the actual consuming state is detected, the remaining printable printing amount is calculated. When the remaining printable printing amount is printed, the printing data prior to the printing is stored in the printing data storage section. Owing to this form, neither the printing data is lost.

Moreover, in another embodiment, an ink event information storage section is provided. It is held so that particularly available event information is easily taken out as the actual consuming information. When the ink cartridge is mounted on the recording apparatus, the even information is read. When the liquid level has already passed through the liquid sensor, that the ink remains little is represented immediately to the user. For example, even in the case where the recording apparatus is not placed in an appropriate manner, it is easily found that the ink remains little.

The present invention can be realized in a variety of forms of the aspects. The present invention may be a method of detecting an ink consumption, an ink consumption detection apparatus, an ink jet recording apparatus, a control apparatus of an ink jet recording apparatus, an ink cartridge, and the other aspects. In the aspect of an ink cartridge, the ink cartridge has preferably a consuming information memory, and provides information necessary to a variety of processings described above.

Next, another embodiment of the present invention will be described below.

Figure 55:
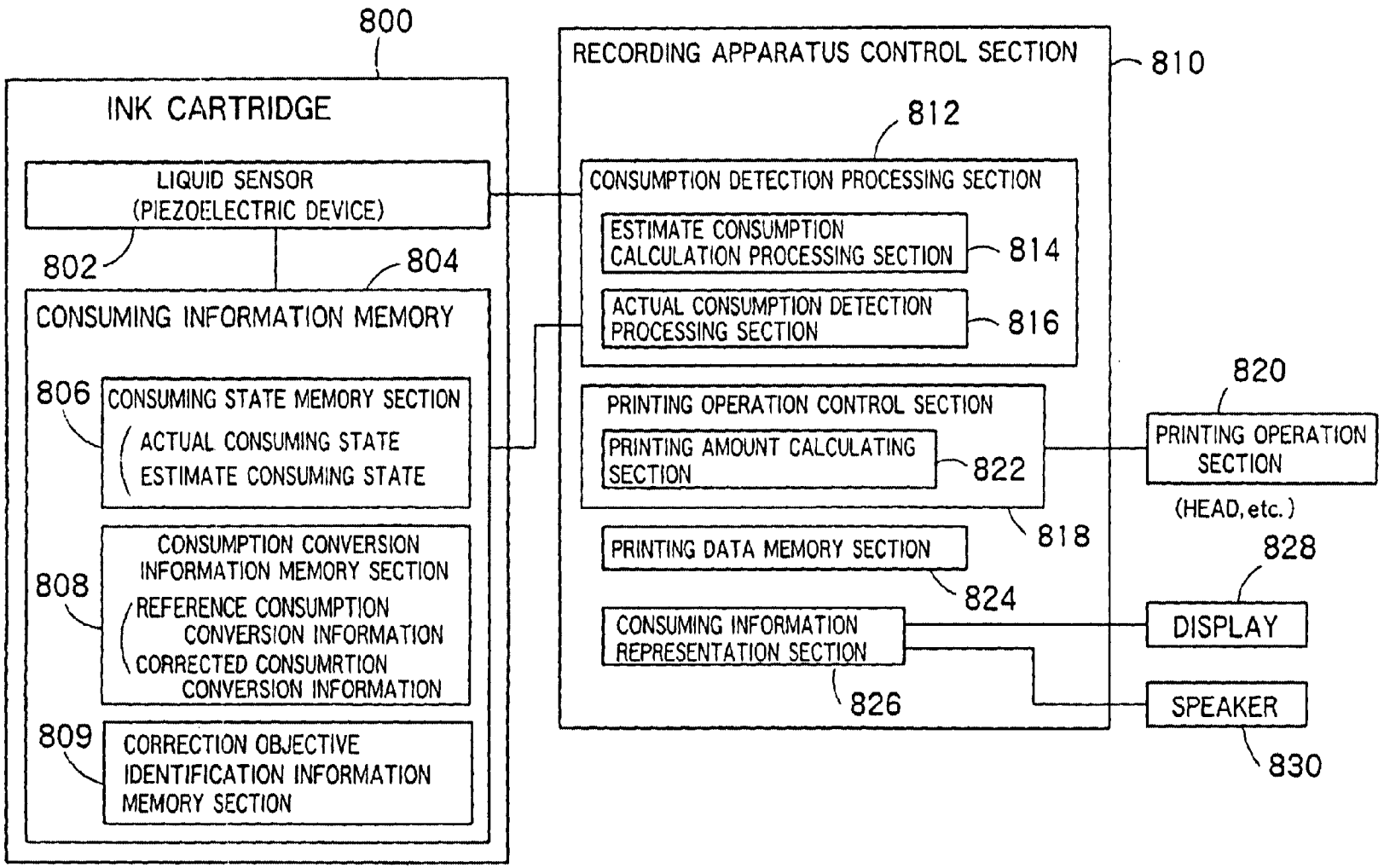
FIG. 55 is a block diagram showing a constitution of employing both of an estimate consumption calculation and an actual consumption detection in combination and an ink jet recording apparatus as well.

FIG. 55 shows a constitution of a system having an ink consumption detection function of the present embodiment. Compared to the embodiment shown in FIG. 47, in the present embodiment, the correction objective identification information storage section 809 is provided in addition to the consuming information memory 804 of the ink cartridge 800. This storage section 809 stores the correction objective identification information. This identification information is information for specifying the ink jet recording apparatus on which the ink cartridge is mounted when the consumption conversion information is corrected. The identification information is written in the storage section 809 by the consumption detection processing section 812 when the consumption conversion information is corrected.

Actually, the consumption conversion information storage section 808 and the correction objective identification information storage section 809 may be integrated. Then, the corrected consumption conversion information is stored in connection with an identification information indicating the recording apparatus which is the objective of the correction.

The correction objective identification information may be information for identifying the kind of ink jet recording apparatus, or may be information for identifying the ink jet recording apparatus individually. The identification information or may be information for identifying the ink jet recording apparatus. The ink consumption related configuration is, for example, a recording head. Moreover, the ink consumption related configuration also includes printing related control software.

In the present embodiment, as one embodiment, individual body numbers of the recording apparatus and the recording head are employed as identification information. When the consumption conversion information is corrected, the individual body number as well as its corrected value is written in the consuming state memory 804.

Figure 56:
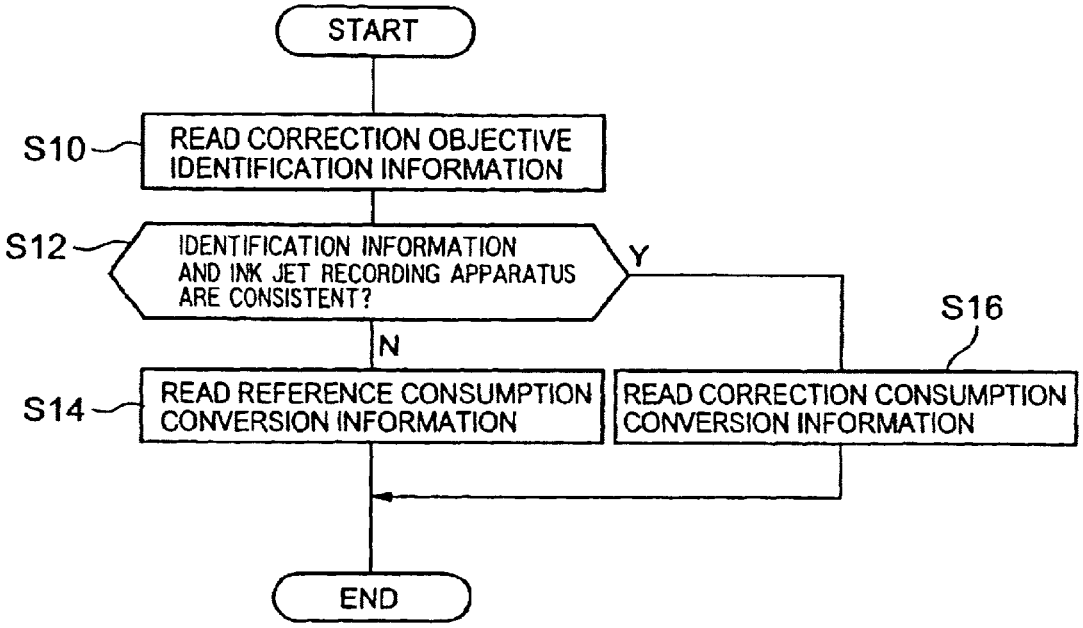
FIG. 56 is a flowchart showing a processing utilizing correction objective identification information in the constitution of FIG. 55.

FIG. 56 shows a processing of the consumption detection processing section 812 for utilizing the correction objective identification information. This processing is performed when the electric source of the printer is turned on, or when the ink cartridge is mounted on the recording apparatus. The mounting of the ink cartridge is determined by employing a suitable switch (not shown) provided on the recording apparatus.

In FIG. 56, first, the correction objective identification information is read from the consuming information memory (S10), and whether or not the identification information and the ink jet recording apparatus is consistent with each other (S12). When they are not consistent with each other (including the case where the identification information is not yet recorded), and the reference consumption conversion information is read (S14). In the subsequent consuming volume estimation calculation, this reference information is employed.

On the other hand, in the case where the determination of the step S12 is YES, the corrected consumption conversion information obtained by making the current recording apparatus as an objective is stored. Hence, the corrected consumption conversion information is read (S16). In the subsequent consuming volume estimation calculation, this corrected information is employed.

In this way, according to the present embodiment, the corrected consumption conversion information is used only in the ink jet recording apparatus when its correction has been performed by referring to the correction objective identification information. Such a situation that the corrected consumption conversion information is used in another ink jet recording apparatus is avoided When the ink cartridge is removed and mounted on another recording apparatus, the determination of the step S12 is indicated as NO, and the reference consumption conversion information is employed. When an ink tank is mounted on the same recording apparatus again, the determination of the step S12 is indicated as YES, and the previous corrected consumption conversion information is employed. When the ink cartridge is not attached or detached and only the electric source is turned on and of f, it is similar to the case described above. In this way, since suitable consumption conversion information is used, an ink consuming state is precisely found.

Next, another embodiment of the present invention will be described below.

Figure 57:
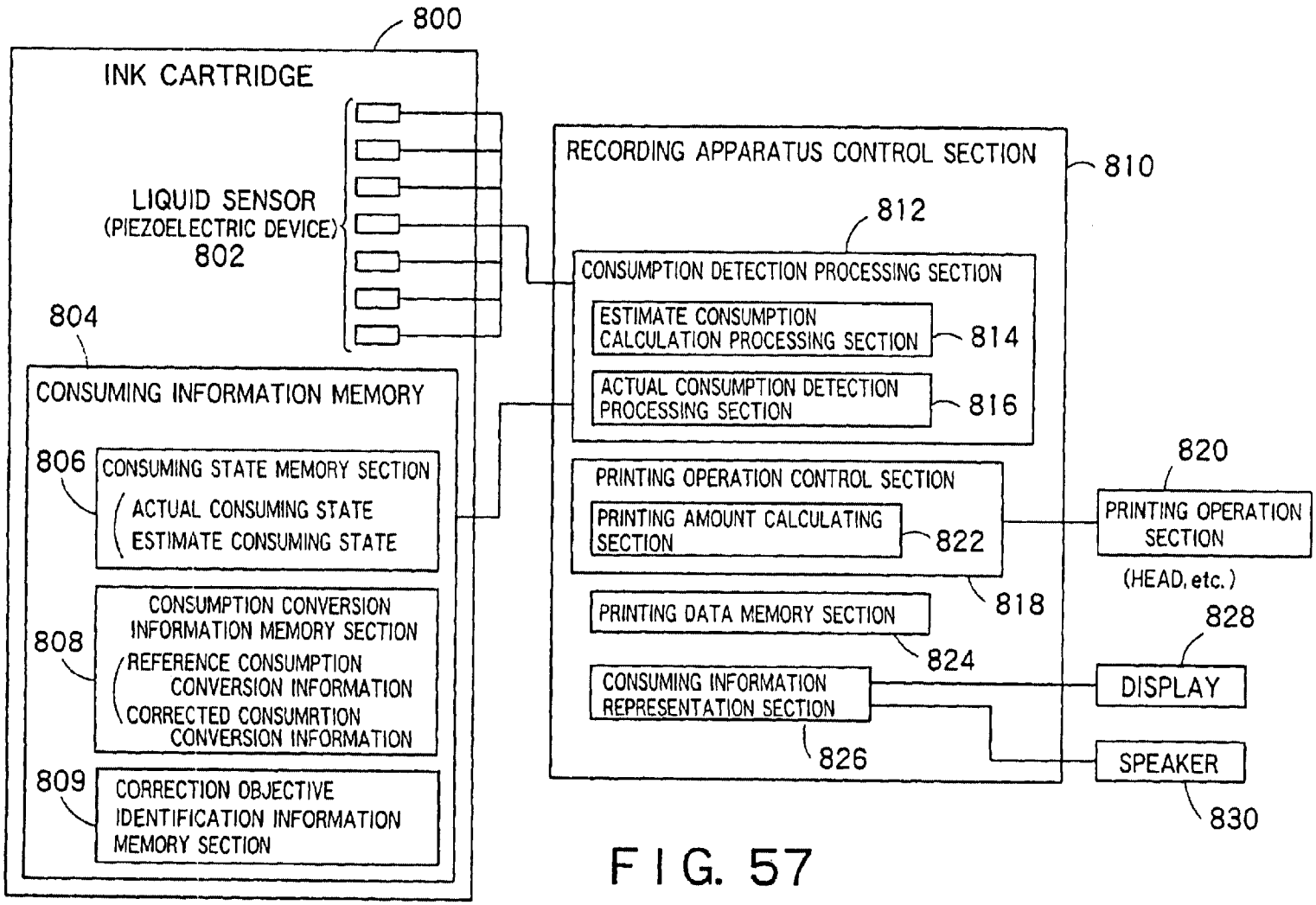
FIG. 57 is a diagram showing an embodiment of an ink jet recording apparatus of another embodiment.

FIG. 57 shows an ink jet recording apparatus having an ink consumption detection function of the present embodiment. In the present embodiment, different from the constitution of FIG. 55, a plurality of the liquid sensors 802 are provided on the ink cartridge 800. In the embodiment of FIG. 57, seven sensors are provided. These multiple liquid sensors 802 is controlled by the consumption detection processing section 812 of the recording apparatus control section 801, and more in detail controlled by the actual consumption detection processing section 816.

Figure 58:
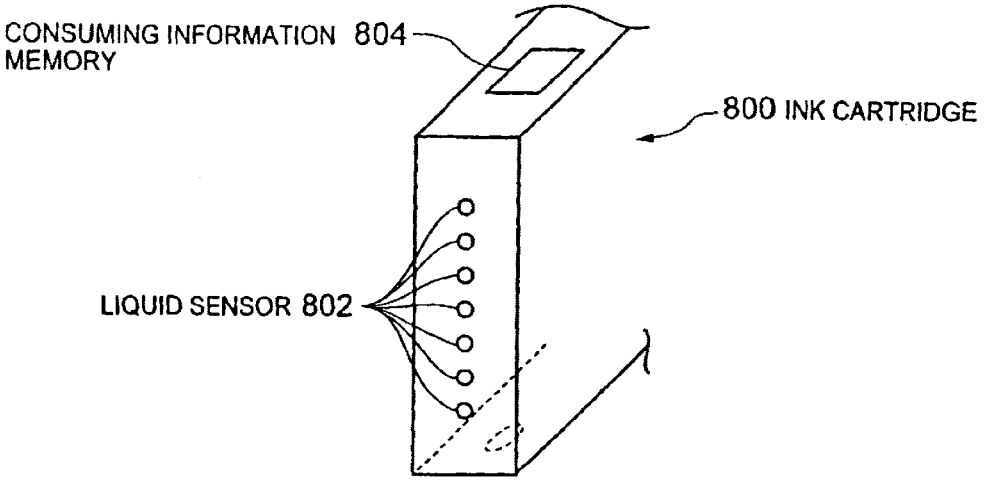
FIG. 58 is a view showing an arrangement of the liquid sensor in the ink cartridge of FIG. 57.

FIG. 58 shows an arrangement of a plurality of the liquid sensor 802 in the ink cartridge 800. The seven sensors are arranged along the direction in which the liquid level is lowered accompanied with the ink consumption at the seven different height positions separated from each other. Such a configuration is suitable for an ink cartridge containing comparatively a large volume of ink, for example, the so-called off carriage type ink cartridge. An off carriage type ink cartridge is fixed away from the recording head and employed. The ink cartridge and the recording head are connected via a tube or the like.

Returning to FIG. 57, the consumption detection processing section 812 detects the consuming state by employing the seven liquid sensors 802 individually. Therefore, consuming states (passage of the liquid level) in the seven different stages are detected.

It should be noted that preferably, all of the liquid sensor are not used at the same time but in turn. Suppose that one of the sensors detects the passage of the liquid level. Specifically, suppose that the detection result of one sensor is changed from the state of the presence of the ink to the state of the absence of the ink. The use of the sensor is stopped and one sensor located at the lower position next to the relevant sensor is used. When the lowermost sensor detects the state of the absence of the ink, the actual consumption detection using sensors is terminated. The operations of the sensors and the processings for them can be made less and sensors can be efficiently utilized.

Next, the correction processing of the consumption conversion information in a system of the present embodiment will be described below. In the present system, when the passages of the liquid level are detected two times, the consumption conversion information is corrected. In the detection of the first time, the passage of the liquid level is detected by a certain sensor. Next, in the detection of the second time, the passage of the liquid level is detected by the sensor located at the lower position next to the sensor detecting first. When this second time detection is performed, the corrected consumption conversion information is found from the printing amount between two detections. Concretely, the number of printing dots is found between the two detections. Then, an ink volume whose liquid level exists between the two sensors are divided by the number of printing dots.

Suppose that the use of an ink cartridge is started from fully filled state and the sensor located at the highest position detects the passage of the liquid level. In this case, the first detection of the liquid level is considered as the second time liquid level and the correction processing is performed. In this way, an amount of the printing from the fully filled state to the detection of the liquid level is found. The corrected consumption conversion information is found from an ink volume existed in higher portion than the highest sensor and an amount of the printing.

Moreover, when the ink cartridge is continuously used in the same recording apparatus, the passages of the liquid level are detected one after another. In this case, whenever the passage of the liquid level is detected, the corrected consumption conversion information is found. The corrected consumption conversion information is found from the printing amount between the previous detection and the detection of this time. In this way, whenever the passage of the liquid level is detected, the corrected consumption conversion information is updated.

Next, the processing of the correction objective identification information in the present system will be described below. As described above, the correction objective identification information is information for specifying the ink jet recording apparatus on which the ink cartridge is mounted when the consumption conversion information is corrected. In the present embodiment, as one embodiment, the individual numbers of the recording apparatus or the recording head are employed as identification information. Similar to the first embodiment described above, when the consumption conversion information is corrected, this identification information is stored in the storage section 809 of the consuming information memory 804 under the control of the consumption detection processing section 812.

Figure 59:
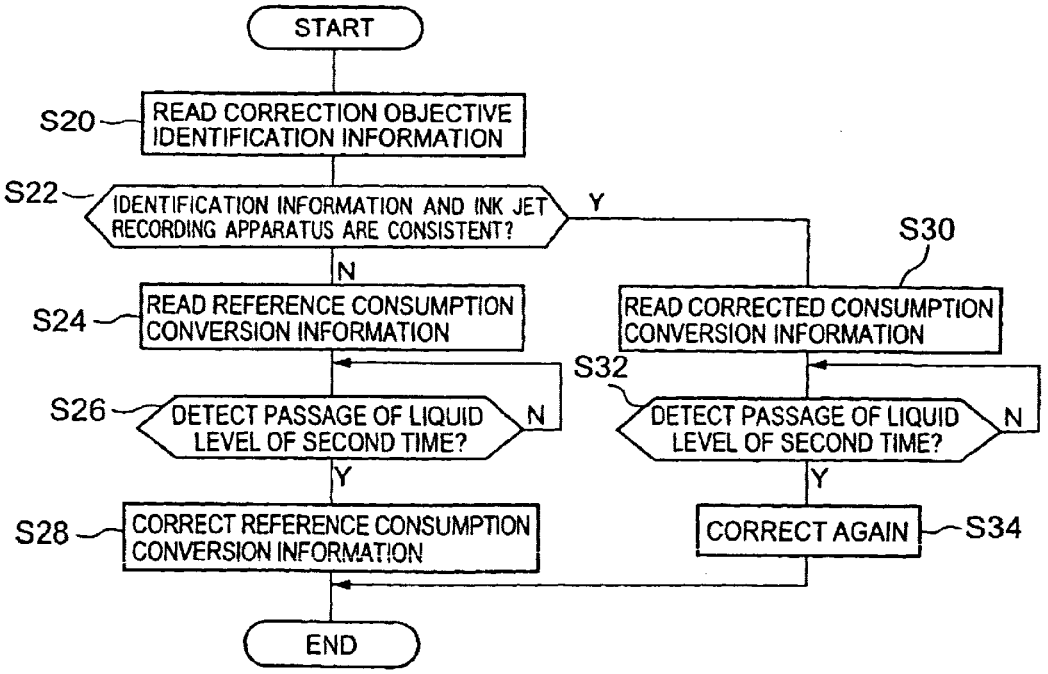
FIG. 59 is a flowchart showing a processing utilizing a correction objective identification information in the constitution of FIG. 58.

FIG. 59 shows a processing of the consumption detection processing section 812 for utilizing the correction objective identification information. This processing is performed when the electric source of the printer is turned on, or when the ink cartridge is mounted on the recording apparatus. The mounting of the ink cartridge is determined by employing a suitable switch (not shown) provided on the recording apparatus.

In the FIG. 59, first, the correction objective identification information is read from the consuming information memory (S20), and whether or not the identification information and the ink jet recording apparatus are consistent with each other is determined (S22). In the case where they are not consistent with each other (including the case where the identification information is not yet recorded), and the reference consumption conversion information is read (S24). In the subsequent consuming volume estimate calculation, this reference information is employed.

In the processing in which the ink is consumed, whether or not the passage of the liquid level become two times is determined (S26). When the determination of the step S20 is indicated as YES, the reference consumption conversion information is corrected (S28). The corrected consumption conversion information as well as the correction objective identification information indicating the recording apparatus which has been the objective of the correction is stored in the consuming state memory 804. In the subsequent consuming volume estimate calculation, the corrected consumption conversion information is used.

On the other hand, in the case where the determination of the step S22 is indicated as YES, the corrected consumption conversion information which has been obtained by making the current recording apparatus be the objective is stored. Hence, the corrected consumption conversion information is read (S30). In the subsequent consuming volume estimation calculation, this corrected information is used.

Subsequently, in the processing in which the ink is consumed, whether or not the detection times of the passages of the liquid level become two times are determined (S32). In the case where the determination of the step S32 is indicated as YES, the corrected consumption conversion information is found again (S34). This corrected consumption conversion information as well as the correction objective identification information indicating the recording apparatus which has been the objective of the correction is stored in the consuming state memory 804. In this way, the corrected consumption conversion information is updated. In the subsequent consuming volume estimate calculation, the consumption conversion information after it is corrected again is used.

Figure 60:
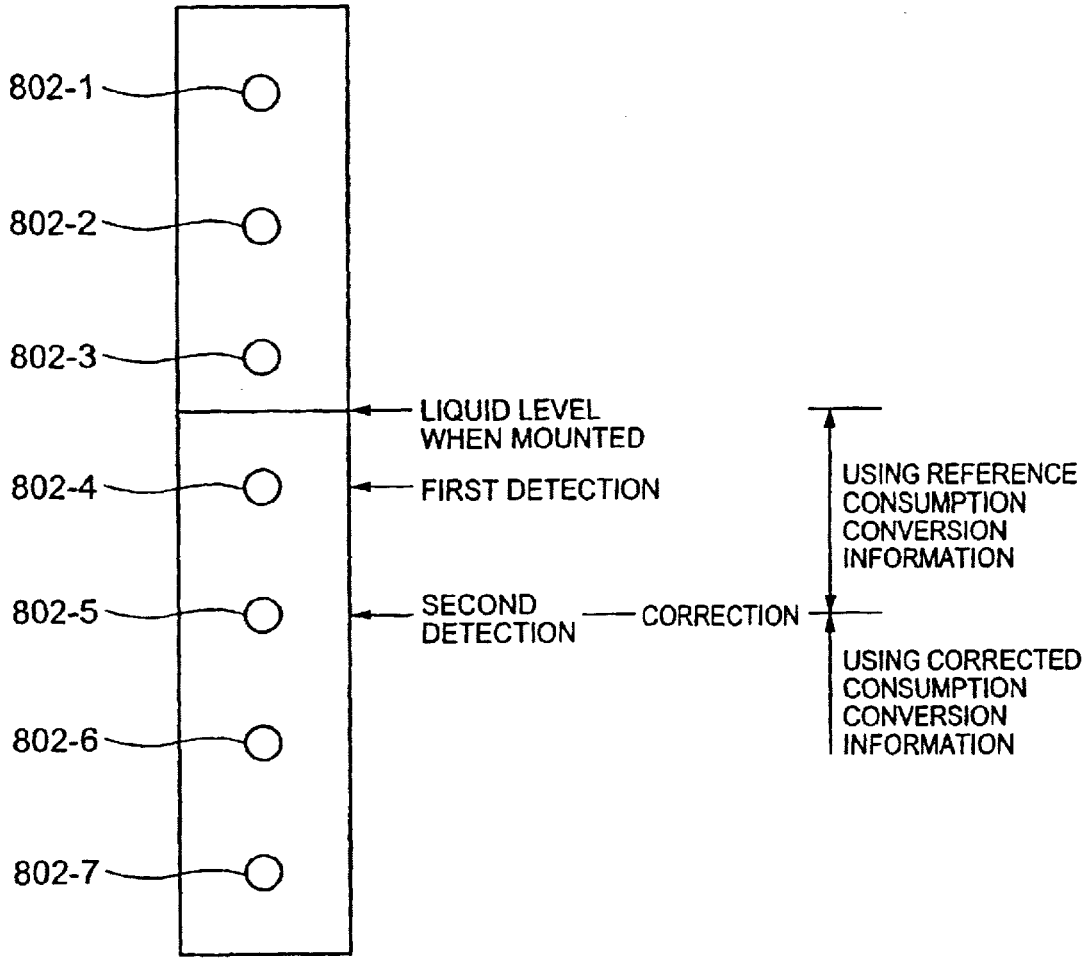
FIG. 60 is a diagram showing one embodiment of a processing of FIG. 59.

FIG. 60 shows one embodiment of the above-described processings. On the ink cartridge 800, the first through seventh sensors 802-1 through 802-7 are arrayed. Suppose that an ink cartridge was mounted on an ink jet recording apparatus which is not yet an objective of the correction of the consumption conversion information. Suppose that when the ink cartridge was mounted, the ink liquid level existed between the third sensor 802-3 and the fourth sensor 802-4.

When the ink is consumed, the passage of the liquid level is detected by the fourth sensor 802-4 (detection of the first time). Furthermore, the passage of the liquid level is detected by the fifth sensor 802-5 (detection of the second time). Suppose that an ink volume whose liquid level exists from the fourth sensor 802-4 to the fifth sensor 802-5 is Vy. Moreover, suppose that the number of printing dots between the detections of two times is Ny. At this time, the corrected consumption conversion information is represented as Vy/Ny. This corrected value as well as the identification information for specifying the recording apparatus is stored in the consuming information memory. Subsequently, the ink consuming volume is calculated by employing the corrected value.

It should be noted that according to the above-described processings, when the ink cartridges are mounted on the multiple recording apparatus, the corrected consumption conversion information is found on these respective recording apparatus. In this case, a plurality of corrected consumption conversion information as well as identification information of each recording apparatus is recorded. Then, each corrected information is used for the relevant recording apparatus.

[Advantages of the Present Embodiment]

Up to this point, the present embodiment has been described. Next, advantages of the present embodiment will be described all together. The other advantages are as described above.

According to the present embodiment, the actual consuming state is detected without using a complex sealing structure and without generating the ink leakage by employing a liquid sensor composed of a piezoelectric device.

When the passage of the liquid level is detected by the liquid sensor, the consuming volume prior to and after the passage is estimated. An ink consuming state is found precisely and in detail by these processings.

In the present embodiment, particularly, the consumption conversion information is corrected on the basis of an actual consuming state. The estimate precision of the ink consuming volume can be enhanced by employing the corrected consumption conversion information.

Furthermore, the ink cartridge is equipped with a consuming information memory. In the consuming information memory, the corrected consumption conversion information as well as correction objective identification information for identifying the ink jet recording apparatus on which the ink cartridge is mounted when the correction processing is performed is stored. With reference to the correction objective identification information, the corrected consumption conversion information is used only in the ink jet recording apparatus when the correction is performed. Since appropriate consumption conversion information is used, the ink consuming state can be precisely obtained.

Moreover, in the present embodiment, a plurality of liquid sensors are provided. Then, when the ink cartridge is mounted, the detection of the passage of the liquid level by the two sensors are waited, and the consumption conversion information is corrected. Therefore, after the corrected consumption conversion information which makes the recording apparatus an objective is obtained, its corrected consumption conversion information is utilized. For example, when an ink cartridge on the way of using is removed and is mounted on another recording apparatus, suitable consumption conversion information is used.

The present invention can be realized in a variety of forms of the aspects. The present invention is not limited to an ink consumption detection apparatus, may be an ink jet recording apparatus, a control apparatus of an ink jet recording apparatus, an ink cartridge, and the other aspects. In the aspect of an ink cartridge, preferably the ink cartridge has a consuming information memory, and provides information necessary to a variety of processings described above.

[Modified Embodiment]

The present embodiment is, needless to say, deformable in the scope of the present invention.

In the present embodiment, a liquid sensor is composed of a piezoelectric device. As afore-mentioned, a change of acoustic impedance may be detected by employing a piezoelectric device. A consuming state may be detected by utilizing the reflected wave of an elastic wave. A time from generation of an elastic wave to arrival of the reflected wave is found. A consuming state may be detected on any of the principles for utilizing the function of the piezoelectric device.

In the present embodiment, a liquid sensor generates oscillation and generates a detection signal for indicating an ink consuming state as well. To the contrary, the liquid sensor may not generate the oscillation itself. Specifically, both of oscillation generation and detection signal output may not be performed. An oscillation is generated by another actuator. Or, when an oscillation is generated in the ink cartridge accompanied with the movement of the carriage, the liquid sensor may generate a detection signal indicating an ink consuming state. Ink consumption is detected without actively generating an oscillation by employing an oscillation naturally generated by printer operation.

The function of the recording apparatus control section may not be realized by the computer of the recording apparatus. One portion of the whole functions or the whole functions may be provided on the external computer. The display and speaker may be also provided on the external computer.

In the present embodiment, a liquid container was an ink cartridge, and a liquid utilizing apparatus was an ink jet recording apparatus. However, a liquid container may be an ink container except for an ink cartridge, for example, an ink tank. For example, it may be a sub tank on the side of a head.

Moreover, an ink cartridge may be the so-called off carriage type cartridge. Furthermore, the present invention may be applied to a container for containing a liquid except for ink.

Next, the other embodiment of the present invention will be described below.

First, a technology for detecting an ink consumption on the basis of the oscillation by employing a piezoelectric device will be described. Subsequently, a variety of applications of detection technologies will be described. Subsequently, referring to FIG. 61, ink consumption detection technologies, specifically, detection technologies which employs an estimate consumption calculation processing and an actual consumption detection processing will be described.

In the present embodiment, a piezoelectric device is provided on the liquid sensor. In the following explanation, "actuator" or "elastic wave generation means" corresponds to a liquid sensor, respectively.

[Combination of Actual Consuming State Detection and Estimate Consuming State Calculation]

Up to this point, a variety of ink cartridges with an ink consumption detection function of the present embodiment has been described. These ink cartridges are equipped with a liquid sensor (actuator or the like) composed of a piezoelectric device. Actual consuming state, that is to say, the actual consuming state is detected by employing a liquid sensor. Then, as shown in FIG. 7 and the like, a plurality of actual consuming state are detected by providing a plurality of sensors.

In the present embodiment, further, a consuming state is estimated on the basis of ink consumption. The ink consumption is ink consumption due to printing and recording head maintenance, both of them may be estimated or one of them may be estimated. In the present embodiment, estimate processing based on the printing amount will be mainly described. An estimate consuming state thus found is referred to as an estimate consuming state. An ink consuming state is found precisely and in detail by combining the detection of an actual consuming state and the calculation of an estimate consuming state. Hereinafter, a preferable constitution of combining an actual consuming state and an estimate consuming state will be described below.

Figure 61:
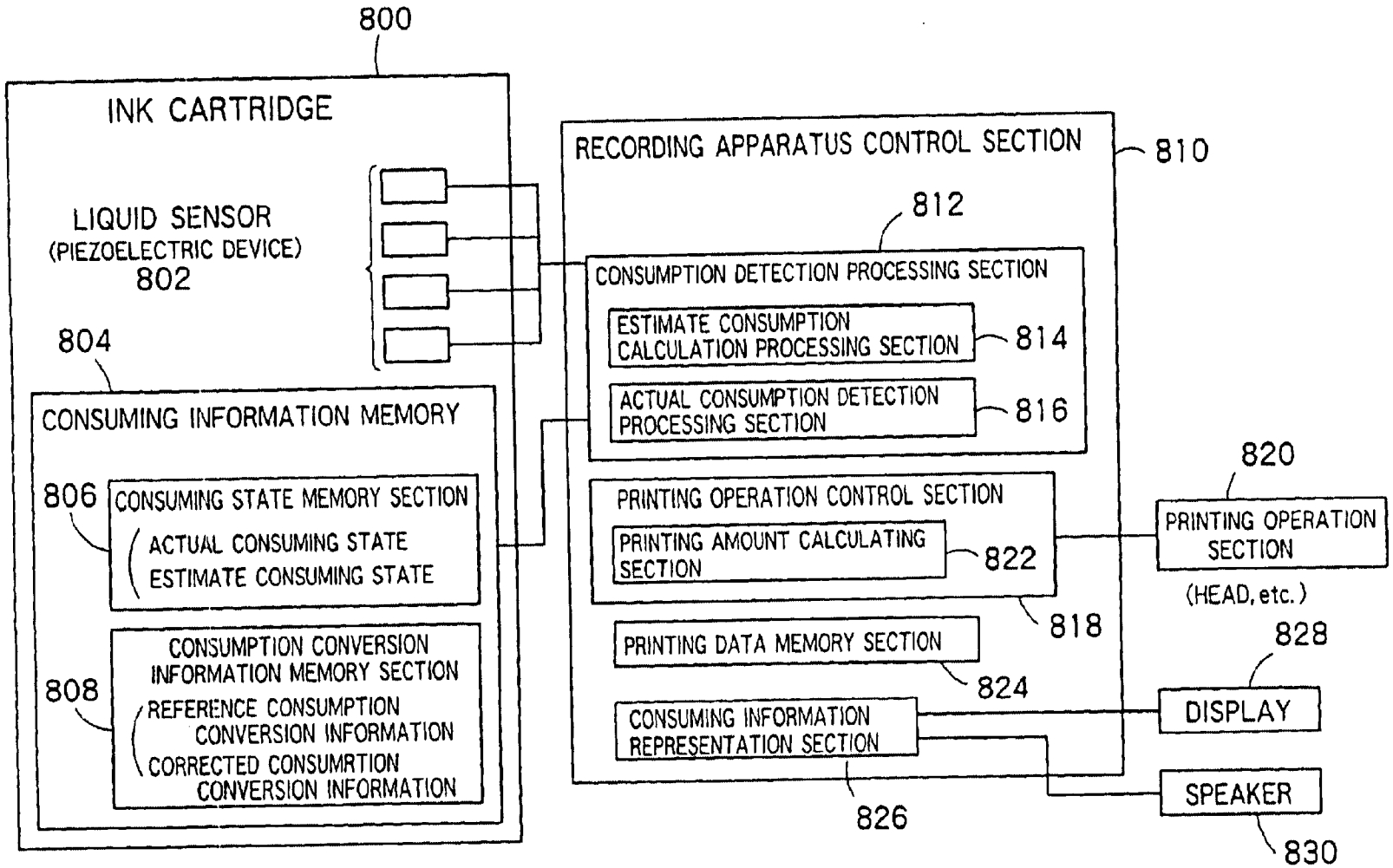
FIG. 61 is a block diagram showing a constitution of employing an estimate consumption calculation and an actual consumption detection in combination and an ink jet recording apparatus as well.

FIG. 61 shows a constitution of a system having an ink consumption detection function of the present embodiment. The ink cartridge 800 has the multiple liquid sensors 802 (four pieces in the embodiment of FIG. 61) and the consuming information memory 804. Each liquid sensor 802 is composed of a piezoelectric device. Concretely, the liquid sensor 802 is composed of the above-described elastic wave generation means or an actuator, and outputs a signal corresponding to an ink consuming state. The consuming information memory 804 is a rewritable memory of EEPROM and the like, and corresponds to the above-described semiconductor storage means (FIG. 1, the reference numeral 7).

Figure 62:
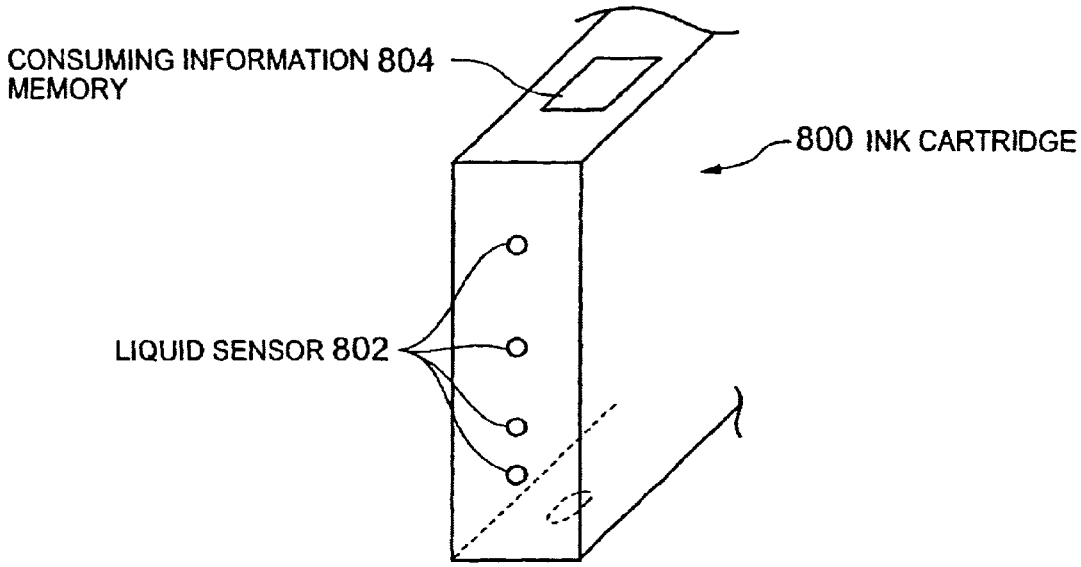
FIG. 62 is a view showing an embodiment of an arrangement of a sensor and a memory on an ink cartridge.

FIG. 62 shows a suitable arrangement of the liquid sensor 802 and the consuming information memory 804. Four liquid sensors 802 are arrayed along the direction in which the ink liquid level moves accompanied with ink consumption. Four liquid sensors 802 are individually employed for detection processing. Owing to this, four stages, specifically, four liquid level passages having different heights are detected.

Moreover, as shown in FIG. 62, the intervals of four liquid sensors 802 are not constant. The liquid sensors 802 are arranged so that arrangement intervals along the direction in which the ink liquid level moves are gradually narrower. In the lower portion of the ink cartridge, intervals of the sensors are set narrower compared to those in the upper portion of the ink cartridge. Owing to this, when the ink is reduced, the detection intervals are narrower. Where, the information of the consuming state is more important when the ink is reduced compared to when the ink is abundant, and then, it is preferable that the consuming state is detected in detail. The consuming state is acknowledged to the user, or utilized for the control of the recording apparatus. According to the present embodiment, such a requirement is appropriately realized by differently set intervals of the sensors.

Figure 63:
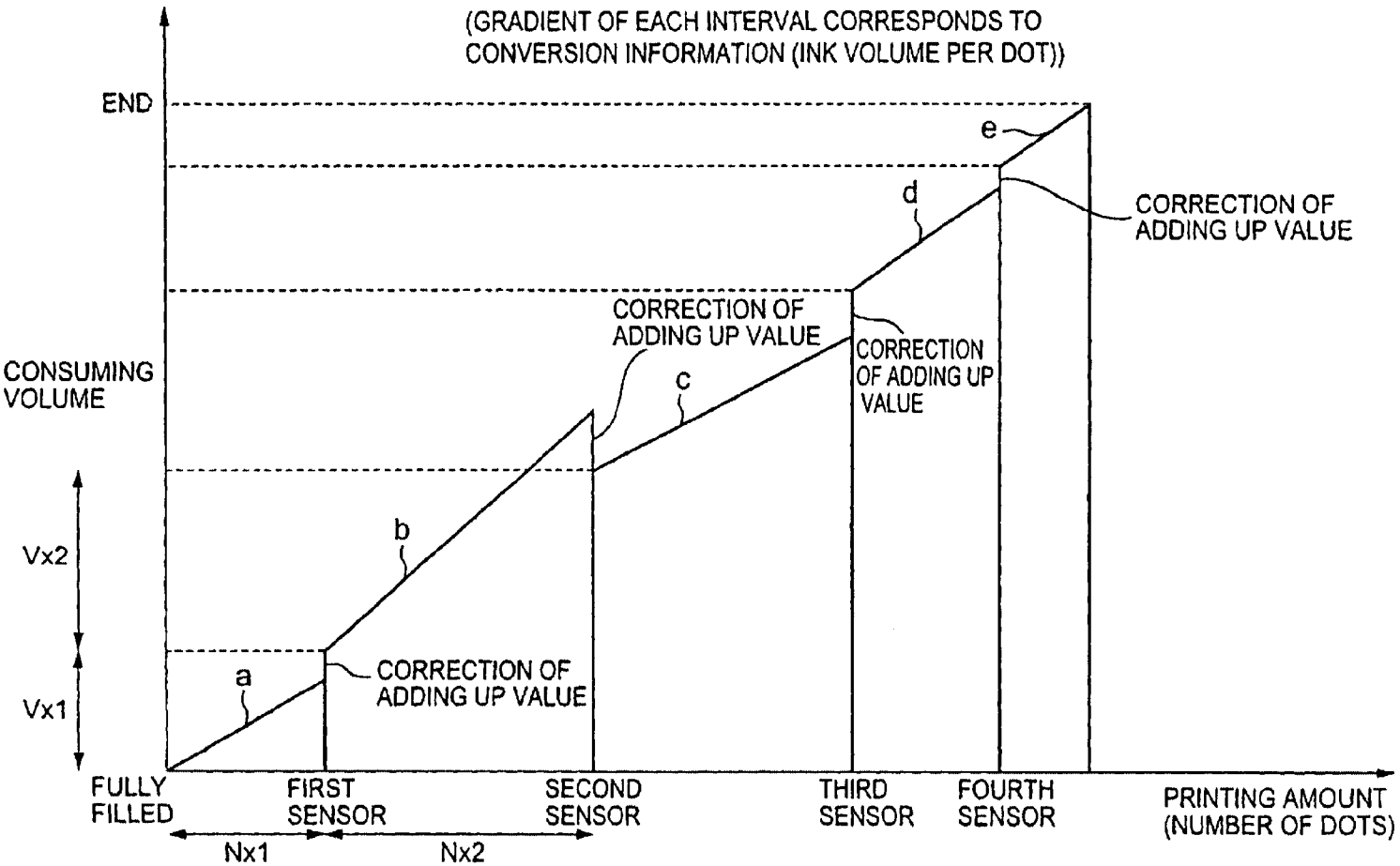
FIG. 63 is a graph showing a consumption detection processing by employing the constitution of FIG. 61.

FIG. 63 shows an embodiment of ink consumption detection according to the present embodiment. In FIG. 63, a preferable processing of combining multiple stages of detection of actual consuming state and estimate of the estimate consuming state is shown. Furthermore, in FIG. 63, the correction processing of the consumption conversion information is also shown.

In FIG. 63, the axis of abscissa indicates an amount of printing (number of printing dots), and the axis of coordinates indicates a consuming volume found by the present system. A fully filled state is a state when the usage of the ink cartridge is started, and the ink consuming volume is zero.

First, an estimate consuming volume is found by multiplying and adding up the number of printing dots by means of the estimate consumption calculation processing section 814. Now, the reference consumption conversion information read from the consuming state storage section 806 are employed. As aforementioned, an estimate consuming volume is the product of the number of printing dots and an ink volume per dot (conversion information). Therefore, the estimate consuming volume is increased in proportion to the number of dots. The gradient a of the estimate consuming volume corresponds to conversion information. As the ink consumption is progressed, the ink liquid level arrives at the liquid sensor 802 having the highest level.

Now, defining that the uppermost liquid sensor 802 is the first sensor, and subsequently in turn, the second sensor, the third sensor, and the fourth sensor. The ink cartridge volume above the respective sensors are previously determined. The consuming volumes at the time when the liquid level passes through the respective sensors are already known. These consuming volume information are previously stored in the consuming information memory 804. Therefore, when the first sensor detects the passage of the liquid level, the precise consuming volume of the point in time is identified.

As described above, there is a deviation between the reference consumption conversion information and the actual conversion information. Therefore, an error is also occurred in an estimate value of the consuming volume employing the conversion information. The error is larger as the ink consumption proceeds. As shown in FIG. 63, in the present embodiment, an error thus occurred is corrected at the point in time when the first sensor detects the passage of the liquid level. The corrected value is stored in the consuming state storage section 808 of the consuming information memory 804.

Furthermore, the conversion information is also corrected on the basis of the actual consuming state. Suppose that the number of dots from "a fully filled ink" to "detection of the liquid level by the first sensor" is N×1. Moreover, suppose that an ink consuming volume of the same period is V×1. In this case, the corrected conversion information is represented by V×1/N×1. The corrected conversion information is stored in the consumption conversion information storage section 808 of the consuming information memory 804.

After the actual consuming state is detected, the consuming volume is again estimated by multiplying the number of dots. However the subsequent consuming volume is calculated on the basis of the adding up value after the correction. Moreover, in the calculation of the consuming volume, the conversion information after the correction is employed. Specifically, the gradient (b) of the estimate consuming volume after the liquid level passes through the first sensor is Vx/Nx, which is described above.

The processing when the second sensor, the third sensor and the fourth sensor detect the passage of the liquid level is also similar to that of the first sensor. When the passage of the liquid level is detected, the estimate consuming volume which has been found by dots sum is corrected. Moreover, the consumption conversion information is corrected. For example, suppose that the second sensor detects the passage of the liquid level. The printing amount (number of dots) from the detection by the first sensor to the detection by the second sensor is represented by N×2. Moreover, suppose that the ink cartridge volume between the first sensor and the second sensor is represented by V×2. In this case, the corrected conversion information is represented by V×2/N×2. A consuming volume is estimated by employing the conversion information after the correction as the consuming volume after the 0 correction.

After the fourth sensor, that is to say, after the fourth sensor detects the passage of the liquid level, a consuming state is estimated by adding up the number of dots, and when whole of the ink is consumed, the printing is made stopped. Specifically, the final ink end is found by estimation. Then, the user is urged to exchange the ink cartridge.

As described above, according to the present embodiment, the consuming volume is estimated by adding up the number of dots. When the sensor detects the passage of the liquid level, the consuming volume and the conversion parameter is corrected. Whenever the respective multiple sensors detect the passages of the liquid level, the correction processing is performed. Owing to this, occurrence of a large deviation between the estimated value and the actual consuming volume can be avoided.

Moreover, in the above-described processing, the consumption conversion information is corrected on the basis of the printing amount per sensor interval. Specifically, an amount of printing from the point in time when one sensor detects the liquid level to the point in time when the next sensor detects the liquid level is found. The ink volume between the sensors is divided by the printing amount. Since in these processings, the data used for the correction is limited, it is advantageous in the viewpoint of being capable of reducing the influence of a change of circumstances during the usage of the ink cartridge.

Moreover, when the lowermost liquid sensor (fourth sensor) detects the passage of the liquid level, the final consumption conversion information may be found on the basis of correction results of the consumption conversion information of the multiple times accompanying with the detection of the passages of the liquid level of the multiple times until then. For example, the average of the corrected conversion information obtained by the correction calculations of four times is found. An estimate consuming state after the lowermost piezoelectric device detects the passage of the liquid level is found by employing the final consumption conversion information. According to this form, a more precise conversion information is obtained by employing the correction results of multiple times. Then, the consuming state when the ink remains little can be precisely estimated.

On the other hand, as another modified embodiment of the correction processing, the accumulated printing amount from the point in time when the cartridge is fully filled may be employed. For example, suppose that the second sensor detects the passage of the liquid level. An ink volume from the fully filled state to the position of the second sensor is divided by the whole printing amount until then, and the corrected consumption conversion information is found. In the embodiment of FIG. 63, the corrected consumption conversion information is represented by the following expression:

$$(V\times1+V\times2)/(N\times1+N\times2)$$

Figure 64:
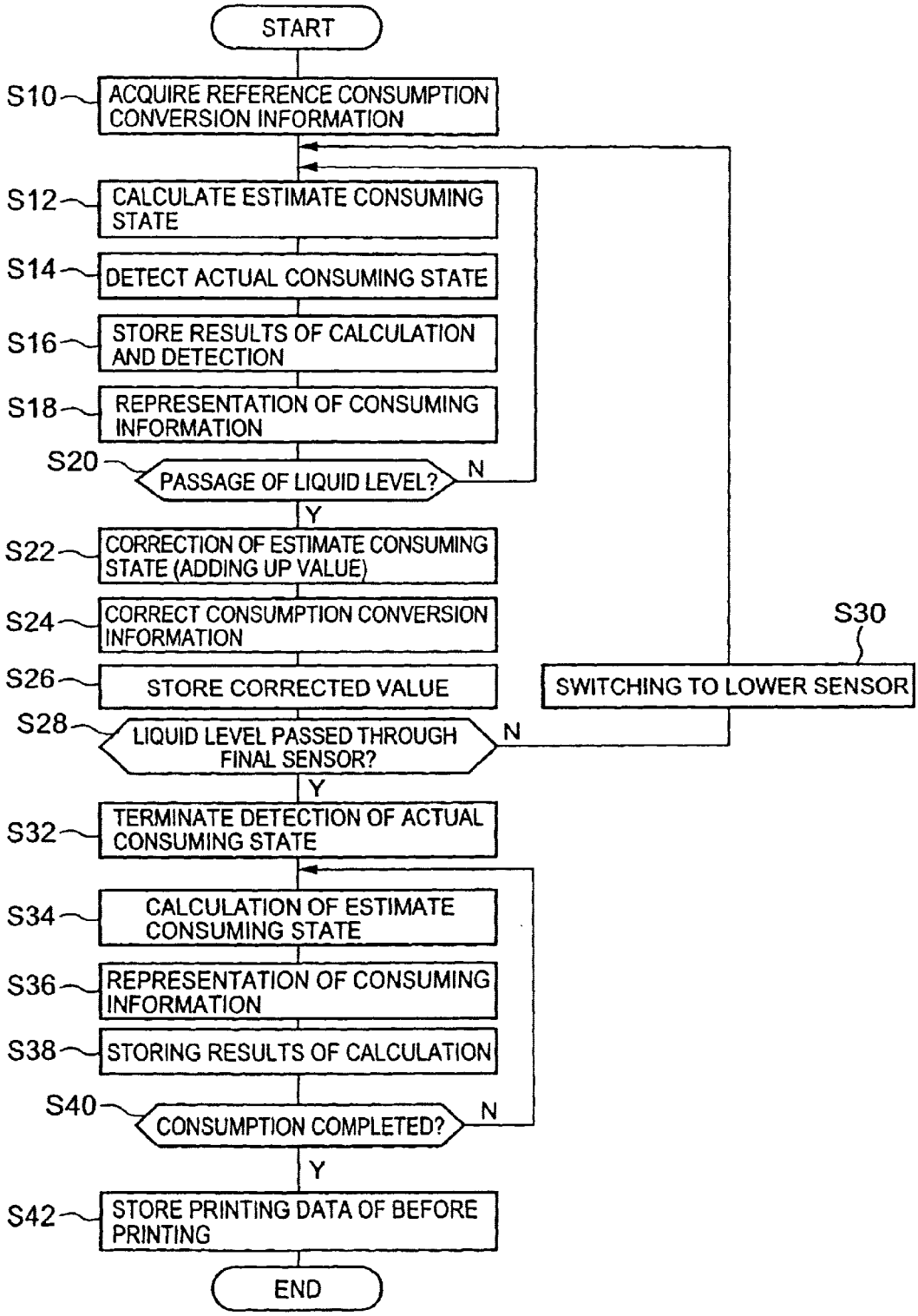
FIG. 64 is a flowchart showing a consumption detection processing by employing the constitution of FIG. 61.

FIG. 64 shows a detection processing by the consumption detection processing section 812. When the ink cartridge 800 is mounted, the reference consumption conversion information is acquired from the consumption conversion information storage section 808 (S10). Then, the estimate consuming state is calculated by the estimate consumption calculation processing section 814 (S12). Moreover, the actual consuming state is detected using the liquid sensor 802 by the actual consumption detection processing section 816 (S14). In this stage, only the uppermost liquid sensor 802, that is to say, only the first sensor is used. Until the ink liquid level arrives at the first liquid sensor 802, "a state of the presence of the ink" is detected as an actual consuming state.

After the step S14, the calculation results of the estimate consuming volume and the detection results of the actual consuming state are stored in the consuming state storage section 806 (S16). Next, the consuming information is represented to the user (S18). The processing of the step S18 is performed by the consuming information representation section 826 of the recording apparatus control section 810 (FIG. 61). This processing will be further described later.

Next, whether or not the passage of the liquid level is detected as an actual consuming state is determined (s20). If it is indicated as NO, returns to the step S12. In the next routine, the results are obtained by adding the subsequent consuming volume to the estimate consuming volume of the last time as an estimate consuming volume.

In the case where YES is indicated in the step S20, as described using FIG. 63, in the step S22, the estimate consuming state (adding up value) is corrected, and in the step S24, the consumption conversion information is corrected. These corrected values are stored in the consuming state storage section 806 and the consuming conversion information storage section 808, respectively (S26).

In the step S28, whether or not the liquid level has passed through the final sensor is determined. When the lowermost sensor (fourth sensor) detects the passage of the liquid level, it is indicated as YES in the step S28. When the first sensor through the third sensor detect the liquid level, it is indicated as NO in the step S28. In the case where it is indicated as NO, the liquid sensor used for detecting the actual consuming state is switched to the lower next to the relevant sensor (S30), and returns to the step S12. Therefore, whenever the liquid level passes through a certain sensor, the estimate consuming volume and the consumption conversion information is corrected, and the subsequent consuming volume is estimated by employing the corrected value. Moreover, an actual consuming state is detected only by necessary sensors. The operations of the piezoelectric devices and the processings for these operations can be made less, and accordingly, the piezoelectric devices can be efficiently utilized.

On the other hand, in the case where it is indicated as YES in the step 28, the detection of the actual consuming state using the liquid sensor 802 is terminated (S32). When the liquid level passes through the final sensor, after that, any of the sensors continuously detects the state of the absence of the ink. Therefore, it is not necessary to detect the actual consuming state any more. Hence, the detection of the actual consuming state is terminated. Owing to such processing in addition to the above-described sensor switching processing, the operations of the piezoelectric devices and the processings for these operations can be made less, and accordingly, the piezoelectric devices can be efficiently utilized.

In the step S34, an estimate consuming state is calculated similarly to the step S12. Then, in the step S36, the consuming state is represented to the user, in the step S38, the calculation results of the consuming state is stored in the consuming sate storage section 806. In the step S40, whether or not the estimate consuming volume achieves the whole ink volume (consumption completed or not) is determined, if it is indicated as NO, returns to the step S34. When the consumption is completed, that is to say, the printing data before the printing is saved (S42).

In the embodiment of FIG. 62, the liquid sensor is arrayed on the vertical wall of an ink cartridge. However, the liquid sensor may be arranged a suitable position in accordance with the specification of the cartridge. In a preferable configuration embodiment, the inside of the ink cartridge is separated by at least one partition wall into a plurality of chambers communicating with each other. The multiple liquid sensors are installed on the upper portion of the multiple chambers. The volume of the chamber whose ink is used later is set to be smaller than the volume of the chamber whose ink is used earlier. Such a configuration has been described with reference to the drawings in the description of the ink cartridge with detection function described above. Then, in this form, sensors are arrayed along the direction in which the ink is consumed, therefore, the actual consuming state is identified step by step. Furthermore, since the sizes of the chambers are differentiated, similarly to the above-described embodiments, the advantage that the detection intervals when the ink is slight can be made shortened.

Next, another embodiment of the present invention will be described below.

Figure 65:
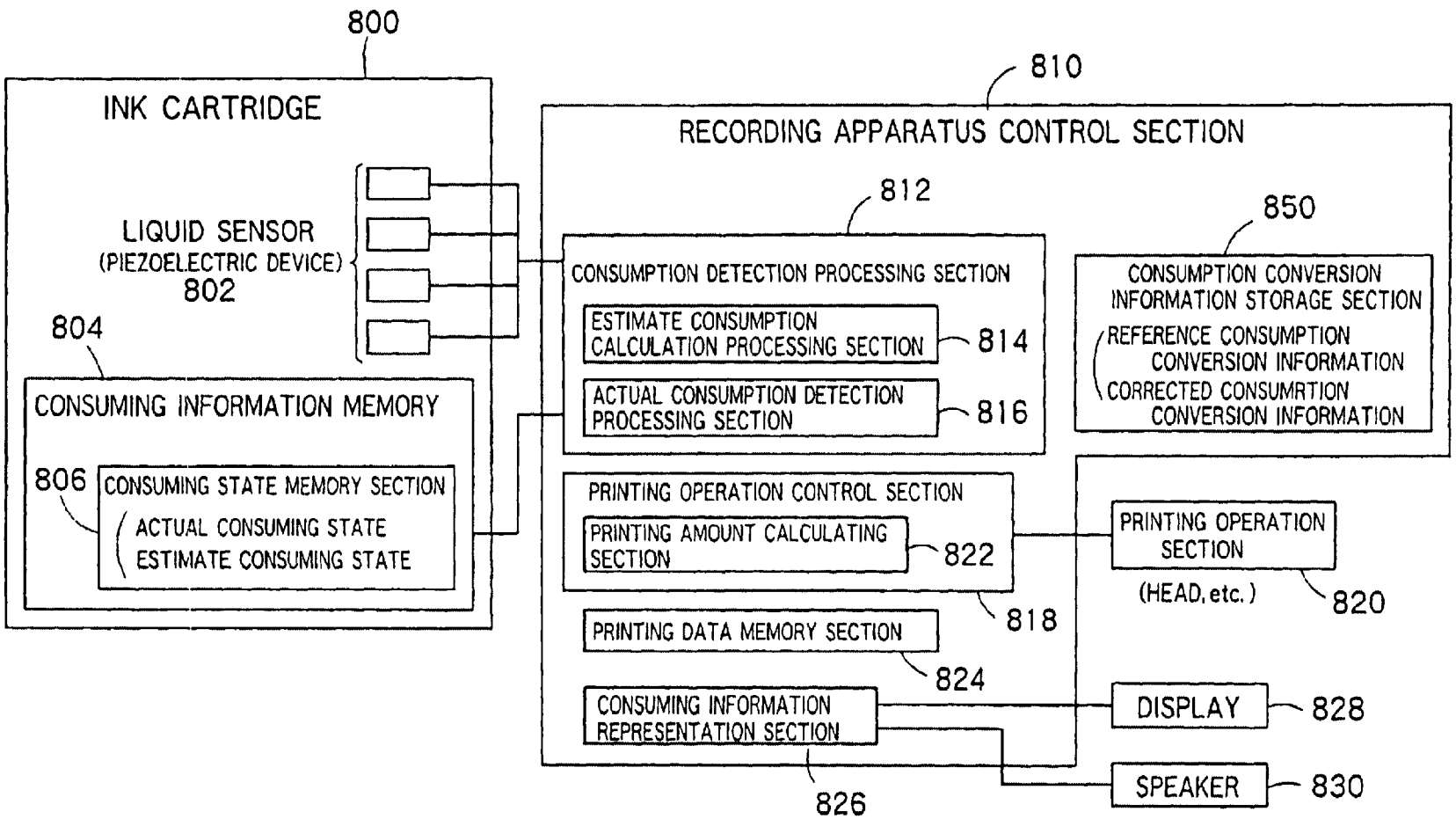
FIG. 65 is a diagram showing an embodiment of an ink jet recording apparatus of another embodiment.

FIG. 65 shows an ink jet recording apparatus having an ink consumption detection function of the present embodiment. In the present embodiment, differing from the constitution of FIG. 61, the consumption conversion information storage section 850 is provided on the recording apparatus control section 810.

Suppose that in this form, when a certain ink cartridge is mounted, the consumption conversion information is corrected on the basis of the actual consuming state. The obtained corrected consumption conversion information is held in the consumption conversion information storage section 850 within the control section 810. When another ink cartridge is mounted, the corrected consumption conversion information is read and utilized for the estimation of the ink consuming volume.

In this way, according to the present embodiment, since the consumption conversion information is held on the side of the recording apparatus, even after the ink cartridge is exchanged, the corrected consumption conversion information can be continuously utilized. The present embodiment is particularly advantageous in the case where the individual difference of the ink jet recording apparatus has an influence on the actually measured consumption conversion value. The individual difference between the recording apparatus typically indicates the individual difference between the recording heads.

Moreover, in this form, a plurality of ink cartridges are used, and when a plurality of performances of the correction processings are performed, the conversion information approaches to a more appropriate value. A more precise estimate processing is possible by utilizing this value.

Moreover, as a deformed form of the present embodiment, the consumption conversion information storage section 850 may be provided on still another constitution, for example, an external computer connected to the ink jet recording apparatus.

Besides those, in the present embodiment, a value (information) per cartridge ID (serial) is stored in the memory, when the same cartridge is mounted, the stored value may be read and utilized.

Moreover, as a modified embodiment of the present embodiment, the storage section of the consumption conversion information is provided on both of the ink cartridge and the recording apparatus. These storage sections may rewrite memory contents in both of them at the same time, or it may be constituted so that data is downloaded from the ink cartridge at the time when the ink cartridge is removed.

Up to this point, the present embodiment has been described. Next, the advantages of the present embodiment will be described all together. The other advantages are as described above.

In the present embodiment, an estimate consumption calculation and an actual consumption detection are used in combination. The actual consuming state is found in detail although an error is somewhat accompanied with it due to the estimation processing. On the other hand, an actual consuming state can be precisely detected by employing a piezoelectric device, and since the piezoelectric device is employed, an ink leakage and the like are preferably prevented. Particularly, by employing multiple piezoelectric devices, the actual consuming state in multiple stages is identified. The ink consuming state is found precisely and in detail from the multiple stages of the actual consuming state and the estimate consuming state.

More concretely, in the actual consumption detection processing, the respective multiple piezoelectric devices detect the passage of the liquid level. During the period from the point in time when one piezoelectric device detects the passage of the liquid level to another piezoelectric device detects the passage of the liquid level, the ink consuming volume is estimated. Even when the liquid level exists out of the levels of the piezoelectric devices of both ends, the ink consuming volume is estimated. Owing to this, the ink consuming volume is continuously found.

In the present embodiment, when the passage of the liquid level is detected, estimate consuming volume is corrected. Moreover, the consumption conversion information used for estimating a consuming volume is also corrected. Since the multiple piezoelectric devices are arrayed, the correction is performed in the multiple stages in the processing in which the ink is consumed. Owing to this, the deviation of the estimate consuming volume from the actually measured volume consuming volume can be limited, and the ink consuming state is found precisely and in detail.

In the present embodiment, all of the piezoelectric devices are not used at the same time but in turn. One piezoelectric device detects the state of the absence of the ink, the usage of the piezoelectric device is stopped and one piezoelectric device located lower next to the relevant piezoelectric device is used. When the lowermost piezoelectric device detects the state of absence of the ink, the actual consumption detection using piezoelectric devices is terminated. Owing to these processings, the operations and the processings for the piezoelectric devices can be made less, and the piezoelectric devices can be efficiently utilized.

In the present embodiment, the information of the consuming volume is displayed on the display and the like using the estimate consuming state. For example, on the basis of the consuming state which has been found, the printable printing amount using the remaining ink is represented. Moreover, on the basis of the consuming state which has been found, the remaining ink volume is represented. At that time, different colors and shapes of graphical forms are employed corresponding to the ink volume. In this way, the ink consuming state is easily acknowledged to the user.

In the present embodiment, the consuming state which has been found is stored in the consuming information memory. The consuming information memory is mounted on the ink cartridge. Therefore, the ink cartridge is removed, and then, when it is mounted again, the consuming state is easily found.

Moreover, the consumption conversion information is also stored in the consuming information memory. This information is also read from the memory when the ink cartridge is mounted, and preferably utilized.

On the other hand, the corrected consumption conversion information may be held on the side of the recording apparatus. In this case, even after the ink cartridge is exchanged, the corrected conversion information can be continuously utilized. When the corrections are repeated, the conversion information approaches to an appropriate value, and the estimate processing is more precisely performed.

Moreover, in the present embodiment, when it is determined that the ink is absent, the printing data is stored in the storage section. Owing to this, the printing data is not lost.

Moreover, in another embodiment, when the actual consuming state is detected, the remaining printable printing amount is calculated. When the remaining printable printing amount is printed, the printing data prior to the printing is stored in the printing data storage section. Owing to this form, and nor is the printing data lost.

The present invention can be realized in a variety of forms of the aspects. The present invention may be a method of detecting ink consumption, an ink consumption detection apparatus, an ink jet recording apparatus, a control apparatus of an ink jet recording apparatus, an ink cartridge, and the other aspects. In the aspect of an ink cartridge, the ink cartridge has preferably consuming information memory, and provides information necessary to a variety of processings described above.

[Modified Embodiment]

The present embodiment is, needless to say, deformable in the scope of the present invention. For example, the number of liquid sensors is not limited to 4 pieces.

Moreover, in the present embodiment, an ink consuming volume was calculated on the basis of the printing amount. By the way, as afore-mentioned, in an ink jet recording apparatus, the ink is consumed in the head maintenance processing. Therefore, preferably, an ink consuming volume is estimated in consideration of the maintenance. For example, the standard ink volume consumed in the maintenance processing (maintenance consuming volume) has been stored in the consuming information memory 804. The product of the times of maintenance and the maintenance consuming volume is added to the estimate consuming volume. The corrected value is found in consideration of portion of consumption due to the maintenance even in the correction processing of the consumption conversion information.

In the present embodiment, a liquid sensor is composed of a piezoelectric device. As afore-mentioned, a change of acoustic impedance may be detected by employing a piezoelectric device. A consuming state may be detected by utilizing the reflected wave of an elastic wave. A time from generation of an elastic wave to arrival of the reflected wave is found. A consuming state may be detected on any of the principles for utilizing the function of the piezoelectric device.

In the present embodiment, a liquid sensor generates oscillation and generates a detection signal for indicating an ink consuming state as well. To the contrary, the liquid sensor may not generate the oscillation itself. Specifically, both of oscillation generation and detection signal output may not be performed. An oscillation is generated by another actuator. Or, when an oscillation is generated in the ink cartridge accompanied with the movement of the carriage, the liquid sensor may generate a detection signal indicating an ink consuming state. Ink consumption is detected without actively generating an oscillation by employing an oscillation naturally generated by printer operation.

The function of the recording apparatus control section may not be realized by a computer of the recording apparatus. The external computer may be provided with one portion of the whole functions or the whole functions. The external computer may be also provided with a display and speaker In the present embodiment, a liquid container was an ink cartridge, and a liquid utilizing apparatus was an ink jet recording apparatus. However, a liquid container may be an ink container except for an ink cartridge, an ink tank. For example, it may be a sub tank on the side of a head. Moreover, an ink cartridge may be the so-called off carriage type cartridge. Furthermore, the present invention may be applied to a container for containing a liquid except for ink.

Next, another embodiment of the present invention will be described below.

First, the principle of the present embodiment will be described below. In the present embodiment, the present invention is applied to technologies for detecting an ink consumption state within an ink container. An ink consumption state is found in cooperation with two kinds of processings. One of the processings is an estimate consumption calculation processing, and the other processing is an actual consumption detection processing.

In an estimate consumption calculation processing, an estimate consumption state is found by calculating an ink consumption state based on ink consumption of an ink tank. Ink consumption includes ink consumption by printing and ink consumption by the recording head maintenance. The present invention may be applied to either of these, and may be applied to both of them. As for an ink volume, ink consuming volume is found by the number of ink droplets ejected from the recording head or a value of product of the number of ink droplets and an ink volume of each droplet and the like. As for maintenance, ink consumption is found by the number of times of maintenance processings, a processed volume, a volume converted from the processed volume into the number of ink droplets and the like.

In an actual consumption detection processing, an actual consumption state is detected by detecting an oscillating state corresponding to an ink consumption state using a piezoelectric device. Preferably, using a piezoelectric device, a change of acoustic impedance accompanied with ink consumption is detected.

According to an estimate processing, although an error is somewhat accompanied with it, a consumption state is found in detail. On the other hand, a consumption state can be precisely detected by employing a piezoelectric device without any complex sensor sealing structure being provided. Therefore, an ink consumption state is found precisely and in detail by employing both of processings in combination.

In the present embodiment described later, an actual consumption detection processing detects that an ink liquid level passes through the piezoelectric device as an actual consumption state. When an ink liquid level passes through the piezoelectric device, an output of the piezoelectric device is largely changed. Therefore, the passage of liquid level portion is securely detected. Ink consumption states prior to and after the passage of a liquid level portion are found in detail by an estimate consumption calculation processing. Furthermore, when a liquid level portion passes through the piezoelectric device, the error of the estimate calculation processing by then is corrected. Moreover, the reference consumption conversion information as the reference of an estimate calculation processing is corrected. An ink consumption processing is found precisely and in detail by these processings.

It should be noted that in the present embodiment, the actual consumption detection processing detects an actual consuming volume of ink as actual consuming volume, and the estimate consumption calculation processing finds an estimate consuming volume of ink.

Hereinafter, the present embodiment will be described in a more concrete manner with reference to the drawings.

In the present embodiment, an actuator is provided as an embodiment of a piezoelectric device, and used as an actuator.

The fundamental concept of the present invention is to detect a liquid state within a liquid container (including the presence or absence of the liquid within the liquid container, a volume of the liquid, the liquid level, the kind of the liquid and components of the liquid) by utilizing an oscillation phenomenon. Some concrete methods are considered as a method of detecting a liquid state within the liquid container by utilizing an oscillation phenomenon. For example, there is a method such that elastic wave generation means generates an elastic wave with respect to the interior of the liquid container, receiving the reflected wave reflected by the liquid level or opposed wall and detects a medium within the liquid container and a change of its state. Moreover, apart from this, there is a method such that a change of acoustic impedance is detected from the oscillation property of an oscillating object. As a method of utilizing a change of acoustic impedance, a method in which a piezoelectric device having a piezoelectric element or an oscillating section of actuator is made oscillated, and subsequently measures an counter electromotive force generated by the residual oscillation remained in the oscillating section, detects an amplitude of resonance frequency or counter electromotive force waveform and as a result, detects a change of acoustic impedance and a method in which an impedance property of the liquid or an admittance property of the liquid is measured by an impedance analyzer, for example, a measuring apparatus such as transmission circuit and a change of current value and voltage value or a change of current value and voltage value due to frequency when an oscillation is given to the liquid is measured. The present embodiment is based on a method of making an oscillating section of an actuator oscillated and detecting a change of acoustic impedance by detecting resonance frequency and the like.

Figure 66:
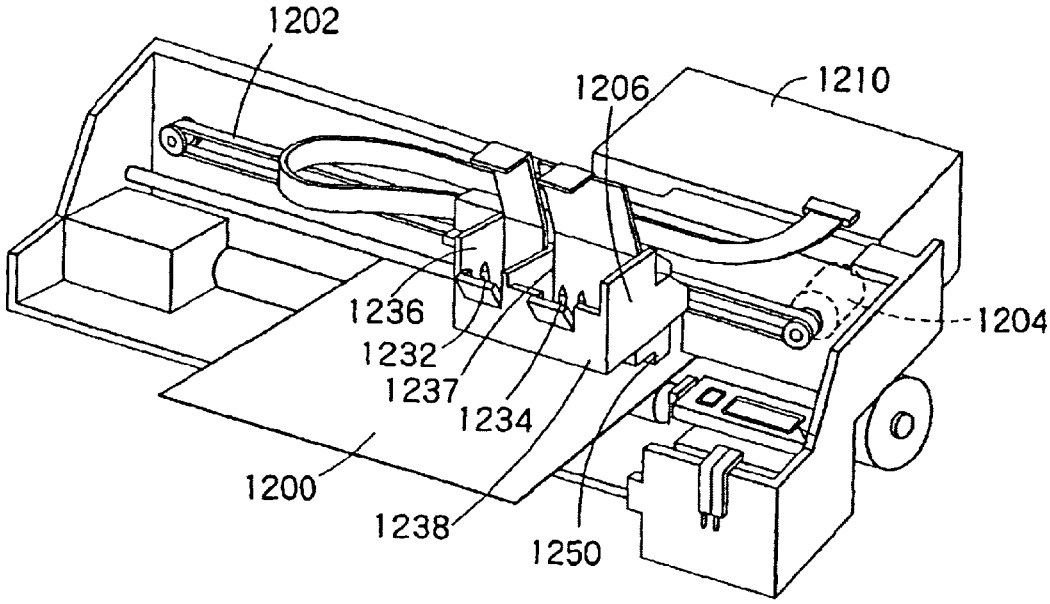
FIG. 66 is a view showing an embodiment of an ink jet recording apparatus.

FIG. 66 is a schematic perspective view of an embodiment of an ink jet recording apparatus applied as an embodiment according to the present invention. A carriage 1206 connected to a drive motor 1204 via a timing belt 1202 has a housing chamber 1236 for housing a black ink cartridge containing black ink in the upper portion and a housing chamber 1237 for housing a color ink cartridge containing color ink. The carriage 1206 further has a recording head 1250 for receiving an ink supply on its lower side. The black ink cartridge and color ink cartridge supply ink to the recording head 1250 via ink supplying needles 1232 and 1234. The timing belt 1202 and the drive motor 1204 are controlled by a recording apparatus control section 1210. The recording head 1205 receiving ink supply discharges ink to a recording medium 1200 while scanning with the timing belt 1202 and the drive motor 1204.

Figure 67:
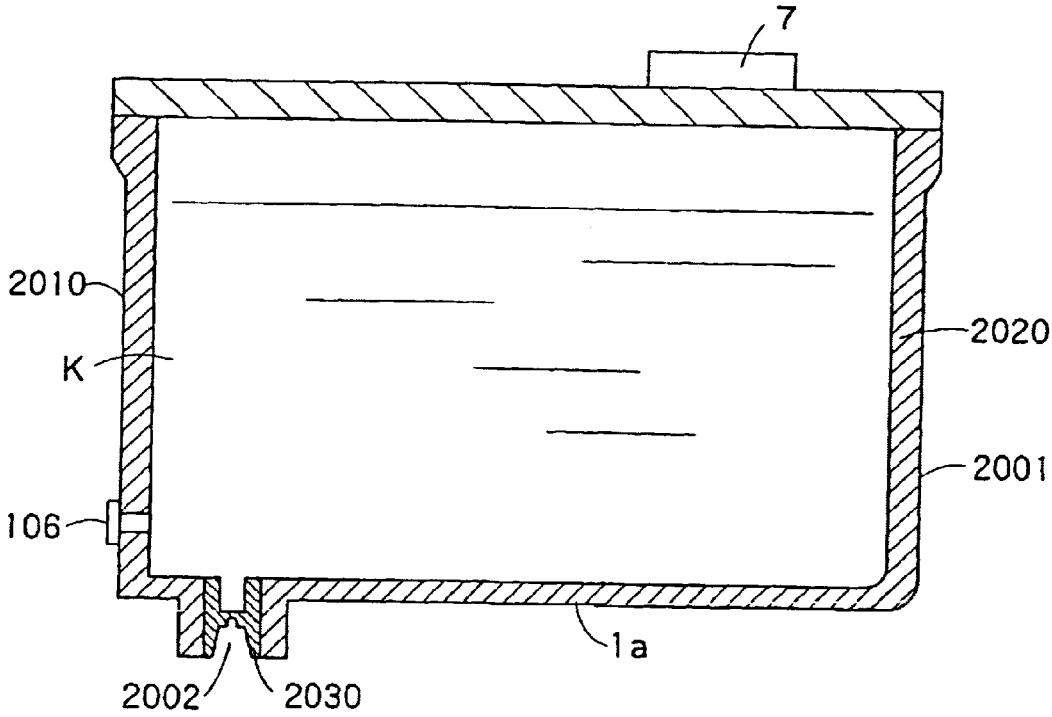
FIG. 67 is a view showing one embodiment of an ink cartridge used for mono color, for example, black color ink.

FIG. 67 is a sectional view of an ink cartridge used for mono color, for example, black color ink applied as an embodiment according to the present invention. An ink cartridge as one embodiment of an ink tank according to the present invention has a container 2001 containing ink, an ink supplying opening 2002 for supplying to the external of the container 2001, and the actuator 106 for detecting a change of acoustic impedance and detecting an ink consuming volume. The ink supplying opening 2002 is arranged on the bottom surface 1*a* located lower with respect to the liquid level of the ink. The actuator 106 is arranged nearby the bottom surface 1*a*, and on a side wall 2010 which is comparatively near to the ink supplying opening 2002 of the side walls of the container 2001. Moreover, on the upper wall of the container 2001, the storage means 7 which has stored information concerning with the ink within the ink cartridge is mounted.

Inside wall of the ink supplying opening 2002, a packing 2030 is provided and arranged. The packing 2030 seals so that the ink does not leak from the container 2001 to the external. On the other hand, when the ink supplying needle 1232 (see FIG. 66) penetrates the packing 2030 and inserted into the ink supplying opening 2002, the ink is supplied from the ink cartridge to the recording head 1250 via the ink supplying needle 1232. Preferably, the packing 2030 is formed with an elastic body, for example, a rubber. Owing to this, otherwise existing gap between the ink supplying needle and the packing 2030 is held in a fluid-tight manner.

Figure 68:
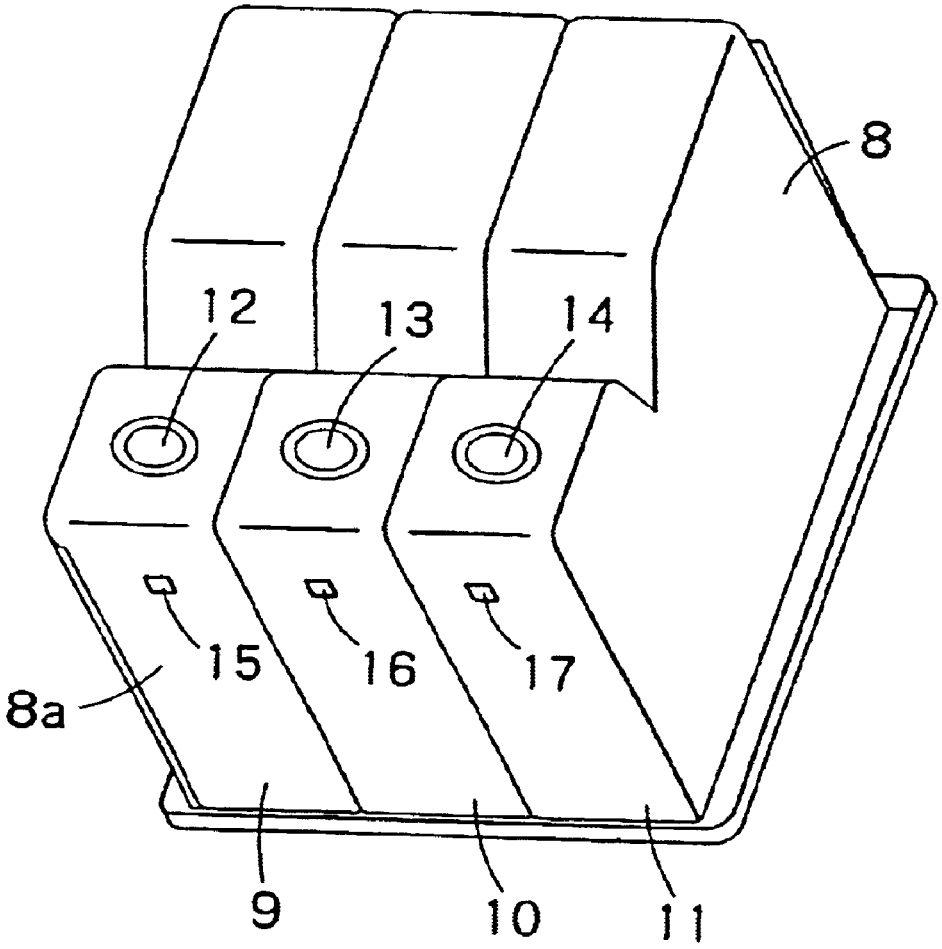
FIG. 68 is a view showing one embodiment of an ink cartridge for housing a plurality of kinds of inks.

FIG. 68 is a perspective view seen from the backside showing one embodiment of an ink cartridge for housing a plurality of kinds of inks. The container 8 is divided into three ink chambers 9, 10 and 11 by partition walls. In each ink chamber, ink supplying openings 12, 13 and 14 are formed. On the side wall 8*a* of the respective ink chamber 9, 10 and 11, the actuators 15, 16 and 17 are mounted so that these can contact with the ink contained in the respective ink chambers via the container 8.

Up to this point, an ink jet recording apparatus, an ink cartridge and actuator of the present embodiment have been described. In this ink cartridge, an actually measured consuming volume, that is to say, an actual consuming volume is detected by employing an actuator. In the present embodiment, further the consuming volume is estimated by measuring a volume of discharging ink droplets from the recording head. The consuming volume found by this estimate is referred to as an estimate consuming volume. Hereinafter, a preferable configuration in which an actual consuming state and an estimate consuming state are combined will be described.

Figure 69:
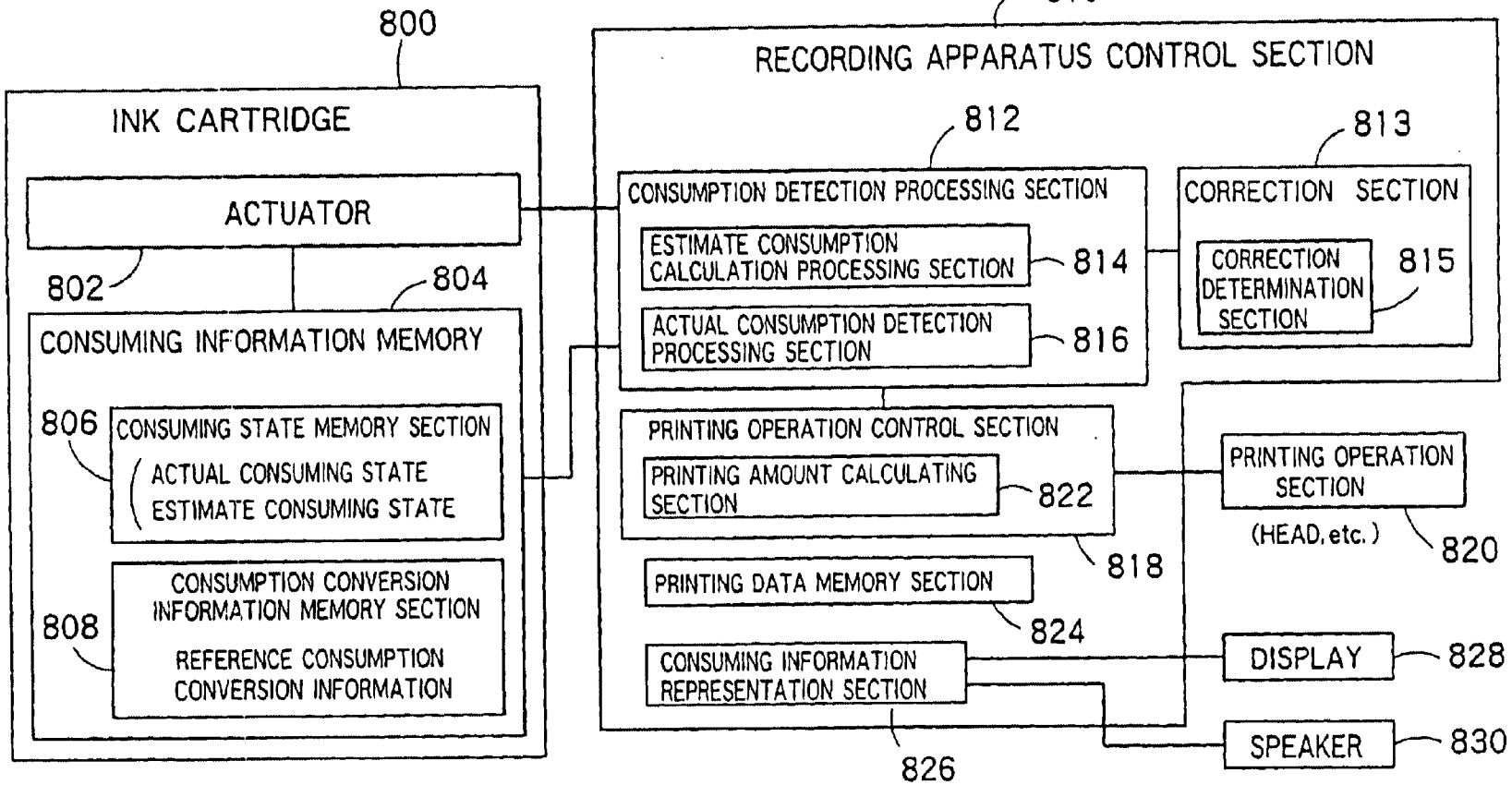
FIG. 69 is a block diagram showing a constitution of employing both of an estimate consumption calculation and an actual consumption detection in combination and an ink jet recording apparatus as well.

FIG. 69 shows a configuration of a system having an ink consuming detection function of the present embodiment. An ink cartridge 800 corresponds to, for example, the cartridge of FIG. 66. The ink cartridge 800 has the actuator 106 and a consuming information memory 804. The actuator 106 is composed of a piezoelectric device. Concretely, the actuator 106 is composed of the above-described actuator and outputs a signal corresponding to an ink consuming state. The consuming information memory 804 is a rewritable memory of EEPROM and the like, and corresponds to the above-described semiconductor storage means (FIG. 67 or FIG. 7, the reference numeral 7).

A recording apparatus control section 810 is composed of a computer for controlling an ink jet recording apparatus. The recording apparatus control section 810 is arranged on the ink jet recording apparatus as the recording apparatus control section 1210. The reference consumption conversion information is stored in the consuming information memory 804. The recording apparatus control section 810 has the consumption detection processing section 812 and the correction section 813.

The consumption detection apparatus is composed of the consumption detection processing section 812, the actuator 106 and the consuming information memory 804. The consumption detection processing section 812 finds a consuming volume by employing the actuator 106 and the consuming information memory 804. Then, the consuming volume which has been found is stored in the consuming information memory 804.

The recording apparatus control section 810 further includes a printing operation control section 818, a printing data storage section 824 and a consuming information presentation section 826. The configuration will be described later.

The consumption detection processing section 812 of the recording apparatus control section 810 includes an estimate consumption calculation processing section 814 and an actual consumption processing section 816.

The actual consumption detection processing section 816 detects an actual consuming volume by controlling the actuator 106, and writes the actual consuming volume in the consuming information memory 804. The actual consuming volume is detected on the afore-mentioned principle. For example, in order to detect an actual consuming state on the basis of acoustic impedance, the actual consumption detection processing section 816 drives a piezoelectric element of the actuator 106. The piezoelectric element outputs a signal indicating the residual oscillation state following the oscillation is generated. An actual consuming volume is detected on the basis of the residual oscillation state changing corresponding to an ink consuming volume.

In the present embodiment, particularly, whether or not the ink liquid level passes through the actuator 106 is detected as an actual consuming volume. An output signal of the sensor largely changes prior to and after the liquid level portion passes through it. Therefore, the passage of the liquid level portion is securely found. Hereinafter, a state prior to the passage of the liquid level portion is referred to as "a state of the presence of the ink" and a state after the passage of the liquid level portion is referred to as "a state of the absence of the ink".

On the other hand, the estimate consumption calculation processing section 814 finds an estimate consuming volume based on an ink consumption of the ink cartridge 800. The ink is consumed by printing in a printing state and the maintenance operation of the recording head even in the non-printing state. Hence, preferably, an ink consuming volume is found from the number of ink droplets used in printing and the number of times of the maintenance. Moreover, either of the printing and the maintenance operation, an ink volume consumed is different depending on the peripheral circumstances where the printing is performed by the recording head. For example, in the case where the temperature of the peripheral of the recording head and the temperature of the ink are comparatively high, the consumed volume of the ink is large. On the other hand, in the case where the temperature on the periphery of the recording head and the temperature of the ink are low, the consumed ink is small. Furthermore, the case where the difference of the humidity on the periphery of the printing site change the consumed volume of the ink is considered. However, within the scope of the present invention, an ink consuming volume may be found from any one of them. Now, a processing in which an ink consuming volume is found from an amount of the printing will be mainly described below. However, the volume (ink volume per droplet) corresponding to the ink droplets ejected from the recording head described below can be applied to the consuming volume of the ink from the recording head in the maintenance. In this case, the processing may be performed by considering the following ink volume per droplet as one time maintenance processing portion. Therefore, the ink consuming times is referred to as the number of the ink droplets ejected from the recording head or the times of the maintenance processing.

The estimate consumption calculation processing section 814 finds an estimate consuming state by calculating an ink consuming volume on the basis of an amount of printing when the ink of the ink cartridge 800 is used. An amount of printing is found by a printing amount calculation section 822 of a printing operation control section 818 and the date is given to the estimate consumption calculation processing section 814. The printing operation control section 818 receives the printing data and controls the printing using the recording head and the like. Therefore, the printing operation control section 818 can grasp the amount of printing. If the amount of printing is grasped, an ink consuming volume corresponding to the amount of printing can be estimated. The estimate consuming volume thus found is, similarly to the actual consuming volume, also stored in the consuming information memory 804 of the ink cartridge 800.

The reference consumption conversion information is employed for an estimate of a consuming volume. The reference consumption conversion information as indicated in FIG. 70 is information indicating relationship between an amount of printing and an estimate consuming state. In the present embodiment, as a factor of the reference consumption conversion information, an ink volume per droplet is employed. In this case, the number of printing dots corresponds to an amount of printing. A consuming volume is estimated by multiplying an ink volume per droplet solely by portion of the number of dots.

It should be noted that as it is clear from the described above, the number of dots is proportional to the ink consuming volume. Therefore, the number of dots may be dealt with as a parameter directly indicating an ink consuming volume.

Furthermore, it is preferable that an estimate of a consuming volume is performed on the basis of the size of an ink droplet. It is known that the recording apparatus ejects a plurality of sizes of ink droplets according to printing data. An ink volume per droplet differs depending on the size of an ink droplet. Therefore, a more precise estimation can be performed by employing different conversion values corresponding to the sizes.

For example, supposing that three kinds of sizes a, b and c of ink droplets are ejected. Supposing that ink volumes of each ink droplet are Va, Vb and Vc. And suppose that the accumulated numbers of ejections of each ink droplet have been Na, Nb and Nc, respectively. In the case, the ink consuming volume is represented as the following expression:

$$Va \cdot Na + Vb \cdot Nb + Vc + Nc.$$

In such a consumption estimation processing, since the number of dots are multiplied and added by employing software means, this processing can be also referred to as soft account processing.

Conversion information for finding an estimate consuming volume is stored in the consuming information memory 804 of the ink cartridge 800. In the consuming information memory 804, the reference consumption conversion information storage section 808 for storing the reference consumption conversion information is provided.

The recording apparatus control section 810 further has a correction section 813. The correction section 813 has a correction determination section 815. The correction section 813 receives an estimate consuming volume and an actual consuming volume of the ink within the ink cartridge from the consumption detection processing section 812.

The correction determination section 815 in the correction section 813 determines whether or not the reference consumption conversion information should be made as an objective of the correction.

Particularly, the correction determination section 815 in the correction section 813 determines whether or not any of unit information (see FIG. 70) out of the unit information included in the reference consumption conversion information is made as an objective of the correction. The correction determination section 815 may determine the specified unit information as an objective of the correction, or determine whole of the reference consumption conversion information as an objective of the correction. Furthermore, it determines whether to be an objective of the correction according to the determination described later.

The correction section 813 corrects unit information which is an object of the correction on the basis of the determination result by the correction determination section 815. In the case where the correction determination section 815 does not determine the objective of the correction, the correction section 813 does not correct the unit information.

The reference consumption conversion information including the corrected unit information is stored in the consumption conversion information storage section 808 as the reference consumption conversion information corrected as a whole. After the reference consumption conversion information is corrected, the estimate consumption calculation processing section 814 detects an estimate consuming volume on the basis of the reference consumption conversion information after the correction.

It should be noted that as another form, the consuming information memory 804 may be provided and arranged on an ink jet recording apparatus, for example, the recording apparatus control section 1210 in the embodiment of FIG. 66. Moreover, one portion of the functions or whole of the functions of the consumption information memory 804 may be provided and arranged on the other external apparatus such as a computer or the like connected to the recording apparatus. Moreover, one portion of the functions or whole of the functions of the recording apparatus control section 810 may be provided and arranged on the external apparatus such as a computer connected to the recording apparatus. Moreover, the reference consumption conversion information may be stored in the recording apparatus control section 810, and still another constitution, for example, may be stored in the external computer connected to the ink jet recording apparatus. Furthermore, multiple reference consumption conversion information different from each other are stored in the consuming information memory 804 or the recording apparatus control section 810. Owing to these, the estimate consumption calculation processing section 814 can find an estimate consuming volume by employing optional reference consumption conversion information out of multiple reference consumption conversion information. Moreover, a modification and determination section (not shown) may be provided instead of the correction section 813, the modification and determination section appropriately may determine the reference consumption conversion information. The estimate consumption calculation processing section 814 can find an estimate consuming volume by employing an appropriate reference consumption conversion information out of multiple reference consumption conversion information data.

In the present embodiment, a value (information) per cartridge ID (serial) is stored in the memory, when the same cartridge is mounted, the stored value may be read and utilized.

Moreover, as a modified embodiment of the present embodiment, the storage section of the reference consumption conversion information is provided on both of the ink cartridge and the recording apparatus. These storage sections may rewrite memory contents in both of them at the same time, or it may be constituted so that data is downloaded from the ink cartridge at the time when the ink cartridge is removed.

FIG. 70 is a table indicating an embodiment of the reference consumption conversion information stored in the consumption conversion information storage section 808. In the present embodiment, as to a factor of the reference consumption conversion information, it is indicated by an ink volume per droplet in a printing state, an ink volume required for one time flashing in a flashing is indicated by pl (picoliter), and an ink volume required for one time cleaning in a cleaning is indicated by ml (milimeter).

The reference consumption conversion information data are classified into printing state information and non-printing state information. Furthermore, the printing state information data are classified into information of dot 1 and dot 2 whose ink droplet volumes are different from each other. Non-printing state information data are classified into information of flashing and maintenance whose consuming volume of the ink are different from each other for maintenance. The flashing indicates maintenance for removing the foreign object of the nozzle opening and recovering its mechanics by discharging ink droplets from all of the nozzle openings of the recording head. The cleaning indicates maintenance in which a negative pressure is given by an absorbing pump and the like from the external of the recording head, the foreign object of the nozzle openings is removed and the mechanics is recovered. Furthermore, The flashing information data are classified into information of flashing 1 and flashing 2 whose volume of the ink droplets are different from each other. The cleaning information data are classified into information of the cleaning 1 and the cleaning 2 whose ink consuming volumes are different form each other.

It should be noted that a factor of the reference consumption conversion information is defined as an ink volume per droplet. Therefore, as to control, flashing and cleaning operations are processed by the printing operation control section 818, the processing operation per one time of the flashing and cleaning are processed as an ink volume per droplet in the printing operation.

Furthermore, the reference consumption conversion information indicates an ink consuming volume in the case where the temperature on the periphery of the recording head is different per classification of the printing state and the non-printing state, the dot 1 and the dot 2, the cleaning 1 and the cleaning 2, and the flashing 1 and flashing 2.

Unit information for classifying the reference consumption conversion information may be classified into two categories as unit information of an ink volume per droplet in whole of the printing state and unit information of an ink volume in the non-printing state. Moreover, unit information may be classified into six categories as units of information of ink volume in the dot 1, the dot 2, the cleaning 1, the cleaning 2, the flashing 1 or the flashing 2.

Furthermore, units of information may be classified into three categories as units of information of ink volumes in the case where the temperatures on the periphery of the recording head are different.

Moreover, units information may be classified into eighteen categories as all of the units of information of ink volumes per droplet which are indicated in the reference consumption conversion information and are different from each other.

It should be noted that in the case where the relationship between the two factors of the reference consumption conversion information are approximately linear, in order to obtain information between the two factors of the reference consumption conversion information, calculation for finding the linear correlation may be performed. For example, in FIG. 70, in order to obtain the information of an ink volume per droplet in the case where the temperature on the periphery of the recording head of the dot 1 is in the range of 1° C. to 25° C., calculation for finding the linear correlation is performed by employing an ink volume per droplet in the respective temperatures. More particularly, an ink volume per droplet when the temperature on the periphery of the recording head is 20° C. can be calculated by the following expression of the linear function:

$$30(pl)+(20(^\circ C.)-10(^\circ C.))*((31(pl)30(pl))/(25(^\circ C.)-10(^\circ C.))=30.66(pl)$$

The correction determination section 815 in FIG. 69 determines whether or not the reference consumption conversion information or unit information shown in FIG. 70 is made an objective of the correction.

For example, the correction determination section 815 determines whether or not the correction is performed according to the difference between an estimate consuming volume of the ink and an actual consuming volume. Because in the case where the estimate consuming volume and the actual consuming volume is approximately identical, the correction is not required. Moreover, the correction determination section 815 determines any of units of information is made an objective of the correction according to the consuming volume or consuming rate per unit information out of the consumed ink. If the unit information whose consuming rate accounting for the rate of the whole consuming volume of the ink is low is corrected, there may be a case where the unit information is corrected to a value apart from the actually measured ink volume per droplet. The correction determination section 815 determines whether or not it is further made an objective of the correction described later.

Figure 71:
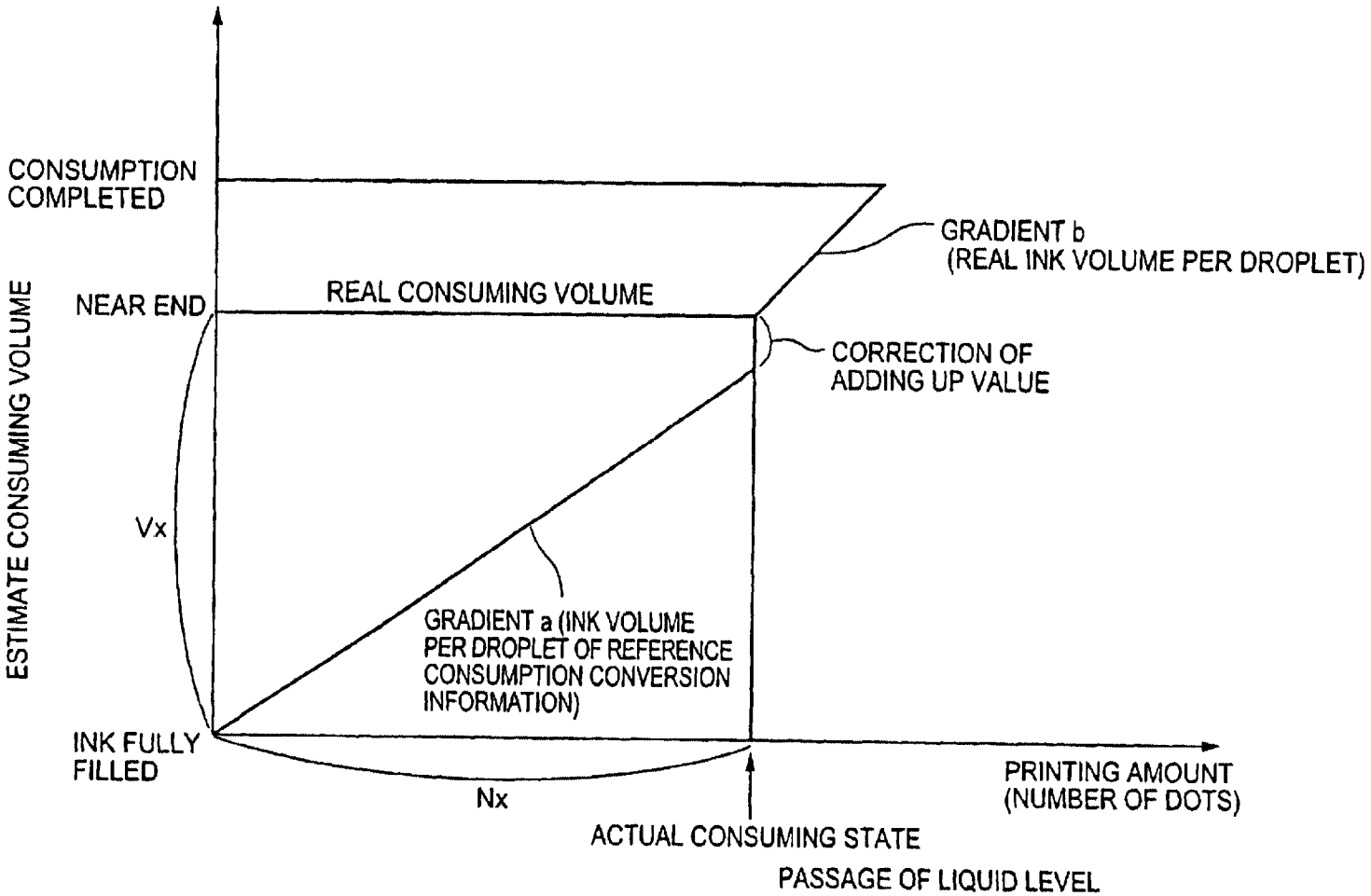
FIG. 71 is a graph showing a consumption detection processing by employing the constitution of FIG. 69.
Figure 72:
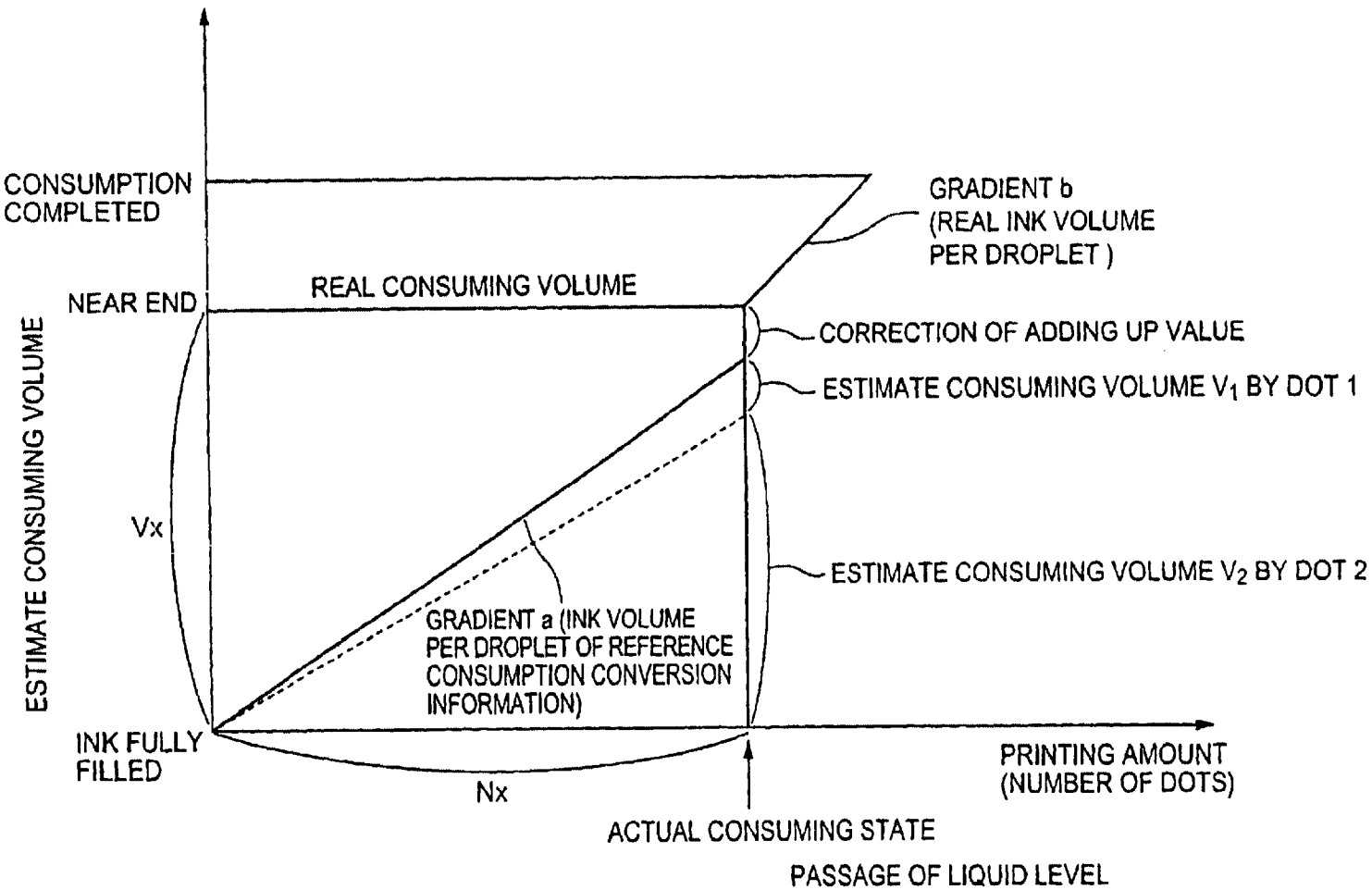
FIG. 72 is a graph showing a consumption detection processing by employing the constitution of FIG. 69.

FIG. 71 and FIG. 72 show an embodiment of an ink consumption detection according to the present embodiment. An ink fully filled state is a state at the time when the usage of a cartridge is started and value of the ink consuming volume is zero. First, an estimate consuming volume is found by multiplying the number of dots by means of the estimate consumption calculation processing section 814, where the reference consumption conversion information which has been read from the consuming state storage section 806 is employed.

An estimate consuming volume is the product of the number of printing dots and an ink volume per dot of the reference consumption conversion information. Therefore, an estimate consuming volume is increase in proportion to the number of dots. The gradient (a) of the estimate consuming volume corresponds to an ink volume per droplet of the reference consumption conversion information.

When the ink consumption progresses, the ink liquid level arrives at the actuator 106. At this time, the actuator 106 detects the passage of the liquid level portion as an actual consuming volume. The actually measured ink consuming volume at the time of passage of the liquid level is a volume of the cartridge whose liquid level is above the actuator 106 and it is previously understood. It is preferable that this information is stored in the consuming information memory 804. The actuator 106 is preferably provided at the position of the liquid level when the ink remaining volume is reduced. Owing to this, the actuator 106 detects the passage of the liquid level in the ink near end state as an actual consuming volume.

As shown in FIG. 71 and FIG. 72, when an actual consuming volume is detected, an error is occurred between the actually measured consuming volume and the estimate consuming volume (adding up value of the ink volume per droplet). Specifically, the gradient (a) of the estimate consuming volume is different from the actually measured ink volume per droplet (b). This is because the conversion value used for the estimation processing is different from the actually measured value.

In general, the reference consumption conversion information includes an error in some degree. The main causes of this error are dispersion of discharging amount of the head, individual differences of ink cartridges and ink jet recording apparatus, conditions for use and their combinations. For example, an ink volume per dot differs due to the variation of ink viscosities among lot numbers. Moreover, there is a case where an error between the actually measured ink volume per droplet and the estimate volume is different per unit information.

FIG. 71 shows a case where all of the ink is discharged according to the mode of any one of the dot 1 or the dot 2 as ink droplet. The units of information are classified into at least two categories of the dot 1 and the dot 2. In the case of the present embodiment, it is not preferable because correcting all of the unit information indicates that units of information of the mode unused are also corrected. Therefore, the correction determination section 815 makes the unit information that ink droplets are discharged an objective of the correction.

Specifically, for example, suppose that the unit information that the ink droplets are discharged is composed of only the dot 1. The correction determination section 815 makes only the unit information of the dot 1 an objective of the correction. Since the reference to be corrected is only an estimate consuming volume and an actual consuming volume of the dot 1; the correction section 813 corrects only the unit information of the dot 1, and does not correct the unit information of the dot 2.

Suppose that the number of dots by the dot 1 from the ink fully filled state to the passage of the liquid level is Nx. Moreover, supposing that a consuming volume from the ink fully filled state to the passage of the liquid level is Vx. In this case, the actually measured ink volume per droplet is represented by Vx/Nx. Therefore, the correction section 813 corrects the unit information into Vx/Nx. It is preferable that the history that the unit information has been corrected is stored in the consuming conversion information storage section 808 of the consuming information memory 804.

Moreover, in the correction section 813, unit information of the dot 1 may be corrected by multiplying unit information by the ratio Vx/V1 of an estimate consuming volume V1=Nx·30 (pl) and an actual consuming volume Vx as correction coefficient. It is preferable that the correction coefficient Vx/V1 is stored in the consuming state storage section 806 of the consuming information memory 804.

Moreover, an estimate consuming volume which is an adding up value is also corrected to the actually measured value. The corrected value is stored in the consuming state storage section 806 of the consuming information memory 804.

After the actual consuming state is detected, the consuming volume is again estimated by multiplying the number of dots. However the subsequent consuming volume is calculated on the basis of the adding up value after the correction. Moreover, in the calculation of the consuming volume, the conversion information after the correction is employed. Specifically, the gradient (b) of the estimate consuming volume after the correction in FIG. 71 is Vx/Nx, which is described above.

In this way, the corrected data is employed, and owing to this, an ink consuming state can be precisely found from the point in time of the ink near end to the point in time of the consumption completion.

Particularly when the volume of the ink is small, it is more important that the ink consuming volume is precisely detected compared to the point in time when the volume of the ink is large. According to the present embodiment, since the estimate consuming volume and the conversion information are corrected at the point in time of the ink near end state, these requirements can be appropriately dealt with it. Owing to this, the poor printing due to the deficiency of the ink can be prevented. Moreover, the appropriate timing of the exchange of the cartridge can be acknowledged to the user.

On the other hand, FIG. 72 shows a case where the ink is consumed based on the both of the unit information of the dot 1 and the dot 2. In this case, it is not clear to what extent the unit information is different from the actually measured ink volume per droplet. For example, in FIG. 72, the ink of the actual consuming volume Vx is consumed based on the both of the unit information of the dot 1 and dot 2. However, it is not clear that the actual consuming volume Vx is consumed by either unit information of the dot 1 or the dot 2. Therefore, it is not clear that the difference between the actual consuming volume Vx and the estimate consuming volume V1+V2 is caused by an error due to the unit information of either the dot 1 or the dot 2.

Therefore, as to the reference of the determination in the correction determination section 815, it determines, first, unit information whose estimate consuming volume is large as an objective of the correction, and second, unit information whose expected value of an error of estimate consuming volume is large as an objective of the correction.

Figures 73A, 73B:
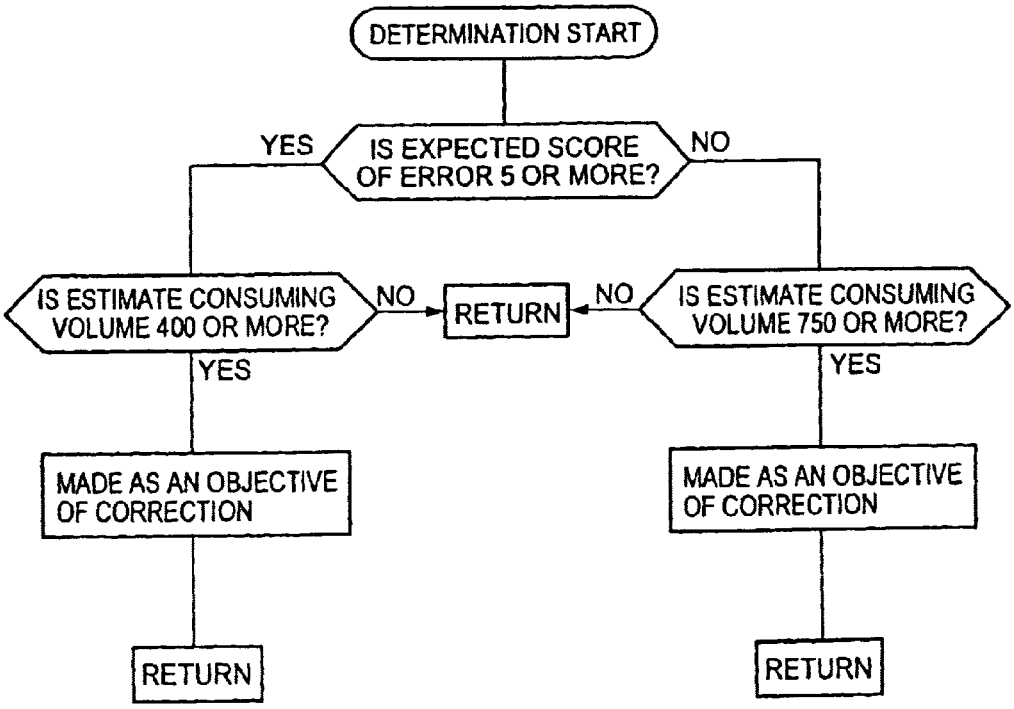
FIG. 73A and FIG. 73B are a table and a flowchart indicating on the determination whether or not a correction determination section 815 determines when the ink is consumed.

FIGS. 73A and 73B are a table indicating that the correction determination section 815 determines whether or not it is to be an objective of the correction and a flowchart of processing of the determination in the case where the ink is consumed on the basis of the both of the unit information of the dot 1 and dot 2 as the embodiment of FIG. 72. The determination of the correction determination section 815 is described by dividing into the case 1 and the case 2.

As for an expectation of an error of the estimate ink volume per droplet with respect to the actually measured ink volume per droplet, an error which can be empirically expected by design, manufacture, usage of the ink jet recording apparatus and an ink cartridge is represented by scores.

For example, the case 1 and the case 2 are cases where it can be expected that an error generated by employing the dot 2 whose ink droplet is comparatively small is larger than an error generated by employing the dot 1 whose ink droplet is comparatively larger due to an error caused by the design of the recording head and the manufacture of it. There is also a case where as to an error of an estimate ink volume per droplet with respect to the actually measured ink volume per droplet, is can be expected that an error caused by employing the dot 2 is smaller than that of the dot 2. For an expectation of an error of an estimate ink volume per droplet with respect to the actually measured ink volume per droplet, expected scores of an error (hereinafter, referred to as expected score of an error) are used.

The case 1 is a case where an estimate consuming volume of the ink of the dot 2 is larger than that of the dot 1. The case 2 is a case where an estimate consuming volume of the ink of the dot 2 is smaller than that of the dot 1.

According to the flowchart of FIG. 73B, the processing of the determination of whether or not the dot 1 and the dot 2 are made objectives of the correction will be described below. First, the correction determination section 815 determines the expected scores of an error. In the present embodiment, whether or not the expected score of an error is 5 or more is determined. Next, whether or not the estimate consuming volume is the predetermined value or more is determined. In the present embodiment, when the expected score of an error is 5 or more, whether or not the estimate consuming volume is 400 or more is determined, and when the expected score of an error is 5 or less, whether or not the estimate consuming volume is 750 or more is determined. Specifically, in the case where it is expected that an error of the estimate ink volume per droplet with respect to the actually measured ink volume per droplet is large, the relevant unit information is made an objective of the correction even if the estimate consuming volume is comparatively small. On the other hand, in the case where it is expected that an error of the estimate ink volume per droplet with respect to the actual ink volume per droplet and the expected score of an error is the predetermined value or less, the relevant unit information is not made an objective of the correction except for the case where the estimate consuming volume is comparatively large.

More particularly, in the case 1, the expected score of the error of the dot 1 is 3. Therefore, whether or not the estimate consuming volume of the dot 1 is 750 or more is determined. Since the estimate consuming volume of the dot 1 is 200 and that is less than 750, the unit information relevant to the dot 1 is determined as not an objective of the correction. On the other hand, the expected score of the error of the dot 2 is 8. Therefore, whether or not the estimate consuming volume of the dot 1 is 400 or more is determined. Since the estimated consuming volume is 800 and that is more than 750, the unit information relevant to the dot 2 is determined as an objective of the correction. On the other hand, in the case 2, the estimate consuming volume of the dot 1 is 700, and that of the dot 2 is 300. Therefore, neither of them is determined as objectives of the correction.

In the present embodiment, although the threshold of the expected score of the error is defined as 5, the predetermined value of the estimate consuming volume which is the reference of comparison is set as 400 or 750, these values can be set previously at an optional value. Moreover, the multiple thresholds of the expected score of the error may be provided. The values of the estimate consuming volumes corresponding to the cases where the respective expected score of the errors are the threshold or more, and the threshold or less are set. It is also possible that unit information relevant to the case where it exceeds over the value of this estimate consuming volume is determined as an objective of the correction. Furthermore, the unit information to be an objective of the correction may be determined by comparing the vale obtained by multiplying the expected score of the error by the estimate consuming volume with the predetermined value.

The predetermined values which are the reference of the determination such as an expected score of the error, the predetermined value of the estimate consuming volume which is the reference of comparison and the like are stored in the external computer connected to an memory which is provided and arranged on the consuming information memory 804 and an ink jet recording apparatus or connected to an ink jet recording apparatus of FIG. 69.

Next, a corrected value in the case where the ink is consumed by the both of the modes of the dot 1 and the dot 2 will be described with reference to FIG. 72. An actual consuming volume by the dot 1 and the dot 2 is Vx. The estimate consuming volume corresponding to it is V1+V2. Therefore, a correction coefficient is defined as Vx/(V1+v2), the reference consumption conversion information is corrected by multiplying the unit information which has been an objective of the correction determined by the correction determination section 815 by this correction coefficient.

When the reference consumption conversion information is corrected, the reference consumption conversion information after the correction is used, and the estimate calculation processing is carried out. Owing to this, a more precise detection can be realized.

When the actual consuming volume is detected, the estimate consuming volume which is adding up value is corrected to the actual consuming volume. The corrected value is stored in the consuming state storage section 806 of the consuming information memory 804.

A determination of the estimate consuming volume may be performed without performing the determination of the expected score of the error in the flowchart of FIG. 73B not according to the embodiment of FIG. 73A and FIG. 73B. Specifically, by defining the determination conditions of the correction as the estimate consuming volume being more than the predetermined value, the correction section 813 may determine the unit information satisfying the determination conditions as an objective of the correction. Moreover, by defining the determination conditions of the correction instead of the determination conditions of the estimate consuming volume that the number of dots discharged from the recording head is more than the predetermined value, the correction section 813 may determine the unit information satisfying this determination conditions as an objective of the correction. Furthermore, by defining the determination conditions of the correction as the unit information whose estimate consuming volume ratio accounting for the ratio of the whole estimate consuming volume is large and whose estimate consuming volume ratio accounting for the ratio of the whole estimate consuming volume is more than the predetermined ratio, the unit information satisfying this determination conditions may be determined as an objective of the correction. Moreover, for the error which is large error or small of the estimate ink volume per droplet with respect to the actual ink volume per droplet, the unit information to be an objective of the correction may have been previously set without determining it by the correction determination section 815.

Figure 74A:
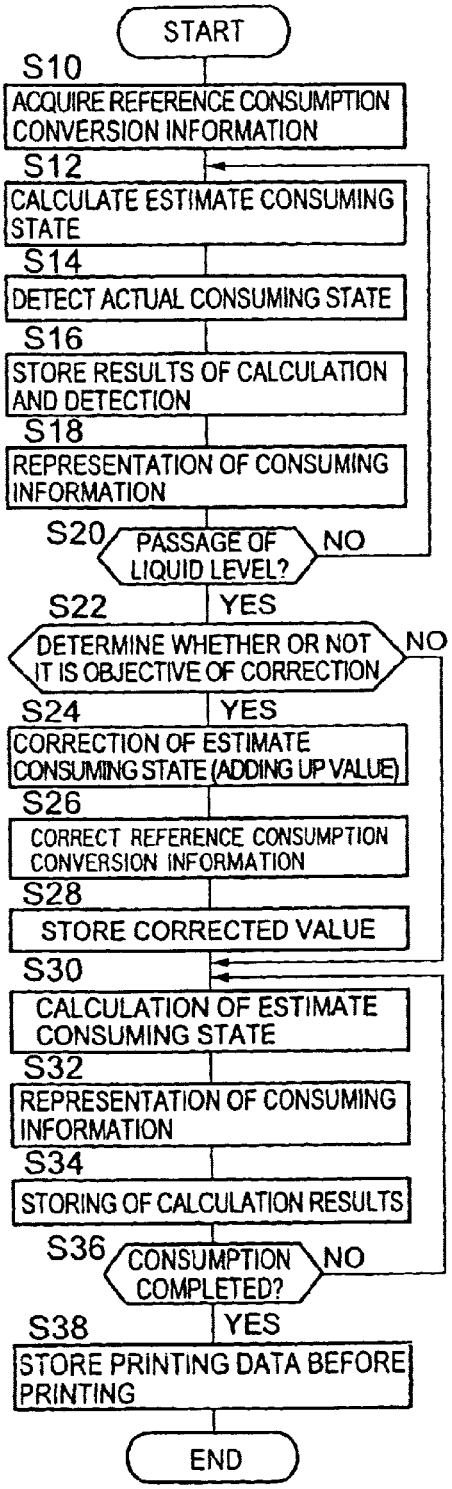
FIG. 74A and FIG. 74B are flowcharts showing a consumption detection processing by employing the constitution of FIG. 69.
Figure 74B:
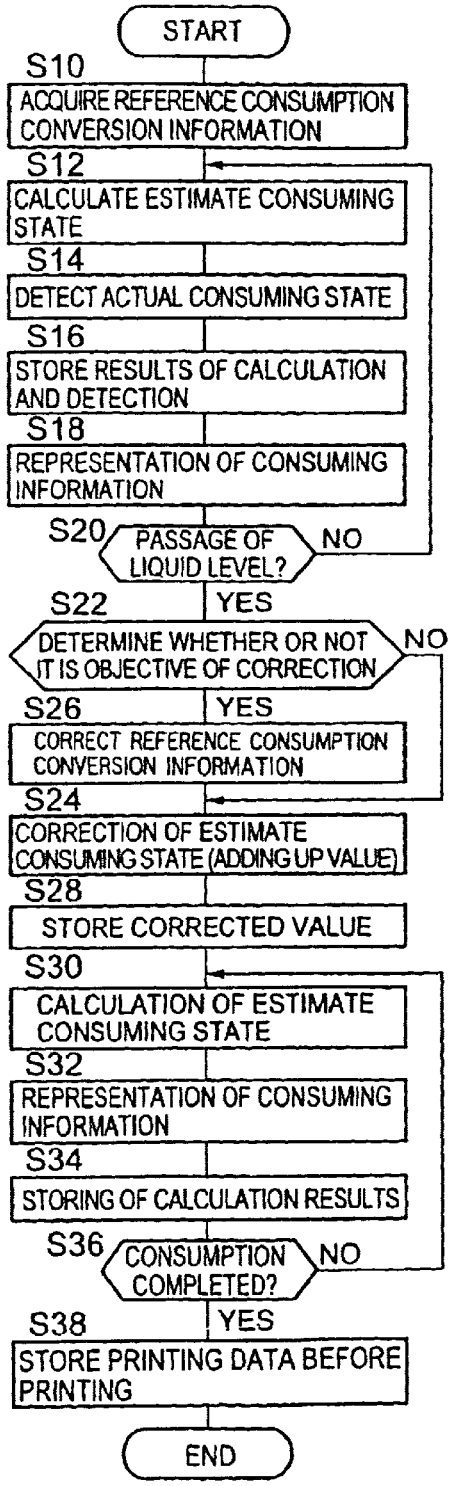

FIG. 74A and FIG. 74B show a detection processing by the consumption detection processing section 812 and a correction processing of the correction section 813. When the ink cartridge 800 is mounted, the reference consumption conversion information is acquired from the consumption conversion information storage section 808 (S10). Then, the estimate consuming state is calculated by the estimate consumption calculation processing section 814 (S12). Moreover, the actual consuming volume is detected using the actuator 106 by the actual consumption detection processing section 816 (S14). Until the ink liquid level arrives at the actuator 106, "a state of the presence of the ink" is detected as an actual consuming state.

An actual consuming volume may be detected at the appropriate intervals. Moreover, when the estimate consuming volume is small, the frequency of the detection is made less, and when the estimate consuming volume arrives at the predetermined switching value, the frequency of the detection is made more. Or, until the estimate consuming volume arrives at the predetermined switching value, the actual consuming state may not be detected.

The predetermined switching value is set at the appropriate value before the ink liquid level arrives at the actuator 106. Preferably, the predetermined switching value is a consuming volume at the point in time when the ink liquid level approaches to the actuator 106. The switching value is set so that the difference between a consuming volume at the time of switching and a consuming volume at the time of the passage of the liquid level is larger than the maximum error of the estimate consuming volume at the time of the passage of the liquid level.

Owing to these processings, an actual consumption detection when the possibility of the detection of the passage of the liquid level is low is suppressed. Therefore, operations of the piezoelectric device and the processings for those operations can be made less. The piezoelectric devices can be efficiently utilized.

Returning to FIG. 74A, after the step S14, the calculation results of the estimate consuming volume and the detection results of the actual consuming state are stored in the consuming state storage section 806 (S16). Next, the consuming information is represented to the user (S18). The processing of the step S18 is performed by the consuming information representation section 826 (FIG. 69) of the recording apparatus control section 810. This processing will be further described later.

Next, whether or not the passage of the liquid level is detected as an actual consuming state (S20). If it is indicated as NO, returns to the step S12. In the next routine, the results are obtained by adding the subsequent consuming volume to the estimate consuming volume of the last time as an estimate consuming volume.

When the liquid level passes through the sensor, the actual consuming state is switched from the state of the presence of the ink to the state of the absence of the ink. In the flowchart of FIG. 74A, proceeds to the case of YES in the step S20. Subsequently, the state of the absence of the ink is continuously detected. In the case where only one of the actuator 106 is provided and arranged on the container as an ink cartridge of FIG. 67, the actual consuming volume cannot be detected any more. Hence, the detection of the actual consuming state is terminated. Owing to these processings, the operations of the piezoelectric devices and the processings for those operations can be made less, and accordingly, the piezoelectric devices can be efficiently utilized.

Next, in the step S21, whether or not the correction determination section 815 of the correction section 813 corrects is determined.

In the case where the difference between the actual consuming volume and the estimate consuming volume is approximately zero, or smaller than the predetermined value, it is determined that the correction determination section 815 does not correct. Owing to this, the processing proceeds without interruption to the calculation of the estimate consuming volume in the step S30 without the reference consumption conversion information being corrected by the correction section 813.

It should be noted that in the error between the actual consuming volume and the estimate consuming volume is approximately zero, the correction section 813 is not necessary to correct the estimate consuming volume (adding up value) in the step S24. Moreover, in the case where the difference between the actual consuming volume and the estimate consuming volume is smaller than the predetermined value, it may be set so that the correction section 813 corrects the estimate consuming volume (adding up value) in the step S24 without performing the correction of the reference consumption conversion information.

On the other hand, in the case where the difference between the actual consuming volume and the estimate consuming volume is larger than the predetermined value, the correction determination section 815 determines that it corrects the reference consumption conversion information. Next, in the step S22, the correction determination section 815 selects the unit information which is an objective of the correction. In the step S24, the correction section 813 corrects the estimate consuming volume (adding up value), in the step S26, the correction section 813 corrects the reference consumption conversion information. These corrected values are stored in the consuming state storage section 806 and the consumption conversion information storage section 808 (S28).

In the step S30, an estimate consuming state is calculated similarly to the S12. However, differing from the step S12, the reference consumption conversion information after the correction is employed. Moreover, subsequent consuming volumes are calculated by defining the estimate consuming volume (adding up volume) corrected in the step S24 as the reference. Then, in the step S32, the consuming state is represented to the user, in the step S34, the calculation results of the consuming volume are stored in the consuming state storage section 806. In the step S36, whether or not the estimate consuming volume arrives at the whole volume of the ink (consumption completed or not) is determined, if it is indicated as NO, returns to the step S30. In the consumption is completed, that is to say, in the case where the ink is absent, the printing data prior to the printing is saved (S38).

Moreover, as shown in FIG. 74B, the order of the correction of the adding up value (S24) and the correction of the consumption conversion information (S26) may be exchanged and processed. By performing the processing in the flowchart of FIG. 74B, in the case where the correction determination section 815 determines that it does not define the reference consumption conversion information as an objective of the correction, the correction section 813 can continue the processing by correcting only the adding up value without correcting the reference consumption conversion information.

In the above-described processing, the processing of correction of the unit information during the printing has been described. By the way, in an ink jet recording apparatus, the maintenance processing of the recording head is carried out at the proper intervals. The ink is consumed in the maintenance processing, and it is possible that its consuming volume is as much as it cannot be neglected. Therefore, an ink volume per droplet also includes the consuming volume from the recording head due to the maintenance.

Specifically, the reference consumption conversion information stored in the recording apparatus control section may have an ink consuming volume of the maintenance processing in the non-printing state as shown in FIG. 70 as a unit information. Similar to the case where an ink volume per droplet is multiplied at the time of the printing state, the estimate consumption calculation processing section multiplies the maintenance times by a consuming volume per one time. Owing to this, the ink consuming volume due to the maintenance is estimated. The sum of the consuming volume and the consuming volume found from the number of the ink droplets is found as the estimate consuming volume. The correction determination section 815 in the correction section 813 determines whether or not any of unit information (see FIG. 70) out of the unit information included in the reference consumption conversion information is made as an objective of the correction on the basis of the estimate consuming volume. The correction determination section 815 may determine the specified unit information as an objective of the correction, and may determine whole of the reference consumption conversion information as an objective of the correction. In such a case, it may be classified into the printing state and non-printing state and may define the respective whole as unit information. Moreover, the maintenance of non-printing state may be classified into flashing and maintenance and may define the respective as unit information. Furthermore, the flashing and cleaning may be classified into the flashing 1 and flashing 2 and the cleaning 1 and the cleaning 2 and may the respective as unit information.

An ink consuming volume may be represented by the number of droplets. Since the ink consuming volume are proportional to the number of droplets. In this case, a consuming volume due to the maintenance may be converted into the number of ink droplets. This converted number of ink droplets is added to the number of ink droplets due to printing. The added number of droplets is treated as a parameter indicating an ink consuming volume.

Moreover, the reference consumption conversion information may be represented as a volume per droplet as the present embodiment, however, its form of representation is not particularly limited. For example, since a volume of the dot 1 is threefold of the volume 10 pl of the dot 2, that is to say, 30 pl, defining 10 pl as the reference, and may be represented as its ratio 3. Furthermore, the reference consumption conversion information may be represented by mass of an ink volume per droplet.

Moreover, the reference consumption conversion information data of the present embodiment are also classified by the temperatures on the periphery of the recording head on an ink volume per ink droplet. However, it may be classified by the other environmental factors on the periphery of the recording head without limiting to the temperatures on the periphery of the recording head. For example, it may be classified by humidity and atmospheric pressure.

In order to measure the temperature, humidity and atmospheric pressure on the periphery of the recording head, the thermometer, hygrometer and barometer are arranged on the periphery of the nozzle opening of the recording head (not shown). It is preferable that the thermometer, hygrometer and barometer are small and light apparatus not to have an influence on the scanning of the recording head. Furthermore, it is more preferable if the thermometer, hygrometer and barometer can be remotely controlled.

According to the present embodiment, an ink consuming volume is estimated by estimating an ink consuming volume due to maintenance in addition to an ink consuming volume due to printing, finding the sum of both and considering an ink volume per droplet influenced by the peripheral circumstances of the recording head.

Next, a constitution for utilizing a consuming volume obtained as described above will be described with reference to FIG. 69. The printing operation control section 818 is a control section for controlling the printing operation section 820 and realizing the printing according to the printing data. The printing operation section 820 is composed of a printing head, ahead moving apparatus, a paper feeder and the like. The printing amount calculation section 822 of the printing operation control section 818 gives an amount of the printing for estimate of an ink consuming volume to the consumption detection processing section 812.

The printing operation control section 818 operates on the basis of the consuming volume detected by the consumption detection processing section 812. In the present embodiment, when it is determined that the ink is absent from the estimate consuming volume, operations that consumes the ink such as the printing operation and maintenance operation are stopped. Then, the printing data prior to the printing is stored in the printing data storage section 824. This printing data is stored after a new ink cartridge is mounted. This processing corresponds to the step S38 of FIG. 74A and FIG. 74B.

It should be noted that it is preferable to determine the absence of the ink in a state where the appropriate slight ink volume remains in order to prevent the poor printing due to the deficiency of the ink.

Moreover, there is a case where it is not preferable the printing is stopped on the way of printing one sheet. In this case, it is preferable to determine whether or not the ink is deficient on the basis of one sheet of the paper as the reference. For example, an ink volume necessary to print one sheet of the paper is appropriately set. It is determined that the ink is absent at the point in time when the remaining volume is less than its ink volume.

A similar determination may be performed on the basis of the printing data. For example, suppose that document data in bulk is printed. It is determined that the ink is absent at the point in time when the remaining volume is less than the ink volume corresponding to the number of printing sheets.

In another processing embodiment of the printing operation control section 818, when the actual consuming state is detected by the actual consumption detection processing, the remaining printable amount is calculated based on the actual consuming state. When the remaining printable amount has been printed, the printing data prior to the printing is stored in the printing data storage section 824. The processing is securely performed on the basis of the actual consuming state.

In still another processing embodiment, another constitution is controlled on the basis of the detected consuming state. For example, an ink refilling apparatus, an ink cartridge exchanging apparatus and the like are provided, these apparatus may be controlled. Specifically, on the basis of the consuming state (actual consuming state and/or estimate consuming state), the necessity or an ink refilling, an ink tank exchanging, or the timing is determined, and refilling or exchange is performed according to the results of the determination. The user may be, needless to say, urged to refill the ink or exchange the ink tank.

The consuming information representation section 826 of FIG. 69 is another constitution of utilizing a consuming state. The consuming information representation section 826 represents the consuming state information detected by the consumption detection processing section 812 to the user using a display 818 and a speaker 820. On the display 818, graphical forms showing the consuming state and the like are displayed, acknowledging sound or synthetic voice is outputted from the speaker 820. An appropriate operation may be guided by the synthetic voice.

The consuming state may be represented corresponding to the requirements of the user. Moreover, it may be represented periodically at appropriate intervals. Moreover, when an appropriate event, for example, events such as the start of the printing or the like is occurred, it may be represented. Moreover, when the ink remaining volume is the predetermined value, it may be automatically represented.

In the present embodiment, the reference consumption conversion information is corrected, however, the actual ink volume per droplet may be corrected by changing the voltage applied to the recording head without correcting the reference consumption conversion information. In such a case, the correction section 813 corrects the corrected estimate consuming volume (adding up value) into the actual consuming volume. Moreover, the correction section 813 transmits the predetermined signal to the printing operation control section 818 and corrects the voltage applied to the printing operation section 820.

Figure 75:
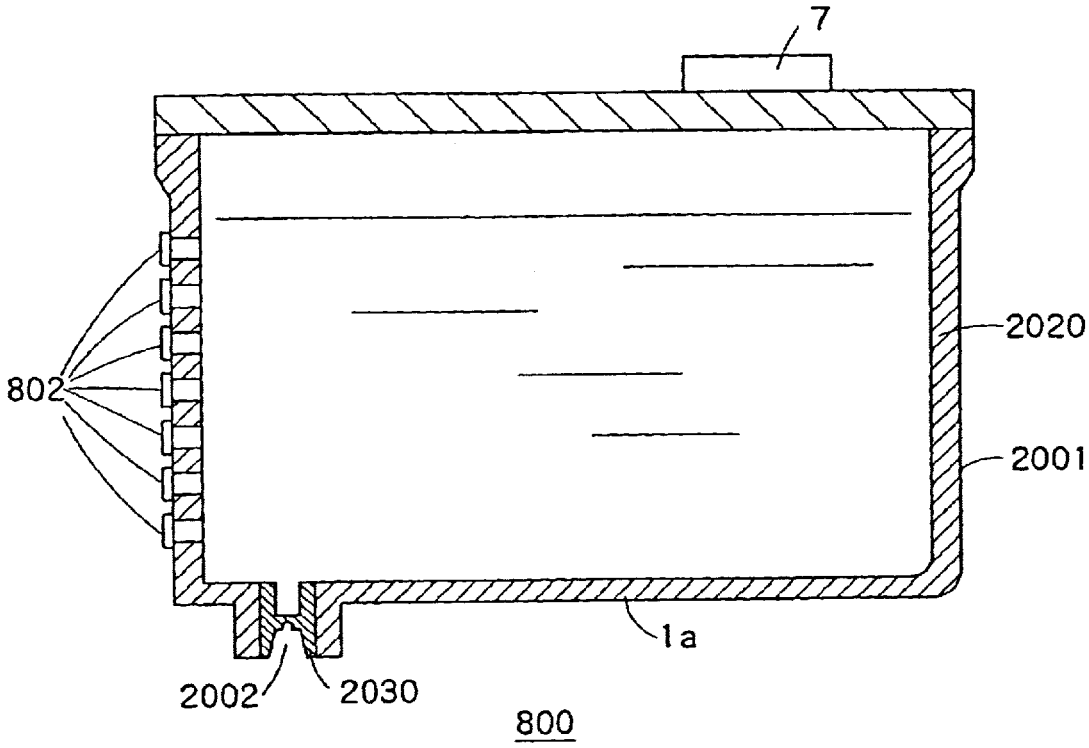
FIG. 75 is a sectional view showing an ink cartridge having a plurality of actuators applied as an embodiment according to the present invention.

FIG. 75 shows a sectional view of the ink cartridge 800 having a plurality of the actuators 802. In the present embodiment, seven pieces of actuators are arranged. The seven sensors are arranged along the direction in which the liquid level is lowered accompanied with the ink consumption at the seven different height positions separated from each other. Such a configuration is suitable for an ink cartridge containing comparatively a large volume of ink, for example, the so-called off carriage type ink cartridge. An off carriage type ink cartridge is fixed away from the recording head and employed. The ink cartridge and the recording head are connected via a tube or the like.

Figure 76:
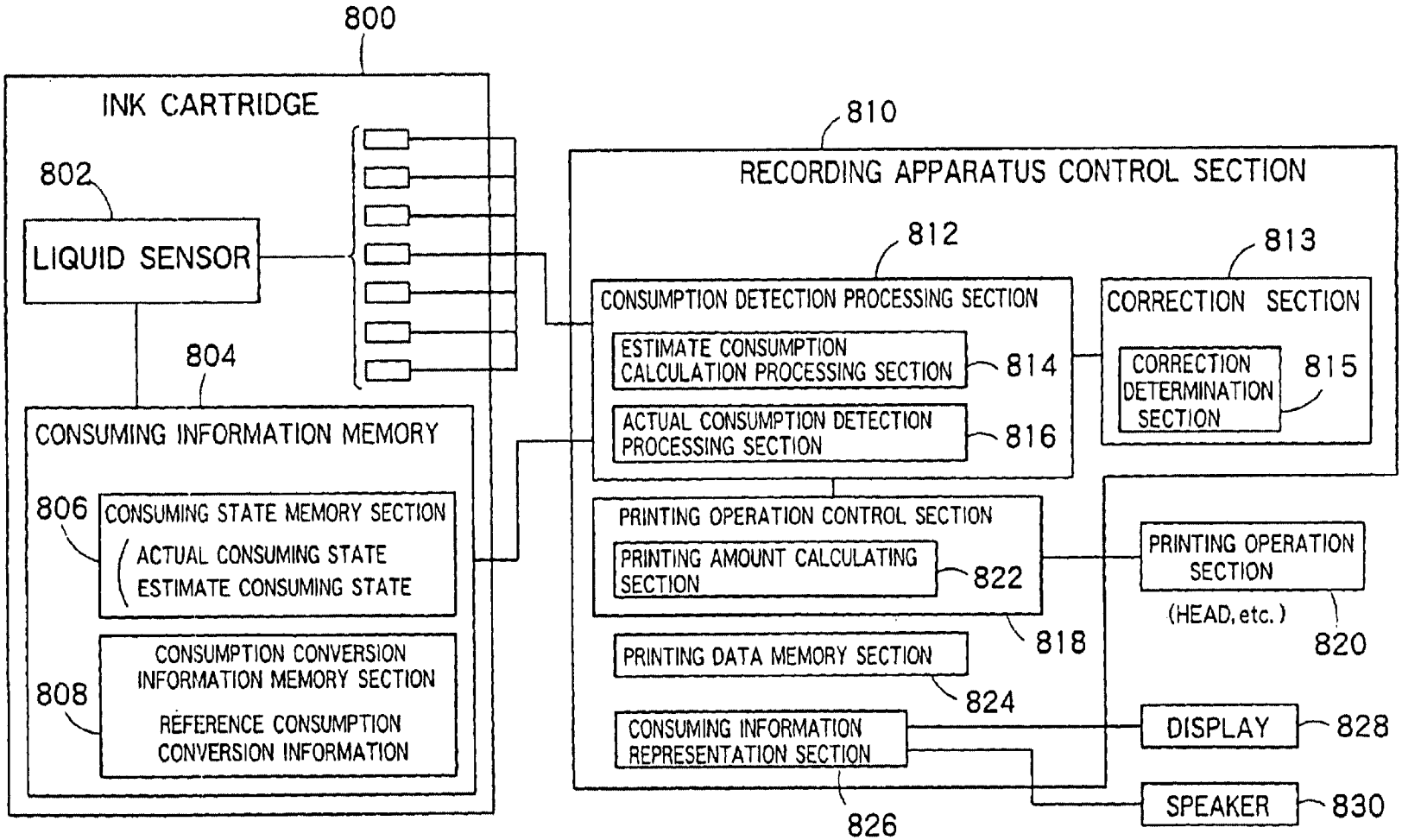
FIG. 76 is a diagram showing an embodiment of an ink jet recording apparatus of another embodiment.

FIG. 76 shows an ink jet recording apparatus having an ink consumption detection function of the present embodiment. In the present embodiment, differing from the constitution of FIG. 69, the multiple liquid sensors 802 are provided on the ink cartridge 800. In the embodiment of FIG. 76, seven pieces of sensors. These multiple liquid sensors 802 are controlled by the consumption detection processing 812 of the recording apparatus control section 801, and more particularly, controlled by the actual consumption detection processing section 816.

The consumption detection processing section 812 detects the consuming state by employing the seven liquid sensor 802 individually. Therefore, consuming volumes (passage of the liquid level) in the seven different stages are detected.

It should be noted that preferably, all of the liquid sensor are not used at the same time but in turn. Suppose that one of the sensors detects the passage of the liquid level. Specifically, suppose that the detection result of one sensor is changed from the state of presence of the ink to the state of absence of the ink. The use of the sensor is stopped and one sensor located lower next to the relevant sensor is used. When the lowermost sensor detects the state of the absence of the ink, the actual consumption detection using sensors is terminated. Owing to these processings, the operations and the processings for them can be made less and sensors can be efficiently utilized.

Furthermore, the recording apparatus control section 810 has the correction section 813. The correction section 813 has the correction determination section 815. The operation of the correction section 813 is similar to that of the correction section 813 of FIG. 69.

Next, the correction processing of the reference consumption conversion information in a system of the present embodiment will be described below. In the present system, when the passages of the liquid level are detected two times, the reference consumption conversion information is corrected. In the detection of the first time, the passage of the liquid level is detected by a certain sensor. Next, in the detection of the second time, the passage of the liquid level is detected by the sensor located at the lower position next to the sensor detecting first. When this second time detection is performed, the corrected reference consumption conversion information is corrected from the printing amount between two detections. More particularly, an estimate consuming volume is found by the estimate consumption calculation processing section 814 by utilizing the detections of two times of the consumption detection processing section. The actual consumption detection processing section 816 detects an actual consuming volume between the two sensors. The correction section 813 corrects the reference consumption conversion information on the basis of the estimate consuming volume and the actual consuming volume as explained in FIG. 69 through FIG. 74A and FIG. 74B.

Suppose that the use of an ink cartridge is started from fully filled state and the sensor located at the highest position detects the passage of the liquid level. In this case, the first detection of the liquid level is considered as the second time liquid level, and the correction processing is performed. An amount of the printing from the fully filled state to the detection of the liquid level is found. The reference consumption conversion information is corrected from an ink volume existed in the higher portion than the sensor located at the highest position and an amount of the printing.

Moreover, when the ink cartridge is continuously used in the same recording apparatus, the passages of the liquid level are detected one after another. In this case, whenever the passage of the liquid level is detected, the reference consumption conversion information is corrected. The reference consumption conversion information is found from the printing amount between the previous detection and the detection of this time. In this way, whenever the passage of the liquid level is detected, the reference consumption conversion information is updated. It should be noted that it is preferable the corrected reference consumption conversion information and its corrected value are stored in the consuming information memory 804.

Even in the case where the ink cartridge used once by the user is removed from the ink jet recording apparatus and that ink cartridge is mounted again, the ink consuming volume within the ink cartridge can be precisely detected.

The multiple reference consumption conversion information which are different from each other may be stored in the consuming information memory 804 or the recording apparatus control section 810. Owing to this, the estimate consumption calculation processing section 814 can find the estimate consuming volume by employing optional reference consumption conversion information out of the multiple reference consumption conversion information. Moreover, a modification and determination section (not shown) may be provided instead of the correction section 813, and the modification and the determination section may an appropriate reference consumption conversion information. The estimate consumption calculation processing section 814 can find an estimate consuming volume on the basis of the determination results of the modification and determination section by employing an appropriate reference consumption conversion information out of the multiple reference consumption conversion information. Furthermore, the number of the reference consumption conversion information to which 1 has been previously added to the number of sensors may be stored in the consuming information memory 804. Owing to this, whenever the ink liquid level passes through the sensors within the ink cartridge, the modification and determination section determines the predetermined or optional reference consumption conversion information. The estimate consumption calculation processing section 814 can find an estimate consuming volume on the basis of the determination results of the modification and determination section by employing the reference consumption conversion information.

Figure 77:
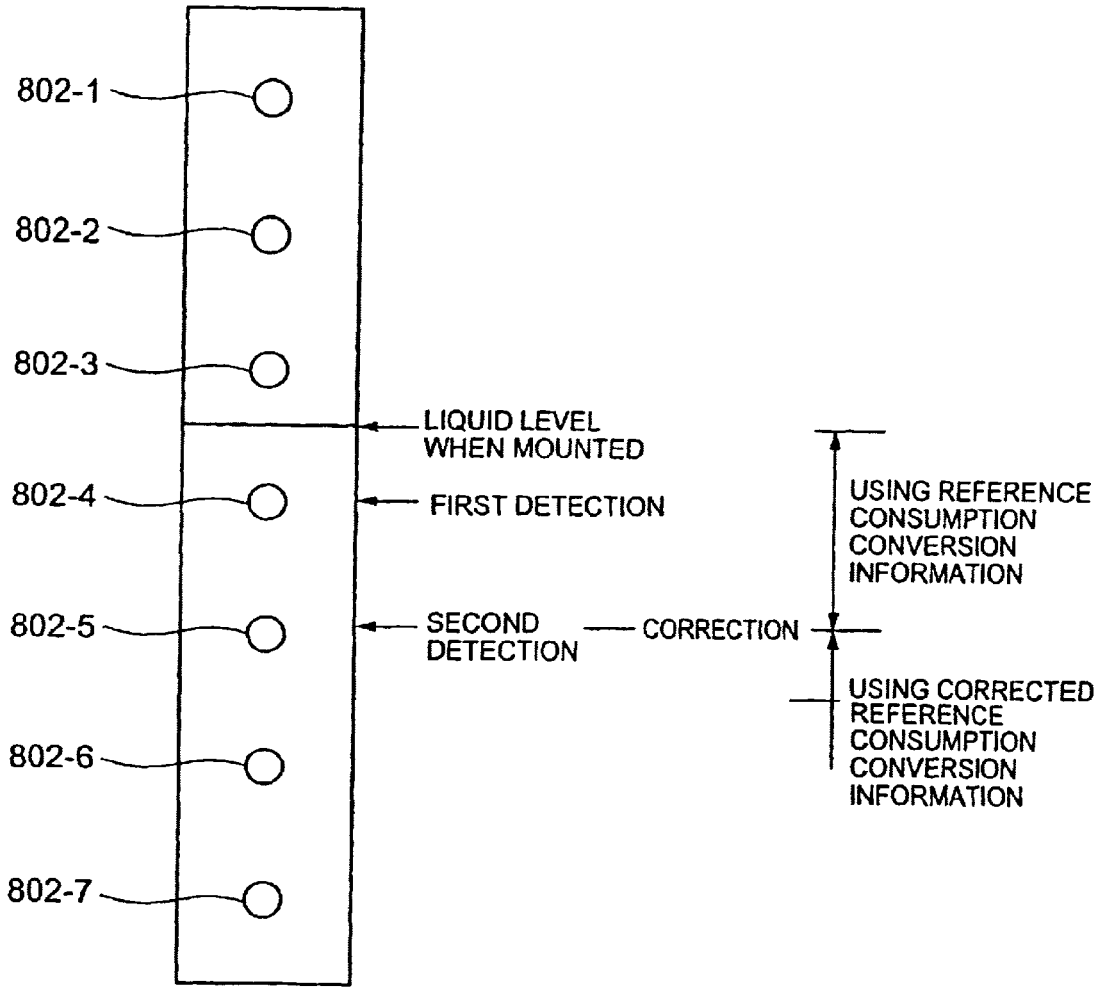
FIG. 77 is an enlarged diagram showing a portion to which an actuator of an ink cartridge is provided and arranged.

FIG. 77 shows an enlarged view of the portion on which the actuator 802 of the ink cartridge 800 is provided and arranged. On the ink cartridge 800, the first through seventh actuators 802-1 through 802-7 are arrayed. Suppose that an ink cartridge was mounted on an ink jet recording apparatus which is not yet an objective of the correction of the reference consumption conversion information. Suppose that when the ink cartridge was mounted, the ink liquid level existed between the third actuator 802-3 and the fourth actuator 802-4.

When the ink is consumed, the passage of the liquid level is detected by the fourth actuator 802-4 (detection of the first time). Furthermore, the passage of the liquid level is detected by the fifth actuator 802-5 (detection of the second time). Suppose that an ink volume level whose liquid level exists from the fourth actuator 802-4 to the fifth actuator 802-5 is Vy. Moreover, suppose that the number of printing dots between the detections of two times is Ny. At this time, the unit information which is an objective of the correction is corrected to Vy/Ny. Preferably, this corrected value as well as the identification information for specifying the recording apparatus is stored in the consuming information memory. Subsequently, the estimate consuming volume is multiplied and added by employing the reference consumption conversion information after the correction.

It should be noted that according to the above-described processings, when the ink cartridges are mounted on the multiple recording apparatus, the reference consumption conversion information is corrected on these respective recording apparatus. In this case, a plurality of reference consumption conversion information as well as identification information of each recording apparatus are recorded. Then, each corrected information data is used for the relevant recording apparatus.

Figure 78:
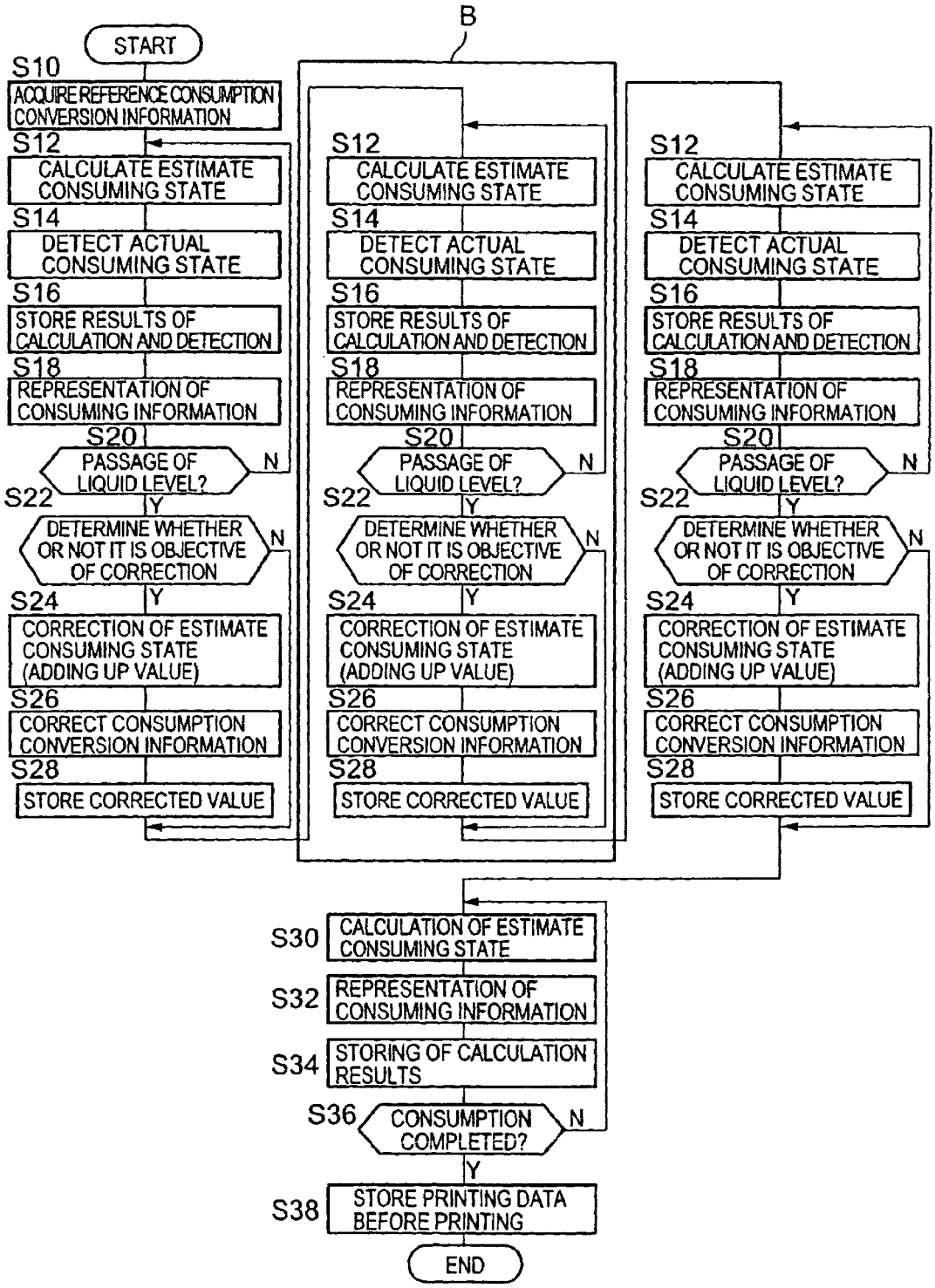
FIG. 78 is a flowchart showing a detection processing and a correction processing corresponding to an ink cartridge having a plurality of actuators.

FIG. 78 is a flowchart showing the detection processing of the consumption detection processing section 812 and the correction processing of the correction section 813 corresponding to an ink cartridge having the multiple actuators. In FIG. 78, a series of flowchart block B is repeated three times, and subsequently, indicated to be processed until the consumption is completed. However, the number of the flowchart block Bs are not particularly limited. For example, in the ink cartridge having 7 pieces of actuators 802 as the embodiment of FIG. 75, the flowchart block B is repeated seven times. Since the flowchart block B is the same with the one portion of the processing explained in FIG. 74A and FIG. 74B, the description is omitted. In the ink cartridge in which the multiple actuators are provided and arranged, by repeatedly processing the chart block B, whenever the ink liquid level passes through the actuator, it can be determined whether or not the unit information of the reference consumption conversion information is made an objective of the correction and the correction on the basis of its determination results can be performed.

Moreover, according to the present embodiment, parameters such as respective estimate consuming volume, actual consuming volume between the respective actuators are obtained. Therefore, the correction determination section 815 can determine whether or not the unit information is made as an objective of the correction by utilizing the already known parameters such as an estimate consuming volume, actual consuming volume and the like between the actuators through which the ink liquid level passed. In FIG. 79 and FIG. 80, a method of correcting unit information by utilizing the already known parameters is shown.

FIG. 79 and FIG. 80 are tables indicating the corrections using numeric values per unit information of the dot 1 and the dot 2. FIG. 79 indicates the embodiment in which threshold is not provided involving with the estimate consuming volume. FIG. 80 indicates, to the contrary to the embodiment of FIG. 79, the embodiment in which threshold is provided involving with the estimate consuming volume.

In FIG. 79, the embodiments from the case 1 to the case 6 are shown. ACT denotes an actuator. Specifically, in the present embodiment, the seven pieces of actuators are provided and arranged, the numbers of ink droplets when the ink liquid level passes through the actuator 1 through the actuator 7, respectively, are indicated.

In the present embodiment, conveniently, suppose that the ink is consumed on the basis of two kinds of unit information of the dot 1 and the dot 2 out of the reference consumption conversion information. Moreover, in the present embodiment, an ink volume per droplet of the dot 1 and the dot 2 is described as an estimate ink droplet volume. The actually measured ink droplet volume of the dot 1 is 28, and the estimate ink droplet volume previously set in the reference consumption conversion information is 30. The actually measured ink droplet volume of the dot 2 is 13, and the estimate ink droplet volume previously set in the reference consumption conversion information is 10.

Suppose that the number of ink droplets of the dot 1 is A, the number of ink droplets of the dot 2 is G, an estimate ink droplet volume as an estimated ink droplet volume of the dot 1 is B, an estimate ink droplet volume as an estimated ink droplet volume of the dot 2 is H, an estimate consuming volume of the dot 1 is C, an estimate consuming volume of the dot 2 is I, a consuming volume which has been actually consumed of the dot 1 is D, a consuming volume which has been actually consumed of the dot 2 is J, an ink droplet volume correctness of the dot 1 is E, an ink droplet volume correctness of the dot 2 is K, an estimate consuming rate of the dot 1 is F, an estimate consuming rate of the dot 2 is L, a consuming volume actually consumed is M, a total estimate consuming volume is N, and a correction coefficient is 0, respectively, the following equation is held.

It should be noted that n within the parenthesis indicates that the ink liquid level passes through the n-th actuator. Specifically, a numeric value from 1 to 7 of ACT of FIG. 79 is indicated. Therefore, n−1 indicates that the ink liquid level passes through the actuator immediately before the n-th actuator.

$$B(n)=B(n-1)\cdot O(n-1) \quad \text{(Expression 1)}$$

$$C(n)=A(n)\cdot B(n) \quad \text{(Expression 2)}$$

$$D(n)=A(n)\cdot 28 \quad \text{(Expression 3)}$$

$$E(n)=C(n)/D(n) \quad \text{(Expression 4)}$$

$$F(n)=C(n)/N(n) \quad \text{(Expression 5)}$$

$$H(n)=H(n-1)\cdot O(n-1) \quad \text{(Expression 6)}$$

$$I(n)=G(n)\cdot H(n) \quad \text{(Expression 7)}$$

$$J(n)=G(n)\cdot 13 \quad \text{(Expression 8)}$$

$$K(n)=I(n)/J(n) \quad \text{(Expression 9)}$$

$$L(n)=I(n)/N(n) \quad \text{(Expression 10)}$$

$$M(n)=D(n)+J(n) \quad \text{(Expression 11)}$$

$$N(n)=C(n)+I(n) \quad \text{(Expression 12)}$$

$$O(n)=M(n)/N(n) \quad \text{(Expression 13)}$$

The number of ink droplets A and the number of ink droplets G are the numbers of ink droplets of the dot 1 and the dot 2 counted by the consumption detection processing section 812, respectively.

An estimate ink droplet volume B (n) is obtained by multiplying an estimate ink droplet volume B (n−1) before the correction by a correction efficient O (n−1). The correction of an estimate ink droplet volume is performed only in the case where it is determined to be an objective of the correction by the correction determination section 815. Therefore, in the case where the determination of an objective of the correction is not performed, the correction coefficient is made as 1.

An estimate consuming volume C is a volume obtained by multiplying an estimate ink droplet volume B by the number of ink droplets A. An estimate consuming C is calculated in the estimate consumption calculation processing section 814.

An actually consumed consuming volume D is a volume obtained by multiplying the actually measured ink droplet volume by the number of ink droplets A. Since actually consumed ink droplet volume is unclear, the actually consumed consuming volume D in the consumption detection processing is also unclear volume.

An ink droplet volume correctness E is a rate of an estimate consuming volume C with respect to the actually consumed consuming volume D. It can be determined that the closer to 1 the ink droplet volume correctness E is, the closer to the actually consumed consuming volume D an estimate consuming volume C is. In FIG. 79, in order to understand the present embodiment, an ink droplet volume correctness E is conveniently indicated.

An estimate consuming rate F indicates a rate of an estimate consuming volume C amounting rate of the total estimate consuming volume N. The estimate consuming rate F is calculated by the estimate consumption calculation processing section 814. The correction determination section 815 can determine whether or not the unit information is made as an objective of the correction on the basis of this estimate consuming rate F.

An ink actual consuming volume is detected by the actual detection processing section 816 when the ink liquid level passes through the actuator 802. Therefore, since the actually consumed consuming volume M is defined as the sum of the actually consumed consuming volume D of the dot 1 and the actually consumed consuming volume J of the dot 2, there may be a case where the deviation exists to some extent between the actual consuming volume detected by the actual consumption detection processing section 816 and it. However, there is not a problem if the actually consumed consuming volume M is used by the expression 11 when the advantages of the present embodiment are explained. Therefore, for example, as the correction coefficient in the expression 13, an actual consuming volume detected by the actual consumption detection processing section 816 is actually used, however, in the present embodiment, as the actually consumed consuming volume, M is used.

The total estimate consuming volume N is the sum of an estimate consuming volume C and an estimate consuming volume I of the dot 1 and the dot 2.

Moreover, in the present embodiment, unit information data are classified into the dot 1 and the dot 2. Moreover, factors of the reference consumption conversion information are an estimate ink droplet volume B and an estimate ink droplet volume H of the dot 1 and the dot 2. Therefore, an object of the present embodiment is to correct the information of the dot 1 and the dot 2 which are the unit information so that an estimate ink droplet volume B and an estimate ink droplet volume H are made closer to actually measured ink droplet volumes 28 and 13, respectively, specifically, the ink droplet volume correctness E and K are made closer to 1.

It should be noted that since G, H, I, J, K and L of the dot 2 correspond to the A, B, C, D, E and F, the description is omitted.

Now, the case 1 through the case 6 are classified corresponding to the cases where methods of determining an objective of the correction of the estimate ink droplet volume are different, specifically, methods of determining an objective of the correction of the unit information of the reference consumption information are different. In the case 1, all of the unit information data are always determined as an objective of the correction. In the case 2, the case 3 and the case 5, in the case where the estimate consuming rate detected at this time is larger than the maximum value of the estimate consuming rate previously and already detected prior to the detection at this time, the relevant unit information is determined as an objective of the correction. In the case 4 and the case 6, the relevant unit information is determined as an objective of the correction by the method in which when the estimate consuming rate detected at this time is larger than the maximum value of the estimate consuming rate previously and already detected prior to the detection at this time, the relevant unit information is determined as an objective of the correction, and in addition, by comparing the estimate consuming rate between the unit information. In the case 2, the case 3 and the case 5, the determination is performed based on the determination method of FIG. 81A described later. In the case 4 and the case 6, the determination is performed based on the determination methods of FIG. 82 and FIG. 81A, which are combined.

In the case 1, whenever the ink liquid level passes through the actuator, all of the estimate ink droplet volumes are made an objective of the correction using a correction coefficient O. Therefore, in the case 1, the correction determination section 815 always determines the volume as an objective of the correction. As a result, it is repeated that the ink droplet volume correctness E and K become closer and away from the value of 1. This is for the purpose of correcting an estimate ink droplet volume to the direction away from the actually measured ink droplet volume by including an estimate ink droplet volume whose estimate consuming rates F and I are low and which is slightly away from the actually measured ink droplet volume as an objective of the correction.

The case 2 is a case where when estimate consuming rates F (n) and L (n) calculated in the actuator through which the ink liquid level has passed are larger than any of the estimate consuming rate F (1 to n−1) and L (1 to n−1) calculated in the actuator through which the ink liquid level had passed before, the correction determination section 815 determines the estimate ink droplet volume as an objective of the correction. For example, in ACT 4 and ACT 5 of the case 2, an estimate ink droplet volume B is not corrected. Owing to this, the ink droplet volume correctness E is converged to the value of 1. In the dot 2, it is similar.

Figure 81B:
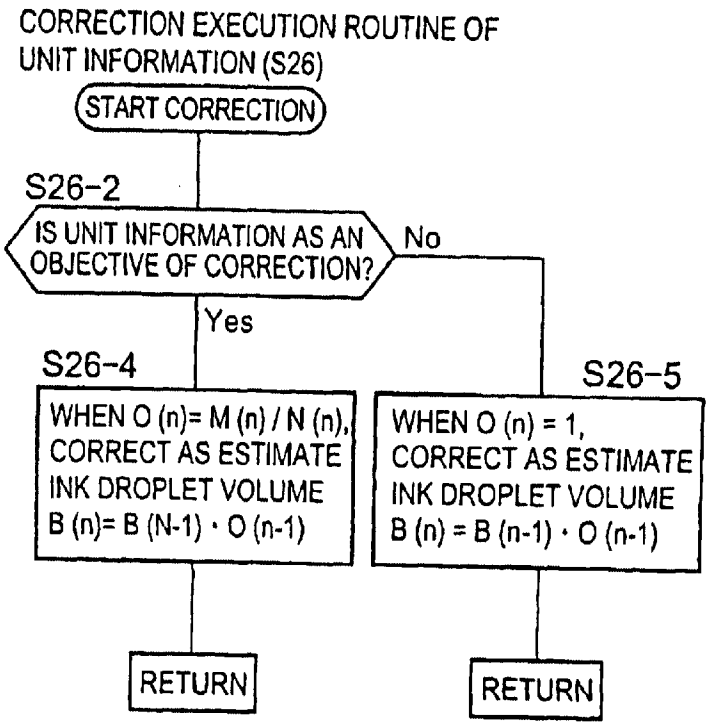
FIG. 81A and FIG. 81B are flowcharts showing the determination of a correction objective (S22) and a correction of the unit information relevant to correction objective (S26) of FIG. 74A, FIG. 74B or FIG. 78.
Figure 81A:
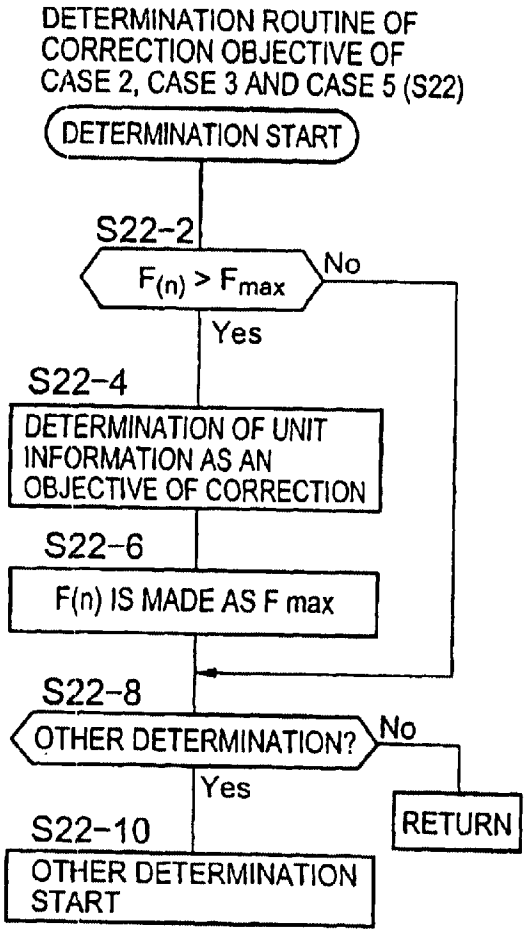
Figure 82:
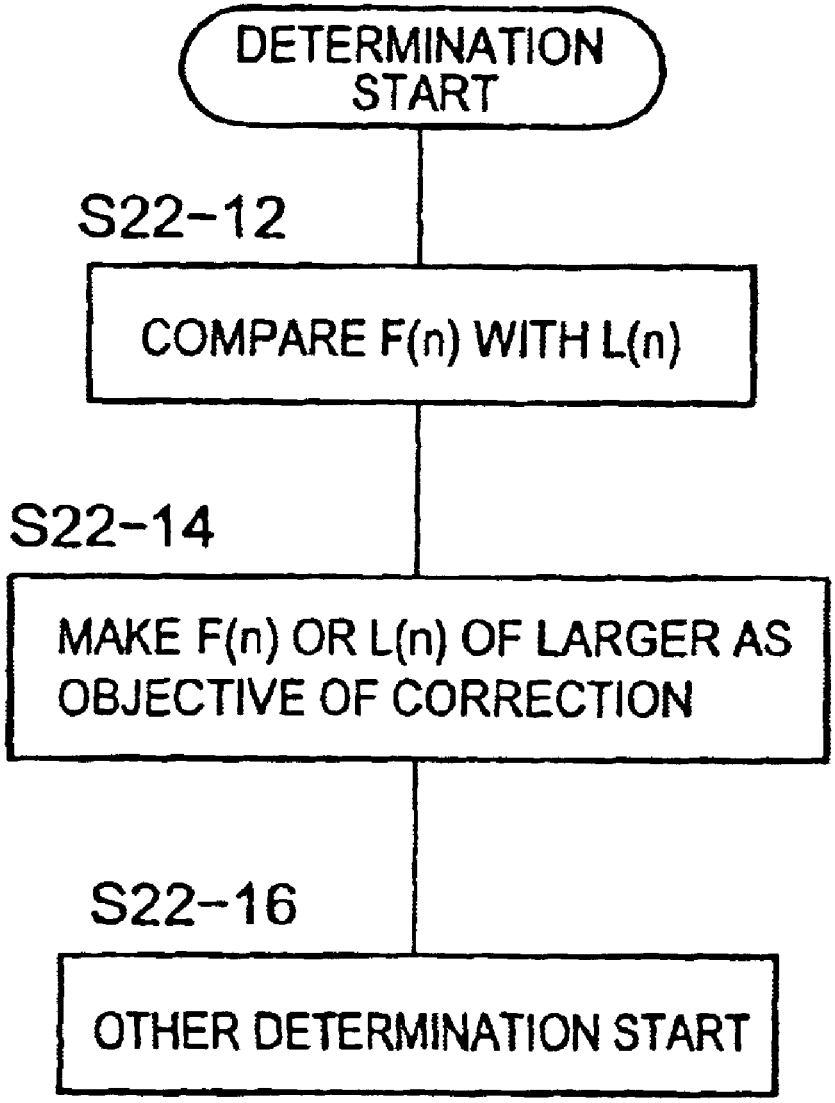
FIG. 82 is a flowchart showing the determination of a correction objective (S22) and a correction of the unit information relevant to correction objective (S26) of FIG. 74A, FIG. 74B or FIG. 78.

FIG. 81A, FIG. 81B and FIG. 82 are flowcharts showing further in detail the determination of an objective of the correction (S22) and the correction of the unit information (S26) relevant to the an object of the correction of FIG. 74A, FIG. 74B or FIG. 78. The processings of the determination of an objective of the correction (S22) and the correction of the unit information relevant to an objective of the correction (S26) of the case 2, the case 3 or the case 5 with reference to Fig. FIG. 81A and FIG. 81B will be described below. The processings of the determination of an objective of the correction (S22) and the correction of the unit information relevant to an objective of the correction (S26) of the case 4 and the case 6 with reference to FIG. 81A, FIG. 81B and FIG. 82.

In FIG. 81A, after the ink liquid level is detected by ACT (n), the correction determination section 815 carries out the individual determination on he all of the unit information. The correction determination section 815 compares an estimate consuming rate F (n) of the relevant unit information with the maximum value F max of an estimate consuming rate F (1 to n−1) when the ink liquid level is detected by ACT (1 to n−1). The correction determination section 815 determines that the relevant unit information as an objective of the correction when F (n) is smaller than F max. On the other hand, when F (n) is F max, the correction determination section 815 determines that the relevant unit information is made as an objective of the correction (S22-4). Moreover, F (n) is made as F max (S22-6), and in the case where further the other determination on the other unit information or the other kinds of determination exist, the other determination is carried out (S22-8, S22-10). In the case where the other determination is performed, the correction of the next estimate consuming volume is carried out.

Subsequently, as shown in FIG. 81B, the relevant unit information is corrected in accordance with the correction execution routine on the basis of the results of the determination of the correction determination section 815 (S26). The correction section 813 corrects the unit information on the basis of the determination results of the correction determination section 815 (S26). First, the correction section 813 determines whether or not the unit information is determined as an objective of the correction (S26-2). The unit information which is not an objective of the correction is corrected while making correction coefficient O (n) as 1. Specifically, it is corrected so that an estimate ink droplet volume, which is the unit information in the present embodiment, is represented by the equation of B (n)=B (n−1)*O (n−1). On the other hand, the unit information which is an objective of the correction is corrected so that the correction coefficient is represented by the equation of O (n)=M (n)/N (n). Specifically, it is corrected so that the estimate ink droplet volume, which is the unit information of the present embodiment, is represented by the equation of B (n)=B (n−1)*O (n−1) (S26-4). Subsequently, the next detection of an estimate consuming volume is carried out by employing the unit information after the correction.

The case 3 is a case where the purpose of the use of the ink jet recording apparatus of the user is exclusively for character record. Therefore, the estimate consuming rate F by the dot 1 whose ink droplet volume is higher compared to the estimate consuming rate L by the dot 2. In the case 3, similar to the case 2, when the estimate consuming rate F (n) or L (n) is larger than any of the estimate consuming rate F (1 to 1−n), L (1 to n−1), the correction determination section 815 determines that the estimate ink droplet volume is corrected.

In the case 3, the ink droplet volume correctness E of the dot 1 is closer to 1 than that of the case 2. This is because the correction of the specified unit information has been more precisely performed, since an ink jet recording apparatus is exclusively used for the character record.

The case 4, similar to the case 3, is a case where the purpose of the usage of an ink jet recording apparatus is exclusively used for character record. Furthermore, in the case 4, the estimate consuming rates between the unit information data are compared. First, in accordance with the routine of FIG. 82, the respective estimate consuming rates F (n) and L (n) of the dot 1 and the dot 2 are compared (S22-12). As a result of comparison, any one of the estimate consuming rate F (n) or L (n) whose consuming rate is larger is made as an objective of the correction (S22-14). Furthermore, as the other determination, in order to compare it with the F max or L max, the determination routine of an objective of the correction of FIG. 81A is carried out by in the step S22-16 (S22), and when it is indicated as NO in the step S22-8, it is carried out in the step S26. Now, when the objective of the correction is L (n) in the step S22-14 of FIG. 82, F (n) of the step S22-2 and S22-6 of FIG. 81A is substituted by L (n), and F max is substituted by L max.

In the embodiment of the case 4, the purpose of the use of the user is settled, since the estimate consuming rate F (n) is always larger than the estimate consuming rate L (n), in the case 4, only the dot 1 is an objective of the correction.

As the embodiment of the case 4, in the case where the purpose of the use of the user is settled, the unit information which is an objective of the correction may be previously set. Owing to this, the work of the correction determination section 815 which determines can be omitted. Comparing with the case 3, in the case 4, the values of the ink droplet volume correctness are dispersed. However, since it is not necessary to store the unit information except for the unit information which is an objective of the correction in the consumption conversion information storage section 808, the capacity of the memory can be made smaller. Since the cycle time of the correction is shortened and the apparatus can be smaller to some extent, while the correction of the unit information is precisely performed, the case 4 is practical.

The case 5 is a case where the purpose of the use of an ink jet recording apparatus is exclusively for image record. Therefore, in the case 5, the estimate consuming rate L by the dot 2 whose ink droplet volume is higher compared to the estimate consuming rate F by the dot 1. In the case 5, similar to the case 2, when the estimate consuming rate F (n), L (n) is larger than any of the estimate consuming rates F (1 to 1−n), L (1 to n−1), the correction determination section 815 determines that the estimate ink droplet volume is corrected.

In the case 5, the ink droplet volume correctness L of the dot 2 is closer to 1 than that of the case 2. This is because the correction of the specified unit information has been more precisely performed, since an ink jet recording apparatus is exclusively used for the image record.

The case 6, similar to the case 5, is a case where the purpose of the use of an ink jet recording apparatus is exclusively for image record. Furthermore, in the case 6, the estimate consuming rates between the unit information data are compared as in the case 4. First, in accordance with the routine of FIG. 82, the respective estimate consuming rates F (n) and L (n) of the dot 1 and the dot 2 are compared (S22-12). As a result of comparison, any one of the estimate consuming rates F (n) and L (n) whose consuming rate is larger is made as an objective of the correction (S22-14). Furthermore, as the other determination, in order to compare it with the F max or L max, the determination routine of an objective of the correction of FIG. 81A is carried out by in the step S22-16 (S22), and when it is indicated as NO in the step S22-8, it is carried out in the step S26. Now, when the objective of the correction is L (n) in the step S22-14 of FIG. 82, F (n) of the step S22-2 and S22-6 of FIG. 81A is substituted by L (n), and F max is substituted by L max.

In the embodiments of the case 4 and the case 6, the purpose of the use of the user is settled. Therefore, in the case 4, only the dot 1 is an objective of the correction, however, the embodiment of the case 6, only the dot 2 is an objective of the correction.

In the embodiment of the case 6, since the purpose of the use of the user is settled, similar to the case 4, the unit information which is an objective of the correction may have been previously set. Since the cycle time of the correction is shortened and the apparatus can be smaller to some extent, while the correction of the unit information is precisely performed, the case 6 is also practical.

FIG. 80 is a table indicating the corrections performed further using threshold of an estimate consuming rate for the correction of FIG. 79. When the ink liquid level passes through the actuator, in the case where an estimate consuming rate of the optional unit information exceeds over the predetermined threshold, the correction determination section 815 determines that its unit information is made as an objective of the correction. For example, in the embodiment of FIG. 80, the threshold of the estimate consuming rate of the dot 1 is defined as 0.5, the threshold of the estimate consuming rate of the dot 2 is defined as 0.6. In the dot 1, when the estimate consuming rate exceeds over 0.5, the correction determination section 815 determines that the estimate ink droplet volume of the dot 1 is make as an objective of the correction. In the dot 2, when the estimate consuming rate exceeds over 0.6, the correction determination section 815 determines that the estimate ink droplet volume of the dot 2 is made as an objective of the correction. Owing to this, the estimate ink droplet volume is prevented from being apart from the actually measured ink droplet volume.

Figure 83:
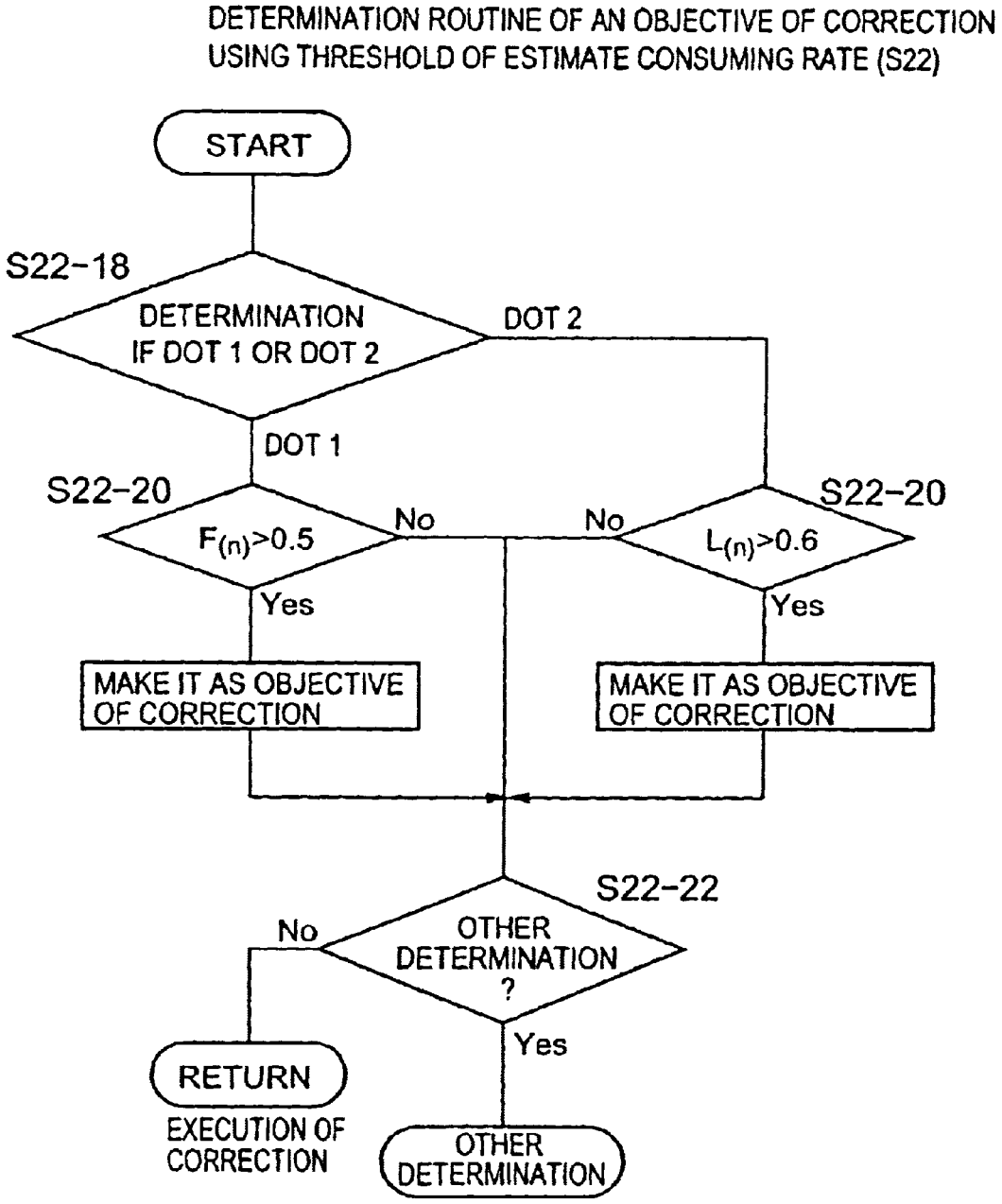
FIG. 83 is a flowchart showing a correction processing performed using threshold of an estimate consuming rate according to FIG. 80.

FIG. 83 is a flowchart showing a determination routine of an objective of the correction performed using threshold of the estimate consuming information in accordance with FIG. 80.

First, the correction determination section 815 determines the unit information (S22-18). In the present embodiment, the correction determination section 815 determines the dot 1 or the dot 2 as the unit information. Next, the correction determination section 815 determines whether or not the estimate consuming rate of the dot 1 or the dot 2 is larger than the threshold (S22-20). For example, in the case where the estimate consuming rate F (n) of the dot 1 is larger than the threshold 0.5, the dot 1 is made an objective of the correction. In the case where the estimate consuming rate L (n) of the dot 2 is larger than threshold 0.6, the dot 2 is made as an objective of the correction. In the case where the other unit information except for the dot 1 and the dot 2, the other determination is carried out (S22-22). In the case where the other unit information is absent, the correction is carried out. In the embodiment of FIG. 80, the determination routine of the objective of the correction of FIG. 83 is utilized as the followings.

The case 1 of FIG. 80 is a case where the determination of the objective of the correction is performed only by the determination routine of the objective of the correction of FIG. 83. Specifically, after the correction determination section 815 carries out the determination routine of the objective of the correction of FIG. 83, when the other unit information to be determined is absent, the correction section 813 carries out the steps of the correction (S24 and S26) of FIG. 74A, FIG. 74B or FIG. 78.

In the correction of the step S26, the correction execution routine of FIG. 81B may be carried out. According to the present embodiment, the unit information whose estimate consuming rate does not exceed over threshold is not made as an objective of the correction. On the other hand, the unit information whose estimate consuming rate exceeds over threshold is made as an objective of the correction.

The case 2, the case 3 and the case 5 of FIG. 80 are cases where the determination of the objective of the correction is performed by the determination routine of the objective of the correction of FIG. 83 and the determination routine of the objective of the correction of FIG. 81A. The correction determination section 815 carries out the determination routine o the objective of the correction of FIG. 83, and further subsequently, carries out the determination routine of the objective of the correction of FIG. 81A. The correction section 813 corrects the unit information determined as an objective of the correction by the determination routine of the objective of the correction of FIG. 83 and the determination routine of the objective of the correction of FIG. 81A in the steps of the correction (S24 and S26) of FIG. 74A, FIG. 74B or FIG. 78. As to the correction of the step S26, the correction execution routine of FIG. 81B may be carried out. According to the present embodiment, the unit information whose estimate consuming rate does not exceed over threshold is not made as an objective of the correction. On the other hand, the unit information whose estimate consuming rate exceeds over threshold is, the unit information which is further determined as an objective of the correction by the determination routine of the objective of the correction of FIG. 81A, is made as an objective of the correction. Moreover, the unit information determined which is not an objective of the correction by the determination routine of an objective of the correction of FIG. 8A is not made as an objective of the correction.

The case 4 and the case 6 of FIG. 80 are cases where the determination of an objective of the correction is performed by the determination routine of FIG. 83, the determination of an objective of the correction of FIG. 81A and the determination routine of an objective of the correction of FIG. 82. The correction determination section 815 carries out the determination routine of an objective of the correction of FIG. 83, carries out the determination routine of an objective of the correction of FIG. 82, and further subsequently the determination routine of an objective of the correction of FIG. 81A. The correction section 813 corrects the unit information determined which is an object of the correction by the determination routine of an objective of the correction of FIG. 83, the determination routine of an objective of the correction of FIG. 81A and the determination routine of an objective of the correction of FIG. 82 in the steps of the correction (S24 and S26) of FIG. 74A, FIG. 74B or FIG. 78. As to the correction of the step S26, the correction execution routine of FIG. 81B may be carried out. According to the present embodiment, the unit information whose estimate consuming rate does not exceed over threshold is not made as an objective of the correction. On the other hand, the unit information whose estimate consuming rate exceeds over threshold is, the unit information which is further determined as an objective of the correction by the determination routine of the objective of the correction of FIG. 82 and the determination routine of the objective of the correction of FIG. 81A, is made as an objective of the correction. Moreover, the unit information determined which is not an objective of the correction by the determination routine of an objective of the correction of FIG. 81A is not made as an objective of the correction.

The effect obtained by providing threshold in the estimate consuming rate is easily found if the rates of the ink droplet correctness in ACT2 of the case 3 of FIG. 79 and FIG. 80 are compared. In FIG. 79 in which the predetermined threshold is not provided, the rate of the ink droplet volume correctness K is corrected from 0.769 of ACT1 to 0.728 of ACT2 in such a direction that the rate of the ink droplet volume correctness K is apart from the value of 1. This is because the estimate consuming rate of ACT1 is 0.036, which is low, however, the estimate ink droplet volume H is corrected. On the other hand, in FIG. 80 in which the predetermined threshold is provided, the rate of the ink droplet volume correctness K is the same in ACT1 and ACT2. Therefore, the rate of the ink droplet volume correctness is not apart from the value of 1. This is because the estimate ink droplet volume H is not corrected by threshold, since the estimate consuming rate of ACT1 is 0.036, which is low.

A threshold may be determined depending on the purpose of the use of an ink jet recording apparatus. For example, in the case where the purpose of the use of an ink jet recording apparatus is a management of the character record using information included in the printing data transmitted from the printing operation control section 818 in FIG. 80, the threshold of the estimate consuming rate of the dot 1 is set at a higher value. On the other hand, in the case where the purpose is an image recording, the threshold of the estimate consuming rate of the dot 2 is set at a higher level.

Up to this point, the present embodiment has been described. Next, the advantages of the present embodiments will be described all together. The other advantages are as described above.

According to the present embodiment, an estimate consumption calculation and an actual consumption detection are used in combination. The actual consuming volume is more precisely detected by employing a piezoelectric device, and since the piezoelectric device is employed, an ink leakage and the like are preferably prevented. On the other hand, according to the estimate processing, although an error is somewhat accompanied with it, the consuming volume is found in detail. Therefore, by employing both processing processings in combination, the ink consuming volume is found precisely and in detail.

In the present embodiment, that the ink liquid level passes through the piezoelectric device is detected by the actual consumption detection processing. When the ink liquid level passes through the piezoelectric device, the output of the piezoelectric device is largely changed. Therefore, the passage of the liquid level is securely detected. The ink consuming volumes prior to and after the passage of the liquid level are estimated in detail. The ink consuming volume is found precisely and in detail by these processings.

In the present embodiment, the reference consumption conversion information is made as an objective of the correction on the basis of the detection results of the actual consuming volume. Owing to this, an error of the estimate processing of the consuming volume can be reduced, and a more precise consuming volume can be estimated.

Moreover, in the correction of the reference consumption conversion information, whether or not the information data is made as an objective of the correction per unit information is determined. Owing to this, only the unit information necessary to be corrected can be corrected without correcting the unit information unnecessary to be corrected out of the reference consumption conversion information.

Therefore, an error of the estimation processing of the consuming volume can be reduced and the estimate consuming volume can be converged into the actual consuming volume.

In the present embodiment, as determination methods, methods of comparing the estimate consuming rate with threshold explained in FIG. 83, comparing the estimate consuming rate with threshold explained in FIG. 73A and FIG. 73B, comparing the estimate consuming rates between the unit information explained in FIG. 82, comparing the estimate consuming rate with the maximum value out of the estimate consuming rates that has been measured before the relevant estimate consuming rate explained in FIG. 81A and FIG. 81B, and comparing the expected score of an error with the threshold explained in FIG. 73A and FIG. 73B have been described. Although these comparisons may be singly performed, respectively, however, any two of comparisons may be used in combination, and the combinations of more than two of comparisons may be used, and the combination of all of the comparisons may be used.

The corrected consumption conversion information may be employed by limiting to the ink tank, which is the objective of the correction. Or, the corrected consumption conversion information may be employed, not limiting to the ink tank, which is the objective of the correction, also for an ink tank mounted later. According to the latter, the corrected information can be continuously utilized even after the ink cartridge is exchanged.

Moreover, in the present embodiment, as described by employing FIG. 71, the estimate consuming volume is corrected on the basis of the detection results of the actual consumption detection processing. Subsequent estimation is precisely performed on the basis of the consuming volume after the correction. Moreover, as described in FIG. 74B, only the adding up value by the estimate consumption calculation processing can be also corrected without correcting the reference consumption conversion information.

In the present embodiment, the information of the consuming volume is displayed on the display and the like by employing the estimate consuming volume. For example, on the basis of the consuming volume which has been found, the printable printing amount using the remaining ink is represented. Moreover, on the basis of the consuming volume which has been found, the remaining ink volume is represented. At that time, different colors and shapes of graphical forms are employed corresponding to the ink volume. In this way, the ink consuming volume is easily acknowledged to the user.

In the present embodiment, the consuming volume which has been found is stored in the consuming information memory. The consuming information memory is mounted on the ink cartridge. Therefore, the ink cartridge is removed, and then, when it is mounted again, the consuming state is easily found.

Moreover, the reference consumption conversion information is also stored in the consuming information memory. This information is also read from the memory when the ink cartridge is mounted, and preferably utilized.

On the other hand, the reference consumption conversion information after the correction may be held on the side of the recording apparatus. In this case, even after the ink cartridge is exchanged, the reference conversion information can be continuously utilized. When the corrections are repeated, the reference consumption conversion information approaches to an appropriate value, and the estimate processing is more precisely performed.

Moreover, in the present embodiment, when it is determined that the ink is absent, the printing data is stored in the storage section. Owing to this form, the printing data is not lost.

Moreover, in another embodiment, when the actual consuming volume is detected, the remaining printable printing amount is calculated. When the remaining printable printing amount is printed, the printing data prior to the printing is stored in the printing data storage section. Owing to this form, nor the printing data is lost.

The present invention can be realized in a variety of forms of the aspects. The present invention may be a method of detecting ink consumption, an ink consumption detection apparatus, an ink jet recording apparatus, a control apparatus of an ink jet recording apparatus, an ink cartridge, and the other aspects. In the aspect of an ink cartridge, the ink cartridge has preferably consuming information memory, and provides information necessary to a variety of processings described above.

The present embodiment is, needless to say, deformable within the scope of the present invention.

In the present embodiment, an actuator is composed of a piezoelectric device. As afore-mentioned, a change of acoustic impedance may be detected by employing a piezoelectric device. A consuming state may be detected by utilizing the reflected wave of an elastic wave. A time spanning from generation of an elastic wave to arrival of the reflected wave is found. A consuming volume may be detected on any of the principles for utilizing the function of the piezoelectric device.

In the present embodiment, an actuator generates an oscillation and generates a detection signal for indicating an ink consuming volume as well. To the contrary, the actuator may not generate the oscillation itself. Specifically, both of oscillation generation and detection signal output may not be performed. An oscillation is generated by another actuator. Or, when an oscillation is generated in the ink cartridge accompanied with the movement of the carriage, the liquid sensor may generate a detection signal indicating an ink consuming state. An ink consumption is detected without actively generating an oscillation by employing oscillation naturally generated by printer operation.

The function of the recording apparatus control section may not be realized by the computer of the recording apparatus. One portion of the whole functions or the whole functions may be provided on the external computer. The display and speaker may be also provided on the external computer.

In the present embodiment, a liquid container was an ink cartridge, and a liquid utilizing apparatus was an ink jet recording apparatus. However, a liquid container may be an ink container except for an ink cartridge, for example, an ink tank. For example, it may be a sub tank on the side of a recording head. Moreover, an ink cartridge may be the so-called off carriage type cartridge. Furthermore, the present invention may be applied to a container for containing a liquid except for ink.

Up to this point, the present invention has been described using the present embodiment, however, the scope of the present invention is not limited to the scope described in the above-described embodiments. A variety of modifications or improvements are capable of adding to the above-described embodiments. Such forms to which the modifications or improvement are added are capable of being also included in the scope of the present invention, that is obvious from the description of the claims.

As described above, according to the present invention, the actual consuming state can be precisely detected by employing a piezoelectric device without employing a complex sealing structure. Then, the ink consuming state can be found precisely and in detail by combining an estimate consumption calculation and an actual consumption detection.

According to the present invention, the ink consuming state can be found precisely and in detail by correcting conversion information, which finds the estimate consuming state. Furthermore, consumption conversion information can be appropriately utilized by recording the corrected consumption conversion information as well as the identification information of a recording apparatus which is an objective of the correction.

According to the present invention, an ink consuming volume can be found precisely and in detail by correcting the reference consumption conversion information which finds the estimate consuming volume. Moreover, the ink consuming volume is further found in precisely and in detail by correcting the information per unit information included in the reference consumption conversion information.

INDUSTRIAL APPLICABILITY

The present invention can be utilized for detecting a consuming state of ink within an ink tank used for an ink jet recording apparatus.

What is claimed is:

1. A method of detecting an ink consuming state of an ink tank used for an ink jet recording apparatus, said method of detecting ink consumption comprising:

an estimate consumption calculation processing of calculating an estimate consuming state of an ink within said ink tank by employing a consumption conversion information indicating a relationship between an operation amount of said ink jet recording apparatus and an ink consuming volume; and an actual consumption detection processing of detecting an actual consuming state of said ink within said ink tank by detecting an oscillation state of a piezoelectric element corresponding to an actual ink consuming state within said ink tank by employing a piezoelectric device having said piezoelectric element, wherein said piezoelectric device has a vibrating portion which comes into contact with said ink in said ink tank via an opening, said opening defining an area of said vibrating portion; and wherein said piezoelectric device outputs a signal indicating a residual oscillating state of said vibrating portion and said actual consuming state is detected based on phenomenon that said residual oscillating state changes corresponding to said ink consuming state.

2. The method of detecting ink consumption according to claim 1, wherein said actual consumption detection processing detects whether or not ink liquid level passes through a position of said piezoelectric element of said piezoelectric device as said actual consuming state, and wherein said estimate consumption calculation processing calculates said estimate consuming state at least either prior to or after when it is detected by said actual consumption detection processing that said ink liquid level passes through said position of said piezoelectric element.

3. The method of detecting ink consumption according to claim 2, wherein, when it is detected that said ink liquid level passes through the position of said piezoelectric element of said piezoelectric device, detection of said actual consuming state is terminated.

4. The method of detecting ink consumption according to claim 1, wherein said estimate consumption calculation processing calculates said estimate consuming state by adding up a number of ink droplets ejected from a recording head.

5. The method of detecting ink consumption according to claim 4, wherein said estimate consumption calculation processing calculates said estimate consuming state based on said number of ink droplets ejected from said recording head and a size of an ink droplet.

6. The method of detecting ink consumption according to claim 1, wherein said estimate consumption calculation processing corrects said consumption conversion information based on a detection result of said actual consumption detection processing and calculates said estimate consuming state based on a corrected consumption conversion information.

7. The method of detecting ink consumption according to claim 6, wherein said consumption conversion information is an ink volume corresponding to an ink droplet ejected from a recording head.

8. The method of detecting ink consumption according to claim 1, wherein said estimate consumption calculation processing corrects said estimate consuming state based on a detection result of said actual consumption detection processing.

9. The method of detecting ink consumption according to claim 8, wherein said estimate consumption calculation processing is a processing for calculating said estimate consuming state by multiplying a number of ink droplets ejected from a recording head, and, wherein, when detection results of said actual consumption detection processing are obtained, said estimate consumption calculation processing corrects said estimate consuming state which has been obtained until then based on said detection results of said actual consumption processing.

10. The method of detecting ink consumption according to claim 1, wherein said ink consuming state which has been obtained by said estimate consumption calculation processing and said actual consumption detection processing is stored in storage means.

11. The method of detecting ink consumption according to claim 10, wherein said storage means is a memory device mounted on said ink tank.

12. The method of detecting ink consumption according to claim 1, wherein a plurality of stages of said actual consuming state are detected by employing a plurality of said piezoelectric devices mounted on different positions of said ink tank.

13. The method of detecting ink consumption according to claim 12, wherein said actual consumption detection processing detects whether or not an ink liquid level passes through said positions of said respective piezoelectric elements of said piezoelectric devices as said actual consuming state.

14. The method of detecting ink consumption according to claim 13, wherein said estimate consumption calculation processing calculates a consuming state after a point in time when a passage of liquid level is detected by said piezoelectric device arranged on lowermost as said estimate consuming state.

15. The method of detecting ink consumption according to claim 1, wherein said ink tank of an objective of detection of said ink consuming state is an ink cartridge which is attachable to and detachable from said ink jet recording apparatus.

16. The method of detecting ink consumption according to claim 1, further comprising:

a correction and determination processing for determine whether or not said consumption conversion information is made an objective of correction; and a correction processing for correcting said consumption conversion information based on a result of determination that a correction should be performed in said correction and determination processing.

17. The method of detecting ink consumption according to claim 16, wherein said consumption conversion information is classified into at least two kinds of unit information which are related to an ink volume consumed from a recording head and are different from each other, and whether or not said at least two kinds of unit information are made as an objective of correction based on said estimate consuming state is determined in said correction and determination processing.

18. The method of detecting ink consumption according to claim 16, wherein said consumption conversion information is classified into at least two kinds of unit information which are related to an ink volume discharged from said recording head and different from each other, and wherein, in said correction and determination processing, at least one of said unit information previously selected is determined as an objective of correction.

19. A method of detecting an ink consuming state of an ink tank used for an ink jet recording apparatus, said method of detecting ink consumption comprising:

an estimate consumption calculation processing of calculating an estimate consuming state of an ink within said ink tank by employing a consumption conversion information indicating a relationship between an operation amount of said ink jet recording apparatus and an ink consuming volume; and an actual consumption detection processing of detecting an actual consuming state of said ink within said ink tank by detecting an oscillation state of a piezoelectric element corresponding to an actual ink consuming state within said ink tank by employing a piezoelectric device having said piezoelectric element, wherein a plurality of stages of said actual ink consuming state are detected by employing a plurality of said piezoelectric devices mounted on different positions of said ink tank, wherein said actual consumption detection processing detects whether or not an ink liquid level passes through said positions of said respective piezoelectric elements of said piezoelectric devices as said actual ink consuming state, and wherein said estimate consumption calculation processing calculates a consuming state between from a point in time when a passage of liquid level is detected by one said piezoelectric device to a point in time when a passage of liquid level is detected by next said piezoelectric device as said estimate consuming state.

20. A method of detecting an ink consuming state of an ink tank used for an ink jet recording apparatus, said method of detecting ink consumption comprising:

an estimate consumption calculation processing of calculating an estimate consuming state of an ink within said ink tank by employing a consumption conversion information indicating a relationship between an operation amount of said ink jet recording apparatus and an ink consuming volume; and an actual consumption detection processing of detecting an actual consuming state of said ink within said ink tank by detecting an oscillation state of a piezoelectric element corresponding to an actual ink consuming state within said ink tank by employing a piezoelectric device having said piezoelectric element, wherein a plurality of stages of said actual ink consuming state are detected by employing a plurality of said piezoelectric devices mounted on different positions of said ink tank, wherein said actual consumption detection processing detects whether or not an ink liquid level passes through said positions of said respective piezoelectric elements of said piezoelectric devices as said actual ink consuming state, and wherein said estimate consumption calculation processing corrects said consumption conversion information when said ink liquid level passes through the positions of said respective piezoelectric elements of said piezoelectric devices and calculates said estimate consuming state based on said consumption conversion information which has been corrected.

21. The method of detecting ink consumption according to claim 20, wherein said estimate consumption calculation processing calculates a final consumption conversion information based on corrected results of a plurality of times of said consumption conversion information accompanying with a plurality of times of detections of passages of liquid level until then when said piezoelectric device arranged at lowermost position detects a passage of liquid level, and wherein said estimate consumption calculation processing calculates said estimate consuming state after said piezoelectric device arranged at lowermost position detects a passage of liquid level, by employing said final consumption conversion information.

22. A method of detecting an ink consuming state of an ink tank used for an ink jet recording apparatus, said method of detecting ink consumption comprising:

an estimate consumption calculation processing of calculating an estimate consuming state of an ink within said ink tank by employing a consumption conversion information indicating a relationship between an operation amount of said ink jet recording apparatus and an ink consuming volume; and an actual consumption detection processing of detecting an actual consuming state of said ink within said ink tank by detecting an oscillation state of a piezoelectric element corresponding to an actual ink consuming state within said ink tank by employing a piezoelectric device having said piezoelectric element, wherein a plurality of stages of said actual ink consuming state are detected by employing a plurality of said piezoelectric devices mounted on different positions of said ink tank, wherein said actual consumption detection processing detects whether or not an ink liquid level passes through said positions of said respective piezoelectric elements of said piezoelectric devices as said actual ink consuming state, and wherein said estimate consumption calculation processing is a processing for calculating said estimate consuming state by summing a number of ink droplets ejected from a recording head, and, when a passage of liquid level is detected by each of a plurality of said respective piezoelectric devices, said estimate consumption calculation processing corrects said estimate consuming state calculated by adding up until then.

23. A method of detecting an ink consuming state of an ink tank used for an ink jet recording apparatus, said method of detecting ink consumption comprising:

an estimate consumption calculation processing of calculating an estimate consuming state of an ink within said ink tank by employing a consumption conversion information indicating a relationship between an operation amount of said ink jet recording apparatus and an ink consuming volume; and an actual consumption detection processing of detecting an actual consuming state of said ink within said ink tank by detecting an oscillation state of a piezoelectric element corresponding to an actual ink consuming state within said ink tank by employing a piezoelectric device having said piezoelectric element, a correction and determination processing for determining whether or not said consumption conversion information is made an objective of correction; and a correction processing for correcting said consumption conversion information based on a result of said determination that a correction should be performed in said correction and determination processing;

wherein said consumption conversion information is classified into at least two kinds of unit information which are related to an ink volume consumed from a recording head and are different from each other, whether or not said at least two kinds of unit information are made as an objective of correction based on said estimate ink consuming state is determined in said correction and determination processing, and wherein, in said correction and determination processing, concerning with an ink consuming volume or consuming rate, when said estimate consuming state based on a second unit information is larger than said estimate consuming state based on a first unit information, said second unit information is made as objective of correction.

24. A method of detecting an ink consuming state of an ink tank used for an ink jet recording apparatus, said method of detecting ink consumption comprising:

an estimate consumption calculation processing of calculating an estimate consuming state of an ink within said ink tank by employing a consumption conversion information indicating a relationship between an operation amount of said ink jet recording apparatus and an ink consuming volume; and an actual consumption detection processing of detecting an actual consuming state of said ink within said ink tank by detecting an oscillation state of a piezoelectric element corresponding to an actual ink consuming state within said ink tank by employing a piezoelectric device having said piezoelectric element, a correction and determination processing for determining whether or not said consumption conversion information is made as an objective of correction; and a correction processing for correcting said consumption conversion information based on a result of said determination that a correction should be performed in said correction and determination processing;

wherein said consumption conversion information is classified into at least two kinds of unit information which are related to an ink volume consumed from a recording head and are different from each other, whether or not said at least two kinds of unit information are made as an objective of correction based on said estimate ink consuming state is determined in said correction and determination processing, and wherein, in said correction and determination processing, concerning with an ink consuming volume or consuming rate, when said estimate consuming state which is larger than any of said estimate consuming states calculated before by employing a common unit information is obtained, said common unit information is made as an objective of correction.

25. A method of detecting an ink consuming state of an ink tank used for an ink jet recording apparatus, said method of detecting ink consumption comprising:

an estimate consumption calculation processing of calculating an estimate consuming state of an ink within said ink tank by employing a consumption conversion information indicating a relationship between an operation amount of said ink jet recording apparatus and an ink consuming volume; and an actual consumption detection processing of detecting an actual consuming state of said ink within said ink tank by detecting an oscillation state of a piezoelectric element corresponding to an actual ink consuming state within said ink tank by employing a piezoelectric device having said piezoelectric element, a correction and determination processing for determining whether or not said consumption conversion information is made as an objective of correction; and a correction processing for correcting said consumption conversion information based on a result of said determination that a correction should be performed in said correction and determination processing;

wherein said consumption conversion information is classified into at least two kinds of unit information which are related to an ink volume consumed from a recording head and are different from each other, whether or not said at least two kinds of unit information are made as an objective of correction based on said estimate ink consuming state is determined in said correction and determination processing, and wherein, in said correction and determination processing, when said estimate consuming state obtained by employing said unit information is larger than a predetermined threshold concerning said ink consuming volume or consuming rate, said unit information is determined as an objective of correction.

26. A method of detecting an ink consuming state of an ink tank used for an ink jet recording apparatus, said method of detecting ink consumption comprising:

an estimate consumption calculation processing of calculating an estimate consuming state of an ink within said ink tank by employing a consumption conversion information indicating a relationship between an operation amount of said ink jet recording apparatus and an ink consuming volume; and an actual consumption detection processing of detecting an actual consuming state of said ink within said ink tank by detecting an oscillation state of a piezoelectric element corresponding to an actual ink consuming state within said ink tank by employing a piezoelectric device having said piezoelectric element, a correction and determination processing for determining whether or not said consumption conversion information is made as an objective or correction; and a correction processing for correcting said consumption conversion information based on a result of said determination that a correction should be performed in said correction and determination processing;

wherein said consumption conversion information is classified into at least two kinds of unit information which are related to an ink volume consumed from a recording head and which are different from each other, and wherein, in said correction and determination processing, when an error between said estimate consuming state and said actual consuming state exceeds over an expected value, at least one of said unit information is determined as an objective of correction.

27. An apparatus for detecting an ink consuming state of an ink tank used for an ink jet recording apparatus, said apparatus for detecting ink consumption comprising:

an estimate consumption calculation processing section of calculating an estimate consuming state of an ink within said ink tank using a consumption conversion information indicating a relationship between an operation amount of said ink jet recording apparatus and an ink consuming volume;

a piezoelectric device having a piezoelectric element, said piezoelectric device being mounted on said ink tank; and an actual consuming detection processing section of detecting an actual consuming state of said ink within said ink tank by detecting an oscillating state of said piezoelectric element corresponding to said ink consuming state in said ink tank using said piezoelectric device, wherein said piezoelectric device has a vibrating portion which comes into contact with said ink in said ink tank via an opening said opening defining an area of said vibrating portion; and wherein said piezoelectric device outputs a signal indicating a residual oscillating state of said vibrating portion and said actual consuming state is detected based on phenomenon that said residual oscillating state changes corresponding to said ink consuming state.

28. The apparatus for detecting ink consumption according to claim 27, wherein a plurality of said piezoelectric devices are provided on different positions of said ink tank, respectively, and wherein said actual consumption detection processing section detects said actual consuming state in a plurality of stages by employing a plurality of said piezoelectric devices.

29. An apparatus for detecting an ink consuming state of an ink tank used for an ink jet recording apparatus, said apparatus for detecting ink consumption comprising:

an estimate consumption calculation processing section of calculating an estimate consuming state of an ink within said ink tank using a consumption conversion information indicating a relationship between an operation amount of said ink jet recording apparatus and an ink consuming volume;

an actual consuming detection processing section of detecting an actual consuming state of said ink within said ink tank using a piezoelectric device having a piezoelectric element by detecting an oscillating state of said piezoelectric element corresponding to an ink consuming volume in said ink tank;

a conversion information correction processing section of correcting said consumption conversion information based on said actual ink consuming state; and a consuming information storage section of storing a reference consumption conversion information which is said consumption conversion information before being corrected and a corrected consumption conversion information which is said consumption conversion information after being corrected and providing said reference consumption conversion information and said corrected consumption conversion information to said estimate consumption calculation processing section, wherein said consuming information storage section is disposed on said ink tank, and wherein said corrected consumption conversion information as well as correction objective identification information for identifying an ink jet recording apparatus, on which said ink tank was mounted when said consumption conversion information was corrected, are stored in said consuming information storage section.

30. The apparatus for detecting ink consumption according to claim 29, wherein said estimate consumption calculation processing section determines whether or not said corrected consumption conversion information concerning with an ink jet recording apparatus, on which said ink tank is mounted, is stored in said consuming information storage section based on said correction objective identification information, and when stored, said corrected consumption conversion information is used.

31. The apparatus for detecting ink consumption according to claim 29, wherein said estimate consumption calculation processing section determines whether or not said corrected consumption conversion information concerning with an ink jet recording apparatus, on which said ink tank is mounted, is stored in said consuming information storage section, and when not stored, said reference consumption conversion information is used.

32. The apparatus for detecting ink consumption according to claim 29, wherein said estimate consumption calculation processing section selects said reference consumption conversion information or said corrected consumption conversion information based on said correction objective identification information at a time that said ink tank is mounted on said ink jet recording apparatus.

33. The apparatus for detecting ink consumption according to claim 29, wherein said correction objective identification information is an information for identifying a kind of said ink jet recording apparatus.

34. The apparatus for detecting ink consumption according to claim 29, wherein said correction objective identification information is an information for individually identifying said ink jet recording apparatus.

35. The apparatus for detecting ink consumption according to claim 33, wherein said correction objective identification information is an information for identifying a constituted portion related to an ink consumption of said ink jet recording apparatus.

36. The apparatus for detecting ink consumption according to claim 35, wherein said correction objective identification information is an information for identifying a recording head of said ink jet recording apparatus.

37. An apparatus for detecting an ink consuming state of an ink tank used for an ink jet recording apparatus, said apparatus for detecting ink consumption comprising:

an estimate consumption calculation processing section of calculating an estimate consuming state of an ink within said ink tank using a consumption conversion information indicating a relationship between an operation amount of said ink jet recording apparatus and an ink consuming volume;

an actual consuming detection processing section of detecting an actual consuming state of said ink within said ink tank using a piezoelectric device having a piezoelectric element by detecting an oscillating state of said piezoelectric element corresponding to an ink consuming volume in said ink tank;

a conversion information correction processing section of correcting said consumption conversion information based on said actual ink consuming state; and a consuming information storage section of storing a reference consumption conversion information which is said consumption conversion information before being corrected and a corrected consumption conversion information which is said consumption conversion information after being corrected and providing said reference consumption conversion information and said corrected consumption conversion information to said estimate consumption calculation processing section, wherein a plurality of said piezoelectric devices are provided on different positions of said ink tank, said actual consumption detection processing section detects whether or not an ink liquid level passes through the position of said piezoelectric element of said respective piezoelectric devices, said conversion information correcting section calculates said corrected consumption conversion information based on an estimate consuming volume from a point in time when one of said piezoelectric devices detects a passage of said ink liquid level to a point in time when said next piezoelectric device detects a passage of said ink liquid level, and said estimate consumption calculation processing section calculates said estimate consuming state by switching said consumption conversion information from said reference consumption conversion information to said corrected consumption conversion information when said corrected consumption conversion information is obtained.

38. The apparatus for detecting ink consumption according to claim 37, wherein, after said ink tank is mounted on said ink jet recording apparatus, said corrected consumption conversion information is obtained when a plurality of said piezoelectric devices detected passages of said ink liquid level, and said consumption conversion information is switched from said reference consumption conversion information to said corrected consumption conversion information.

39. An ink jet recording apparatus comprising:

a consuming information memory for storing an information concerning with an ink consuming state of an ink tank, wherein said consuming information memory stores:

an estimate consuming state of an ink within said ink tank calculated using a consumption conversion information indicating a relationship between an operation amount of said ink jet recording apparatus and an ink consuming volume;

an actual consuming state of said ink within said ink tank detected using a piezoelectric device having a piezoelectric element mounted on said ink tank; and an ink end event information obtained as said actual consuming state, said ink end event information indicating an occurrence of an ink end event corresponding to a passage of an ink liquid level through a position of said piezoelectric element of said piezoelectric device.

40. The ink jet recording apparatus according to claim 39, wherein, when said ink tank is mounted on said ink jet recording apparatus, said ink end event information stored in said consuming information memory is read, whether or not said ink liquid level has already passed through the position of said piezoelectric element, and if already passed, a predetermined operation is performed.

41. The ink jet recording apparatus according to claim 39, further comprising an estimate consumption calculation processing section of calculating said estimate consuming state, wherein said estimate consumption calculation processing section corrects said consumption conversion information based on detection results of said actual consuming state and calculates said estimate consuming state based on said consumption conversion information which is corrected.

42. The ink jet recording apparatus according to claim 41, wherein said consumption conversion information is an ink volume corresponding to an ink droplet ejected from said recording head.

43. The ink jet recording apparatus according to claim 39, further comprising an estimate consumption calculation processing section of calculating said estimate consuming state, wherein said estimate consumption calculation processing section corrects said estimate consuming state based on a detection result of said actual consuming state.

44. The ink jet recording apparatus according to claim 43, wherein said estimate consumption calculation processing section calculates said estimate consuming state by adding up a number of ink droplets ejected from a recording head, and when a detection result of said actual consuming state is obtained, said estimate consumption calculation processing section corrects said estimate consuming state obtained until then based on said detection result of said actual consuming state.

45. The ink jet recording apparatus according to claim 39, wherein a detection of said actual consuming state is terminated when said ink end event is occurred.

46. The ink jet recording apparatus according to claim 39, wherein said actual consuming state is detected based on a change of acoustic impedance accompanying with an ink consumption using said piezoelectric device.

47. The ink jet recording apparatus according to claim 46, wherein said piezoelectric device outputs a signal indicating a residual oscillating state of said piezoelectric element, and said actual consuming state is detected based on said residual oscillating state being changing corresponding to said ink consuming state.

48. An ink jet recording apparatus in which an ink tank is attachable and detachable, said ink tank containing an ink to be supplied to a recording head which jets ink droplets and records, said ink tank having a piezoelectric device for detecting said ink, said ink jet recording apparatus comprising:

an estimate consumption calculation processing section of calculating an estimate consuming state of said ink within said ink tank based on a reference consumption conversion information indicating a relationship between an operation amount of said ink jet recording apparatus and an ink consuming volume;

an actual consumption detection processing section of detecting a consuming state of said ink within said ink tank by detecting an oscillating state of a piezoelectric element of said piezoelectric device corresponding to an consuming state of said ink within said ink tank; and a correction section of determining whether or not said reference consumption conversion information is made as an objective of correction and correcting said reference consumption conversion information based on a determination that said reference consumption conversion information is made as said objective of correction, wherein said piezoelectric device has a vibration portion which comes into contact with said ink in said ink tank via an opening, said opening defining an area of said vibrating portion; and wherein said piezoelectric device outputs a signal indicating a residual oscillating state of said vibrating portion and said actual consuming state is detected based on phenomenon that said residual oscillating state changes corresponding to said ink consuming state.

49. The ink jet recording apparatus according to claim 48, wherein said reference consumption conversion information is classified into at least two kinds of unit information which are different from each other, and wherein said correction section determines one of said at least two kinds of unit information as an objective of correction based on at least said estimate consuming state.

50. The ink jet recording apparatus according to claim 48, wherein said reference consumption conversion information is classified into at least two kinds of unit information which are different from each other, and wherein said correction section is previously set to determine at least one predetermined unit information as an objective of correction.

51. The ink jet recording apparatus according to claim 50, wherein said at least two kinds of unit information are classified according to an ink droplet volume discharged from a recording head.

52. The ink jet recording apparatus according to claim 50, wherein said at least two kinds of unit information are classified according to a printing state and a non-printing state.

53. The ink jet recording apparatus according to claim 50, wherein said at least two kinds of unit information are classified according to a temperature in a circumference where a recording head performs recording.

54. The ink jet recording apparatus according to claim 50, wherein said at least two kinds of unit information are classified according to a humidity in a circumstance where a recording head performs recording.

55. An ink jet recording apparatus in which an ink tank is attachable and detachable, said ink tank containing an ink to be supplied to a recording head which jets ink droplets and records, said ink tank having a piezoelectric device for detecting said ink, said ink jet recording apparatus comprising:

an estimate consumption calculation processing section of calculating an estimate consuming state of said ink within said ink tank based on a reference consumption conversion information indicating a relationship between an operation amount of said ink jet recording apparatus and an ink consuming volume;

an actual consumption detection processing section of detecting an actual consuming state of said ink within said ink tank by detecting an oscillating state of a piezoelectric element of said piezoelectric device corresponding to a consuming state of said ink within said ink tank; and a correction section of determining whether or not said reference consumption conversion information is made as an objective of correction and correcting said reference consumption conversion information based on a determination that said reference consumption conversion information is made as said objective of correction, wherein said correction section corrects said reference consumption conversion information by employing a ratio of said estimate consuming state and said actual consuming state.

56. The ink jet recording apparatus according to claim 48, further comprising a storage section in which said reference consumption conversion information is stored.

57. The ink jet recording apparatus according to claim 48, further comprising a storage section in which said reference consumption conversion information corrected by said correction section is stored.

58. The ink jet recording apparatus according to claim 48, wherein a factor constituting said reference consumption conversion information is indicated by an ink droplet volume discharged from a recording head.

59. The ink jet recording apparatus according to claim 48, wherein a factor constituting said reference consumption conversion information is indicated by a mass of an ink droplet discharged from a recording head.

60. The ink jet recording apparatus according to claim 48, wherein a factor constituting said reference consumption conversion information is indicated by a ratio based on a factor constituting optional reference consumption conversion information.

61. An ink tank mounted on an ink jet recording apparatus, comprising:

a consuming information memory of storing an information concerning with an ink consuming state of said ink tank, wherein said consuming information memory stores an estimate consuming state of said ink tank calculated using a consumption conversion information indicating a relationship between an operation amount of said ink jet recording apparatus and an ink consuming volume; and an ink end event information obtained as an actual consuming state using a piezoelectric device having a piezoelectric element, said ink end event information indicating an occurrence of an ink end event corresponding to a passage of an ink liquid level through a position of said piezoelectric element of said piezoelectric device.

62. The ink tank according to claim 61, wherein said piezoelectric device is capable of detecting a change of an acoustic impedance accompanying with an ink consumption.

63. The ink tank according to claim 62, wherein said piezoelectric device is capable of outputting a signal indicating a residual oscillating state of said piezoelectric element.

64. An ink tank used for an ink jet recording apparatus, comprising:

a consuming information memory for storing a consumption conversion information indicating a relationship between an operation amount of said ink jet recording apparatus and an ink consuming volume, which is used for obtaining an estimate consuming state by calculating an ink consuming state of said ink tank, wherein said consuming information memory stores a corrected consumption conversion information, which is said consumption conversion information corrected based on an actual consuming state of an ink within said ink tank detected by detecting an oscillating state of a piezoelectric element of a piezoelectric device corresponding to a consuming state of said ink within said ink tank, as well as reference consumption conversion information which is said consumption conversion information before correction.

65. An ink tank used for an ink jet recording apparatus, comprising:

a consuming information memory for storing a consumption conversion information indicating a relationship between an operation amount of said ink jet recording apparatus and an ink consuming volume, which is used for obtaining an estimate consuming state by calculating an ink consuming state of said ink tank, wherein said consuming information memory stores a corrected consumption conversion information, which is said consumption conversion information corrected based on an actual consuming state of an ink within said ink tank detected by detecting an oscillating state of a piezoelectric element of a piezoelectric device corresponding to a consuming state of said ink within said ink tank, as well as reference consumption conversion information which is said consumption conversion information before correction, wherein said consuming information memory stores said corrected consumption conversion information as well as correction objective identification information for identifying an ink jet recording apparatus on which said ink tank was mounted when said consumption conversion information was corrected.

66. An ink tank comprising:

a container for containing an ink to be supplied to a recording head for discharging ink droplets;

a liquid supplying opening for supplying said ink to said recording head;

a piezoelectric device having a piezoelectric element for detecting an actual consuming state of said ink within said container; and a storage section for storing a reference consumption conversion information classified into at least two kinds of unit information which indicate a relationship between an operation amount of an ink jet recording apparatus and an ink consuming volume, wherein said ink tank is attachable to and detachable from said ink jet recording apparatus which performs recording by discharging ink droplets, wherein said piezoelectric device has a vibrating portion which comes into contact with said ink in said ink tank via an opening, said opening defining an area of said vibrating portion; and wherein said piezoelectric device outputs a signal indicating a residual oscillating state of said vibrating portion and said actual consuming state is detected based on phenomenon that said residual oscillating state changes corresponding to said ink consuming state.

67. The ink tank according to claim 66, wherein said storage section stores said reference consumption conversion information, said reference consumption conversion information having been corrected based on both an estimate consuming state of said ink within said ink tank which was obtained based on said reference consumption conversion information and said actual consuming state which was detected from an oscillating state of said piezoelectric element corresponding to a consuming state of said ink within said ink tank using said piezoelectric device.

68. An ink tank mounted on an ink jet recording apparatus, comprising:

a comsuming information memory of storing an information concerning with an ink consuming state of said ink tank, wherein said consuming information memory stores an estimate consuming state of said ink tank calculated using a consumption conversion information indicating a relationship between an operation amount of said ink jet recording apparatus and an ink consuming volume; and an ink end event information obtained as an actual consuming state using piezoelectric device having a piezoelectric element.

69. An ink tank mounted on an ink jet recording apparatus, comprising, a consuming information memory of storing an information concerning with an ink consuming state of said ink tank, wherein said consuming information memory stores an estimate consuming state of said ink tank calculated using a consumption conversion information indicating a relationship between an operation amount of said ink jet recording apparatus and an ink consuming volume; and an ink level passage information obtained as an actual consuming state using a piezoelectric device having a piezpelectric element.

* * * * *